US008544656B2

(12) United States Patent
Mennie et al.

(10) Patent No.: US 8,544,656 B2
(45) Date of Patent: Oct. 1, 2013

(54) CURRENCY BILL PROCESSING DEVICE AND METHOD

(75) Inventors: Douglas U. Mennie, Barrington, IL (US); John M. Mikkelsen, Langhorne, PA (US); Marek Baranowski, Shamong, NJ (US); Charles H. Cummings, Philadelphia, PA (US); Ken W. Maier, North Wales, PA (US)

(73) Assignee: Cummins-Allison Corp., Mt. Prospect, IL (US)

( * ) Notice: Subject to any disclaimer, the term of this patent is extended or adjusted under 35 U.S.C. 154(b) by 239 days.

(21) Appl. No.: 13/039,296

(22) Filed: Mar. 2, 2011

(65) Prior Publication Data

US 2011/0215034 A1 Sep. 8, 2011

Related U.S. Application Data

(60) Provisional application No. 61/310,142, filed on Mar. 3, 2010, provisional application No. 61/330,071, filed on Apr. 30, 2010.

(51) Int. Cl.
*B07C 5/00* (2006.01)

(52) U.S. Cl.
USPC ..... 209/534; 194/207; 902/14

(58) Field of Classification Search
USPC ..... 209/534; 194/206, 207; 902/14, 902/15; 382/135
See application file for complete search history.

(56) References Cited

U.S. PATENT DOCUMENTS

| | | | | |
|---|---|---|---|---|
| 3,362,532 | A | 1/1968 | Riddle et al. | 209/3.1 |
| 3,671,035 | A | 6/1972 | Reist | 271/76 |
| 3,972,520 | A | 8/1976 | McKeefry | 270/52.11 |
| 3,976,198 | A | 8/1976 | Carnes, Jr. et al. | 209/111.7 T |
| 4,025,420 | A | 5/1977 | Horino | 209/74 |
| 4,744,468 | A | 5/1988 | Goi et al. | 209/534 |
| 4,787,518 | A | 11/1988 | Yuge et al. | 209/534 |
| 5,163,672 | A | 11/1992 | Mennie | 271/187 |
| 5,207,788 | A | 5/1993 | Geib | 271/122 |
| 5,295,196 | A | 3/1994 | Raterman et al. | 382/135 |

(Continued)

FOREIGN PATENT DOCUMENTS

| | | |
|---|---|---|
| CA | 2 624 638 A1 | 12/2007 |
| CA | 2 684 159 A1 | 4/2010 |

(Continued)

OTHER PUBLICATIONS

BARS: 5000 Currency Sorter, 6 pages (estimated prior to Aug. 13, 2003).

(Continued)

*Primary Examiner* — Joseph C Rodriguez
(74) *Attorney, Agent, or Firm* — Nixon Peabody LLP

(57) ABSTRACT

A currency bill processing system includes a transport mechanism that is configured to transport bills from an input receptacle along a transport path that extends generally horizontally past at least one detector. The transport path transitions generally-vertically upward between a first and a second output receptacle. The transport mechanism is configured to deliver some of the bills toward a first end of the system into the first output receptacle and some of the bills toward a second end of the system into the second output receptacle. The system provides access openings in a front side of the system that are proximate the first and the second output receptacles thereby permitting operator access into the first and the second output receptacles from the front side.

194 Claims, 62 Drawing Sheets

(56) References Cited

U.S. PATENT DOCUMENTS

| | | | | |
|---|---|---|---|---|
| 5,310,062 | A | 5/1994 | Stevens et al. | 209/584 |
| 5,390,910 | A | 2/1995 | Mandel et al. | 271/296 |
| 5,467,405 | A | 11/1995 | Raterman et al. | 382/135 |
| 5,467,406 | A | 11/1995 | Graves et al. | 382/135 |
| D369,984 | S | 5/1996 | Larsen | D10/97 |
| 5,564,544 | A | 10/1996 | Takemoto et al. | 194/206 |
| 5,633,949 | A | 5/1997 | Graves et al. | 382/135 |
| 5,640,463 | A | 6/1997 | Csulits | 382/135 |
| 5,652,802 | A | 7/1997 | Graves et al. | 382/135 |
| 5,687,963 | A | 11/1997 | Mennie | 271/119 |
| 5,692,067 | A | 11/1997 | Raterman et al. | 382/135 |
| 5,704,491 | A | 1/1998 | Graves | 209/534 |
| 5,724,438 | A | 3/1998 | Graves | 382/135 |
| 5,740,897 | A | 4/1998 | Gauselmann | 194/206 |
| 5,751,840 | A | 5/1998 | Raterman et al. | 382/135 |
| 5,790,693 | A | 8/1998 | Graves et al. | 382/135 |
| 5,790,697 | A | 8/1998 | Munro et al. | 382/135 |
| 5,806,650 | A | 9/1998 | Mennie et al. | 194/206 |
| 5,815,592 | A | 9/1998 | Mennie et al. | 382/135 |
| 5,822,448 | A | 10/1998 | Graves et al. | 382/135 |
| 5,832,104 | A | 11/1998 | Graves et al. | 382/135 |
| 5,867,589 | A | 2/1999 | Graves et al. | 382/135 |
| 5,870,487 | A | 2/1999 | Graves et al. | 382/135 |
| 5,875,259 | A | 2/1999 | Mennie et al. | 382/135 |
| 5,905,810 | A | 5/1999 | Jones et al. | 382/135 |
| 5,909,502 | A | 6/1999 | Mazur | 382/135 |
| 5,909,503 | A | 6/1999 | Graves et al. | 382/135 |
| 5,912,982 | A | 6/1999 | Munro et al. | 382/135 |
| 5,938,044 | A | 8/1999 | Weggesser | 209/534 |
| 5,940,623 | A | 8/1999 | Watts et al. | 395/712 |
| 5,943,655 | A | 8/1999 | Jacobsen | 705/30 |
| 5,960,103 | A | 9/1999 | Graves et al. | 382/135 |
| 5,966,456 | A | 10/1999 | Jones et al. | 382/135 |
| 5,982,918 | A | 11/1999 | Mennie et al. | 382/135 |
| 5,992,601 | A | 11/1999 | Mennie et al. | 194/207 |
| 6,003,761 | A | 12/1999 | Chapman | 232/24 |
| 6,012,565 | A | 1/2000 | Mazur | 194/207 |
| 6,021,883 | A | 2/2000 | Casanova et al. | 194/217 |
| 6,026,175 | A | 2/2000 | Munro et al. | 382/135 |
| 6,028,951 | A | 2/2000 | Raterman et al. | 382/135 |
| 6,039,645 | A | 3/2000 | Mazur | 453/10 |
| 6,068,194 | A | 5/2000 | Mazur | 235/492 |
| 6,072,896 | A | 6/2000 | Graves et al. | 382/135 |
| 6,073,744 | A | 6/2000 | Raterman et al. | 194/207 |
| 6,074,334 | A | 6/2000 | Mennie et al. | 493/438 |
| 6,128,402 | A | 10/2000 | Jones et al. | 382/135 |
| 6,220,419 | B1 | 4/2001 | Mennie | 194/207 |
| 6,237,739 | B1 | 5/2001 | Mazur et al. | 194/207 |
| 6,241,069 | B1 | 6/2001 | Mazur et al. | 194/207 |
| 6,256,407 | B1 | 7/2001 | Mennie et al. | 382/135 |
| 6,278,795 | B1 | 8/2001 | Anderson et al. | 382/135 |
| 6,311,819 | B1 | 11/2001 | Stromme et al. | 194/207 |
| 6,318,537 | B1 | 11/2001 | Jones et al. | 194/346 |
| 6,328,166 | B1 | 12/2001 | Sakai | 209/534 |
| 6,351,551 | B1 | 2/2002 | Munro et al. | 382/135 |
| 6,363,164 | B1 | 3/2002 | Jones et al. | 382/135 |
| 6,371,303 | B1 | 4/2002 | Klein et al. | 209/534 |
| 6,371,476 | B2 | 4/2002 | Isogai et al. | 271/3.14 |
| 6,378,683 | B2 | 4/2002 | Mennie | 194/207 |
| 6,381,354 | B1 | 4/2002 | Mennie et al. | 382/135 |
| 6,398,000 | B1 | 6/2002 | Jenrick et al. | 194/200 |
| 6,439,395 | B1 | 8/2002 | Voellmer et al. | 209/534 |
| 6,459,806 | B1 | 10/2002 | Raterman et al. | 382/135 |
| 6,460,705 | B1 | 10/2002 | Hallowell | 209/534 |
| 6,493,461 | B1 | 12/2002 | Mennie et al. | 382/135 |
| 6,539,104 | B1 | 3/2003 | Raterman et al. | 382/135 |
| 6,560,355 | B2 | 5/2003 | Graves et al. | 382/135 |
| 6,578,695 | B1 | 6/2003 | Blaser et al. | 194/206 |
| 6,588,569 | B1 | 7/2003 | Jenrick et al. | 194/206 |
| 6,601,687 | B1 | 8/2003 | Jenrick et al. | 194/206 |
| 6,603,872 | B2 | 8/2003 | Jones et al. | 382/135 |
| 6,621,919 | B2 | 9/2003 | Mennie et al. | 382/135 |
| 6,628,816 | B2 | 9/2003 | Mennie et al. | 382/135 |
| 6,636,624 | B2 | 10/2003 | Raterman et al. | 382/135 |
| 6,647,136 | B2 | 11/2003 | Jones et al. | 382/137 |
| 6,650,767 | B2 | 11/2003 | Jones et al. | 382/135 |
| 6,654,486 | B2 | 11/2003 | Jones et al. | 382/135 |
| 6,659,258 | B2 | 12/2003 | Otsuka | 194/206 |
| 6,661,910 | B2 | 12/2003 | Jones et al. | 382/135 |
| 6,665,431 | B2 | 12/2003 | Jones et al. | 382/135 |
| 6,676,127 | B2 | 1/2004 | Johnson et al. | 273/149 R |
| 6,678,401 | B2 | 1/2004 | Jones et al. | 382/135 |
| 6,678,402 | B2 | 1/2004 | Jones et al. | 382/135 |
| 6,705,470 | B2 | 3/2004 | Klein et al. | 209/534 |
| 6,721,442 | B1 | 4/2004 | Mennie et al. | 382/135 |
| 6,724,926 | B2 | 4/2004 | Jones et al. | 382/135 |
| 6,724,927 | B2 | 4/2004 | Jones et al. | 382/135 |
| 6,731,785 | B1 | 5/2004 | Mennie et al. | 382/135 |
| 6,731,786 | B2 | 5/2004 | Jones et al. | 382/135 |
| 6,748,101 | B1 | 6/2004 | Jones et al. | 382/135 |
| 6,772,886 | B2 | 8/2004 | Werner et al. | 209/534 |
| 6,778,693 | B2 | 8/2004 | Jones et al. | 382/135 |
| 6,798,899 | B2 | 9/2004 | Mennie et al. | 382/135 |
| 6,810,137 | B2 | 10/2004 | Jones et al. | 382/135 |
| 6,811,016 | B2 | 11/2004 | Blair | 194/206 |
| 6,820,874 | B2 | 11/2004 | Blaser et al. | 271/274 |
| 6,843,418 | B2 | 1/2005 | Jones et al. | 235/462.01 |
| 6,860,375 | B2 | 3/2005 | Hallowell et al. | 194/328 |
| 6,866,134 | B2 | 3/2005 | Stromme et al. | 194/207 |
| 6,868,954 | B2 | 3/2005 | Stromme et al. | 194/207 |
| 6,877,733 | B2 | 4/2005 | Blaser et al. | 271/18 |
| 6,880,692 | B1 | 4/2005 | Mazur et al. | 194/207 |
| 6,896,116 | B2 | 5/2005 | Deaville et al. | 194/206 |
| 6,913,130 | B1 | 7/2005 | Mazur et al. | 194/207 |
| 6,913,260 | B2 | 7/2005 | Maier et al. | 271/265.04 |
| 6,915,893 | B2 | 7/2005 | Mennie | 194/207 |
| 6,929,109 | B1 | 8/2005 | Klein et al. | 194/206 |
| 6,955,253 | B1 | 10/2005 | Mazur et al. | 194/207 |
| 6,957,733 | B2 | 10/2005 | Mazur et al. | 194/215 |
| 6,959,800 | B1 | 11/2005 | Mazur et al. | 194/207 |
| 6,962,247 | B2 | 11/2005 | Maier et al. | 194/207 |
| 6,980,684 | B1 | 12/2005 | Munro et al. | 382/135 |
| 6,994,200 | B2 | 2/2006 | Jenrick et al. | 194/206 |
| 6,996,263 | B2 | 2/2006 | Jones et al. | 382/135 |
| 7,000,828 | B2 | 2/2006 | Jones | 235/379 |
| 7,016,767 | B2 | 3/2006 | Jones et al. | 700/224 |
| 7,036,651 | B2 | 5/2006 | Tam et al. | 194/217 |
| 7,051,926 | B2 * | 5/2006 | Saltsov et al. | 235/379 |
| 7,082,216 | B2 | 7/2006 | Jones et al. | 382/137 |
| 7,092,560 | B2 | 8/2006 | Jones et al. | 382/135 |
| 7,103,206 | B2 | 9/2006 | Graves et al. | 382/135 |
| 7,103,438 | B2 | 9/2006 | Hallowell et al. | 700/116 |
| 7,146,245 | B2 | 12/2006 | Jones et al. | 700/224 |
| 7,149,336 | B2 | 12/2006 | Jones et al. | 382/135 |
| 7,158,662 | B2 | 1/2007 | Chiles | 382/135 |
| 7,171,032 | B2 | 1/2007 | Jones et al. | 382/135 |
| 7,187,795 | B2 | 3/2007 | Jones et al. | 382/135 |
| 7,191,657 | B2 | 3/2007 | Maier et al. | 73/587 |
| 7,197,173 | B2 | 3/2007 | Jones et al. | 382/135 |
| 7,200,255 | B2 | 4/2007 | Jones et al. | 382/135 |
| 7,201,320 | B2 | 4/2007 | Csulits et al. | 235/462.01 |
| 7,219,083 | B2 | 5/2007 | Bellucci et al. | 705/43 |
| 7,232,024 | B2 | 6/2007 | Mazur et al. | 194/207 |
| 7,248,731 | B2 | 7/2007 | Raterman et al. | 382/135 |
| 7,256,874 | B2 | 8/2007 | Csulits et al. | 356/71 |
| 7,269,279 | B2 | 9/2007 | Chiles | 382/135 |
| 7,349,566 | B2 | 3/2008 | Jones et al. | 382/139 |
| 7,362,891 | B2 | 4/2008 | Jones et al. | 382/135 |
| 7,366,338 | B2 | 4/2008 | Jones et al. | 382/135 |
| 7,391,897 | B2 | 6/2008 | Jones et al. | 382/135 |
| 7,505,831 | B2 | 3/2009 | Jones et al. | 700/224 |
| 7,536,046 | B2 | 5/2009 | Raterman et al. | 382/135 |
| 7,542,598 | B2 | 6/2009 | Jones et al. | 382/135 |
| 7,551,764 | B2 | 6/2009 | Chiles et al. | 382/135 |
| 7,590,274 | B2 | 9/2009 | Raterman et al. | 382/135 |
| 7,591,428 | B2 | 9/2009 | Freeman et al. | 235/449 |
| 7,599,543 | B2 | 10/2009 | Jones et al. | 382/137 |
| 7,600,626 | B2 | 10/2009 | Hallowell et al. | 194/206 |
| 7,602,956 | B2 | 10/2009 | Jones et al. | 382/135 |
| 5,909,503 | C1 | 11/2009 | Graves et al. | 382/135 |
| 7,619,721 | B2 | 11/2009 | Jones et al. | 356/71 |
| 7,620,231 | B2 | 11/2009 | Jones et al. | 382/137 |
| 5,966,456 | C1 | 12/2009 | Jones et al. | 382/135 |
| 6,381,354 | C1 | 12/2009 | Mennie et al. | 382/135 |

| | | | | |
|---|---|---|---|---|
| 7,628,326 | B2 | 12/2009 | Freeman et al. | 235/450 |
| 7,635,082 | B2 | 12/2009 | Jones | 235/379 |
| 7,647,275 | B2 | 1/2010 | Jones | 705/40 |
| 7,650,980 | B2 | 1/2010 | Jenrick et al. | 194/206 |
| 7,672,499 | B2 | 3/2010 | Raterman et al. | 382/135 |
| 7,686,151 | B2 | 3/2010 | Renz et al. | 194/206 |
| 7,726,457 | B2 | 6/2010 | Maier et al. | 194/206 |
| 7,735,621 | B2 | 6/2010 | Hallowell et al. | 194/206 |
| 7,753,189 | B2 | 7/2010 | Maier et al. | 194/206 |
| 7,762,380 | B2 | 7/2010 | Freeman et al. | 194/210 |
| 7,778,456 | B2 | 8/2010 | Jones et al. | 382/135 |
| 7,779,982 | B2 | 8/2010 | Fitzgerald et al. | 194/206 |
| 7,817,842 | B2 | 10/2010 | Mennie | 382/137 |
| 7,849,994 | B2 | 12/2010 | Klein et al. | 194/206 |
| 7,873,576 | B2 | 1/2011 | Jones et al. | 705/43 |
| 7,881,519 | B2 | 2/2011 | Jones et al. | 382/135 |
| 7,882,000 | B2 | 2/2011 | Jones | 705/35 |
| 7,903,863 | B2 | 3/2011 | Jones et al. | 382/135 |
| 8,297,428 | B2 * | 10/2012 | Renz et al. | 194/206 |
| 8,346,610 | B2 * | 1/2013 | Mennie et al. | 705/16 |
| 2001/0006557 | A1 | 7/2001 | Mennie et al. | 382/135 |
| 2001/0015309 | A1 | 8/2001 | Ikuta | |
| 2001/0015311 | A1 | 8/2001 | Mennie | 194/207 |
| 2001/0019624 | A1 | 9/2001 | Raterman et al. | 382/135 |
| 2001/0035603 | A1 | 11/2001 | Graves et al. | 271/265.01 |
| 2002/0000689 | A1 | 1/2002 | Isogai et al. | 271/3.14 |
| 2002/0001393 | A1 | 1/2002 | Jones et al. | 382/100 |
| 2002/0020603 | A1 | 2/2002 | Jones et al. | 194/346 |
| 2002/0043443 | A1 | 4/2002 | Mizuta et al. | |
| 2002/0056605 | A1 | 5/2002 | Mazur et al. | 194/207 |
| 2002/0085245 | A1 | 7/2002 | Mennie et al. | 358/498 |
| 2002/0085745 | A1 | 7/2002 | Jones et al. | 382/135 |
| 2002/0103757 | A1 | 8/2002 | Jones et al. | 705/45 |
| 2002/0104785 | A1 | 8/2002 | Klein et al. | 209/534 |
| 2002/0107801 | A1 | 8/2002 | Jones et al. | 705/45 |
| 2002/0118871 | A1 | 8/2002 | Jones et al. | 382/137 |
| 2002/0122580 | A1 | 9/2002 | Jones et al. | 382/137 |
| 2002/0126885 | A1 | 9/2002 | Mennie et al. | 382/135 |
| 2002/0126886 | A1 | 9/2002 | Jones et al. | 382/135 |
| 2002/0131630 | A1 | 9/2002 | Jones et al. | 382/137 |
| 2002/0136442 | A1 | 9/2002 | Jones et al. | 382/135 |
| 2002/0145035 | A1 | 10/2002 | Jones | 235/379 |
| 2002/0154804 | A1 | 10/2002 | Jones et al. | 382/135 |
| 2002/0154805 | A1 | 10/2002 | Jones et al. | 382/135 |
| 2002/0154806 | A1 | 10/2002 | Jones et al. | 382/135 |
| 2002/0154807 | A1 | 10/2002 | Jones et al. | 382/135 |
| 2002/0154808 | A1 | 10/2002 | Jones et al. | 382/135 |
| 2002/0186876 | A1 | 12/2002 | Jones et al. | 382/135 |
| 2003/0009420 | A1 | 1/2003 | Jones | 705/39 |
| 2003/0015395 | A1 | 1/2003 | Hallowell et al. | 194/206 |
| 2003/0015396 | A1 | 1/2003 | Mennie | 194/206 |
| 2003/0059098 | A1 | 3/2003 | Jones et al. | 382/135 |
| 2003/0062242 | A1 | 4/2003 | Hallowell et al. | 194/302 |
| 2003/0081824 | A1 | 5/2003 | Mennie et al. | 382/135 |
| 2003/0108233 | A1 | 6/2003 | Raterman et al. | 382/135 |
| 2003/0121752 | A1 | 7/2003 | Stromme et al. | 194/207 |
| 2003/0121753 | A1 | 7/2003 | Stromme et al. | 194/207 |
| 2003/0132281 | A1 | 7/2003 | Jones et al. | 235/379 |
| 2003/0139994 | A1 | 7/2003 | Jones | 705/36 |
| 2003/0168308 | A1 | 9/2003 | Maier et al. | 194/207 |
| 2003/0174874 | A1 | 9/2003 | Raterman et al. | 382/135 |
| 2003/0182217 | A1 | 9/2003 | Chiles | 705/35 |
| 2003/0198373 | A1 | 10/2003 | Raterman et al. | 382/135 |
| 2003/0202690 | A1 | 10/2003 | Jones et al. | 382/139 |
| 2004/0003980 | A1 | 1/2004 | Hallowell et al. | 194/206 |
| 2004/0016621 | A1 | 1/2004 | Jenrick et al. | 194/206 |
| 2004/0016797 | A1 | 1/2004 | Jones et al. | 235/379 |
| 2004/0028266 | A1 | 2/2004 | Jones et al. | 382/135 |
| 2004/0083149 | A1 | 4/2004 | Jones | 705/35 |
| 2004/0145726 | A1 | 7/2004 | Csulits et al. | 356/71 |
| 2004/0149538 | A1 | 8/2004 | Sakowski | 194/207 |
| 2004/0153408 | A1 | 8/2004 | Jones et al. | 705/43 |
| 2004/0154964 | A1 | 8/2004 | Jones | 209/534 |
| 2004/0164483 | A1 | 8/2004 | Focke et al. | 271/264 |
| 2004/0168880 | A1 | 9/2004 | Blaser et al. | 194/206 |
| 2004/0173432 | A1 | 9/2004 | Jones | 194/216 |
| 2004/0182675 | A1 | 9/2004 | Long et al. | 194/206 |
| 2004/0251110 | A1 | 12/2004 | Jenrick et al. | 194/207 |
| 2004/0256450 | A1 | 12/2004 | Fujioka | |
| 2005/0029168 | A1 | 2/2005 | Jones et al. | 209/534 |
| 2005/0035034 | A1 | 2/2005 | Long et al. | 209/534 |
| 2005/0040225 | A1 | 2/2005 | Csulits et al. | 235/379 |
| 2005/0047642 | A1 | 3/2005 | Jones et al. | 382/137 |
| 2005/0060055 | A1 | 3/2005 | Hallowell et al. | 700/95 |
| 2005/0060059 | A1 | 3/2005 | Klein et al. | 700/213 |
| 2005/0060061 | A1 | 3/2005 | Jones | 700/226 |
| 2005/0077142 | A1 | 4/2005 | Tam et al. | 194/217 |
| 2005/0086271 | A1 | 4/2005 | Jones et al. | 707/200 |
| 2005/0087422 | A1 | 4/2005 | Maier et al. | 194/207 |
| 2005/0108165 | A1 | 5/2005 | Jones et al. | 705/43 |
| 2005/0117791 | A2 | 6/2005 | Raterman et al. | 382/135 |
| 2005/0117792 | A2 | 6/2005 | Graves et al. | 382/135 |
| 2005/0150738 | A1 | 7/2005 | Hallowell et al. | 194/206 |
| 2005/0163361 | A1 | 7/2005 | Jones et al. | 382/135 |
| 2005/0163362 | A1 | 7/2005 | Jones et al. | 382/137 |
| 2005/0169511 | A1 | 8/2005 | Jones | 382/135 |
| 2005/0173221 | A1 | 8/2005 | Maier et al. | 194/207 |
| 2005/0183928 | A1 | 8/2005 | Jones et al. | 194/207 |
| 2005/0207634 | A1 | 9/2005 | Jones et al. | 382/135 |
| 2005/0213803 | A1 | 9/2005 | Mennie et al. | 382/135 |
| 2005/0241909 | A1 | 11/2005 | Mazur et al. | 194/207 |
| 2005/0249394 | A1 | 11/2005 | Jones et al. | 382/135 |
| 2005/0265591 | A1 | 12/2005 | Jones et al. | 382/135 |
| 2005/0276458 | A1 | 12/2005 | Jones et al. | 382/135 |
| 2005/0278239 | A1 | 12/2005 | Jones et al. | 705/35 |
| 2006/0010071 | A1 | 1/2006 | Jones et al. | 705/42 |
| 2006/0078186 | A1 | 4/2006 | Freeman et al. | 382/135 |
| 2006/0182330 | A1 | 8/2006 | Chiles | 382/135 |
| 2006/0195567 | A1 | 8/2006 | Mody et al. | 709/224 |
| 2006/0210137 | A1 | 9/2006 | Raterman et al. | 382/135 |
| 2006/0274929 | A1 | 12/2006 | Jones et al. | 382/135 |
| 2007/0071302 | A1 | 3/2007 | Jones et al. | 382/135 |
| 2007/0076939 | A1 | 4/2007 | Jones et al. | 382/135 |
| 2007/0078560 | A1 | 4/2007 | Jones et al. | 700/224 |
| 2007/0095630 | A1 | 5/2007 | Mennie et al. | 194/206 |
| 2007/0112674 | A1 | 5/2007 | Jones et al. | 705/45 |
| 2007/0122023 | A1 | 5/2007 | Jenrick et al. | 382/135 |
| 2007/0172107 | A1 | 7/2007 | Jones et al. | 382/137 |
| 2007/0209904 | A1 | 9/2007 | Freeman et al. | 194/210 |
| 2007/0221470 | A1 | 9/2007 | Mennie et al. | 194/216 |
| 2007/0237381 | A1 | 10/2007 | Mennie et al. | 382/135 |
| 2007/0258633 | A1 | 11/2007 | Jones et al. | 382/135 |
| 2007/0269097 | A1 | 11/2007 | Chiles et al. | 382/135 |
| 2007/0278064 | A1 | 12/2007 | Hallowell et al. | 194/206 |
| 2008/0006505 | A1 | 1/2008 | Renz et al. | 194/206 |
| 2008/0033829 | A1 | 2/2008 | Mennie et al. | 705/16 |
| 2008/0044077 | A1 | 2/2008 | Mennie et al. | 382/135 |
| 2008/0060906 | A1 | 3/2008 | Fitzgerald et al. | 194/207 |
| 2008/0123932 | A1 | 5/2008 | Jones et al. | 382/135 |
| 2008/0133411 | A1 | 6/2008 | Jones et al. | 705/42 |
| 2008/0177420 | A1 | 7/2008 | Klein et al. | 700/224 |
| 2008/0219543 | A1 | 9/2008 | Csulits et al. | 382/135 |
| 2008/0285838 | A1 | 11/2008 | Jones et al. | 382/135 |
| 2009/0001661 | A1 | 1/2009 | Klein et al. | 271/258.01 |
| 2009/0022390 | A1 | 1/2009 | Yacoubian et al. | 382/135 |
| 2009/0087076 | A1 | 4/2009 | Jenrick | 382/135 |
| 2009/0090779 | A1 | 4/2009 | Freeman | 235/450 |
| 2009/0183967 | A1 | 7/2009 | Hamasaki | 194/320 |
| 2009/0184034 | A1 | 7/2009 | Doi et al. | |
| 2009/0310188 | A1 | 12/2009 | Jones et al. | 358/448 |
| 2009/0313159 | A1 | 12/2009 | Jones et al. | 705/35 |
| 2010/0034454 | A1 | 2/2010 | Jones et al. | 382/137 |
| 2010/0051687 | A1 | 3/2010 | Jones et al. | 235/379 |
| 2010/0057617 | A1 | 3/2010 | Jones et al. | 705/44 |
| 2010/0063916 | A1 | 3/2010 | Jones et al. | 705/35 |
| 2010/0092065 | A1 | 4/2010 | Jones et al. | 382/135 |
| 2010/0108463 | A1 | 5/2010 | Renz et al. | 194/206 |
| 2010/0116619 | A1 | 5/2010 | Jones | 194/217 |
| 2010/0163366 | A1 | 7/2010 | Jenrick et al. | 194/206 |
| 2010/0236892 | A1 | 9/2010 | Jones et al. | 194/206 |
| 2010/0263984 | A1 | 10/2010 | Freeman et al. | 194/206 |
| 2010/0276485 | A1 | 11/2010 | Jones et al. | 235/379 |

FOREIGN PATENT DOCUMENTS

| | | |
|---|---|---|
| EP | 0 795 842 | 9/1997 |
| EP | 1 139 303 A2 | 10/2001 |
| GB | 2 464 826 A | 5/2010 |
| WO | WO 91/11778 A1 | 8/1991 |

| | | | |
|---|---|---|---|
| WO | WO 92/17394 | A1 | 10/1992 |
| WO | WO 93/23824 | A1 | 11/1993 |
| WO | WO 95/24691 | A1 | 9/1995 |
| WO | WO 96/10800 | A1 | 4/1996 |
| WO | WO 96/36933 | A1 | 11/1996 |
| WO | WO 97/30422 | A1 | 8/1997 |
| WO | WO 97/43734 | A1 | 11/1997 |
| WO | WO 97/45810 | A1 | 12/1997 |
| WO | WO 98/12662 | A1 | 3/1998 |
| WO | WO 98/13785 | A1 | 4/1998 |
| WO | WO 98/24052 | A1 | 6/1998 |
| WO | WO 98/24067 | A1 | 6/1998 |
| WO | WO 98/35323 | A2 | 8/1998 |
| WO | WO 98/40839 | A2 | 9/1998 |
| WO | WO 98/47100 | A1 | 10/1998 |
| WO | WO 98/50892 | A1 | 11/1998 |
| WO | WO 98/59323 | A1 | 12/1998 |
| WO | WO 99/09511 | A1 | 2/1999 |
| WO | WO 99/14668 | A1 | 3/1999 |
| WO | WO 99/23601 | A1 | 5/1999 |
| WO | WO 99/41695 | A1 | 8/1999 |
| WO | WO 99/48040 | A1 | 9/1999 |
| WO | WO 99/48042 | A1 | 9/1999 |
| WO | WO 00/24572 | A1 | 5/2000 |
| WO | WO 00/65546 | A1 | 11/2000 |
| WO | WO 01/08108 | A2 | 2/2001 |
| WO | WO 01/59685 | A2 | 8/2001 |
| WO | WO 01/59723 | A1 | 8/2001 |
| WO | WO 01/62650 | A1 | 8/2001 |
| WO | WO 02/29735 | A2 | 4/2002 |
| WO | WO 02/054360 | A2 | 7/2002 |
| WO | WO 03/005312 | A1 | 1/2003 |
| WO | WO 03/028361 | A2 | 4/2003 |
| WO | WO 03/029913 | A2 | 4/2003 |
| WO | WO 03/030113 | A1 | 4/2003 |
| WO | WO 03/067532 | A1 | 8/2003 |
| WO | WO 03/107282 | A2 | 12/2003 |
| WO | WO 2004/010367 | A1 | 1/2004 |
| WO | WO 2004/027717 | A2 | 4/2004 |
| WO | WO 2004/036508 | A2 | 4/2004 |
| WO | WO 2004/038631 | A2 | 5/2004 |
| WO | WO 2004/068422 | A1 | 8/2004 |
| WO | WO 2005/013209 | A2 | 2/2005 |
| WO | WO 2005/017842 | A1 | 2/2005 |
| WO | WO 2005/028348 | A2 | 3/2005 |
| WO | WO 2005/029240 | A2 | 3/2005 |
| WO | WO 2005/036445 | A1 | 4/2005 |
| WO | WO 2005/041134 | A2 | 5/2005 |
| WO | WO 2005/076229 | A1 | 8/2005 |
| WO | WO 2006/039439 | A2 | 4/2006 |
| WO | WO 2006/076289 | A2 | 7/2006 |
| WO | WO 2006/076634 | A2 | 7/2006 |
| WO | WO 2007/044570 | A2 | 4/2007 |
| WO | WO 2007/120825 | A2 | 10/2007 |
| WO | WO 2007/143128 | A2 | 12/2007 |
| WO | WO 2008/030356 | A1 | 3/2008 |
| WO | WO 2008/112132 | A1 | 9/2008 |

OTHER PUBLICATIONS

BARS: 5600 Currency Sorter, 6 pages (estimated prior to Aug. 12, 2003).
BARS: 6000 Single Note Inspection System, 6 pages (estimated prior to Aug. 12, 2003).
BEB Industrie-Electronik AG: CashCat Banknote Sorting System, 4 pages (date unknown, possibly Mar. 1997).
BEB Webpages Cashcat Desktop Banknote Processing System, 4 pages (Apr. 2002).
BEB: CashCat, "Desktop Banknote Processing System," 4 pages (Jun. 28, 2010).
Cummins: JetScan™ MPS Brochure (Form 023-1614), 2 pages (Nov. 2000).
Cummins: JetScan™ MPS Model 4100 Brochure (From 023-1661), 8 pages (Jun. 2003).
Cummins: JetScan™ MPS Model 4101—Operating Instructions (Form 022-1951 Rev. 1), 152 pages (Jun. 2001).
Cummins: JetScan™ MPS Models 4102 and 4103 (Form 023-1639), 1 page (Sep. 2001).
Cummins: JetScan™ MPS Model 4200 Brochure (Form 023-1674), 2 pages (Jun. 2003).
Cummins: JetScan™ MPS Bar Coded Ticket Processing Brochure (Form 023-1655 Rev 1), 2 pages (Sep. 2002).
Currency Systems International: Cash Cat Desktop Sorter Webpages, url: http://www.currencysystems.com/CashCat.html,2 pages (Oct. 1999).
Currency Systems International: Cobra™ Banknote Sorter brochure, 4 pages (© 2001) [GL002495-97].
Currency Systems International: Description of Currency Discriminators, 2 pages, (date uncertain, believed to be prior to Mar. 7, 1995).
Currency Systems International: CPS 300 Currency Processing System, 4 pages (© 1992).
Currency Systems International: CPS 300-600 Webpage, 1 page, url: http://www.currencysystems.com/300600.html (Feb. 10, 1998).
Currency Systems International: CPS 300-600 Webpages, 4 pages, url: http://www.currencysystems.com300600.html (Oct. 1999).
Currency Systems International: CPS 600/900, Description of CSI CPS 600 and CPS 900 devices, 1 page (date: estimated 1994).
Currency Systems International: CPS 600/900, Medium Speed Currency Sorting Family, CPS 600 and CPS 900, 4 pages (© 1994).
Currency Systems International: CPS 600-900 Webpages, url: http://www.currencysystems.com, 4 pages (Feb. 10, 1998).
Currency Systems International: CPS 900 Webpages, 4 pages, url: http://www.currencysystems.com/900.html (Oct. 1999).
Currency Systems International: CPS 1200-1500-1800 Webpages, 4 pages, url: http://www.currencysystems.com/1200.html (Oct. 1999).
Currency Systems International: CPS 1200 brochure, 4 pages (© 1992).
Currency Systems International: CPS 1200-1500-1800 Webpages, 4 pages, url: http://www.currencysystems.com (Feb. 10, 1998).
Currency Systems International: Mr. W. Kranister in Conversation with Richard Haycock, 5 pages (estimated 1994).
De La Rue: "The Processing of Money and Documents," 4 pages (© 1987).
De La Rue: 2800VB Operator's Guide—Value Balancing Currency Sorter/Counter, 55 pages (© 1997).
De La Rue: 2800VB Value Balancing Sorter/Counter brochure, "Document recognition currency sorter/counter," 2 pages (Dec. 9, 1996).
De La Rue: 2800VB Value Balancing currency counter brochure, "Two pocket denomination recognition currency counter," 2 pages (Sep. 1999) [GL002518-19].
De La Rue: 2800VB Currency Counting Machine brochure, "Uninterrupted function . . . ," 2 pages (© 2000).
De La Rue: 3100 Serie, L'Internationale des Machines a trier les Billets, 4 pages (© 1989) (French).
De La Rue: 3700e—The World's Leading Note Sorter, 6 pages (estimated prior to Apr. 9, 2003).
De La Rue: 9000 Series High Speed Document Reader/Sorters, 8 pages (© 1980).
De La Rue: Cobra™ 4004 Banknote Sorter brochure, 2 legal pages (© 2001) [GL002498-99].
De La Rue: Cobra Note Sorter Webpages, 2 pages, url: http://www.delarue.com/cash/processing/notesort/product/cobra.asp (Apr. 2002).
De La Rue/Inter Innovation: Innomat, 3 pages (Apr. 1996).
G&D: BPS 200 Banknote Processing System brochure, 2 pages (Mar. 2000) [GL002643-44].
G&D: BPS 200 Desktop Banknote Processing System brochure, 10 pages (Mar. 1999).
G&D: BPS 200, 500, & 1000, "One Size Does Not Fit All!" brochure, 1 page (date uncertain, prior to Nov. 7, 2002) [GL002645].
G&D: BPS 500 Banknote Processing System brochure, 1 page (hand dated Sep. 1999) [GL002654].
G&D: BPS 500 Banknote Processing System, "The BPS 500 verifies, counts, authenticates and sorts up to 30 000 banknotes per hour," 4 pages, (Mar. 1998).
G&D: BPS 500 Banknote Processing System brochure, "Banknote Processing System for Commercial Applications," 8 pages (date uncertain, prior to Nov. 7, 2002) [GL002639-42 and GL002646-49].
G&D: BPS 500 Banknote Processing System, 2 pages (date unknown, prior to Jun. 1998) [CG0030289-90].

G&D: BPS 1000 Banknote Processing System with Bundler, 2 pages (Feb. 1998).
G&D: BPS 1000 Banknote Processing System brochure, 2 pages (Aug. 1997).
G&D: BPS 1000 Banknote Processing System, Preliminary Product Information brochure, 1 page (Oct. 1997).
G&D: BPS 1000, Banknote Processing System brochure, 4 pages (© 2004).
G&D: Numeron webpage picture of sorting machine and Design Award for Numeron, 2 pages (Mar. 29, 2002) [GL002650-51].
G&D: Numeron®—"Small, fast and reliable—desktop machine for banknote processing," 4 pages (Mar. 2002).
Glory: GSA-500 Sortmaster brochure, 4 pages (estimated Jan. 14, 1994).
Glory: GSA-500 Sortmaster brochure, 2 pages (estimated Jan. 14, 1994).
Glory: GSA-500 Sortmaster, Sale of Glory GSA-500 Sortmaster, 1 page (1986).
Glory: GSA-500—Instruction Manual, 40 pages (prior to Jul. 1998).
Glory: GSA-500—Operating Procedures, SR-700 for Sortmaster Model GSA-500, 9 pages (prior to Jul. 1998).
Glory: UW-100 Compact Currency Fitness Sorter, 2 pages (© 1999).
Glory: UW-200 Multi-Purpose Compact Currency Sorter, 4 pages (© 1999).
Toshiba/Mosler: CS-6600—Optical Currency Counter/Sorter, "Advanced Technology Achieves One-Step Deposit Processing & Verification," 4 pages (© 1985).
Toshiba/Mosler: CS-6600—Optical Currency Counter/Sorter, 4 pages (© 1992).
(Toshiba /) Mosler: CS-6600 Currency Handler brochure—"Let Mosler Help You Cut Costs Four Ways," 4 pages (© 1993).
(Toshiba /) Mosler: TouchSort Currency Processing System, "One Touch. One Pass. One Solution,"10 pages (© 1999).
(Toshiba /) Mosler TouchSort Currency Processing System webpages, url: http://www.mosler.com/currency.html, 3 pages (Jun. 28, 2002).
(Toshiba /) Mosler TouchSort Currency Processing System webpages, url: http://www.mosler.com/currency.html, 4 pages (May 12, 2000).
Toshiba (/ Mosler): CS-601 and CS-700, "All in one pass"—product information printed from website, url: http://www.3toshiba.co.jp/sic/english/inf_com/labor/cash/index.htm, 6 pages (Jun. 28, 2002).
EP 04 780 228.5 corresponding to PCT/US2004/025359 [WO 2005/013209] which claims priority to U.S. Appl. No. 60/492,104 and 60/580,662: Communication pursuant to Article 96(2) [Examination Report], 9 pages (Dec. 21, 2006).
EP 04 780 228.5 corresponding to PCT/US2004/025359 [WO 2005/013209] which claims priority to U.S. Appl. No. 60/492,104 and 60/580,662: Response to Communication pursuant to Article 96(2) [Examination Report] dated Dec. 21, 2006, 17 pages (Apr. 26, 2007).
EP 04 780 228.5 corresponding to PCT/US2004/025359 [WO 2005/013209] which claims priority to U.S. Appl. No. 60/492,104 and 60/580,662: Communication pursuant to Article 96(2) [Examination Report], 4 pages (Jun. 5, 2007).
EP 04 780 228.5 corresponding to PCT/US2004/025359 [WO 2005/013209] which claims priority to U.S. Appl. No. 60/492,104 and 60/580,662: Response to Communication pursuant to Article 96(2) [Examination Report] dated Jun. 5, 2007, 21 pages (Oct. 5, 2007).
EP 08 161 715.1 divisional of EP 04 780 228.5 corresponding to PCT/US2004/025359 [WO 2005/013209] which claims priority to U.S. Appl. No. 60/492,104 and 60/580,662: Search Report, 5 pages (Nov. 10, 2008).
PCT/US2004/025359 [WO 2005/013209] which claims priority to U.S. Appl. No. 60/492,104 and 60/580,662: Search Report, 8 pages (May 12, 2005).
PCT/US2004/025359 [WO 2005/013209] which claims priority to U.S. Appl. No. 60/492,104 and 60/580,662: Int'l Preliminary Report on Patentability, 13 pages (Feb. 16, 2006).
PCT/US2006/000670 [WO 2006/076289] which claims priority to U.S. Appl. No. 11/036,686: Search Report, 5 pages (Jun. 7, 2006).
PCT/US2006/000670 [WO 2006/076289] which claims priority to U.S. Appl. No. 11/036,686: Search Report, 6 pages (May 22, 2006).
PCT/US2006/000670 [WO 2006/076289] which claims priority to U.S. Appl. No. 11/036,686: Written Opinion, 7 pages (Oct. 19, 2006).
PCT/US2006/000670 [WO 2006/076289] which claims priority to U.S. Appl. No. 11/036,686: Notification re republication, 8 pages (Feb. 8, 2007).
PCT/US2006/000670 [WO 2006/076289] which claims priority to U.S. Appl. No. 11/036,686: Int'l Preliminary Report on Patentability, 9 pages (Jul. 26, 2007).
U.S. Appl. No. 11/809,621: Office Action Dated Feb. 18, 2009, 12 pages.
International Search Report, Application No. PCT/US2011/026935, dated May 3, 2011, 2 pages.
International Written Opinion, Application No. PCT/US2011/026935, dated May 3, 2011, 12 pages.

* cited by examiner

Table 9

Cp to Pxx

| Circle Cpx | Points Pxx | # Central Plate Points | Distance between Points Cp and Pxx (in.) | Pockets per distance (in.) from given point | Pockets per distance (ft.) from given point | Pockets/Square Foot of Circular Area | Area (ft2) | Distance between furthest Pxx (in.) | Pockets per furthest Pxx distance (in) | Distance between furthest Pxx (ft.) | Pockets per furthest Pxx distance (ft) |
|---|---|---|---|---|---|---|---|---|---|---|---|
| Cp1 | P42, P43, P52, P53 | 4 | 2.9 | 1.4 | 16.8 | 0.2 | 22.4 | 5.7 | 0.7 | 0.5 | 8.4 |
| Cp2 | P41, P44, P51, P54 | 8 | 8.3 | 1.0 | 11.6 | 1.5 | 5.3 | 16.6 | 0.5 | 1.4 | 5.8 |
| Cp3 | P32, P33, P62, P63 | 12 | 15.2 | 0.8 | 9.5 | 5.1 | 2.4 | 30.4 | 0.4 | 2.5 | 4.7 |
| Cp4 | P22, P23, P72, P73 | 16 | 16.8 | 1.0 | 11.5 | 6.1 | 2.6 | 33.5 | 0.5 | 2.8 | 5.7 |
| Cp5 | P31, P34, P61, P64 | 20 | 17.1 | 1.2 | 14.0 | 6.4 | 3.1 | 34.2 | 0.6 | 2.8 | 7.0 |
| Cp6 | P21, P24, P71, P74 | 24 | 18.5 | 1.3 | 15.6 | 7.5 | 3.2 | 37.0 | 0.6 | 3.1 | 7.8 |
| Cp7 | P12, P13, P82, P83 | 28 | 30.8 | 0.9 | 10.9 | 20.7 | 1.3 | 61.7 | 0.5 | 5.1 | 5.4 |
| Cp8 | P11. P14, P81, P84 | 32 | 31.8 | 1.0 | 12.1 | 22.1 | 1.4 | 63.6 | 0.5 | 5.3 | 6.0 |
| Cp9 | P80 | 33 | 33.7 | 1.0 | 11.8 | 24.7 | 1.3 | 67.4 | 0.5 | 5.6 | 5.9 |

FIG. 13A

Table 10

Cw to Wxx

| Circle Cwx | Points Wxx | # Points Wxx | Distance between Points Cw and Wxx (in.) | Pockets per distance (in.) from given point | Pockets per distance (ft.) from given point | Pockets/Square Foot of Circular Area | Area (ft2) | Distance between furthest Wxx (in.) | Pockets per furthest Wxx distance (in) | Distance between furthest Wxx (ft.) | Pockets per furthest Wxx distance (ft) |
|---|---|---|---|---|---|---|---|---|---|---|---|
| Cw1 | W42, W43, W,52, W53 | 4 | 5.0 | 0.8 | 9.7 | 0.5 | 7.5 | 9.9 | 0.4 | 0.8 | 4.8 |
| Cw2 | W41, W44, W51, W54 | 8 | 9.2 | 0.9 | 10.4 | 1.9 | 4.3 | 18.4 | 0.4 | 1.5 | 5.2 |
| Cw3 | W32, W33, W62, W63 | 12 | 12.0 | 1.0 | 12.1 | 3.1 | 3.9 | 23.9 | 0.5 | 2.0 | 6.0 |
| Cw4 | W31, W34, W61, W64 | 16 | 14.3 | 1.1 | 13.5 | 4.4 | 3.6 | 28.5 | 0.6 | 2.4 | 6.7 |
| Cw5 | W22, W23, W72, W73 | 20 | 20.1 | 1.0 | 12.0 | 8.8 | 2.3 | 40.1 | 0.5 | 3.3 | 6.0 |
| Cw6 | W21, W24, W71, W74 | 24 | 21.5 | 1.1 | 13.4 | 10.1 | 2.4 | 43.0 | 0.6 | 3.6 | 6.7 |
| Cw7 | W12, W13, W82, W83 | 28 | 27.5 | 1.0 | 12.2 | 16.5 | 1.7 | 55.0 | 0.5 | 4.6 | 6.1 |
| Cw8 | W11, W14, W81, W84 | 32 | 28.6 | 1.1 | 13.4 | 17.8 | 1.8 | 57.2 | 0.6 | 4.8 | 6.7 |
| Cw9 | W80 | 33 | 30.6 | 1.1 | 12.9 | 20.5 | 1.6 | 61.3 | 0.5 | 5.1 | 6.5 |

FIG. 13B

Table 11

Cr to Rxx

| Circle Crx | Points Rxx | # Points Rxx | Distance between Points Cr and Rxx (in.) | Pockets per distance (in.) from given point | Pockets per distance (ft.) from given point | Pockets/Square Foot of Circular Area | Area (ft2) | Distance between furthest Rxx (in.) | Pockets per furthest Rxx distance (in) | Distance between furthest Rxx (ft.) | Pockets per furthest Rxx distance (ft) |
|---|---|---|---|---|---|---|---|---|---|---|---|
| Cr1 | R42, R43, R52, R53 | 4 | 7.0 | 0.6 | 6.9 | 1.1 | 3.8 | 13.9 | 0.3 | 1.2 | 3.4 |
| Cr2 | R41, R44, R51, R54 | 12 | 10.4 | 1.1 | 13.8 | 2.4 | 5.0 | 20.9 | 0.6 | 1.7 | 6.9 |
| Cr3 | R32, R33, R62, R63 | 8 | 9.7 | 0.8 | 9.9 | 2.1 | 3.9 | 19.4 | 0.4 | 1.6 | 4.9 |
| Cr4 | R31, R34, R61, R64 | 16 | 12.5 | 1.3 | 15.4 | 3.4 | 4.7 | 24.9 | 0.6 | 2.1 | 7.7 |
| Cr5 | R22, R23, R72, R73 | 20 | 22.3 | 0.9 | 10.8 | 10.9 | 1.8 | 44.6 | 0.4 | 3.7 | 5.4 |
| Cr6 | R21, R24, R71, R74 | 24 | 23.6 | 1.0 | 12.2 | 12.2 | 2.0 | 47.3 | 0.5 | 3.9 | 6.1 |
| Cr7 | R12, R13, R82, R83 | 28 | 25.3 | 1.1 | 13.3 | 13.9 | 2.0 | 50.5 | 0.6 | 4.2 | 6.7 |
| Cr8 | R11, R14, R81, R84 | 32 | 27.4 | 1.2 | 14.0 | 16.4 | 2.0 | 54.8 | 0.6 | 4.6 | 7.0 |
| Cr9 | R80 | 33 | 28.3 | 1.2 | 14.0 | 17.5 | 1.9 | 56.6 | 0.6 | 4.7 | 7.0 |

FIG. 13C

CURRENCY BILL PROCESSING DEVICE AND METHOD

CROSS REFERENCE TO RELATED APPLICATIONS

The present application claims the benefit of U.S. Provisional Application Ser. No. 61/310,142 filed Mar. 3, 2010 and U.S. Provisional Application Ser. No. 61/330,071 filed Apr. 30, 2010, each of which is incorporated by reference in its entirety.

FIELD OF THE INVENTION

The present invention relates generally to document processing. In particular, the present invention relates to devices, systems, and methods for evaluating, authenticating, discriminating, sorting, and/or otherwise processing documents such as currency bills.

BACKGROUND OF THE INVENTION

A variety of techniques and apparatuses have been used in automated or semi-automated currency bill handling and processing systems. For example, as the number of businesses that deal with large quantities of paper currency grow, such as banks, casinos, and armored carriers, these businesses are continually requiring not only that their currency be processed more quickly but, also, processed with greater accuracy and with more efficiency.

Some currency bill processing machines are capable of rapidly discriminating and counting multiple currency denominations, and then sorting the currency bills into a multitude of output receptacles. However, many of these high-end machines are very large and cumbersome such that they are commonly found only in large institutions. These machines are not readily available to businesses which have space constraints, but still have the need to process large volumes of currency. For example, one of these machines can cost upwards of $500,000, and with added currency document receiving units, such as strapping units, additional output receptacles, and/or a shredder, the machines may be too large to fit within a standard room found in many buildings. Many of these systems are too large for the operator to be close to the input receptacle, operating panel, and output receptacles while remaining in one position. Thus, a need exists for an improved apparatus, method, and system. The present disclosure is directed to satisfying one or more of these needs and solving other problems.

SUMMARY OF THE INVENTION

According to some embodiments, a currency bill processing device includes a housing, an input receptacle, a first output receptacle, a second output receptacle, at least one detector, and a transport mechanism. The housing has a front side in opposing spaced relation to a back side, and a first end in opposing spaced relation to a second end. The front and the back sides of the housing are generally orthogonal with respect to the first and the second ends of the housing. The input receptacle is positioned proximate the first end of the housing. The input receptacle is configured to receive a stack of bills. The second output receptacle is proximate the second end of the housing and the first output receptacle is horizontally offset from the second output receptacle in a direction toward the first end of the housing. The housing is configured to provide access openings in the front side of the housing.

The access openings are proximate the first and the second output receptacles thereby permitting operator access into the first and the second output receptacles from the front side of the housing. The least one detector is positioned between the input receptacle and the first output receptacle. The transport mechanism is configured to transport bills from the input receptacle, one at a time, along a transport path originating at the input receptacle proximate the first end of the housing. The transport path extends generally horizontally past the at least one detector toward the second end of the housing. The transport path transitions generally-vertically upward between the first and the second output receptacles. The transport mechanism is further configured to deliver some of the bills toward the first end into the first output receptacle and some of the bills toward the second end into the second output receptacle.

According to some embodiments, a currency bill processing device for processing a stack of currency bills includes an input receptacle, a first output receptacle, a second output receptacle, at least one detector, and a transport mechanism. The input receptacle is configured to receive the stack of currency bills. Each of the output receptacles has a receiving opening (or receiving passage) and an access opening associated therewith. The receiving openings are configured to receive bills therethrough, and the access openings are proximate a front side of the currency bill processing device thereby permitting operator access into the first and the second output receptacles from the front side of the currency bill processing device. The receiving opening of the first output receptacle faces the receiving opening of the second output receptacle such that the first and the second output receptacles are oriented in a back-to-back manner with respect to each other. The at least one detector is positioned between the input receptacle and the output receptacles. The transport mechanism is configured to transport currency bills, one at a time, from the input receptacle past the at least one detector to one or more of the output receptacles.

According to some embodiments, a method of transporting bills from a stack of bills in an input receptacle of a currency bill processing device to at least one of a plurality of output receptacles including first and second horizontally-offset output receptacles includes receiving a stack of bills in the input receptacle of the currency bill processing device and transporting the bills, one at a time, from the input receptacle along a first segment of a transport path past at least one detector. The first segment includes a generally-horizontal portion. The method further includes generating data associated with the bills via the at least one detector and transporting the bills from the first segment along a second segment of the transport path. The second segment extends in a generally horizontal direction beneath the first and the second output receptacles. The method further includes transporting the bills from the second segment along a third segment of the transport path that extends generally vertically from the second segment between the first and the second output receptacles and delivering some of the bills from third segment into the first output receptacle and delivering some of the bills from third segment into the second output receptacle. The bills are delivered to one of the plurality of output receptacles based in part on the generated data.

According to some embodiments, a currency processing system includes a currency processing device and a first base module. The currency processing device has a first end and a second opposing end. The currency processing device includes an input receptacle, at least one detector, and a device transport mechanism. The input receptacle is configured to receive a plurality of bills and is positioned proximate to the first end. The at least one detector is configured to detect characteristic information from the bills and to generate data associated with each bill. The at least one detector is positioned between the first and the second ends of the currency processing device. The device transport mechanism is configured to transport the plurality of bills, one at a time, along a first segment of a transport path. The first segment of the transport path extends from the input receptacle past the at least one detector to a device outlet opening. The device outlet opening is located in the second end of the currency processing device. The first base module is configured to detachably connect to the second end of the currency processing device. The first base module includes a first end, a second opposing end, a top, and an opposing bottom. The first base module further includes a first base module inlet opening, a first outlet opening, a second outlet opening, a first output receptacle, a second output receptacle, and a first base module transport mechanism. The first base module inlet opening is in operative communication with the device outlet opening of the currency processing device such that the first base module inlet opening receives bills transported through the device outlet opening via the device transport mechanism. The first base module inlet opening is located in the first end of the first base module. The first outlet opening of the first base module is located in the second end of the first base module and the second outlet opening of the first base module is located in the top of the first base module. The first and the second output receptacles are configured to receive bills. The first and the second output receptacles are positioned between the first and the second ends and between the top and the bottom of the first base module. The first base module transport mechanism is configured to selectively transport bills received through the first base module inlet opening along a second segment of the transport path. The second segment of the transport path extends from the first base module inlet opening to the first outlet opening of the first base module. The second segment is positioned beneath the first and the second output receptacles. A third segment of the transport path extends generally-vertically upward from the second segment of the transport path between the first and the second output receptacles. The first base module transport mechanism is further configured to selectively deliver some of the bills from the third segment into the first output receptacle, some of the bills from the third segment into the second output receptacle, some of the bills from the second segment to the first outlet opening of the first base module, and some of the bills from the third segment to the second outlet opening of the first base module.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

FIGS. 13A-13C are tables providing various information, according to some embodiments, associated with the document processing system of FIGS. 12E-12G.

DETAILED DESCRIPTION OF THE ILLUSTRATED EMBODIMENTS

Definitions

Figure 1:
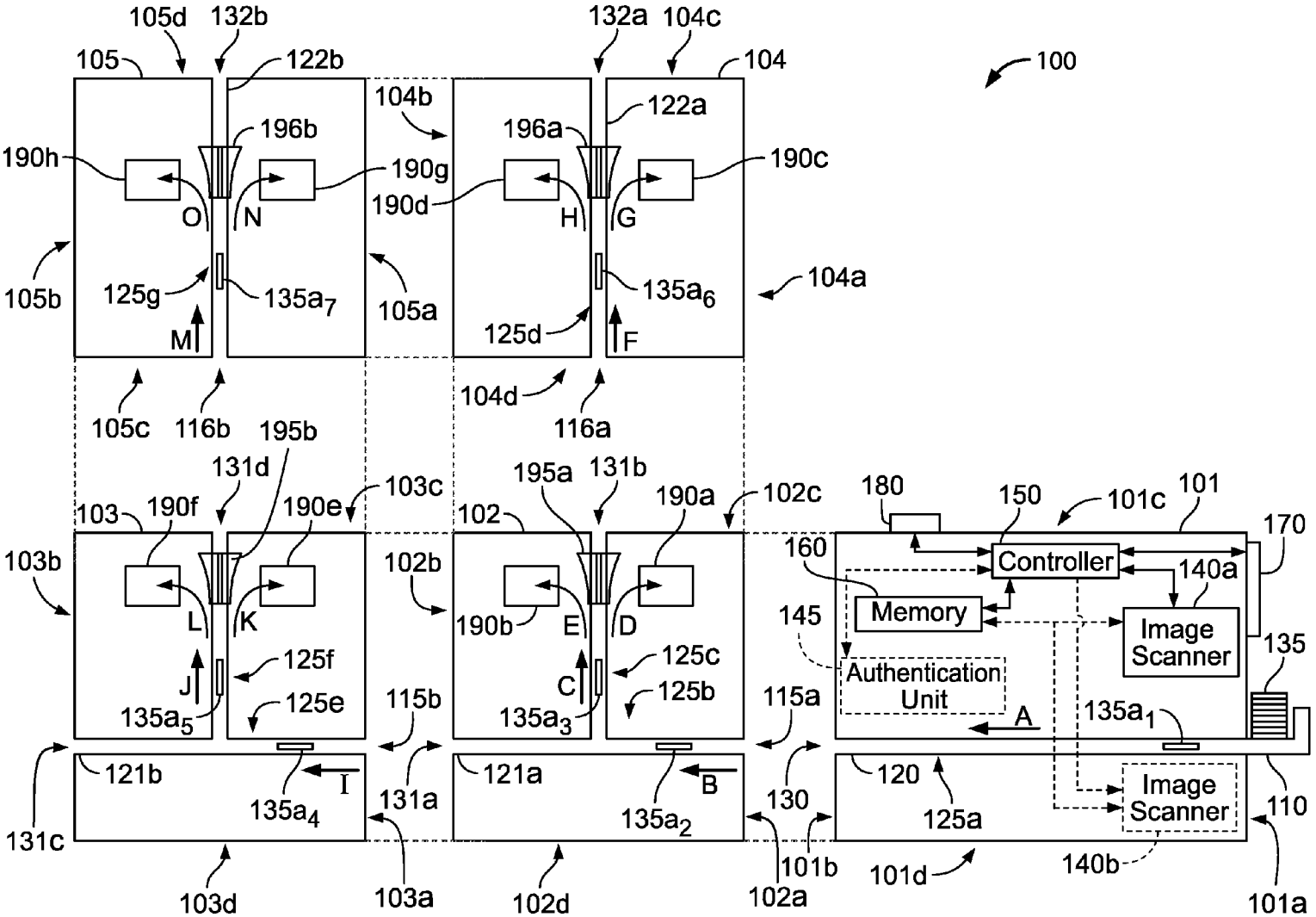
FIG. 1 is a partially exploded front schematic view of a currency processing system according to some embodiments of the present disclosure.

Other than schematic and block diagrams, the figures are drawn to scale. Accordingly, the following figures were generated from a CAD system and are drawn to scale: FIGS. 2A-2D, 4A-12H.

When describing various embodiments, the term "currency bills" or "bills" refers to official currency bills including both U.S. currency bills, such as a $1, $2, $5, $10, $20, $50, or $100 bills, and foreign currency bills. Foreign currency bills are notes issued by a non-U.S. governmental agency as legal tender, such as a euro, Japanese yen, pound sterling (e.g., British pound), Canadian dollar, Australian dollar bill, Mexican Peso, or Turkish lira.

The term "brick U.S. currency bills" generally refers to U.S. currency bills in mint or near mint condition having the highest fitness level. Brick U.S. currency can also refer to non-circulated U.S. currency bills, such as, for example, new bills shipped by the U.S. Federal Reserve to commercial banks. Brick U.S. currency bills are crisp, free of holes, free of tears, free of wrinkles, free of stray markings (e.g., pen and/or pencil marks), etc.

The term "general circulation U.S. currency bills" refers to random U.S. currency bills having a variety of different fitness levels (e.g., some mint bills, some near mint bills, some heavily worn bills, some bills with holes, some bills with tears, some soiled bills, or combinations thereof). For example, general circulation U.S. currency bills would include currency bills scheduled to be deposited by a retail store in a bank for a given workday and/or work week that were collected from customers. For another example, general circulation U.S. currency bills include all of or a portion of the bills in a bank vault. For another example, general circulation U.S. currency bills do not only include heavily worn bills and/or torn bills.

"Substitute currency notes" are sheet-like documents similar to currency bills, but are issued by non-governmental agencies such as casinos and amusement parks and include, for example, casino script and Disney Dollars. Substitute currency notes each have a denomination and an issuing entity associated therewith such as, for example, a $5 Disney Dollar, a $10 Disney Dollar, a $20 ABC Casino note, and a $100 ABC Casino note.

"Currency notes" consist of currency bills and substitute currency notes.

"Substitute currency media" are non-currency bill documents that represent a value by some marking or characteristic such as a bar code, color, size, graphic, or text. Examples of "substitute currency media" include without limitation: casino cashout tickets (also variously called cashout vouchers or coupons) such as, for example, "EZ Pay" tickets issued by International Gaming Technology or "Quicket" tickets issued by Casino Data Systems; casino script; promotional media such as, for example, Disney Dollars or Toys 'R Us "Geoffrey Dollars"; or retailer coupons, gift certificates, gift cards, or food stamps. Accordingly, substitute currency media includes, but is not limited to, substitute currency notes. Substitute currency media may or may not be issued by a governmental body.

The term "currency documents" includes both currency bills and "substitute currency media." The term "non-currency documents" includes any type of document except currency documents. For example, non-currency documents include personal checks, commercial checks, deposit slips, loan payment documents, cash credit or cash debit tickets, etc. The terms "financial documents" and "documents" are used throughout the specification to generally refer to any of currency bills, substitute currency notes, currency notes, substitute currency media, currency documents, checks, and non-currency documents. According to some embodiments, the term document can also refer to full sheets of letter sized (e.g., 8½"×11") and/or A4 sized documents. According to some such embodiments, a document processing system or device of the present disclosure can be configured to run in a scan-only mode that scans documents, including full sheets of letter and/or A4 sized documents, to generate a visually readable image of the document.

The term "deposit document" includes deposit slips, cash-in tickets, and cash-out tickets. A deposit document is generally associated with a deposit of currency bills and/or checks into, for example, a financial bank account by a bank customer. A deposit slip can include information such as, for example, a customer financial account number, a total deposit amount, a total currency bill deposit amount, a number of deposited currency bills broken down by denomination, a total check deposit amount, a number of deposited checks broken down by on-us checks and transit checks, a total on-us check deposit amount, a total transit check deposit amount, a total cashout amount, or combinations thereof.

Everyday, businesses and people unknowingly accept counterfeit currency documents as genuine. A counterfeit currency document is a currency document which is not issued by an authorized maker and/or a currency document which has been altered, for example, a $1 bill which has been altered to appear to be a $20 bill. For example, in the case of U.S. currency bills, a counterfeit currency bill would be a document printed to look like a genuine U.S. bill but not printed by the U.S. Treasury Department's Bureau of Engraving and Printing or one that has been tampered with or altered. As another example, in the case of casino script, a counterfeit currency document would be a script that is not issued by the corresponding casino or one that has been tampered with or altered.

The term "financial institution" as used herein includes, but is not limited to, banks, such as, brick and mortar banks, internet/online banks, casinos, brokers, investment banks, and armored carriers. Armored carriers can be stand alone financial institutions and/or agents of another financial institution.

Throughout this disclosure, the term "operator" is used to refer to a person or persons operating a document processing device or system under normal operating conditions such as, for example, a store clerk, a store manager, a bank employee, a bank teller, or a bank customer.

The term "teller" is used to refer to a person or persons that processes deposits of documents at a bank branch, a bank vault, an armored carrier, etc.

Throughout this disclosure, the term "batch" is used to refer to a set of documents that is associated with a transaction. A batch of documents can include one or more deposit documents, one or more currency bills, one or more checks, a header card, a trailer card, or any combination thereof. For example, a batch of documents associated with a first transaction between a store and a bank can include ten documents, the ten documents including one deposit slip, eight currency bills, and one check. For another example, a batch of documents associated with a second transaction between an individual and a bank can include twenty-five documents, the twenty-five documents including one deposit slip, twenty currency bills, and four checks.

There are at least two types of batches of documents, which include a "sorted" batch of documents and an "intermingled" or "commingled" batch of documents. A sorted batch of documents is a batch of documents wherein the order of different types of documents, such as, for example, currency bills, checks, and deposit documents, is arranged by groups, wherein each batch consists of at most only one group for each type of document. For example, for a batch consisting of ten checks and ten currency bills, a sorted batch of documents would include one group of the ten checks preceding or following a group of the ten currency bills. For another example, for a batch consisting of one deposit slip, five checks, and five currency bills, a sorted batch of documents would include the deposit slip and one group of the five checks preceding or following a group of the five currency bills. It is contemplated that the deposit slip can precede or follow either of the two groups of documents.

An intermingled batch of documents is a batch of documents wherein the order of different types of documents, such as, for example, currency bills, checks, and deposit documents, is mixed or random. For example, a batch consisting of ten checks and ten currency bills would be an intermingled batch of documents if the batch consisted of, in order, two bills, then three checks, then one bill, then seven checks, and finally seven bills. For another example, a batch consisting of one deposit slip, one cash-out ticket, ten currency bills, and twenty checks would be an intermingled batch of documents if the batch consisted of, in order, the deposit slip, five currency bills, ten checks, the cash-out ticket, five checks, five currency bills, and finally five checks.

A batch of documents including currency bills, checks, and/or deposit documents can be processed in a document processing device or system according to several modes of operation, such as, for example, a sorted-group mode, an ordered-batch mode, and an intermingled-batch mode. According to some embodiments, sorted batches of documents can be processed according to the sorted-group mode or the ordered-batch mode. According to some embodiments, intermingled batches of documents can be processed according to the intermingled-batch mode.

In the sorted-group mode, the currency bills are processed in separate groups from the checks. For example, for a batch of documents that includes one hundred currency bills and twenty-five checks, the one hundred currency bills are input into an input receptacle of the document processing device and processed as a first group of documents. Subsequently, the twenty-five checks are input into an input receptacle of the document processing device and processed separately as a second group of documents. That is, the currency bills and the checks of the batch of documents are processed in separate groups of documents by the same device.

In the ordered-batch mode, the currency bills are sorted from the checks into separate groups of documents, but the currency bills and the checks are input into an input receptacle of the document processing device together as a single batch of documents such that the document processing device can process the currency bills and then process the checks as a batch of documents associated with a transaction. For example, for a batch of documents that includes three hundred and fifty-five currency bills and six hundred checks, according to some embodiments, the three hundred and fifty-five currency bills are input into the input receptacle of the document processing device and the six hundred checks are positioned on top of the currency bills such that the currency bills are transported and processed first, and then the checks are transported and processed second. That is, the currency bills and the checks of the batch of documents are processed together, one after the other. For another example, for a sorted batch of documents that includes five currency bills and ten checks, according to some embodiments, the ten checks are input into the input receptacle of the document processing device and the five currency bills are positioned on top of the checks such that the checks are transported and processed first, and then the currency bills are transported and processed second.

In the intermingled-batch mode, the currency bills are mixed with the checks and input into the input receptacle of the document processing device together as a single intermingled or commingled batch of documents. For example, for a batch of documents that includes ten currency bills and ten checks, where the documents are ordered from one to twenty, the batch can be ordered such that the first five documents in the batch are currency bills, the second five documents in the batch are checks, then three currency bills, then two checks, then two currency bills, followed by three checks. In the intermingled-batch mode, the document processing device is configured to process the mixed currency bills and checks of the intermingled or commingled batch of documents together. Furthermore, in the intermingled-batch mode, the order of the documents does not matter and the processing device does not expect or require the documents in a batch to be in any particular order. Thus, a sorted batch of documents can be processed in the intermingled-batch mode.

Throughout this disclosure, the term "stack" or stack of documents is used to refer to a set of documents that is received in an input receptacle of a document processing device or system. A stack of documents can include a group of currency bills only; a group of checks only; a batch of documents including currency bills, checks, and/or other documents, such as deposit documents; one or more batches of documents; one or more subbatches of documents, one or more ordered batches of documents; an intermingled batch of documents; one or more deposit documents; one or more header cards and/or trailer cards; or any combination thereof.

Throughout this disclosure, the term "visually readable image," as would be understood by one of ordinary skill in the art, refers to image data or a portion of image data obtained for a document, that image data or portion thereof being reproducible as a visually readable image—that is, a visually readable image is reproducible from or using image data. For example, one of ordinary skill in the art would understand a visually readable image would be reproduced on a display device, or otherwise, for viewing by a human user of the devices and systems described herein. The visually readable image reproduced on the display device is associated with image data or a portion of image data obtained from a physical document (for example, currency bill, check, deposit slip). Therefore, one of ordinary skill in the art would understand the phrases "image data" and "visually readable image," as either individually or in some combination, to generally refer to and include image data or a portion of image data from which a visually readable image may be produced. In some contexts, reference may be made to, for example, the electronic storage or transmittal of image data that is reproducible as a visually readable image. In other contexts, reference may be made to, for example, the electronic storage or transmittal of a visually readable image. In both contexts, one of ordinary skill in the art would understand both phrases to generally be the same or similar, that is, image data, or a portion thereof, from which a visually readable image may be produced. The image data and/or visually readable images of the present disclosure can be in any of a variety of file formats, such as, for example, JPEG, JFIF, Exif, TIFF, RAW, PNG, GIF, BMP, etc.

Currency Processing System

Referring to FIG. 1, a document processing system 100 is shown according to some embodiments of the present disclosure. According to some embodiments, the document processing system 100 is a currency processing system. The document processing system 100 includes a document processing device 101, a first base module 102, a second base module 103, a first pocket module 104, and a second pocket module 105. According to some embodiments, the document processing device 101 is configured to process a variety of documents such as currency bills, checks, header/trailer cards, deposit slips, cash-in tickets, and cash-out tickets. While FIG. 1 illustrates a document processing system 100 having a particular number and arrangement of devices and modules, it is contemplated that a document processing system according to the present disclosure can have a variety of other numbers of devices and modules with the same and/or different relative positions. For example, according to some embodiments, a document processing system can have between one and four base modules and between zero and twelve pocket modules. For another example, according to some embodiments, a document processing system can have between one and ten base modules and/or between zero and one hundred pocket modules. Various other numbers of base module and pocket module combinations are possible and are contemplated, such as, for example, those shown in FIGS. 2A-2D, 3A-3F, 7A-7G, 8A-8G, 9A-9G, 10A-10G, 11A-11G, and 12A-12H.

Referring to FIGS. 2A-2D, a document processing system 200 is shown according to some embodiments of the present disclosure. The document processing system 200 is similar to the document processing system 100 in that the document processing system 200 includes a document processing device 101, a first base module 102, and a first pocket module 104, which are the same as, or similar to, the document processing device 101, the first and/or the second base modules 102, 103, and the first and/or the second pocket modules 104, 105 respectively. Throughout this disclosure, reference is made to the document processing systems 100 and 200 for illustrative purposes where like components/elements have like reference numbers. While system 100 includes modules (the second base module 103 and the second pocket module 105) not included in the document processing system 200, it is understood that the document processing system 200 can include such additional modules and/or fewer modules.

Document Processing Device

Referring generally to FIGS. 1 and 2A-2D, according to some embodiments, the document processing device 101 includes an input receptacle 110, a device transport mechanism 120, and a device outlet opening 130. While, only one input receptacle 110 and one device outlet opening 130 are shown, it is contemplated that according to some embodiments, the document processing device 101 may include a plurality of input receptacles 110 and/or a plurality of device outlet openings 130. Details of such systems/devices are described in International Publication No. WO 97/45810 and U.S. Pat. No. 6,311,819, entitled "Method and Apparatus for Document Processing", which are incorporated herein by reference in their entireties.

Referring to FIG. 1, the input receptacle 110 is positioned proximate to a first end 101*a* of the document processing device 101. According to some embodiments, the document processing device 101 is configured to receive only one document at a time. According to other embodiments, the document processing device 101 is configured to receive a stack of documents 135 in the input receptacle 110. According to some embodiments, the stack of documents 135 only includes U.S. currency bills. It is contemplated that in lieu of or in addition to bills, the stack of bills 135 can include one or more of a variety of other types of documents, such as, for example, currency bills of one or more countries, financial documents such as, for example, checks, and/or deposit documents such as those described above in the Definitions Section. According to some embodiments, the stack of documents 135 can include one or more sorted batches of documents and/or one or more intermingled batches of documents, such as, for example, intermingled bills and checks.

According to some embodiments, the stack of documents 135 includes a first batch of documents and a second batch of documents. According to some such embodiments, the first batch of documents solely includes bills and the second batch of documents solely includes checks. According to some embodiments, the first batch of documents is inputted and processed separately from the second batch of documents. According to some embodiments, the first batch of documents is received in a first input receptacle and the second batch of documents is received in a second separate input receptacle. In such embodiments, the first and the second batches of documents can be run and/or transported simultaneously or one after the other.

The device transport mechanism 120 is coupled to the input receptacle 110 and is configured to transport the plurality of documents 135 along a first segment 125*a* of a transport path. The documents, such as bills 135*a* (shown in FIG. 1 at various positions as $\mathbf{135}a_{1\text{-}7}$), are transported via the device transport mechanism 120 in the direction of arrow A from the first end 101*a* to a second opposing end 101*b* of the document processing device 101, past at least one detector, and to the device outlet opening 130, which is located in the second end 101*b* of the document processing device 101.

According to some embodiments, the at least one detector is configured to detect characteristic information from the documents 135 and generate one or more electrical signals associated with the documents. According to some embodiments, the document processing device 101 includes a plurality of detector bays for mounting a plurality of detectors. In some embodiments, the document processing device 101 includes two or more detector bays. In some embodiments, the document processing device 101 includes three or four detector bays along a first side of the first segment of the transport path such as adjacent to a top side of the transport path, and/or three or four corresponding detector bays along a second opposing side of the first segment of the transport path such as adjacent to a bottom side of the transport path. According to some embodiments, the plurality of detector bays are universal such that each one of the detector bays is configured to receive a variety of different types of detectors and/or sensors, such as, for example, image scanners, authentication sensors, and density sensors.

According to some embodiments, the at least one detector includes one or more denomination sensors, one or more image scanner(s) 140*a* and/or 140*b*, one or more authentication sensors or units 145, one or more density sensors, or a combination thereof. According to some embodiments, the document processing device 101 includes a single image scanner 140*a* to scan and/or image one or both sides of each passing bill. According to other embodiments, the document processing device 101 includes a first image scanner 140*a* to scan and/or image a first side of each passing document and a second scanner 140*b* to scan and/or image a second opposing side of each respective passing document. The second image scanner 140*b* is positioned on an opposing side of the first segment 125*a* of the transport path as compared with the position of the first image scanner 140*a*. According to some embodiments, the second image scanner 140*b* is opposite or off-set up or downstream from the first image scanner 140*a*.

According to some embodiments, the document processing device 101 does not include any image scanners. According to some such embodiments, the document processing device 101 includes denomination sensors for denominating currency bills. Additional details on such non-imaging denominating devices are described in U.S. Pat. No. 5,295,196, entitled "Method and Apparatus for Currency Discrimination and Counting"; U.S. Pat. No. 5,815,592, entitled "Method and Apparatus for Discriminating and Counting Documents"; and U.S. Pat. No. 5,790,697, entitled "Method and Apparatus for Discriminating and Counting Documents"; all of which are hereby incorporated by reference herein in their entireties.

According to some embodiments, the document processing device 101 includes an authentication sensor or authentication unit 145. Yet according to other embodiments, the document processing device 101 does not include an authentication sensor/unit 145. In some such embodiments, the lack of the authentication sensor/unit 145 reduces the overall weight and cost of the document processing device 101. For bills, authentication can be accomplished using the authentication sensor/unit 145 and/or by using a database of serial numbers for known or suspected counterfeit currency bills. The authentication sensor/unit 145 is optionally positioned adjacent to the first segment 125*a* of the transport path in a similar fashion as the image scanner(s) 140*a* and/or 140*b*. The authentication sensor/unit 145 is configured to authenticate the documents 135 based on one or more criteria and/or authentication tests as is commonly known in the art. Some examples of authentication sensors/units and authentication tests are described in U.S. Pat. No. 5,640,463, issued on Jun. 17, 1997, entitled "Method and Apparatus For Authenticating Documents Including Currency"; U.S. Pat. No. 5,790,693, issued on Aug. 4, 1998, entitled "Currency Discriminator and Authenticator"; U.S. Pat. No. 5,992,601, issued on Nov. 30, 1999, entitled "Method and Apparatus for Document Identification and Authentication"; and U.S. Pat. No. 5,960,103, issued on Sep. 28, 1999, entitled "Method and Apparatus for Authenticating Currency"; all of which are hereby incorporated by reference herein in their entireties.

According to some embodiments, the input receptacle 110 is configured to receive the stack of bills or documents 135 with a wide edge or a longer edge of the documents 135 being initially fed into the document processing device 101. That is, according to some embodiments, the wide edge of the stack of bills or documents 135 is perpendicular to the direction of arrow A (FIGS. 1 and 2A), which is also called the feed direction. According to some embodiments, the documents are transported in a wide edge leading manner such that one of the wide edges of each document is the sole leading edge during the transport of that document from the input receptacle to an output receptacle, such as one of the output receptacles 190*a-h*, which are described in below.

According to some embodiments, transporting the stack of bills/documents 135 with the wide edge leading can increase the overall processing speed of the document processing device 101. According to some embodiments, the transport mechanism(s) (e.g., device transport mechanism 120) can transport the stack of documents 135 with the wide edge leading at a decreased linear speed while simultaneously increasing the processing speed of the document processing device 101. According to some embodiments, transporting the stack of documents 135 with the wide edge leading uses shorter transport paths as compared to systems that transport with the narrow edge leading. According to some embodiments, the shorter transport paths are employed to minimize and/or reduce the size and weight of the document processing system 100, 200.

According to some embodiments, the documents are transported in a wide edge leading manner such that each of the documents is moved from the input receptacle 110 to one of the plurality of output receptacles 190*a-h* without rotating the document around an axis passing through a leading edge and a trailing edge of the document. That is, according to some embodiments, a document is not flipped about an axis passing through its leading edge and its trailing edge to change the face orientation of the document. It is contemplated that according to such embodiments, for documents transported in a wide edge leading manner as described above, the documents can be faced by rotating and/or flipping the documents about an axis passing through both of the narrower edges. Such a facing can occur as the documents are deposited into one of the output receptacles. For example, as a bill is transported in the wide edge leading manner in the direction of arrow F (FIGS. 1 and 2B), the bill can be directed and deposited in the third output receptacle 190*c* such that a first side of the bill is facing upwards or the bill can be directed and deposited in the fourth output receptacle 190*d* such that a second opposing side of the bill is facing upwards. It is contemplated that according to some embodiments, to face documents—that is, to deposit documents in the output receptacles 190*a-h* such that all documents face in the same direction, e.g., upward—the document processing systems 100, 200 can determine the face orientation of the documents and deposit the documents in an appropriate output receptacle such that the documents are all faced without rotating a single one of the documents about an axis passing through a leading edge and a trailing edge of the document.

According to some embodiments, the input receptacle 110 includes two slidable guides that are adjustable such that the input receptacle 110 can receive the stack of documents 135 with the wide edge leading or a narrow edge or shorter edge of the documents leading. That is, according to some alternative embodiments, the narrow edge of the documents 135 is perpendicular to the feed direction.

According to some embodiments, a controller or processor 150 is coupled to the image scanner(s) 140*a* and/or 140*b*, the device transport mechanism 120, a memory 160, an operator interface or control panel 170, and a communications port or network device 180. The controller 150 is configured to control the operation of the device transport mechanism 120 and the image scanner(s) 140*a* and/or 140*b*. The controller 150 is also configured to communicate information to and from the memory 160, the control panel 170, and the communications port 180. For example, the controller 150 may send information to and receive operator input from the control panel 170. The control panel 170 can be configured to display information regarding the documents 135 and/or status information concerning the operation of the document processing system 100. For example, according to some embodiments, the control panel 170 is configured to display an image or a partial image (e.g., snippet image) of a document of concern, such as, for example, a currency bill that is identified as a possible counterfeit currency bill, also known as a suspect currency bill. According to some embodiments, the controller 150 comprises one or more computers. In these embodiments, the controller 150 can include a plurality of memory devices (e.g., RAM, ROM, Hard Drive, etc.), processor(s), etc. necessary to perform a plurality of document processing actions within the document processing system 100. Some examples of document processing actions may include, but are not limited to, cropping and deskewing images and/or data, compressing data, down-sampling, denominating bills, extracting information (e.g., character information, serial numbers, MICR lines, etc.), comparing extracted data with one or more databases, determining information from and/or analyzing data, storing data, transmitting data, etc.

According to some embodiments, in response to the image scanners 140*a* and/or 140*b* scanning and/or imaging documents, the image scanners 140*a* and/or 140*b* generate one or more electrical signals associated with the scanned and/or imaged documents. According to some embodiments, the one or more electrical signals are transmitted to one or more controllers and/or processors, such as, for example, the controller 150. The controller 150 is configured to receive the one or more electrical signals and to derive and/or generate data therefrom. According to some embodiments, the one or more electrical signals are analog signals that the controller 150 is configured to convert into one or more digital signals using, for example, an analog-to-digital converter (ADC). The derived data can include, for example, image data, authentication data, positional data (e.g., position of document along the first segment), etc. According to some embodiments, the image data can be reproduced as one or more visually readable images of the documents.

According to some embodiments, the operator can initiate document processing via use of the control panel 170. According to some embodiments, the operator can initiate document processing via use of a computer (not shown) communicatively connected to the document processing device 101 via, for example, the communications port 180. According to some embodiments, the control panel 170 is a full graphics color touch screen display with various soft touch keys used to operate the document processing system 100, 200 such as the control panel 170 shown in FIG. 2A. Alternatively or additionally, the control panel 170 may contain physical keys or buttons and/or another type of display such as an LED display. For example, a QWERTY keyboard and/or a ten key numerical keypad may be utilized. According to some embodiments, the control panel 170 displays "functional" keys when appropriate. According to some embodiments, the control panel 170 is integrated within a single housing of the document processing device 101. Alternatively, the control panel 170 can be remotely positioned from the document processing device 101, but communicatively connected therewith via, e.g., a wired connection and/or a wireless connection.

In response to the initiation of document processing, the device transport mechanism 120 transports the stack of documents 135 in the direction of arrow A in a serial fashion, one document at a time, one after another. As the documents 135 are transported along the first segment 125*a* of the transport path via the device transport mechanism 120, data associated with each document, such as, for example, bill 135$a_1$, is generated and/or derived using the at least one detector, such as, for example, the image scanner(s) 140*a* and/or 140*b* and/or the controller 150.

According to some embodiments, the generated and/or derived data is image data that is reproducible as a visually readable image or a human readable image of substantially the entire bill 135$a_1$ (a "full image") and/or of selected portions of the bill 135$a_1$ (a "snippet image"). According to some embodiments, a visually readable and/or human readable image is defined based on a number of dots or pixels per inch ("DPI") that form the image. For purposes of the present disclosure, a visually readable image is an image having a resolution of at least 50 DPI×50 DPI—that is, the image includes 2500 dots or pixels per square inch. According to some embodiments, the visually readable image is formed with a resolution of at least 100 DPI×100 DPI. According to some embodiments, the visually readable image is formed with a resolution of at least 200 DPI×100 DPI. According to some embodiments, the visually readable image is formed with a resolution of at least 200 DPI×200 DPI. As the DPI increase, the amount of data generated by the image scanner(s) 140*a* and/or 140*b* increases, which may be a factor in causing relatively slower processing speeds in some embodiments. According to some embodiments, the resolution of an image is defined as P DPI X Q DPI, where P is the resolution in the x-direction or the direction perpendicular to the feed direction, and Q is the resolution in the y-direction or the direction parallel to the feed direction.

According to some embodiments, the image scanner(s) 140*a* and/or 140*b*, the controller 150, and/or the memory 160 includes data extraction software such as optical character recognition (OCR) software for identifying characters contained in one or more fields of the visually readable images of the documents 135 and extracting the characters as extracted data. It is contemplated that according to some embodiments, other software can be used to extract character or symbol information from the visually readable images. According to some embodiments, the document processing system 100 uses the OCR software to obtain or extract identifying information from each of the visually readable images. For example, the OCR software may implement a search of the visually readable image of a currency bill for a serial number data field and extract a serial number of the currency bill once the data field is located. Additional details regarding OCR can be found in U.S. Provisional Patent Application No. 61/259,018, filed Nov. 6, 2009, which is hereby incorporated by reference herein in its entirety.

According to some embodiments, the visually readable image is formed with a resolution of 300 DPI×200 DPI, 300 DPI×300 DPI, 400 DPI×200 DPI, or 400 DPI×400 DPI. Such elevated resolutions can be desired when using OCR software to extract relatively small characters from an image. For example, when trying to extract small characters on a currency bill, such as, for example, back plate numbers found on U.S. currency bills, the image scanner(s) 140*a* and/or 140*b* can be configured to generate visually readable images having elevated resolutions (e.g., 400 DPI×200 DPI). According to some embodiments, if fine printing defects are to be identified, a higher resolution, such as, for example, 1200 DPI×1200 DPI or 2400 DPI×2400 DPI, could be used.

According to some embodiments, the memory 160 is configured to store and/or buffer data associated with the documents 135. The data can be reproducible as a visually readable image when read and displayed on a display device (e.g., control panel 170) or printed on a printing device (not shown). The visually readable image can be a full visually readable image that depicts the bill 135$a_1$ or a partial or snippet visually readable image (e.g., serial number snippet image) that depicts the bill 135$a_1$. According to some embodiments, the memory 160 is configured to store and/or buffer extracted and/or inputted data, such as, for example, identifying information and/or transactional information associated with the stack of documents 135. The identifying information can include, for example, serial numbers, denominations, batch/deposit identification numbers, MICR data/lines, etc. The transaction information can include, for example, a financial institution account number, a transaction identifier, a customer name, address, phone number, a total deposit amount, a total currency bill deposit amount, and/or a number of deposited currency bills broken down by denomination, a total check deposit amount, and/or a number of deposited checks.

According to some embodiments, the memory 160 is configured to store a database and/or a suspect database. According to some embodiments, a number of types of information can be used to assess whether a currency bill is a suspect currency bill, including serial number, denomination, series, check letter and quadrant number, check letter and face plate number, back plate number, federal reserve letter/number, signatories, issuing bank, image quality, infrared characteristics, magnetic characteristics, ultraviolet characteristics, color shifting ink, watermarks, metallic threads, holograms, etc., or some combination thereof. Additional details on databases and authentication using such databases are described in U.S. Patent Application No. 61/259,018, entitled "Apparatus for Imaging Currency Bills and Financial Documents and System and Method for Using the Same", which is hereby incorporated by reference herein in its entirety.

According to some embodiments, the document processing device 101 is configured to determine a fitness of each document being processed. For example, the document processing device 101 can employ one or more fitness sensors to determine if a currency bill is worn, torn, soiled, holes, marked, etc. According to some such embodiments, unfit documents can be sorted to one or more specified output receptacles for further processing by an operator of the document processing system 100. Additional disclosure on determining fitness of a document can be found in U.S. Pat. No. 6,913,260, entitled "Currency Processing System with Fitness Detection" and U.S. Patent Application No. 2007/0122023 A1, entitled "Currency Processing System with Fitness Detection".

As described above, according to some embodiments, the controller 150 is configured to communicate information to and from the communications port 180. The communications port 180 is configured to be communicatively connected to a network (e.g., Internet, private network, customer network, financial institution network, LAN, WAN, secured network, etc.) to permit information to be transmitted to and from the document processing device 101. For example, according to some embodiments, the document processing device 101 comprises an Ethernet card comprising the communications port 180 that is communicatively connected to a network. It is contemplated that according to some embodiments, the document processing device 101 includes two or more communications ports 180 to increase the flow and/or transfer of data to and from the document processing device 101.

Figure 2A:
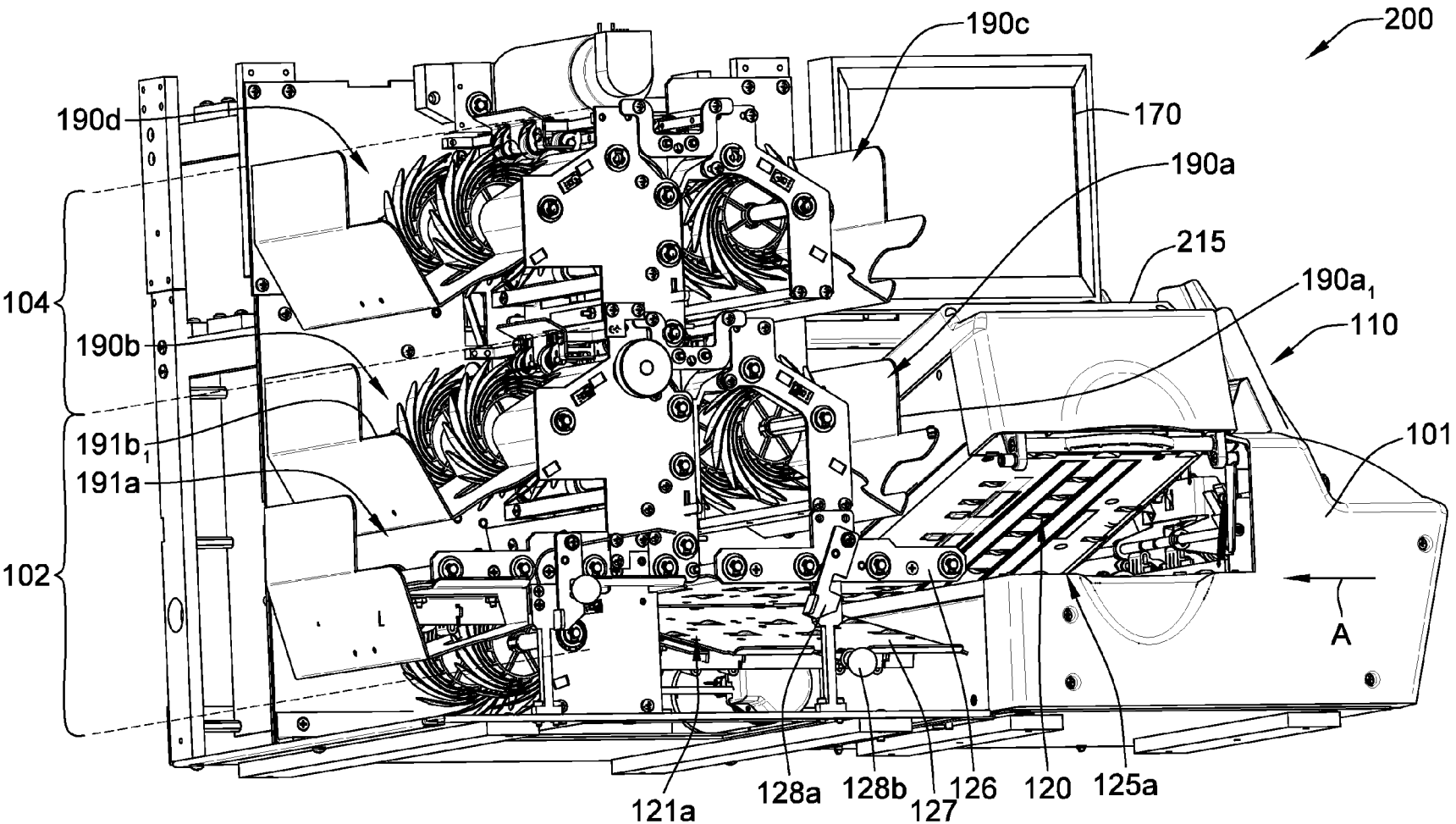
FIG. 2A is a partial perspective view of a currency processing system having a currency processing device, a base module, and a pocket module according to some embodiments of the present disclosure.

Referring to FIG. 2A, the document processing device 101 is shown with a moveable upper portion 215 in an open position. Opening the moveable upper portion 215 provides access to one or more detectors and a portion of the transport mechanism 120 such that an operator can remove jammed documents, clean scanheads, etc. According to some embodiments, the moveable upper portion 215 pivots open about 30 degrees. According to some embodiments, the moveable upper portion 215 pivots open about 45 degrees. According to some embodiments, the moveable upper portion 215 pivots open about 60 degrees. According to some embodiments, the moveable upper portion 215 pivots open about 90 degrees. According to some embodiments, the moveable upper portion 215 pivots open about 120 degrees. According to some embodiments, the control panel 170 is mounted on the moveable upper portion 215 such that the control panel 170 moves with the moveable upper portion 215. According to other embodiments, the control panel 170 is mounted remote from the moveable upper portion 215 on the housing of the document processing device 101 or elsewhere, such as remote from the document processing system 200.

First Base Module

Figure 2B:
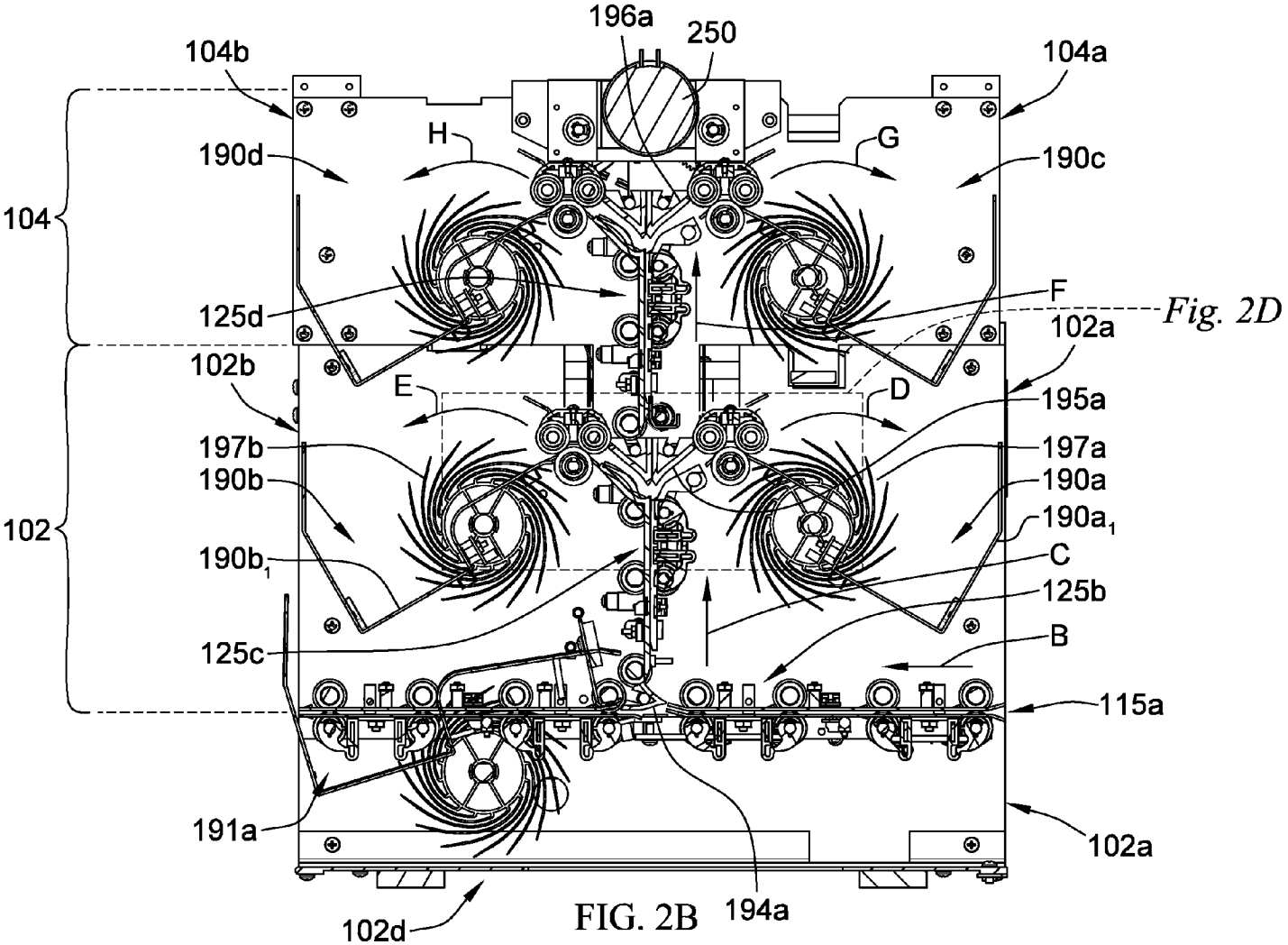
FIG. 2B is a partial front cross-sectional view of the base module and the pocket module of the currency processing system of FIG. 2A.

Referring generally to FIGS. 1 and 2A-2C, according to some embodiments, the first base module 102 has a first end 102*a* and a second opposing end 102*b*; and a top 102*c* and an opposing bottom 102*d*. The first base module 102 includes a first base module transport mechanism 121*a*, a first output receptacle 190*a*, a second output receptacle 190*b*, a first base module 2-way diverter 194*a* (FIG. 2B), and a first base module 3-way diverter 195*a* (FIGS. 1 and 2B).

According to some embodiments, the first base module 102 is configured to be detachably and operatively connected with the second end 101*b* of the document processing device 101. That is, the first end 102*a* of the first base module 102 abuts the second end 101*b* of the document processing device 101 such that a first base module inlet opening 115*a* (FIGS. 1 and 2B) located in the first end 102*a* of the first base module 102 aligns with the device outlet opening 130 (FIG. 1). According to some embodiments, the first base module inlet opening 115*a* is communicatively coupled with the device outlet opening 130 such that documents (e.g., bill 135$a_1$) can be transported by the device transport mechanism 120, through the device outlet opening 130, through the first base module inlet opening 115*a*, and further transported by the first base module transport mechanism 121*a*. According to some embodiments, mechanically coupling and/or abutting the first base module 102 with the document processing device 101 also communicatively and/or electronically couples the first base module 102 with the document processing device 101 such that one or more components of the document processing device 101 (e.g., the controller 150) is communicatively connected with one or more components (e.g., the first base module 3-way diverter 195*a*) of the first base module 102.

According to some embodiments, the first and the second output receptacles 190*a,b* (FIGS. 1, 2A-2C) are configured to receive documents, such as, the bill 135$a_1$. The first and the second output receptacles 190*a,b* are positioned between the first end 102*a* and the second end 102*b* and between the top 102*c* and the bottom 102*d* of the first base module 102. According to some embodiments, the first and the second output receptacles 190*a,b* are horizontally offset from one another.

According to some embodiments, each of the first and the second output receptacles 190*a,b* includes a stacker plate 190$a_1$, 190$b_1$ configured to allow processed bills to rest thereon. According to some embodiments, the output receptacles 190*a,b* further include entry rollers (e.g., including drive roller 192*b*, belt 192*c*, and wheels 192*d,e* described below and shown in FIG. 2D). The entry rollers bridge the gap between the transport mechanism and the output receptacle by receiving bills from the transport mechanism and delivering the bills into the output receptacle. According to some embodiments, the output receptacle optionally includes a stacker wheel (e.g., stacker wheels 197*a,b* shown in FIGS. 2B-2D) positioned between the stacker plate 190$a_1$, 190$b_1$ and the entry rollers. The stacker wheel can be configured to receive bills from the entry rollers and to deliver bills to the stacker plate. While the first and the second output receptacles 190*a,b* are shown as including stacker plates, entry rollers, and stacker wheels, it is contemplated that first and the second output receptacles 190*a,b* may include only one or two of these components. For example, it is contemplated that first and the second output receptacles 190*a,b* can only include a stacker plate without a stacker wheel and without entry rollers. Alternatively or additionally other mechanisms and arrangements for receiving documents in output receptacles known in the art may be employed according to some embodiments.

The first base module transport mechanism 121*a* (FIGS. 1 and 2A) is configured to transport documents along a second segment 125*b* (FIGS. 1 and 2B) of the transport path in the direction of arrow B. The second segment 125*b* extends generally from the first base module inlet opening 115*a* to a first outlet opening 131*a* (FIG. 1) located in the second end 102*b* of the first base module 102. According to some embodiments, the second segment 125*b* is positioned at least partially beneath the first and the second output receptacles 190*a,b*. The first base module transport mechanism 121*a* is further configured to selectively transport documents along a third segment 125*c* (FIGS. 1 and 2B) of the transport path. The third segment 125*c* extends generally-vertically upward from the second segment 125*b* of the transport path in the direction of arrow C and between the first and the second output receptacles 190*a,b*. According to some embodiments, a controller (e.g., the controller 150) controls whether the first base module transport mechanism 121*a* delivers a document along the second segment 125*b* beneath the third segment 125*c* and toward the first outlet opening 131*a* of the first base module 102 or transports the document generally upward in the direction of arrow C along the third segment 125*c*. According to some such embodiments, the controller is configured to control the first base module 2-way diverter 194*a* (FIGS. 2B-2C) positioned at the junction of the second segment 125*b* and the third segment 125*c* to selectively direct documents along the second segment 125*b* or the third segment 125*c* of the transport path.

According to some embodiments, the first base module 3-way diverter 195*a* (FIGS. 1 and 2B-2D) is positioned along the third segment 125*c* of the transport path and between the first and the second output receptacles 190*a,b*. According to some embodiments, the first base module 3-way diverter 195*a* is configured to transition between at least three distinct positions to selectively direct documents along one of at least three distinct paths or directions. According to some such embodiments, the first base module 3-way diverter 195*a* is configured to rotate and/or pivot about an axis between the at least three distinct positions. According to some embodiments, the first base module 3-way diverter 195*a* is a single unitary piece made of, for example, extruded plastic, molded plastic, and/or metal. According to some embodiments, the first base module 3-way diverter 195*a* includes a slot configured to pass documents therethrough. For example, the slot can be large enough such that a U.S. currency bill can be transported through the slot in a wide-edge leading manner.

According to some embodiments, the first base module 3-way diverter 195*a* includes two 2-way diverters, where each of the 2-way diverters are a single unitary piece made of, for example, extruded plastic, molded plastic, and/or metal. According to such embodiments, the two 2-way diverters are configured to be controlled and/or to move in unison and/or in a cooperative fashion to selectively direct documents being transported. For example, the two 2-way diverters can be configured to be controlled by a controller to selectively direct documents into one of the first and the second output receptacles 190*a,b* and/or past both of the first and the second output receptacles 190*a,b* such as to a second outlet opening 131*b*. It is contemplated that the 3-way diverters of the present disclosure can be a single unitary 3-way diverter or a 3-way diverter comprised of two cooperative 2-way diverters as described above. According to some embodiments, the diverters are not made of a single unitary member but are constructed of several pieces.

Figure 2C:
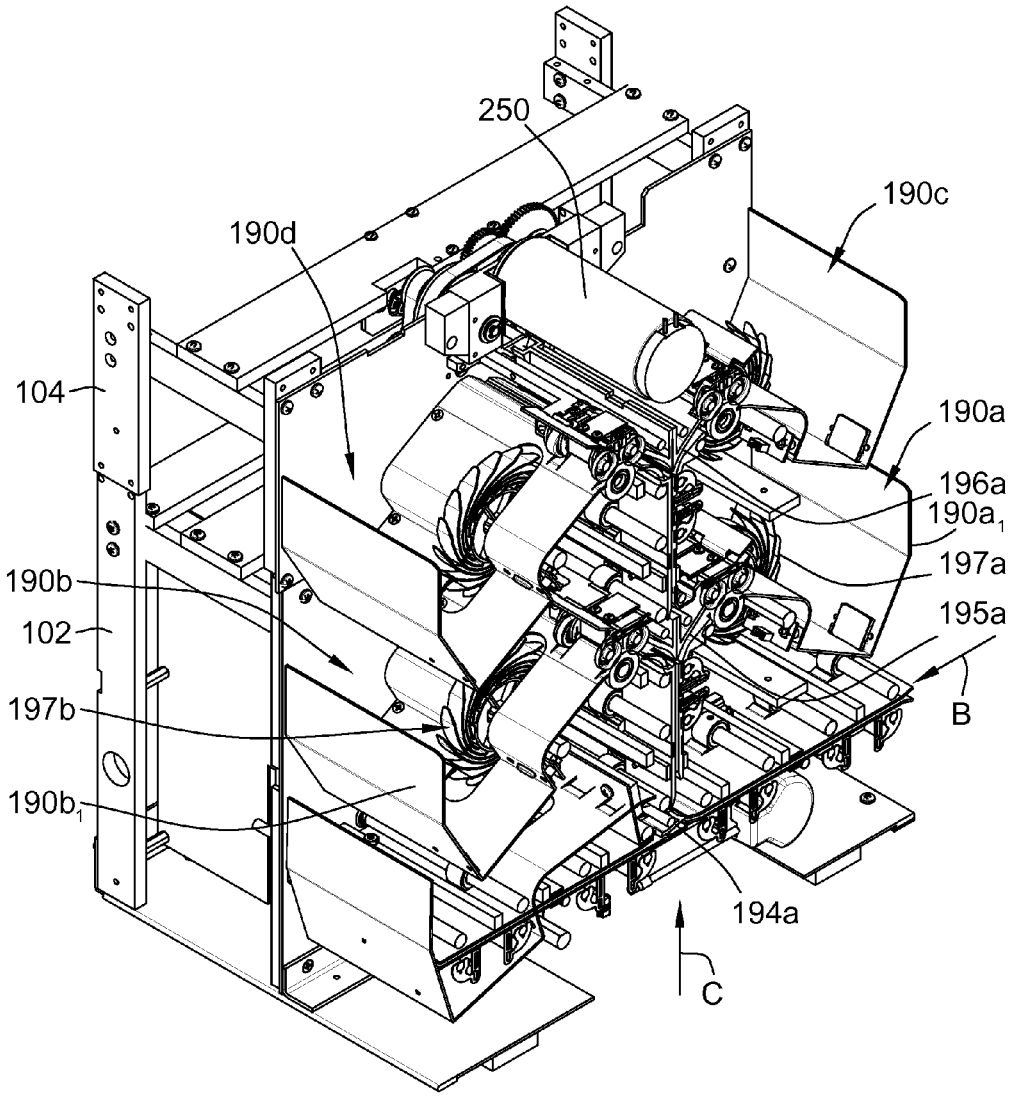
FIG. 2C is a partial perspective cross-sectional view of the base module and the pocket module of the currency processing system of FIG. 2A.
Figure 2D:
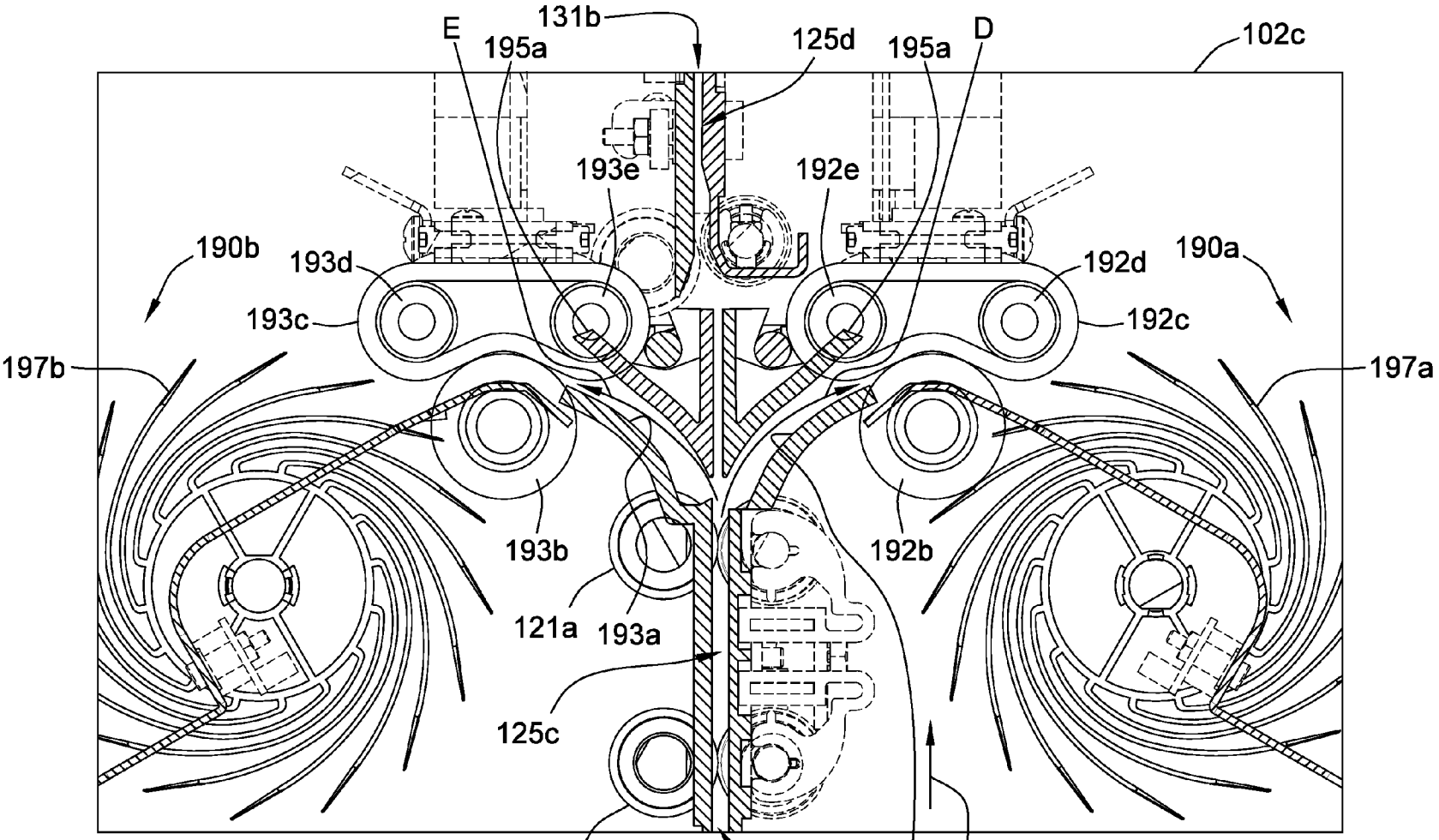
FIG. 2D is an enlarged view of a portion of the partial front cross-sectional view of the base module in FIG. 2B.

Referring to FIG. 2D, according to some embodiments, a controller is configured to cause the first base module 3-way diverter 195*a* to reside in and/or rotate to a position to selectively direct documents being transported via the first base module transport mechanism 121*a* along the third segment 125*c* of the transport path. According to some such embodiments, the controller is configured to cause the first base module 3-way diverter 195*a* to reside in a first position to selectively direct documents from the third segment 125*c* in the direction of arrow D into the first output receptacle 190*a*. According to some such embodiments, the controller is configured to cause the first base module 3-way diverter 195*a* to reside in a second position to selectively direct documents from the third segment 125*c* in the direction of arrow E into the second output receptacle 190*b*. According to some such embodiments, the controller is configured to cause the first base module 3-way diverter 195*a* to reside in a third position to selectively direct documents in the direction of arrow C past both the first and the second output receptacles 190*a,b* toward the second outlet opening 131*b* located in the top 102*c* of the first base module 102. According to some embodiments, in response to the first base module 3-way diverter 195*a* residing in the third position, documents are transported in the direction of arrow C through the slot of the first base module 3-way diverter 195*a*. Thus, the first base module transport mechanism 121*a* can transport documents from the first base module inlet opening 115*a* to one of four locations including, but not limited to, the first outlet opening 131*a*, the first output receptacle 190*a*, the second output receptacle 190*b*, and the second outlet opening 131*b*.

With reference to FIG. 2D, according to some embodiments, as the documents are selectively directed to one of the first or the second output receptacles 190*a,b*, the documents are transported along a respective transition surface 192*a*, 193*a*. For example, for a document being transported from the third segment 125*c* of the transport path to the first output receptacle 190*a* via the first base module transport mechanism 121*a*, the document is transported from the third segment 125*c* in the direction of arrow D where the document is engaged between drive roller 192*b* and belt 192*c*. According to some embodiments, the belt 192*c* is a passive belt around non-driven rollers or wheels 192*d,e*. The driver roller 192*b* moves the document further along the transport path and into engagement with stacker wheels 197*a* (also shown in FIGS. 2B and 2C) which rotate to deposit the document in the first output receptacle 190*a*.

According to some embodiments, the belt 192*c* is not employed and a transport plate is positioned between rollers or wheels 192*d,e*. In such embodiments, the transport plate operates to guide documents from being positioned between roller 193*e* and roller 192*b* to being positioned between roller 193*d* and roller 192*b*. Rollers 192*d,e* are positioned to engage and be driven by roller 192*b*.

For another example, for a document being transported from the third segment 125*c* of the transport path to the second output receptacle 190*b* via the first base module transport mechanism 121*a*, the document is transported from the third segment 125*c* in the direction of arrow E where the document is engaged between drive roller 193*b* and belt 193*c*. According to some embodiments, the belt 193*c* is a passive belt around non-driven rollers or wheels 193*d,e*. The driver roller 193*b* moves the document further along the transport path and into engagement with stacker wheels 197*b* (also shown in FIGS. 2B and 2C) which rotate to deposit the document in the second output receptacle 190*b*.

According to some embodiments, as a document is transported along the transition surface 192*a*,193*a* from the third segment 125*c* of the transport path and into the first or the second output receptacle 190*a,b*, the document is rotated by at least about 90 degrees and/or the forward direction of the document is changed by at least about 90 degrees. According to some embodiments, as a document is transported along the transition surface 192*a*,193*a* from the third segment 125*c* of the transport path and into the first or the second output receptacle 190*a,b*, the document is rotated between about 100 degrees and about 140 degrees.

Referring generally to FIGS. 2A-2C, according to some embodiments, the first and the second output receptacles 190*a,b* each define a respective receiving opening or passage and a respective access opening. The receiving openings or passages provide document access into the first and the second output receptacles 190*a,b* in response to the first base module 3-way diverter 195*a* diverting documents therein from the third segment 125*c* of the transport path. The receiving opening of the first output receptacle 190*a* is positioned adjacent to a first side of the third segment 125*c* of the transport path and the receiving opening of the second output receptacle 190*b* is positioned adjacent to a second opposing side of the third segment 125*c* of the transport path. That is, the first and the second output receptacles 190*a,b* are positioned within the first base module 102 such that the receiving opening of the first output receptacle 190*a* faces the receiving opening of the second output receptacle 190*b*. Such an output receptacle configuration is called back-to-back output receptacles. That is, two adjacent output receptacles on opposite sides of a transport segment of a transport path that each receive documents from a common transport mechanism are oriented in a back-to-back manner with respect to each other.

The access openings provide operator access from a front side of the first base module 102 to permit an operator to remove documents transported to and deposited within one of the first and the second output receptacles 190*a,b*. The access openings can be provided in any of a variety of shapes with any of a variety of dimensions such that an operator can remove deposited documents from the front side of the first base module 102. According to some embodiments, the access openings are selectively closed (not shown). For example, a door (not shown) can be provided to restrict physical access to documents deposited within the first or the second output receptacles 190*a,b*. The door can be large enough to restrict access into both of the first and the second output receptacles 190*a,b*. Alternatively, individual doors can be provided for restricting access into each of the output receptacles 190*a,b*.

According to some embodiments, each of the receiving openings lays in one or more parallel receiving planes and each of the access openings lays in one or more parallel access planes that are orthogonal or generally orthogonal to the one or more receiving planes.

Referring to FIGS. 2A-2B, according to some embodiments, the first base module 102 includes an output receptacle 191*a*. According to some embodiments, the output receptacle 191*a* is the same as, or similar to, the output receptacles 190*a-h*. According to some embodiments, the output receptacle 191*a* is an offsort pocket or a reject pocket. According to some embodiments, the output receptacle 191*a* facilitates off-sorting of larger documents, such as, for example, commercial checks and 8.5"×11" sheets. While the first base module 102 is illustrated as including the output receptacle 191*a*, according to some embodiments, the first base module 102 does not include the output receptacle 191*a*.

Referring back to FIG. 2A, according to some embodiments, the first base module transport mechanism 121*a* includes a lower moveable transport plate 127 and an upper stationary transport plate 126. According to some embodiments, the moveable transport plate 127 has an open position (shown in FIG. 2A) and a closed position (shown in FIGS. 2B and 2C). According to some such embodiments, the moveable transport plate 127 is pivotably coupled within the first base module 102 such that the moveable transport plate 127 can pivot between the open and closed positions. In response to the moveable transport plate being in the closed position, the moveable transport plate 127 is generally parallel to the stationary transport plate 126. According to some embodiments, in response to the moveable transport plate 127 being in the open position, documents, such as currency bills, remaining on the moveable transport plate 127 slide toward a front side of the first base module 102. For example, during the processing of documents, currency bills are being transported between the stationary and the moveable transport plates 126,127. In the case of a jam, an operator can open and/or move the moveable transport plate 127 into the open position, whereby the bills are free to fall or slide toward the front of the module 102 due to gravity. That is, document jams can be cleared using gravity to cause the jammed documents to fall out of the system 100, 200.

According to some embodiments, the first base module 102 includes a latch assembly including a latch 128*a* and a knob 128*b*. According to such embodiments, the latch assembly is configured to selectively retain the moveable transport plate 127 in its closed position. According to some embodiments, the knob 128*b* is rigidly mounted to the moveable transport plate 127 and the latch 128*a* is pivotably mounted to the stationary transport plate 126. According to some embodiments, the latch 128*a* can include a roller or an angled engagement surface at one end thereof. According to some embodiments, the knob 128*b* is configured to receive and mate with the roller or the angled engagement surface and thereby lock the latch 128*a* to the knob 128*b* such that the moveable transport plate 127 is retained in the closed position. According to some embodiments, the latch assembly further includes a biasing member configured to bias the latch 128*a* into the latched orientation.

According to some embodiments, a width W of the first base module 102 is between about twelve inches (30 cm) and about eighteen inches (46 cm). According to some embodiments, the width W of the first base module 102 is about sixteen inches (41 cm). According to some embodiments, a height H of the first base module 102 is between about eighteen inches (46 cm) and about twenty-two inches (56 cm). According to some embodiments, the height H of the first base module 102 is about twenty inches (51 cm). According to some embodiments, a depth D of the first base module 102 is between about fifteen inches (38 cm) and about nineteen inches (49 cm). According to some embodiments, the depth D of the first base module 102 is about seventeen inches (43 cm).

According to some embodiments, the first base module 102 has a footprint of less than about two and a half square feet. According to some embodiments, the first base module 102 has a footprint of less than about two square feet. According to some embodiments, the first base module 102 has a footprint of less than one and a half square feet.

According to some embodiments, the first base module 102 occupies less than about four and a half cubic feet. According to some embodiments, the first base module 102 occupies less than about three and a half cubic feet. According to some embodiments, the first base module 102 occupies less than about three cubic feet. According to some embodiments, the first base module 102 occupies less than about two and a half cubic feet.

First Pocket Module

According to some embodiments, the first pocket module 104 has a first end 104*a* and a second opposing end 104*b*; and a top 104*c* and an opposing bottom 104*d*. The first pocket module 104 includes a first pocket module transport mechanism 122*a*, a third output receptacle 190*c*, a fourth output receptacle 190*d*, and a first pocket module 3-way diverter 196*a*.

According to some embodiments, the first pocket module 104 is configured to be detachably and operatively connected with the top 102*c* of the first base module 102. That is, the bottom 104*d* of the first pocket module 104 abuts the top 102*c* of the first base module 102 such that a first pocket module inlet opening 116*a* located in the bottom 104*d* of the first pocket module 104 aligns with the second outlet opening 131*b* of the first base module 102. According to some embodiments, the first pocket module inlet opening 116*a* is communicatively coupled with the second outlet opening 131*b* of the first base module 102 such that documents (e.g., bill 135$a_3$) can be transported by the first base module transport mechanism 121*a*, through the second outlet opening 131*b* of the first base module 102, through the first pocket module inlet opening 116*a*, and further transported by the first pocket module transport mechanism 122*a*. According to some embodiments, mechanically coupling and/or abutting the first pocket module 104 with the first base module 102 also communicatively and/or electronically couples the first pocket module 104 with the first base module 102 and/or the document processing device 101 such that one or more components of the document processing device 101 (e.g., the controller 150) is communicatively connected with one or more components (e.g., the first pocket module 3-way diverter 196*a*) of the first pocket module 104.

According to some embodiments, the third and the fourth output receptacles 190*c,d* are configured to receive documents, such as, the bill 135$a_6$. The third and the fourth output receptacles 190*c,d* are positioned between the first end 104*a* and the second end 104*b* and between the top 104*c* and the bottom 104*d* of the first pocket module 104. According to some embodiments, the third and the fourth output receptacles 190*c,d* are horizontally offset from one another.

The first pocket module transport mechanism 122*a* is configured to transport documents along a fourth segment 125*d* of the transport path in the direction of arrow F. The fourth segment 125*d* extends generally from the first pocket module inlet opening 116*a* to a first pocket module outlet opening 132*a* located in the top 104*c* of the first pocket module 104. According to some embodiments, the fourth segment 125*d* extends generally vertically upward from the first pocket module inlet opening 116*a* and is positioned at least partially between the third and the fourth output receptacles 190*c,d*.

According to some embodiments, the first pocket module 3-way diverter 196*a* is positioned along the fourth segment 125*d* of the transport path and between the third and the fourth output receptacles 190*c,d*. According to some embodiments, the first pocket module 3-way diverter 196*a* is configured to transition between at least three distinct positions to selectively direct documents along one of at least three distinct paths or directions. According to some such embodiments, the first pocket module 3-way diverter 196*a* is configured to rotate and/or pivot about an axis between the at least three distinct positions.

According to some embodiments, a controller is configured to cause the first pocket module 3-way diverter 196*a* to reside in and/or rotate to a position to selectively direct documents being transported via the first pocket module transport mechanism 122*a* along the fourth segment 125*d* of the transport path. According to some such embodiments, the controller is configured to cause the first pocket module 3-way diverter 196*a* to reside in a first position to selectively direct documents from the fourth segment 125*d* in the direction of arrow G into the third output receptacle 190*c*. According to some such embodiments, the controller is configured to cause the first pocket module 3-way diverter 196*a* to reside in a second position to selectively direct documents from the fourth segment 125*d* in the direction of arrow H into the fourth output receptacle 190*d*. According to some such embodiments, the controller is configured to cause the first pocket module 3-way diverter 196*a* to reside in a third position to selectively direct documents in the direction of arrow F past both the third and the fourth output receptacles 190*c,d* toward the first pocket module outlet opening 132*a* located in the top 104*c* of the first pocket module 104. Thus, the first pocket module transport mechanism 122*a* can transport documents from the first pocket module inlet opening 116*a* to one of three locations including, but not limited to, the third output receptacle 190*c*, the fourth output receptacle 190*d*, and the first pocket module outlet opening 132*a*.

According to some embodiments, the third and the fourth output receptacles 190*c,d* each define a respective receiving opening and a respective access opening. The receiving openings provide document access into the third and the fourth output receptacles 190*c,d* in response to the first pocket module 3-way diverter 196*a* diverting documents therein from the fourth segment 125*d* of the transport path. The receiving opening of the third output receptacle 190*c* is positioned adjacent to a first side of the fourth segment 125*d* of the transport path and the receiving opening of the fourth output receptacle 190*d* is positioned adjacent to a second opposing side of the fourth segment 125*d* of the transport path. That is, the third and the fourth output receptacles 190*c,d* are positioned within the first pocket module 104 such that the receiving opening of the third output receptacle 190*c* faces the receiving opening of the fourth output receptacle 190*d* in a back-to-back manner as defined above. The access openings of the first pocket module 104 are the same as, or similar to, the access openings of the first base module 102 discussed above.

According to some embodiments, a width W of the first pocket module 104 is between about twelve inches (30 cm) and about eighteen inches (46 cm). According to some embodiments, the width W of the first pocket module 104 is about sixteen inches (41 cm). According to some embodiments, a height H of the first pocket module 104 is between about four inches (10 cm) and about seven inches (18 cm). According to some embodiments, the height H of the first pocket module 104 is about five and a half inches (14 cm). According to some embodiments, a depth D of the first pocket module 104 is between about fifteen inches (38 cm) and about nineteen inches (49 cm). According to some embodiments, the depth D of the first pocket module 104 is about seventeen inches (43 cm).

According to some embodiments, the first pocket module 104 has a footprint of less than about two and a half square feet. According to some embodiments, the first pocket module 104 has a footprint of less than about two square feet. According to some embodiments, the first pocket module 104 has a footprint of less than one and a half square feet.

According to some embodiments, the first pocket module 104 occupies less than about one and a half cubic feet. According to some embodiments, the first pocket module 104 occupies less than about one cubic foot. According to some embodiments, the first pocket module 104 occupies less than about 0.9 cubic feet. According to some embodiments, the first pocket module 104 occupies less than about 0.8 cubic feet.

Second Base Module

According to some embodiments, the second base module 103 has a first end 103*a* and a second opposing end 103*b*; and a top 103*c* and an opposing bottom 103*d*. The second base module 103 is configured to be detachably and operatively connected with the second end 102*b* of the first base module 102 in the same, or similar manner, as the first end 102*a* of the first base module 102 is configured to be detachably and operatively connected with the second end 101*b* of the document processing device 101. That is, the first end 103*a* of the second base module 103 abuts the second end 102*b* of the first base module 102 such that a second base module inlet opening 115*b* located in the first end 103*a* of the second base module 103 aligns with the first outlet opening 131*a* of the first base module 102. According to some embodiments, the second base module inlet opening 115*b* couples with the first outlet opening 131*a* of the first base module 102 such that documents (e.g., bill 135$a_2$) can be transported by the first base module transport mechanism 121*a*, through the first outlet opening 131*a* of the first base module 102, through the second base module inlet opening 115*b*, and further transported by the second base module transport mechanism 121*b*. According to some embodiments, mechanically coupling and/or abutting the second base module 103 with the first base module 102 also communicatively and/or electronically couples the second base module 103 with the first base module 102 and/or the document processing device 101 such that one or more components of the document processing device 101 (e.g., the controller 150) is communicatively connected with one or more components (e.g., a second base module 3-way diverter 195*b*) of the second base module 103.

According to some embodiments, the second base module 103 includes an output receptacle 191*b*. According to some embodiments, the output receptacle 191*b* is the same as, or similar to, the output receptacles 190*a-h*. According to some embodiments, the output receptacle 191*b* is an offsort pocket or a reject pocket.

According to some embodiments, the first and the second base modules 102, 103 are structurally identical and operatively interchangeable. In some such embodiments, the second base module 103 can be detachably and operatively connected with the second end 101*b* of the document processing device 101 in the same, or similar, manner as the first end 102*a* of the first base module 102 is configured to be detachably and operatively connected with the second end 101*b* of the document processing device 101.

According to some embodiments, the second base module 103 is the same as, or similar to, the first base module 102, where like reference numbers are used to indicate like components. For example, the second base module 103 includes the second base module inlet opening 115*b*, a first outlet opening 131*c* of the second base module 103, a second outlet opening 131*d* of the second base module 103, a second base module transport mechanism 121*b* including a fifth segment 125*e* and a sixth segment 125*f* of the transport path, a fifth output receptacle 190*e*, a sixth output receptacle 190*f*, a second base module 2-way diverter 194*b*, and the second base module 3-way diverter 195*b*, which are the same as, or similar to, the first base module inlet opening 115*a*, the first outlet opening 131*a* of the first base module 102, the second outlet opening 131*b* of the first base module 102, the first base module transport mechanism 121*a* including a second segment 125*b* and a third segment 125*c* of the transport path, the first output receptacle 190*a*, the second output receptacle 190*b*, the first base module 2-way diverter 194*a*, and the first base module 3-way diverter 195*a*, respectively. According to some embodiments, the second base module transport mechanism 121*b* of the second base module 103 includes an upper stationary transport plate (not shown) and a lower moveable transport plate (not shown), which are the same as, or similar to, the stationary transport plate 126 and the moveable transport plate 127 described above in reference to the first base module 102.

According to some embodiments, the first outlet opening 131*c* of the second base module 103 is configured to be mechanically coupled with and/or abutting a strapper module (not shown), a facing module (not shown), an inlet opening of another base module (e.g., inlet opening 115*a*), or another ancillary device and/or module. According to some embodiments, mechanically coupling and/or abutting the second base module 103 with an ancillary device or module also communicatively and/or electronically couples the second base module 103 with the ancillary device or module such that one or more components of the document processing device 101 (e.g., the controller 150) is communicatively connected with one or more components (e.g., a strapping unit) of the ancillary device or module.

Second Pocket Module

According to some embodiments, the second pocket module 105 has a first end 105*a* and a second opposing end 105*b*; and a top 105*c* and an opposing bottom 105*d*. The second pocket module 105 is configured to be detachably and operatively connected with the top 103*c* of the second base module 103 in the same, or similar manner, as the bottom 104*d* of the first pocket module 104 is configured to be detachably and operatively connected with the top 102*c* of the first base module 102. That is, the bottom 105*d* of the second pocket module 105 abuts the top 103*c* of the second base module 103 such that a second pocket module inlet opening 116*b* located in the bottom 105*d* of the second pocket module 105 aligns with the second outlet opening 131*d* of the second base module 103. According to some embodiments, the second pocket module inlet opening 116*b* couples with the second outlet opening 131*d* of the second base module 103 such that documents (e.g., bill $\mathbf{135}a_5$) can be transported by the second base module transport mechanism 121*b*, through the second outlet opening 131*d* of the second base module 103, through the second pocket module inlet opening 116*b*, and further transported by the second pocket module transport mechanism 122*b*. According to some embodiments, mechanically coupling and/or abutting the second pocket module 105 with the second base module 103 also communicatively and/or electronically couples the second pocket module 105 with the second base module 103, the first base module 102, the first pocket module 104, and/or the document processing device 101 such that one or more components of the document processing device 101 (e.g., the controller 150) is communicatively connected with one or more components (e.g., the second pocket module 3-way diverter 196*b*) of the second pocket module 105.

According to some embodiments, the first and the second pocket modules 104, 105 are structurally identical and operatively interchangeable. In some such embodiments, the second pocket module 105 can be detachably and operatively connected with the top 102*c* of the first base module 102 in the same, or similar manner, as the bottom 104*d* of the first pocket module 104 is configured to be detachably and operatively connected with the top 102*c* of the first base module 102.

According to some embodiments, the second pocket module 105 is the same as, or similar to, the first pocket module 104, where like reference numbers are used to indicate like components. For example, the second pocket module 105 includes a second pocket module inlet opening 116*b*, a second pocket module outlet opening 132*b*, a second pocket module transport mechanism 122*b* including a seventh segment 125*g* of the transport path, a seventh output receptacle 190*g*, an eighth output receptacle 190*h*, and a second pocket module 3-way diverter 196*b*, which are the same as, or similar to, first pocket module inlet opening 116*a*, the first pocket module outlet opening 132*a*, the first pocket module transport mechanism 122*a* including the fourth segment 125*d* of the transport path, the third output receptacle 190*c*, the fourth output receptacle 190*d*, and the first pocket module 3-way diverter 196*a*, respectively.

Interchangeable and Stackable Modules

According to some embodiments, the first pocket module 104 can be detachably connected to the top 103*c* of the second base module 103 and receive documents transported through the second outlet opening 131*d* of the second base module 103. Similarly, the second pocket module 105 can be detachably connected to the top 102*c* of the first base module 102 and receive documents transported through the second outlet opening 131*b* of the first base module 102.

According to some embodiments, the first pocket module 104 can be detachably connected to the top 105*c* of the second pocket module 105 to receive documents therethrough. That is, the first pocket module 104 can be detachably connected to the second pocket module 105 such that the first pocket module inlet opening 116*a* mates with the second pocket module outlet opening 132*b* to receive documents therefrom. Similarly, the second pocket module 105 can be detachably connected to the top 104*c* of the first pocket module 104 to receive documents transported therethrough. That is, the second pocket module 105 can be detachably connected to the first pocket module 104 such that the second pocket module inlet opening 116*b* mates with the first pocket module outlet opening 132*a* to receive documents therefrom.

Document Transport Path Examples

According to some embodiments, a stack of bills 135 is received in the input receptacle 110 of the document processing device 101. As described above, the device transport mechanism 120 transports the bills one at a time along the transport path. The following description focuses on some of the various transport paths of one of the bills 135*a*. As shown in FIG. 1, the bill $\mathbf{135}a_1$ is first shown in the first segment 125*a* of the transport path being transported in the direction of arrow A past the image scanner(s) 140*a* and/or 140*b*. According to some embodiments, as the bill $\mathbf{135}a_1$ is transported in the direction of arrow A along the first segment 125*a* of the transport path, the document processing system 100 determines a desired final destination or location for the bill 135*a* based at least in part on data generated by the image scanner(s) 140*a* and/or 140*b* and/or the authentication unit 145 and/or other sensor(s).

For example, the document processing system 100 shown in FIG. 1 includes eight output receptacles 190*a-h*. The document processing system 100, thus, can determine to transport and deliver the bill 135*a* into any one of the eight output receptacles 190*a-h* based on a bill's denomination, authenticity, fitness, face orientation, etc. According to some embodiments, each one of the output receptacles 190*a-h* is assigned a denomination of a currency bill. For a standard set of U.S. currency bills having seven different denominations (e.g., $1, $2, $5, $10, $20, $50, $100), one of the eight output receptacles remains to serve as a reject receptacle, or as a duplicate receptacle.

According to some embodiments, the first output receptacle 190*a* is assigned to receive $1's, the second output receptacle 190*b* is assigned to receive $2's, the third output receptacle 190*c* is assigned to receive $5's, the fourth output receptacle 190*d* is assigned to receive $10's, the fifth output receptacle 190*e* is assigned to receive $20's, the sixth output receptacle 190*f* is assigned to receive $50's, the seventh output receptacle 190*g* is assigned to receive $100's, and the eighth output receptacle 190*h* can be assigned to receive suspect bills. It is contemplated that various other assignments of output receptacles 190*a-h* are possible. According to some embodiments, an operator of the document processing system 100 can assign a particular denomination and/or document type (e.g., check, deposit slip, header/trailer card, etc.) to a particular output receptacle via the control panel 170. According to some embodiments, each output receptacle 190*a-h* is automatically assigned a denomination and/or document type. It is contemplated that according to some embodiments, assignment of the output receptacles 190*a-h* can be manual, automatic, or a combination thereof.

Proceeding with the above example and assuming that the bill 135*a* is a $100, the device transport mechanism 120 transports the bill 135$a_1$ in the direction of arrow A along the first segment 125*a* of the transport path through the device outlet opening 130. The document processing device 101 determines that the bill 135$a_1$ is a non-suspect $100 bill and thus should be transported and delivered to the seventh output receptacle 190*g*. In response to the determination of the bill 135$a_1$, the bill 135$a_2$ is received through the first base module inlet opening 115*a* and engaged with the first base module transport mechanism 121*a*. The bill 135$a_2$ is transported beneath the first and the second output receptacles 190*a,b* in the direction of arrow B, under or past the first base module 2-way diverter 194*a*, and to the first outlet opening 131*a* of the first base module 103. The bill 135$a_4$ is received through the second base module inlet opening 115*b* and engaged with the second base module transport mechanism 121*b*. The bill 135$a_4$ is transported beneath the fifth output receptacle 190*e* in the direction of arrow I and then transitioned and/or diverted from the fifth segment 125*e* of the transport path in a generally vertical manner in the direction of arrow J onto the sixth segment 125*f* of the transport path via the second base module 2-way diverter 194*b*. The bill 135$a_5$ is transported between the fifth and the sixth output receptacles 190*e,f* and past or through the second base module diverter 195*b* towards the second outlet opening 131*d* of the second base module 103. The bill 135$a_7$ is received through the second pocket module inlet opening 116*b* and engaged with the second pocket module transport mechanism 122*b*. The bill 135$a_7$ is transported in a generally vertical manner in the direction of arrow M toward the second pocket module 3-way diverter 196*b*. According to some embodiments, the controller 150 instructs and/or causes the second pocket module 3-way diverter 196*b* to adjust its position such that the bill 135$a_7$ is directed in the direction of arrow N into the seventh output receptacle 190*g* as the second pocket module transport mechanism 122*b* transports the bill 135$a_7$ along the seventh segment 125*g* of the transport path.

According to some embodiments of the example disclosed above, assuming the bill 135*a* was determined to be a suspect bill rather than a non-suspect, the document processing system 100 determines to transport and deliver the bill 135*a* to the eight output receptacle 190*h*, which was designated as the reject receptacle. Thus, instead of the controller 150 instructing and/or causing the second pocket module 3-way diverter 196*b* to adjust its position such that the bill 135$a_7$ is directed in the direction of arrow N, the controller instructs and/or causes the second pocket module 3-way diverter 196*b* to adjust its position such that the bill 135$a_7$ is directed in the direction of arrow O into the eight output receptacle 190*h* as the second pocket module transport mechanism 122*b* transports the bill 135$a_7$ along the seventh segment 125*g* of the transport path.

In a similar fashion, the document processing system 100 can direct the bill 135*a* into any one of the output receptacles 190*a-h* by controlling the various transport mechanisms and diverters.

Document Processing System Configurations

Figure 3A:
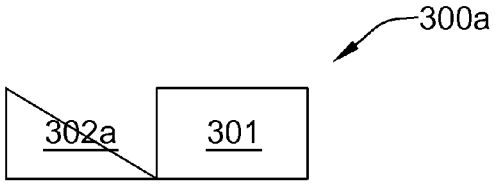
FIG. 3A is a block diagram of a currency processing system according to some embodiments of the present disclosure.

Referring to FIGS. 3A-3F, several block diagrams of currency processing systems are shown according to some embodiments of the present disclosure. A currency processing system 300*a* is shown in FIG. 3A. The currency processing system 300*a* includes a currency processing device 301 and one base module 302*a*. According to some embodiments, the currency processing device 301 is the same as, or similar to, the document processing device 101 and the base module 302*a* is the same as, or similar to, the first base module 102 and/or the second base module 103.

Figure 3B:
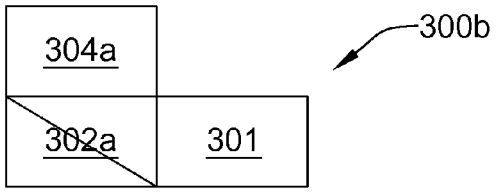
FIG. 3B is a block diagram of a currency processing system according to some embodiments of the present disclosure.

A currency processing system 300*b* is shown in FIG. 3B. The currency processing system 300*b* includes a currency processing device 301, one base module 302*a*, and one pocket module 304*a*. According to some embodiments, the currency processing device 301 is the same as, or similar to, the document processing device 101, the base module 302*a* is the same as, or similar to, the first base module 102 and/or the second base module 103, and the pocket module 304*a* is the same as, or similar to, the first pocket module 104 and/or the second pocket module 105.

Figure 3C:
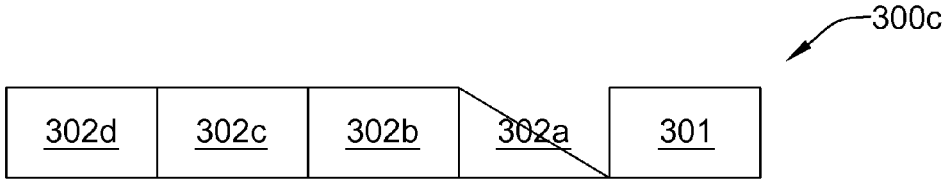
FIG. 3C is a block diagram of a currency processing system according to some embodiments of the present disclosure.

A currency processing system 300*c* is shown in FIG. 3C. The currency processing system 300*c* includes a currency processing device 301 and four base modules 302*a-d*. According to some embodiments, the currency processing device 301 is the same as, or similar to, the document processing device 101 and the base modules 302*a-d* are the same as, or similar to, the first base module 102 and/or the second base module 103.

Figure 3D:
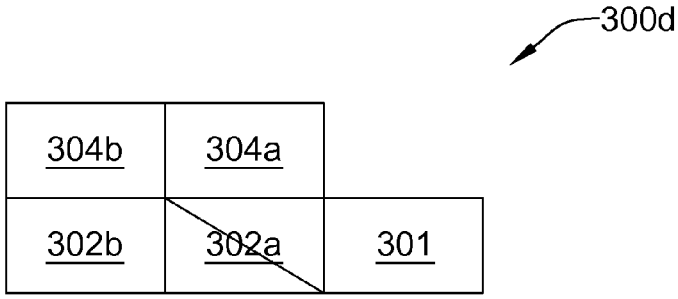
FIG. 3D is a block diagram of a currency processing system according to some embodiments of the present disclosure.

A currency processing system 300*d* is shown in FIG. 3D. The currency processing system 300*d* includes a currency processing device 301, two base modules 302*a,b*, and two pocket modules 304*a,b*. According to some embodiments, the currency processing device 301 is the same as, or similar to, the document processing device 101, the base modules 302*a,b* are the same as, or similar to, the first base module 102 and/or the second base module 103, and the pocket modules 304*a,b* are the same as, or similar to, the first pocket module 104 and/or the second pocket module 105.

Figure 3E:
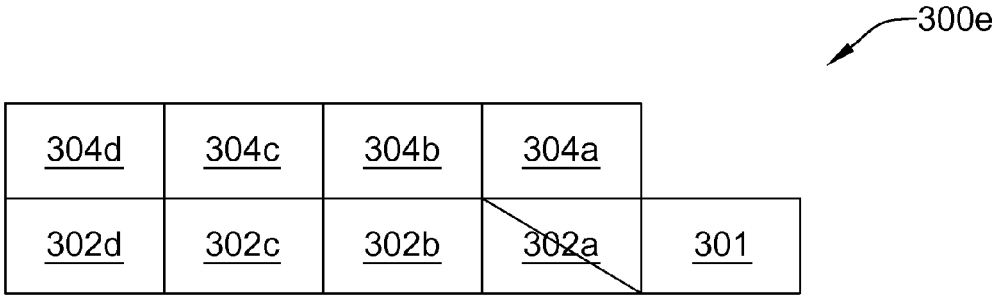
FIG. 3E is a block diagram of a currency processing system according to some embodiments of the present disclosure.

A currency processing system 300*e* is shown in FIG. 3E. The currency processing system 300*e* includes a currency processing device 301, four base modules 302*a-d*, and four pocket modules 304*a-d*. According to some embodiments, the currency processing device 301 is the same as, or similar to, the document processing device 101, the base modules 302*a-d* are the same as, or similar to, the first base module 102 and/or the second base module 103, and the pocket modules 304*a-d* are the same as, or similar to, the first pocket module 104 and/or the second pocket module 105.

Figure 3F:
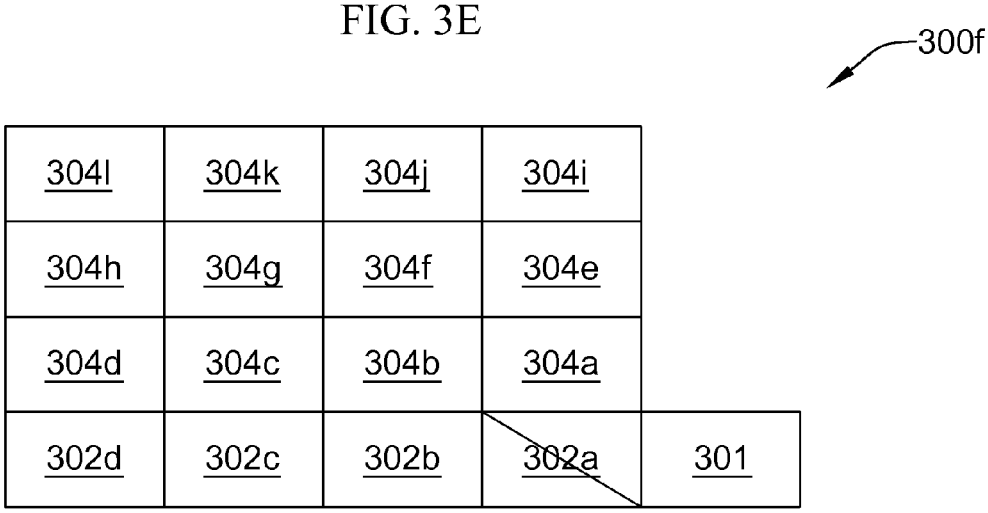
FIG. 3F is a block diagram of a currency processing system according to some embodiments of the present disclosure.
Figure 4A:
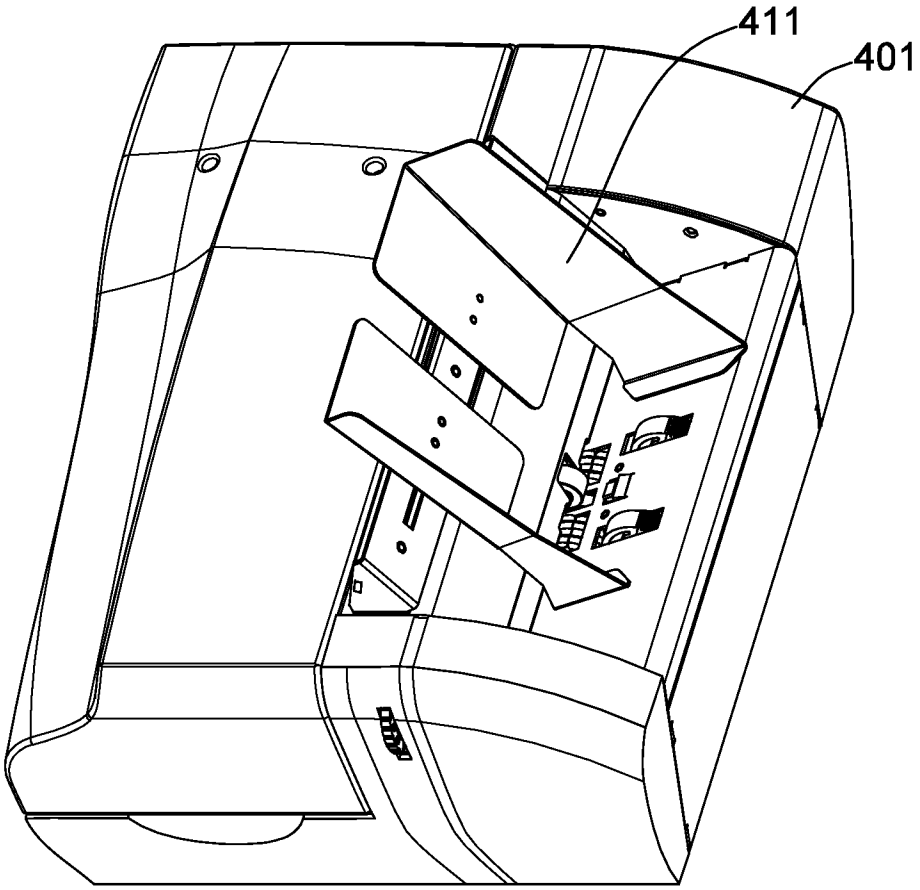
FIG. 4A is a perspective view of a document processing device according to some embodiments of the present disclosure.
Figure 4B:
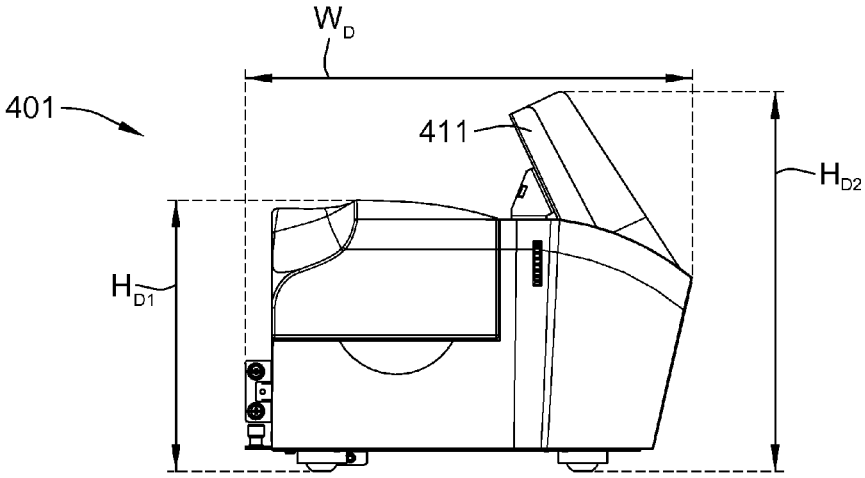
FIG. 4B is a front view of the document processing device of FIG. 4A.
Figure 4C:
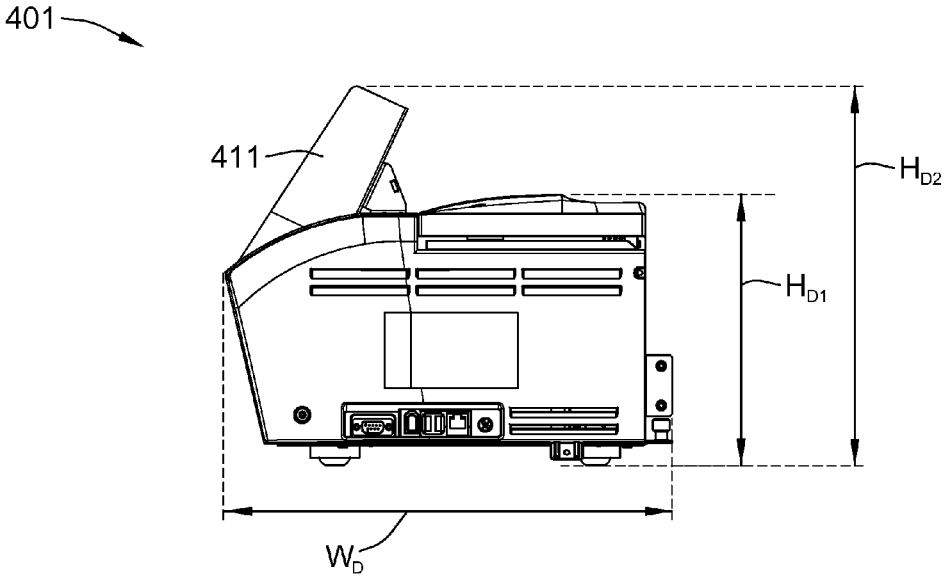
FIG. 4C is a back view of the document processing device of FIG. 4A.
Figure 4D:
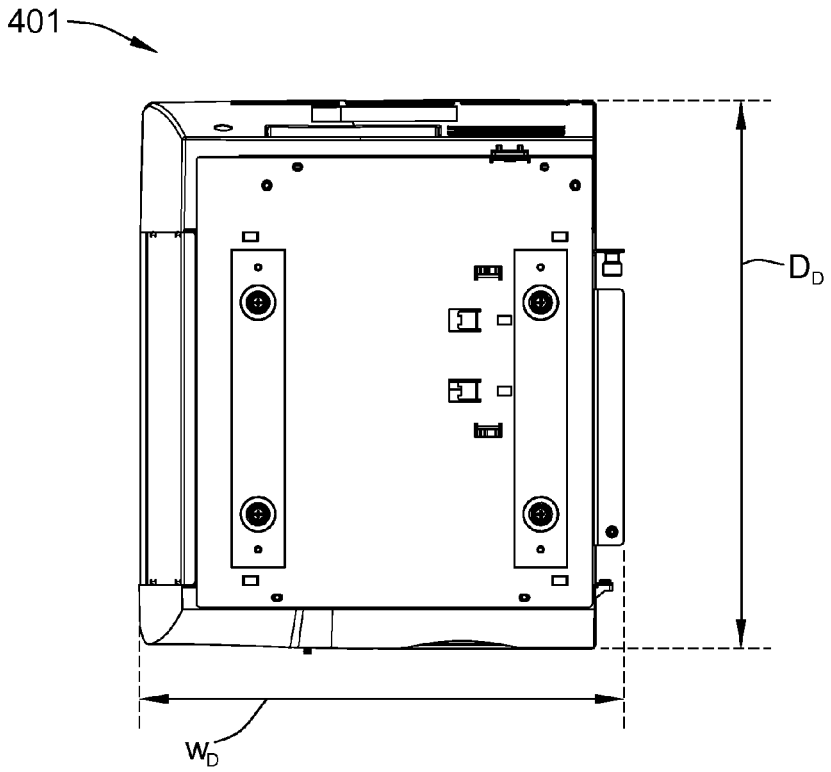
FIG. 4D is a bottom view of the document processing device of FIG. 4A.
Figure 4E:
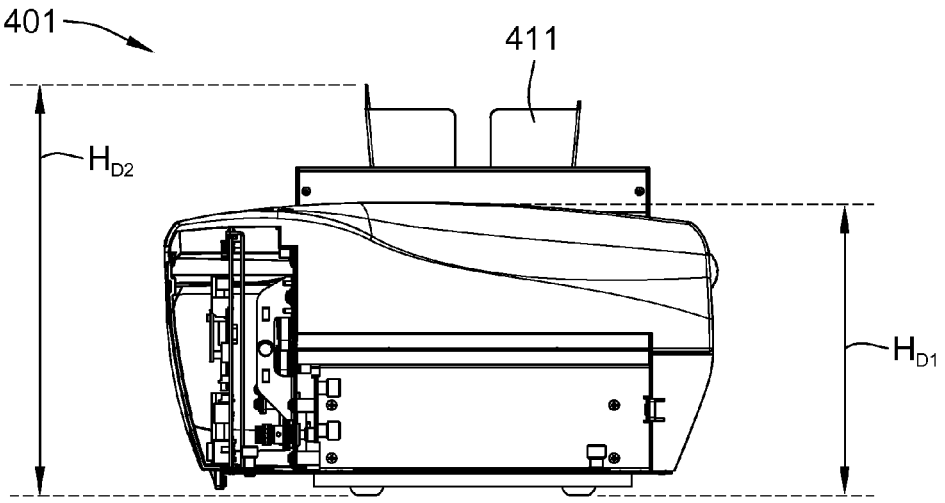
FIG. 4E is a left side view of the document processing device of FIG. 4A.
Figure 4F:
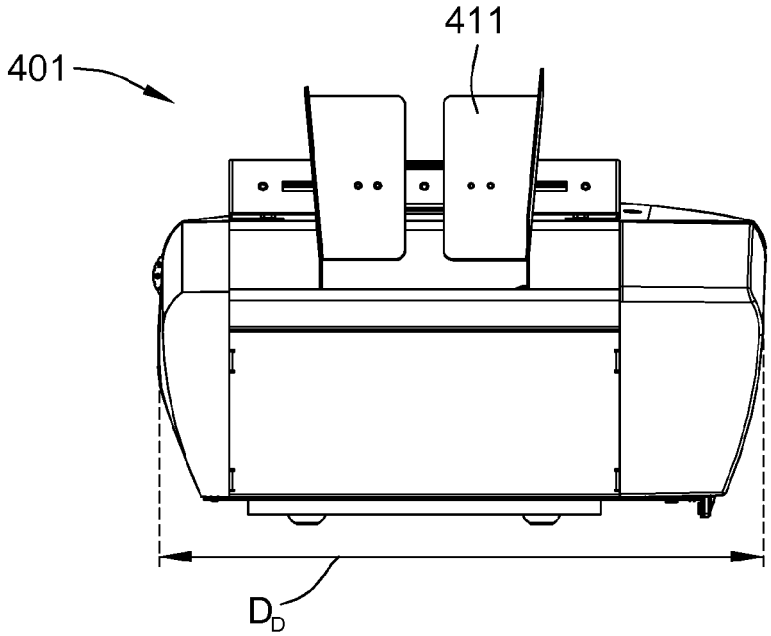
FIG. 4F is a right side view of the document processing device of FIG. 4A.
Figure 4G:
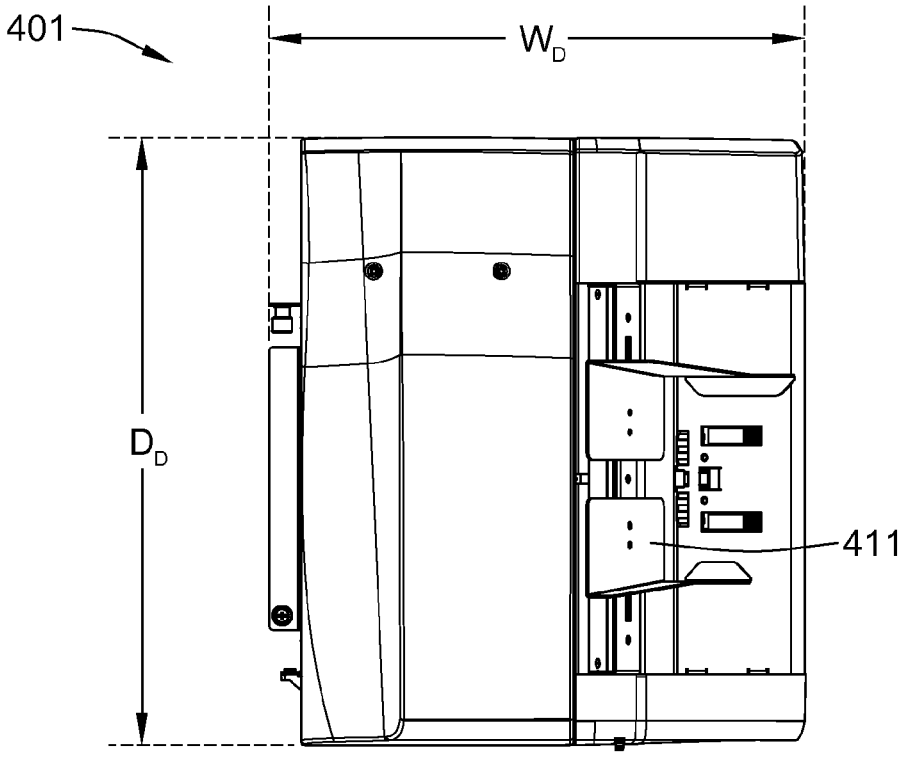
FIG. 4G is a top view of the document processing device of FIG. 4A.

A currency processing system 300*f* is shown in FIG. 3F. The currency processing system 300*f* includes a currency processing device 301, four base modules 302*a-d*, and twelve pocket modules 304*a*-1. According to some embodiments, the currency processing device 301 is the same as, or similar to, the document processing device 101, the base modules 302*a-d* are the same as, or similar to, the first base module 102 and/or the second base module 103, and the pocket modules 304*a*-1 are the same as, or similar to, the first pocket module 104 and/or the second pocket module 105.

Device, Module, and System Dimensions and Pocket Density

According to some embodiments, the document and/or currency processing systems of the present disclosure (e.g., systems 100, 200, 300*a-f*, and 400*a-f*) can include more output receptacles per square foot of faceprint, per square foot of footprint, and/or per cubic foot of volume as compared with prior document processing systems. The output receptacle density is generally referred to herein as a system's pocket density. The pocket density can be defined in a number of ways such as: (1) a number of output receptacles/square foot of faceprint, (2) a number of output receptacles/square foot of footprint, (3) a number of output receptacles/cubic foot of volume, (4) a number of output receptacles enclosed within a specified area or a specified distance (e.g., circular area, arc area, etc.), and (5) a number of output receptacles per lineal foot of transport path length. According to some embodiments, an increased pocket density can reduce the size and cost of the document processing systems of the present disclosure as compared to other document processing systems without such pocket densities. It is contemplated that the pocket density varies with the configuration of the document processing system. For example, the pocket density varies for each of the systems 300*a*-300*f* illustrated and described in reference to FIGS. 3A-3F and for each of the systems 400*a-f* illustrated and described in reference to FIGS. 7A-12H. According to some embodiments, one non-limiting factor/feature that increases the pocket density of the document processing systems of the present disclosure is the back-to-back orientation of output receptacles as shown in the FIGS. and as described herein.

Referring to FIGS. 4A-4G, a document processing device 401 is shown according to some embodiments. The document processing device 401 is the same as, or similar to, the document processing device 101 described above and shown in FIGS. 1 and 2A. The document processing device 401 can optionally include an input receptacle hopper or tray 411 to hold and/or guide documents while being processed. The document processing device 401 has a width, $W_D$, a depth, $D_D$, a height without the hopper 411, $H_{D1}$, and a height with the hopper 411, $H_{D2}$.

According to some embodiments, the width, $W_D$, of the document processing device 401 is between about ten inches (25 cm) and about sixteen inches (41 cm). According to some embodiments, the width, $W_D$, of the document processing device 401 is about thirteen inches (33 cm). According to some embodiments, the height, $H_{D1}$, of the document processing device 401 without the hopper 411 is between about six inches (15 cm) and about ten inches (26 cm). According to some embodiments, the height, $H_{D1}$, of the document processing device 401 without the hopper 411 with the moveable upper portion 215 in the closed position is about eight inches (20 cm). According to some embodiments, the height, $H_{D2}$, of the document processing device 401 with the hopper 411 is between about ten inches (25 cm) and about fourteen inches (36 cm). According to some embodiments, the height, $H_{D2}$, of the document processing device 401 with the hopper 411 with the moveable upper portion 215 in the closed position is about twelve inches (30½ cm). According to some embodiments, a depth, $D_D$, of the document processing device 401 is between about twelve inches (30 cm) and about nineteen inches (49 cm). According to some embodiments, the depth, $D_D$, of the document processing device 401 is about fifteen and a half inches (39 cm).

According to some embodiments, the document processing device 401 has a width, $W_D$, less than about sixteen inches (41 cm), a depth, $D_D$, less than about nineteen inches (49 cm), and a height, $H_{D1,D2}$, less than about fourteen inches (36 cm). According to some embodiments, the document processing device 401 has a width, $W_D$, of about 12.9 inches, a depth, $D_D$, of about 15.4 inches, and a height without the hopper, $H_{D1}$, of about 8.3 inches. According to some embodiments, the document processing device 401 has a width, $W_D$, of about 12.9 inches, a depth, $D_D$, of about 15.4 inches, and a height with the hopper, $H_{D2}$, of about 11.7 inches.

According to some embodiments, a faceprint of the document processing device 401 is between about 0.4 square feet ($ft^2$) and about 1.6 square feet ($ft^2$), where the faceprint of the document processing device 401 is defined as the width, $W_D$, multiplied by the height, $H_{D1,D2}$, of the document processing device 401 ($W_D \times H_{D1,D2}$). According to some embodiments, the faceprint of the document processing device 401 without the hopper 411 is about 0.7 square feet ($ft^2$). According to some embodiments, the faceprint of the document processing device 401 with the hopper 411 is about 1.1 square feet ($ft^2$). According to some embodiments, the faceprint of the document processing device 401 is less than about 1.6 square feet ($ft^2$).

According to some embodiments, the document processing device 401 has a footprint of less than about two square feet, where the footprint of the document processing device 401 is defined as the width, $W_D$, multiplied by the depth, $D_D$, of the document processing device 401 ($W_D \times D_D$). According to some embodiments, the document processing device 401 has a footprint of less than about one and a half square feet. According to some embodiments, the document processing device 401 has a footprint of less than one and a quarter square feet. According to some embodiments, the document processing device 401 has a footprint of about 1.4 square feet. According to some embodiments, a footprint of the document processing device 401 is between about two square feet ($ft^2$) and about one and a quarter square feet ($ft^2$).

According to some embodiments, the document processing device 401 has a volume of less than about four cubic feet, where the volume is defined as the width, $W_D$, multiplied by the height, $H_{D1,D2}$, multiplied by the depth, $D_D$, of the document processing device 401 ($W_D \times H_{D1,D2} \times D_D$). According to some embodiments, the document processing device 401 has a volume of less than about two cubic feet. According to some embodiments, the document processing device 401 has a volume of less than about one and a half cubic feet. According to some embodiments, the document processing device 401 has a volume of less than about one and a quarter cubic feet. According to some embodiments, the document processing device 401 has a volume of about 1.4 cubic feet. According to some embodiments, a volume of the document processing device 401 is between about four cubic feet ($ft^3$) and about one and a quarter cubic feet ($ft^3$).

Figure 5A:
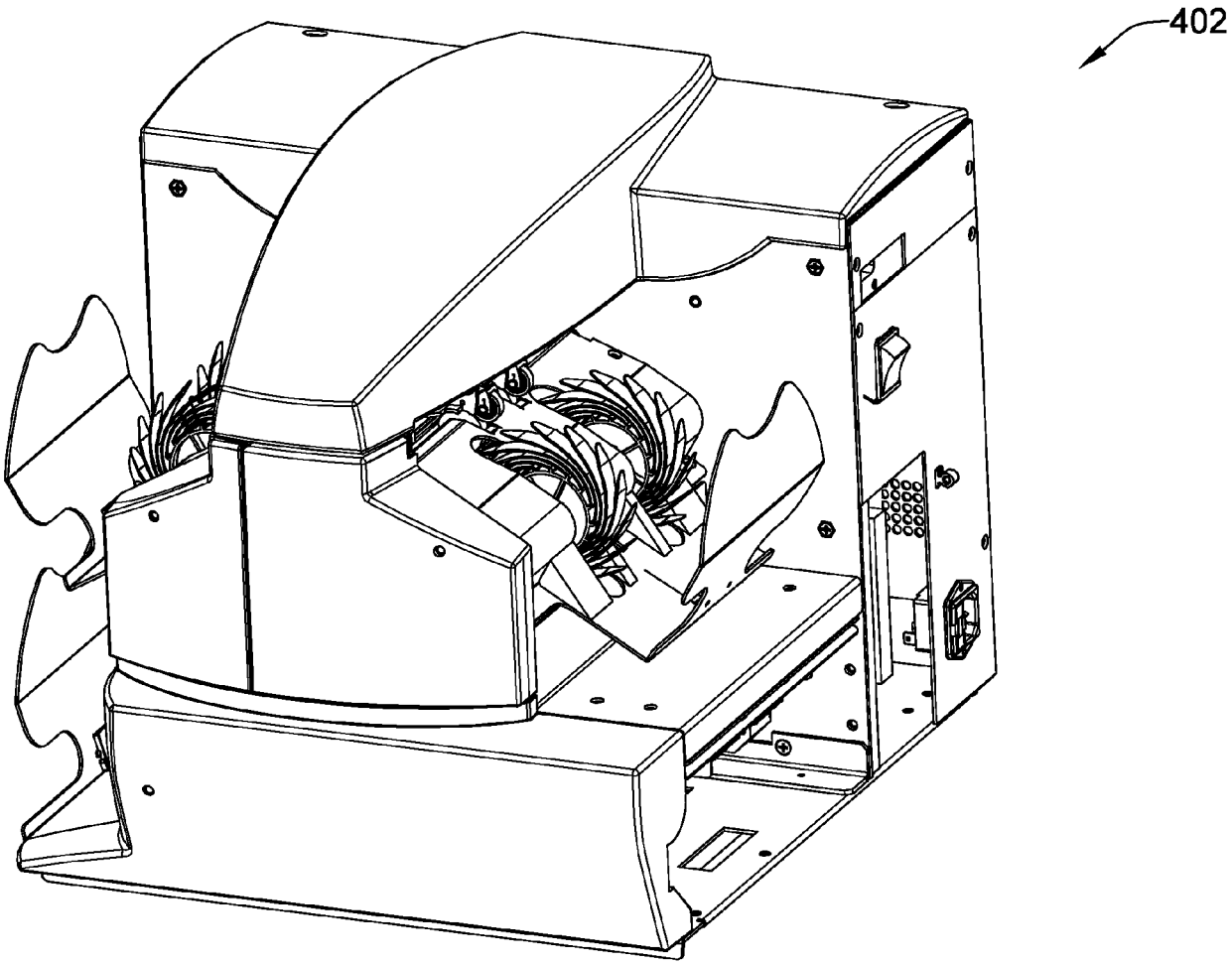
FIG. 5A is a perspective view of a base module according to some embodiments of the present disclosure.
Figure 5B:
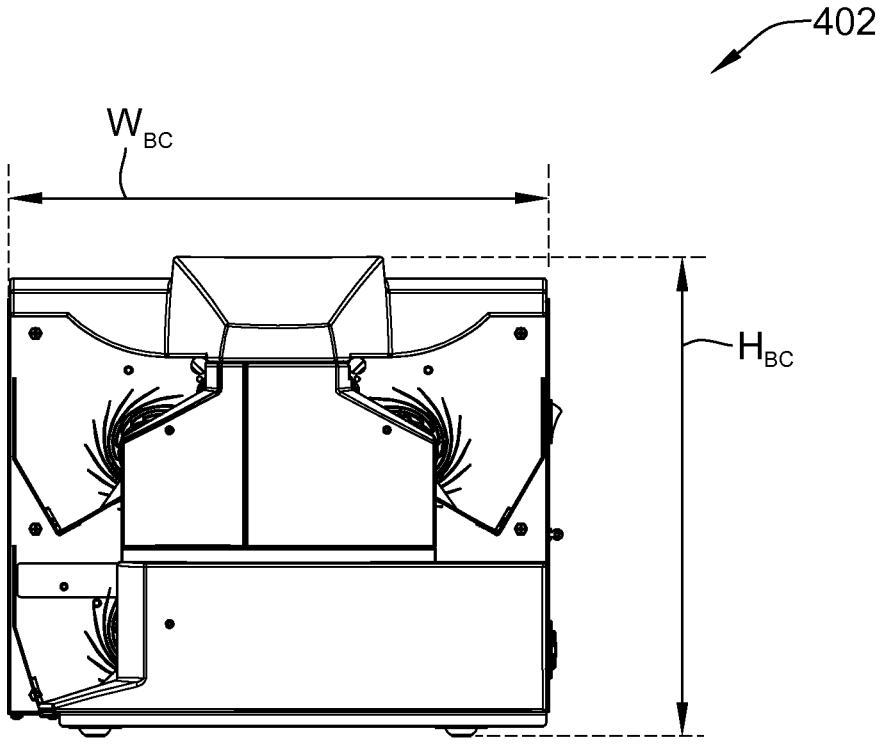
FIG. 5B is a front view of the base module of FIG. 5A.
Figure 5C:
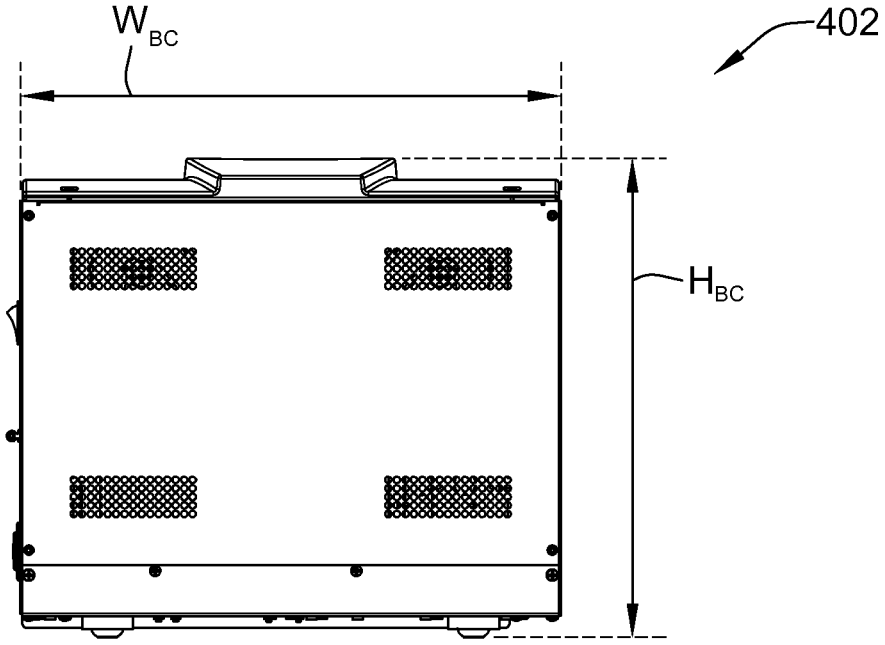
FIG. 5C is a back view of the base module of FIG. 5A.
Figure 5D:
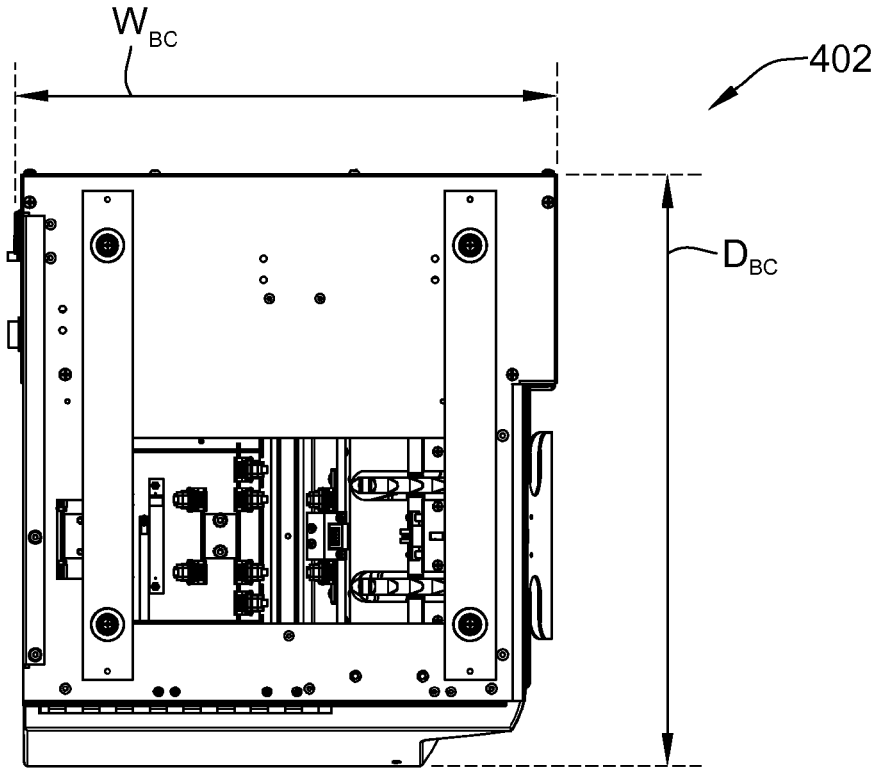
FIG. 5D is a bottom view of the base module of FIG. 5A.
Figure 5E:
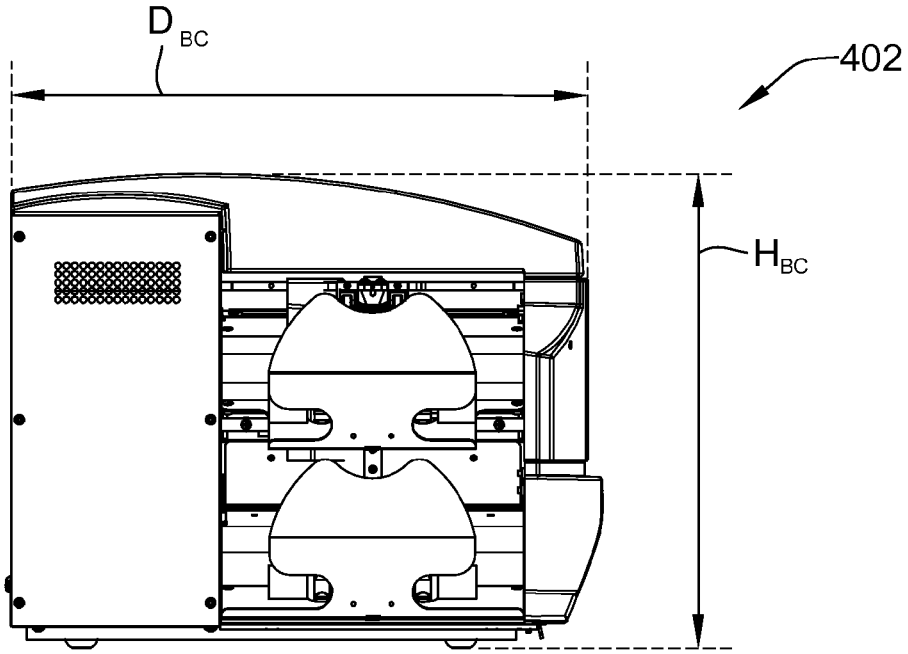
FIG. 5E is a left side view of the base module of FIG. 5A.
Figure 5F:
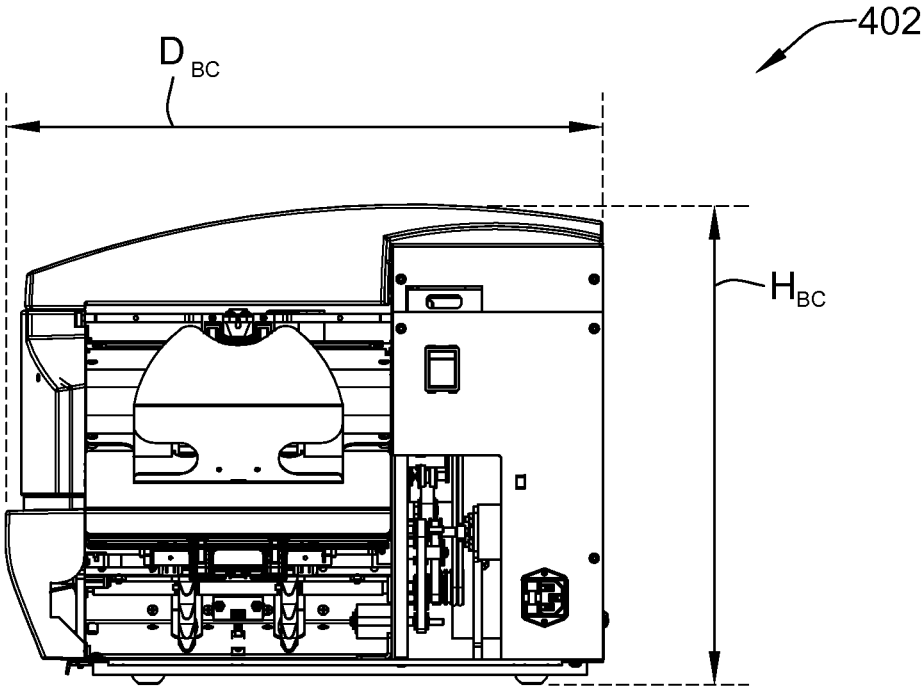
FIG. 5F is a right side view of the base module of FIG. 5A.
Figure 5G:
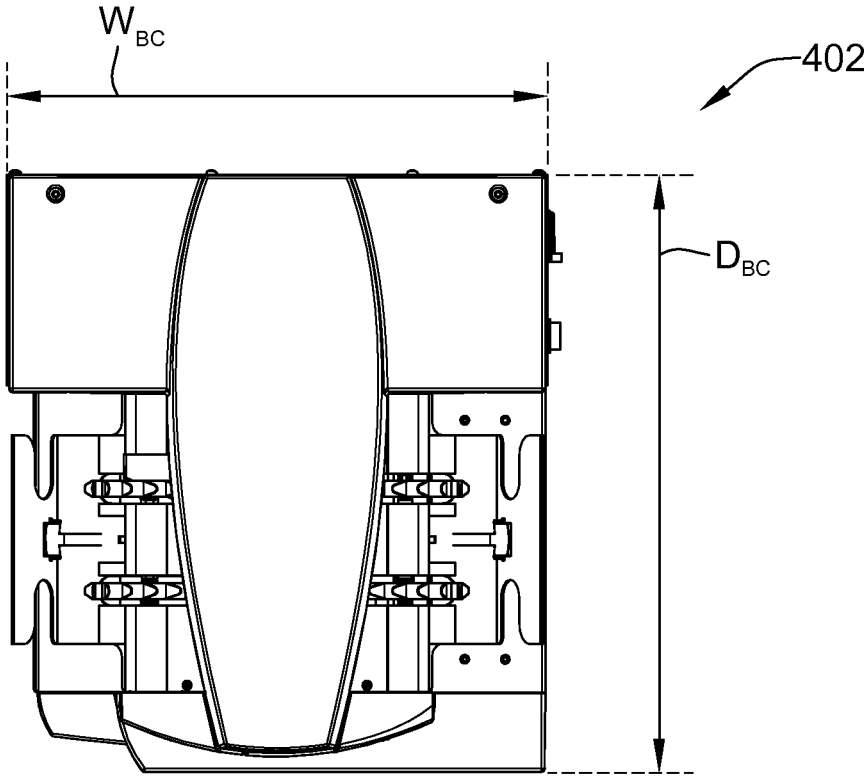
FIG. 5G is a top view of the base module of FIG. 5A.
Figure 5H:
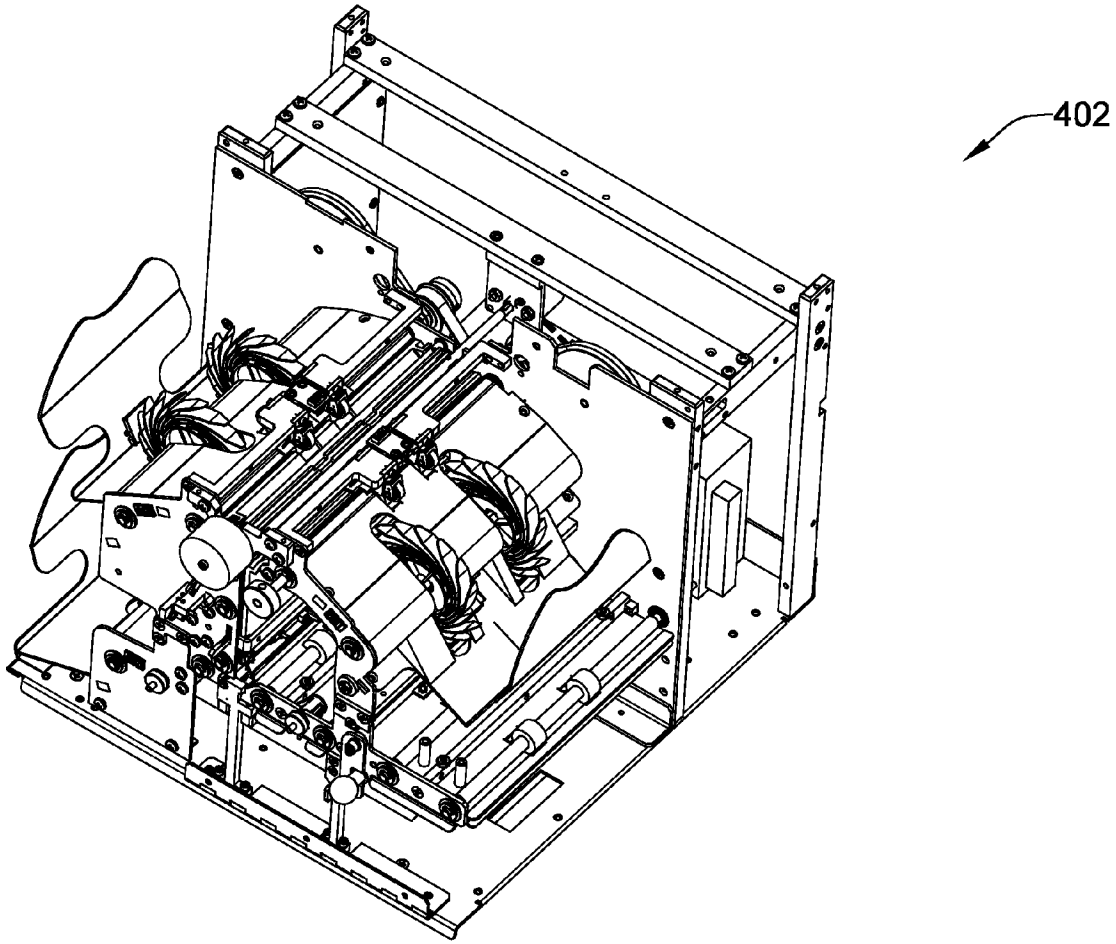
FIG. 5H is a perspective view of the base module of FIG. 5A with its covers removed.
Figure 5I:
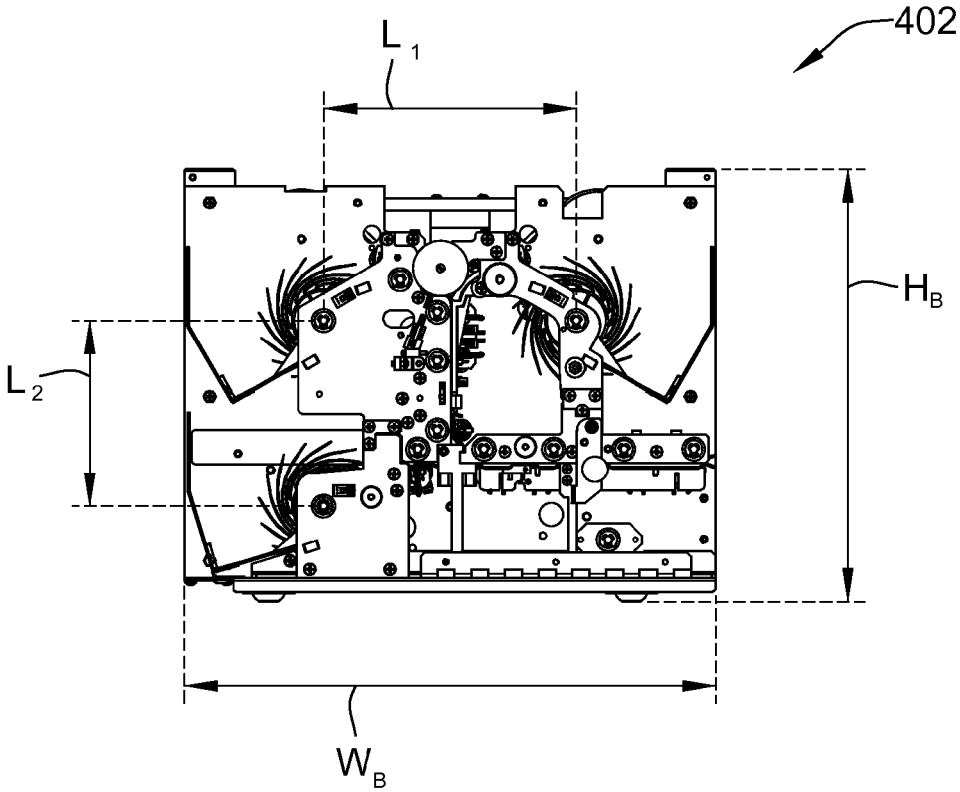
FIG. 5I is a front view of the base module of FIG. 5H.
Figure 5J:
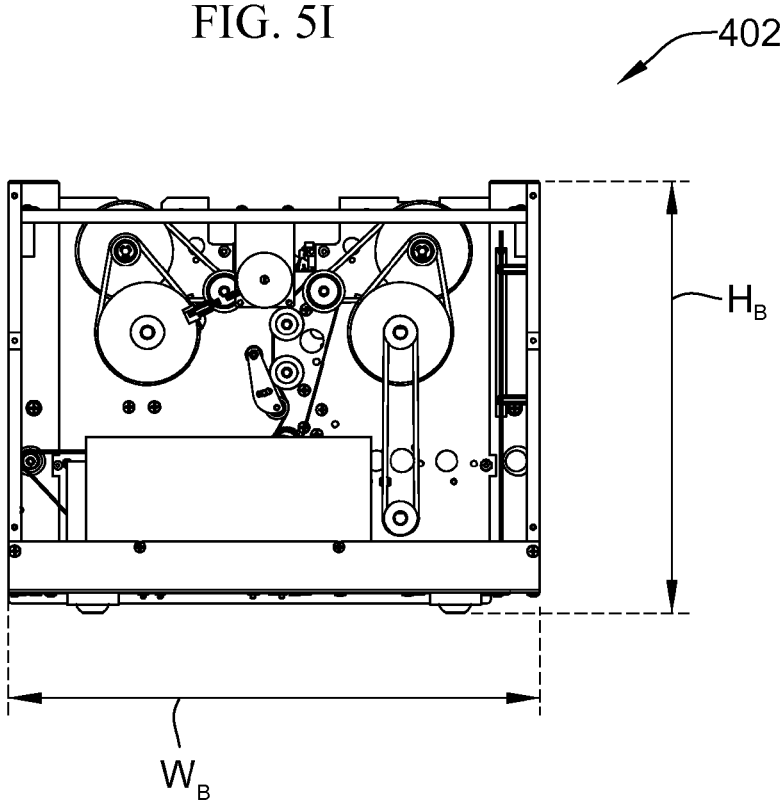
FIG. 5J is a back view of the base module of FIG. 5H.
Figure 5K:
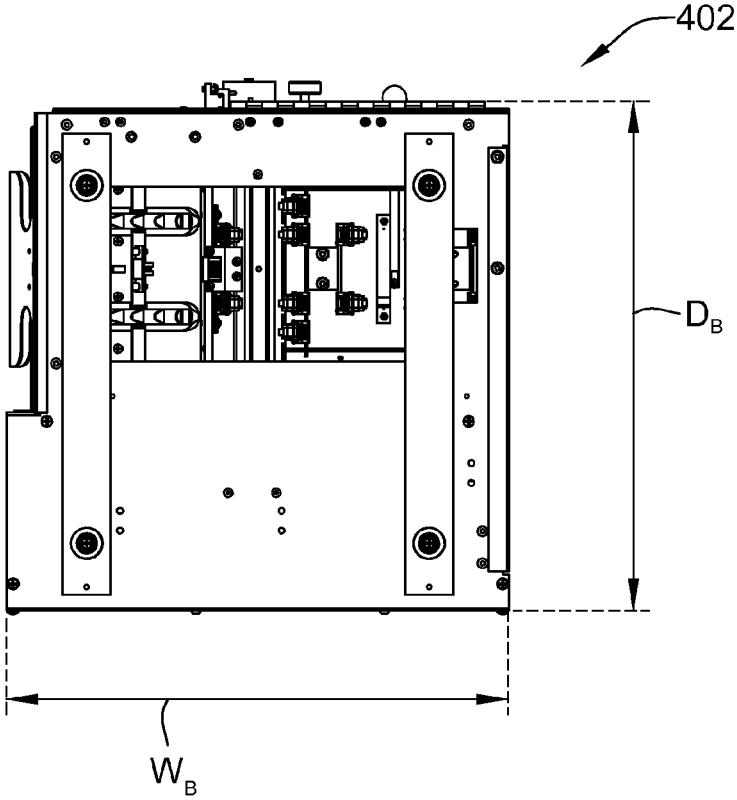
FIG. 5K is a bottom view of the base module of FIG. 5H.
Figure 5L:
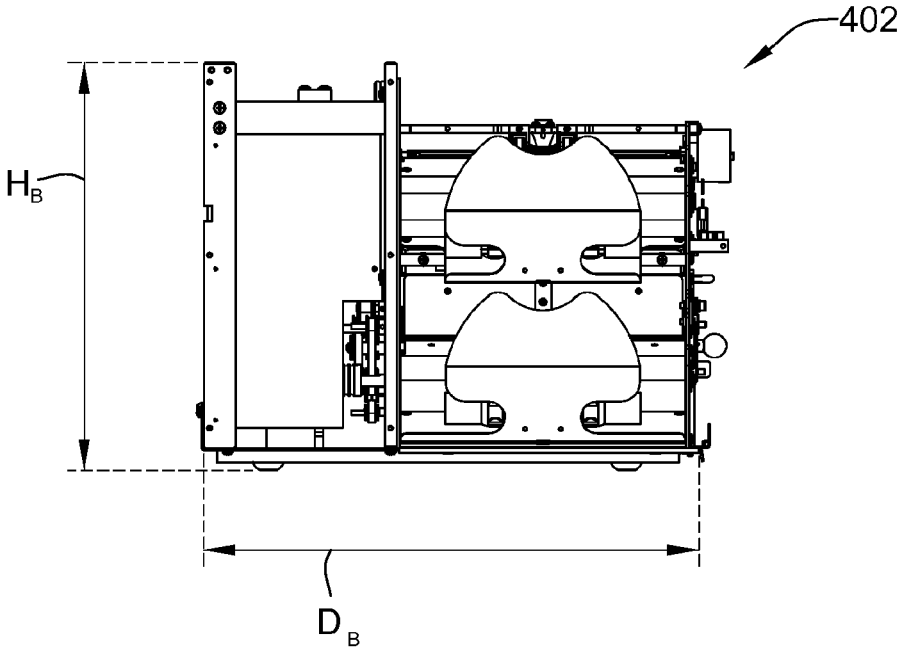
FIG. 5L is a left side view of the base module of FIG. 5H.
Figure 5M:
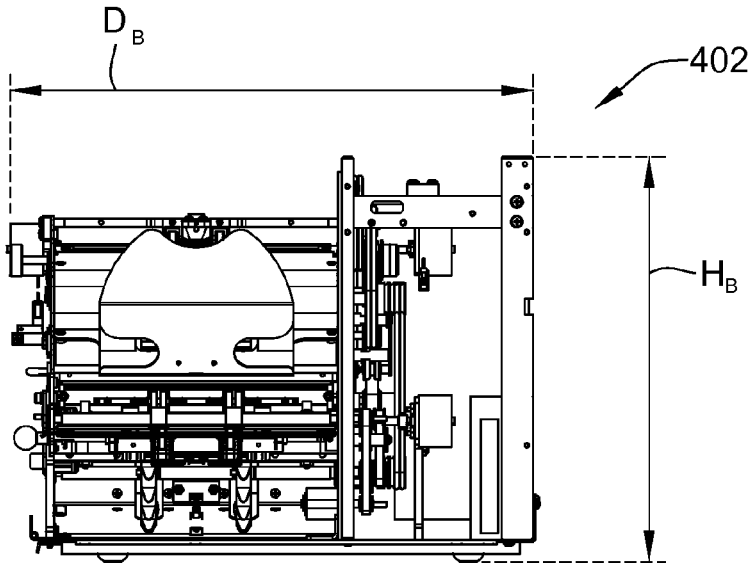
FIG. 5M is a right side view of the base module of FIG. 5H.
Figure 5N:
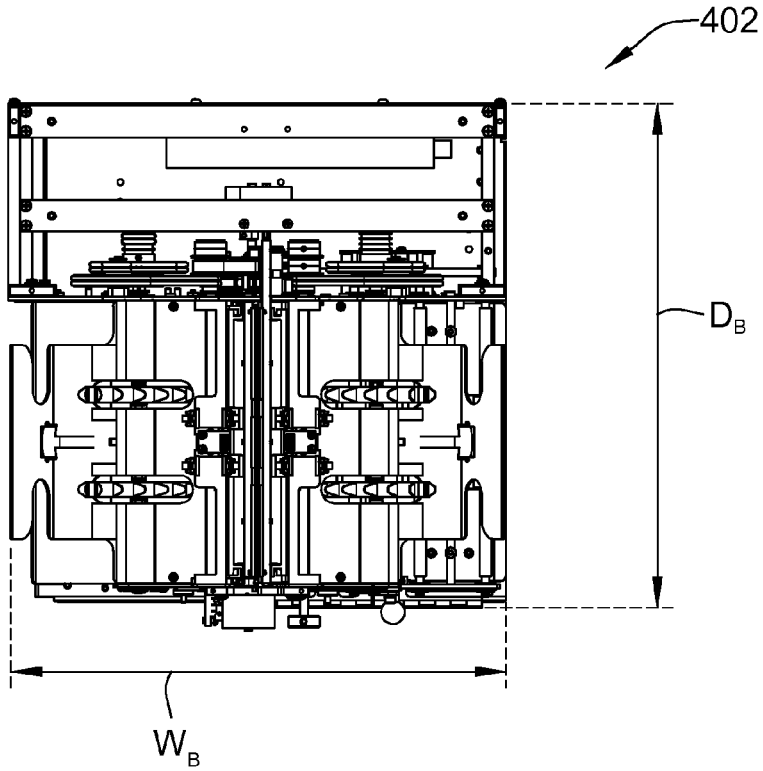
FIG. 5N is a top view of the base module of FIG. 5H.

Referring to FIGS. 5A-5N, a base module 402 is shown according to some embodiments. The base module 402 is the same as, or similar to, the first base module 102 and/or the second base module 103. The base module 402 is shown in FIGS. 5A-5G as including attached covers and in FIGS. 5H-5N without the attached covers for illustrative purposes. The base module 402 has a width including attached covers, $W_{BC}$, a width without attached covers, $W_B$, a depth including attached covers, $D_{BC}$, a depth without attached covers, $D_B$, a height including attached covers, $H_{BC}$, and a height without attached covers, $H_B$. The base module 402 is shown as including three output receptacles where one of the output receptacles can operate as a reject or offsort receptacle as described elsewhere herein. However, according to some embodiments, the base module includes two output receptacles. Such a base module is denoted herein as base module 402'.

According to some embodiments, the width, $W_{BC}$, of the base module 402 including the attached covers is between about thirteen inches (33 cm) and about nineteen inches (49 cm). According to some embodiments, the width, $W_{BC}$, of the base module 402 including the attached covers is about sixteen inches (41 cm). According to some embodiments, the width, $W_B$, of the base module 402 without the attached covers is between about thirteen inches (33 cm) and about nineteen inches (49 cm). According to some embodiments, the width, $W_B$, of the base module 402 without the attached covers is about sixteen inches (41 cm). According to some embodiments, the width, $W_{BC}$, of the base module 402 less than about twenty inches (51 cm). According to some embodiments, the width, $W_B$, of the base module 402 without the attached covers is less than about twenty inches (51 cm). According to some embodiments, the width, $W_{BC}$, of the base module 402 less than about seventeen inches (43 cm). According to some embodiments, the width, $W_B$, of the base module 402 without the attached covers is less than about seventeen inches (43 cm).

According to some embodiments, the height, $H_{BC}$, of the base module 402 including the attached covers is between about eleven inches (27 cm) and about seventeen inches (44 cm). According to some embodiments, the height, $H_{BC}$, of the base module 402 including the attached covers is about fourteen inches (36 cm). According to some embodiments, the height, $H_B$, of the base module 402 without the attached covers is between about ten inches (25 cm) and about sixteen inches (41 cm). According to some embodiments, the height, $H_B$, of the base module 402 without the attached covers is about thirteen inches (33 cm). According to some embodiments, the height, $H_{BC}$, of the base module 402 including the attached covers is less than about eighteen inches (46 cm). According to some embodiments, the height, $H_B$, of the base module 402 without the attached covers is less than about seventeen inches (43 cm). According to some embodiments, the height, $H_{BC}$, of the base module 402 including the attached covers is less than about fifteen inches (38 cm). According to some embodiments, the height, $H_B$, of the base module 402 without the attached covers is less than about fourteen inches (36 cm).

According to some embodiments, a depth, $D_{BC}$, of the base module 402 including the attached covers is between about fourteen inches (35 cm) and about twenty inches (51 cm). According to some embodiments, the depth, $D_{BC}$, of the base module 402 including the attached covers is about seventeen inches (43 cm). According to some embodiments, a depth, $D_B$, of the base module 402 without the attached covers is between about thirteen inches (33 cm) and about eighteen inches (46 cm). According to some embodiments, the depth, $D_B$, of the base module 402 without the attached covers is about fifteen and a half inches (39 cm).

According to some embodiments, a distance or length, $L_1$, (FIG. 5I) between two horizontally adjacent output receptacles of the base module 402, such as measured between the stacker wheel shafts, is between about six inches (15 cm) and about nine inches (23 cm). According to some embodiments, the distance or length, $L_1$, is about seven and a half inches (19 cm). According to some embodiments, a distance or length, $L_2$, between two vertically adjacent output receptacles of the base module 402, such as measured between the stacker wheel shafts, is between about four inches (10 cm) and about seven inches (18 cm). According to some embodiments, the distance or length, $L_2$, is about five and a half inches (14 cm).

According to some embodiments, a faceprint of the base module 402 is between about 0.9 square feet ($ft^2$) and about 2.25 square feet ($ft^2$), where the faceprint of the base module 402 is defined as the width, $W_{BC,B}$, multiplied by the height, $H_{BC,B}$, of the base module 402 ($W_{BC,B} \times H_{BC,B}$). According to some embodiments, the faceprint of the base module 402 without the attached covers is about 1.4 square feet ($ft^2$). According to some embodiments, the faceprint of the base module 402 including the attached covers is about 1.5 square feet ($ft^2$). According to some embodiments, the faceprint of the base module 402 is less than about 2.3 square feet ($ft^2$). According to some embodiments, the faceprint of the base module 402 (with or without covers) is less than about 2 square feet ($ft^2$). According to some embodiments, the faceprint of the base module 402 (with or without covers) is less than about 1½ square feet ($ft^2$).

According to some embodiments, the base module 402 has a footprint of less than about three square feet, where the footprint of the base module 402 is defined as the width, $W_{BC,B}$, multiplied by the depth, $D_{BC,B}$, of the base module 402 ($W_{BC,B} \times D_{BC,B}$). According to some embodiments, the base module 402 has a footprint of less than about two square feet. According to some embodiments, the base module 402 has a footprint of less than one square feet. According to some embodiments, the base module 402 has a footprint of about 1.7 square feet. According to some embodiments, a footprint of the base module 402 is between about three square feet ($ft^2$) and about one square feet ($ft^2$).

According to some embodiments, the base module 402 has a volume of less than about four cubic feet, where the volume is defined as the width, $W_{BC,B}$, multiplied by the height, $H_{BC,B}$, multiplied by the depth, $D_{BC,B}$, of the base module 402 ($W_{BC,B} \times H_{BC,B} \times D_{BC,B}$). According to some embodiments, the base module 402 has a volume of less than about three cubic feet. According to some embodiments, the base module 402 has a volume of less than about two cubic feet. According to some embodiments, the base module 402 has a volume of less than about one cubic feet. According to some embodiments, the base module 402 has a volume of about 1.8 cubic feet. According to some embodiments, a volume of the base module 402 is between about four cubic feet ($ft^3$) and about one cubic feet ($ft^3$).

According to some embodiments, the base module 402 has a pocket density between about 1.3 pockets/square foot of faceprint and about 3.3 pockets/square foot of faceprint. According to some embodiments, the base module 402 has a pocket density of about 2.1 pockets/square foot of faceprint. According to some embodiments, the base module 402 has a pocket density of at least about 1.3 pockets/square foot of faceprint. According to some embodiments, the base module 402 has a pocket density of at least about 2 pockets/square foot of faceprint. According to some embodiments, the base module 402 has a pocket density between about 1.1 pockets/square foot of footprint and about 2.6 pockets/square foot of footprint. According to some embodiments, the base module 402 has a pocket density of about 1.8 pockets/square foot of footprint. According to some embodiments, the base module 402 has a pocket density of at least about 1.1 pockets/square foot of footprint. According to some embodiments, the base module 402 has a pocket density of at least about 1.8 pockets/square foot of footprint. According to some embodiments, the base module 402 has a pocket density of at least about 2 pockets/square foot of footprint. According to some embodiments, the base module 402 has a pocket density between about 0.8 pockets/cubic foot of volume and about 3 pockets/cubic foot of volume. According to some embodiments, the base module 402 has a pocket density of about 1.7 pockets/cubic foot of volume. According to some embodiments, the base module 402 has a pocket density of at least about 1 pockets/cubic foot of volume. According to some embodiments, the base module 402 has a pocket density of at least about 1½ pockets/cubic foot of volume. According to some embodiments, the base module 402 has a pocket density of at least about 2 pockets/cubic foot of volume.

According to some embodiments, the base module 402 has a width, $W_{BC,B}$, less than about nineteen inches, a depth, $D_{BC,B}$, less than about twenty inches, and a height, $H_{BC,B}$, less than about seventeen inches. According to some embodiments, the base module 402 has a width, $W_{BC}$, of about 15.9 inches, a depth, $D_{BC}$, of about 17.1 inches, and a height, $H_{BC}$, of about 14.1 inches. According to some embodiments, the base module 402 has a pocket density greater than about 1.3 pockets/square foot of faceprint, greater than about 1.1 pockets/square foot of footprint, and greater than about 0.8 pockets/cubic foot of volume.

Figure 6A:
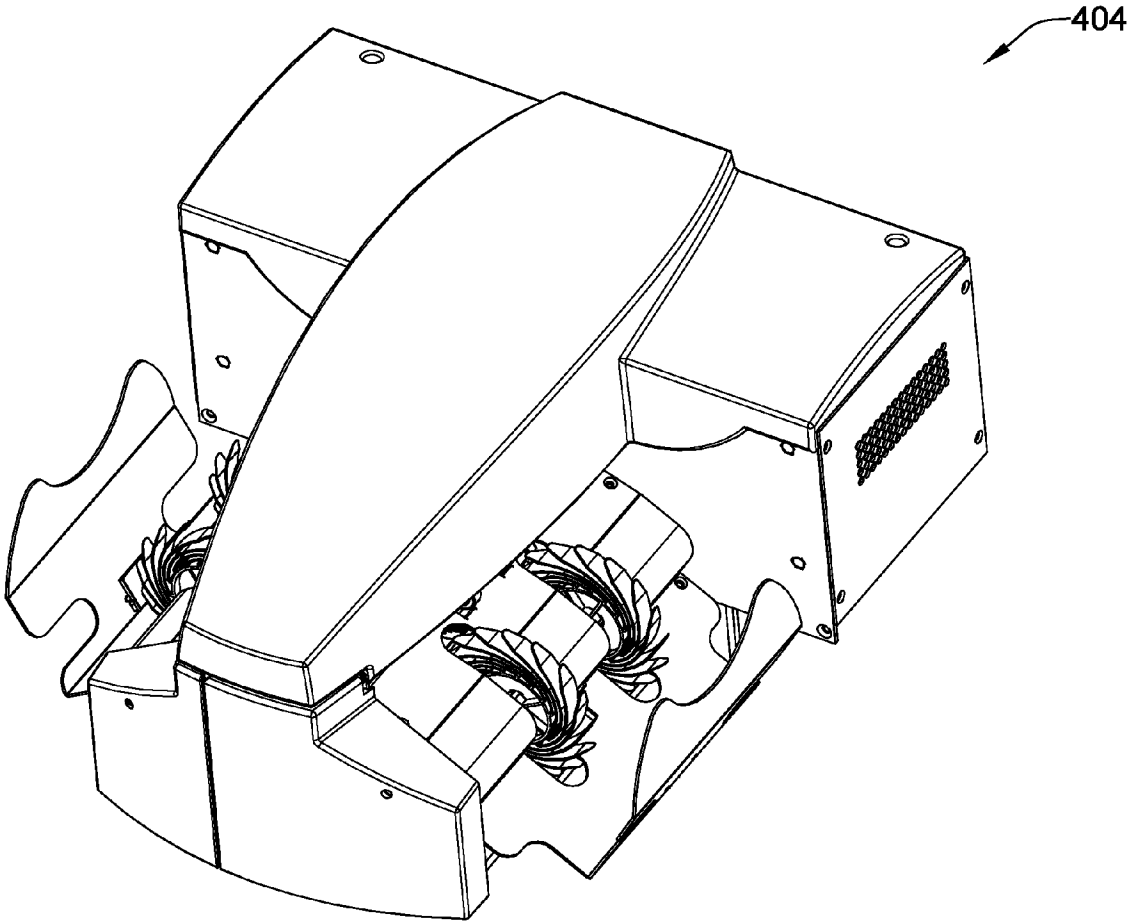
FIG. 6A is a perspective view of a pocket module according to some embodiments of the present disclosure.
Figure 6B:
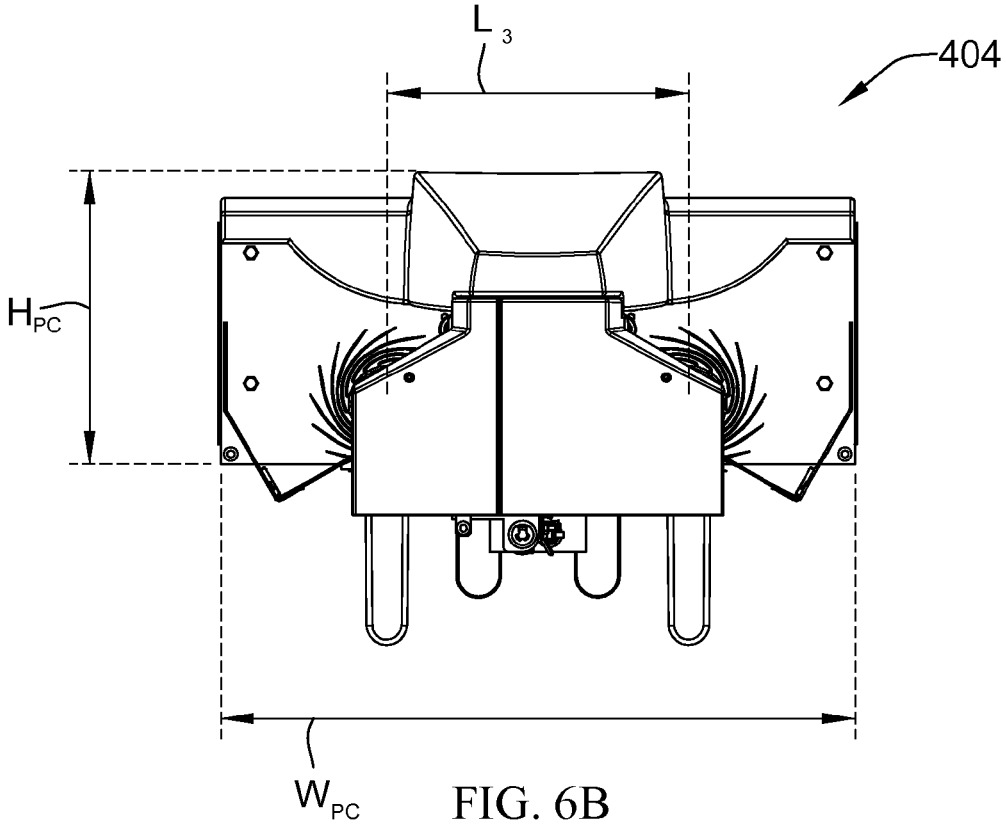
FIG. 6B is a front view of the pocket module of FIG. 6A.
Figure 6C:
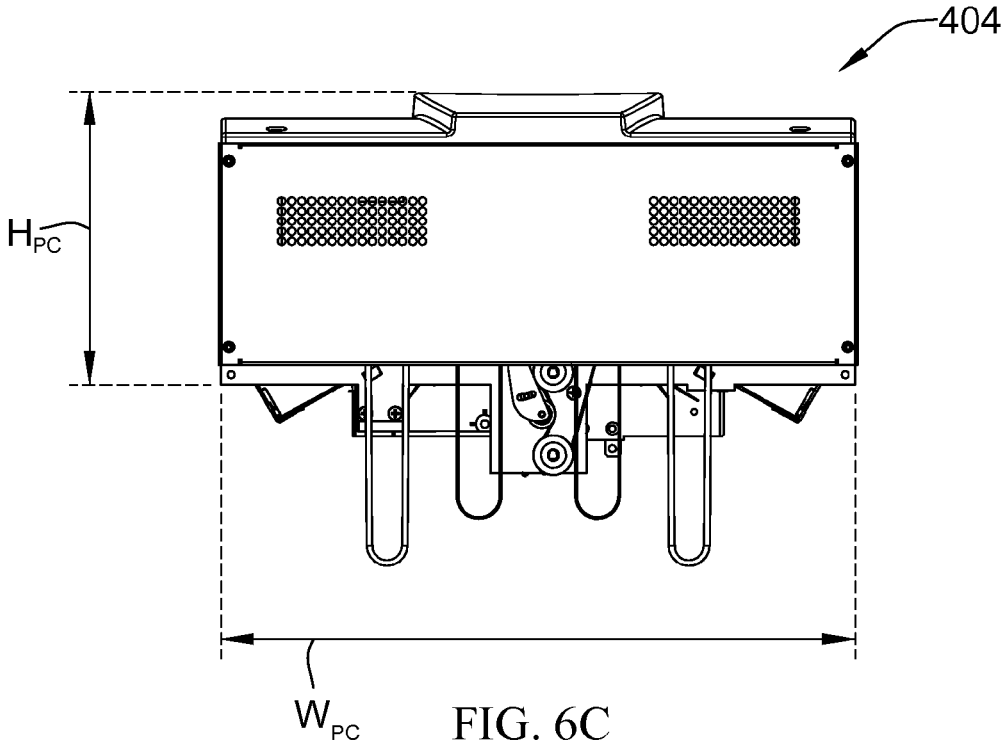
FIG. 6C is a back view of the pocket module of FIG. 6A.
Figure 6D:
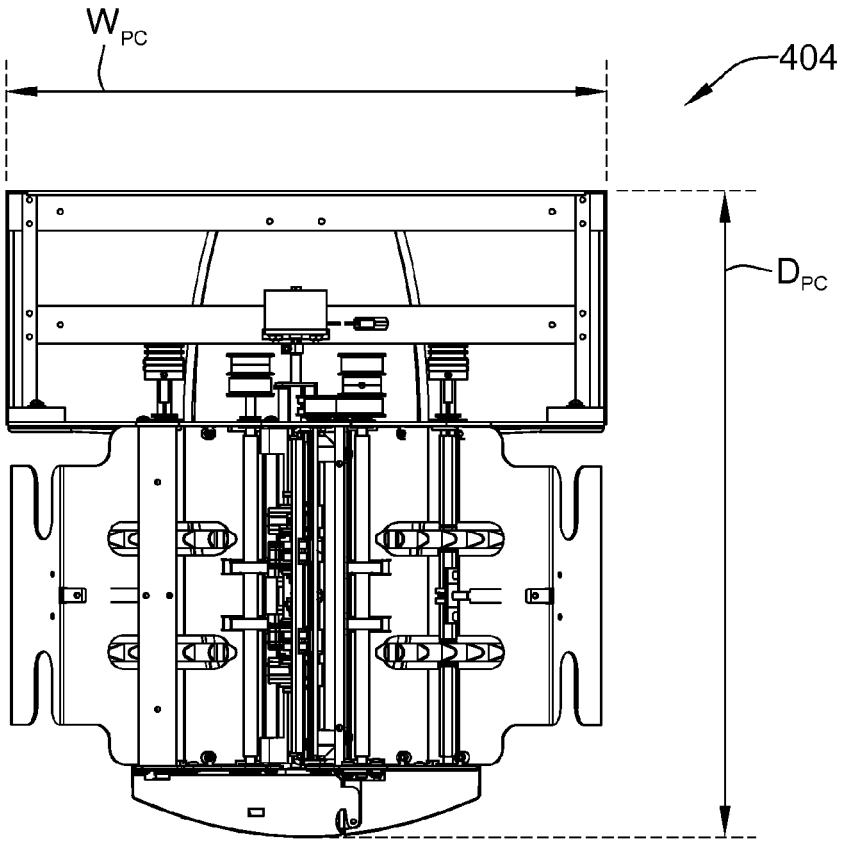
FIG. 6D is a bottom view of the pocket module of FIG. 6A.
Figure 6E:
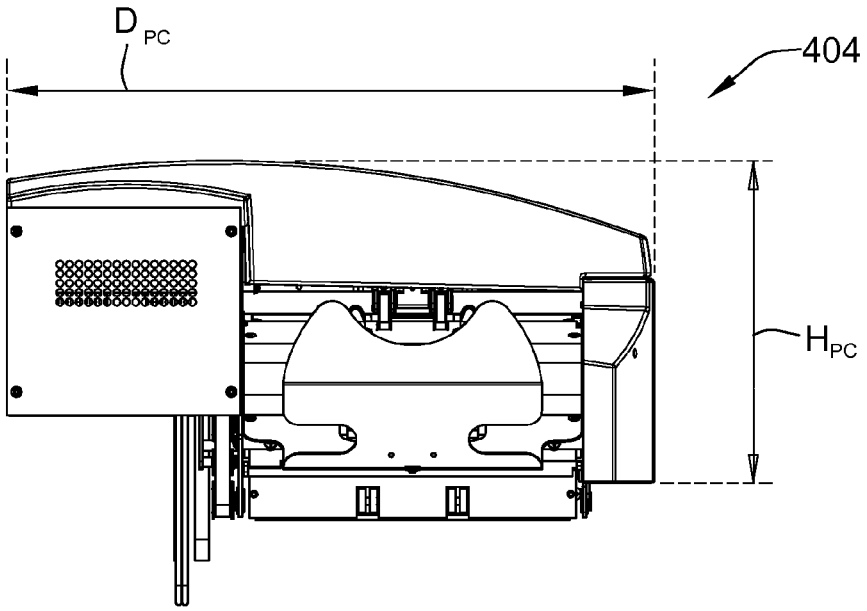
FIG. 6E is a left side view of the pocket module of FIG. 6A.
Figure 6F:
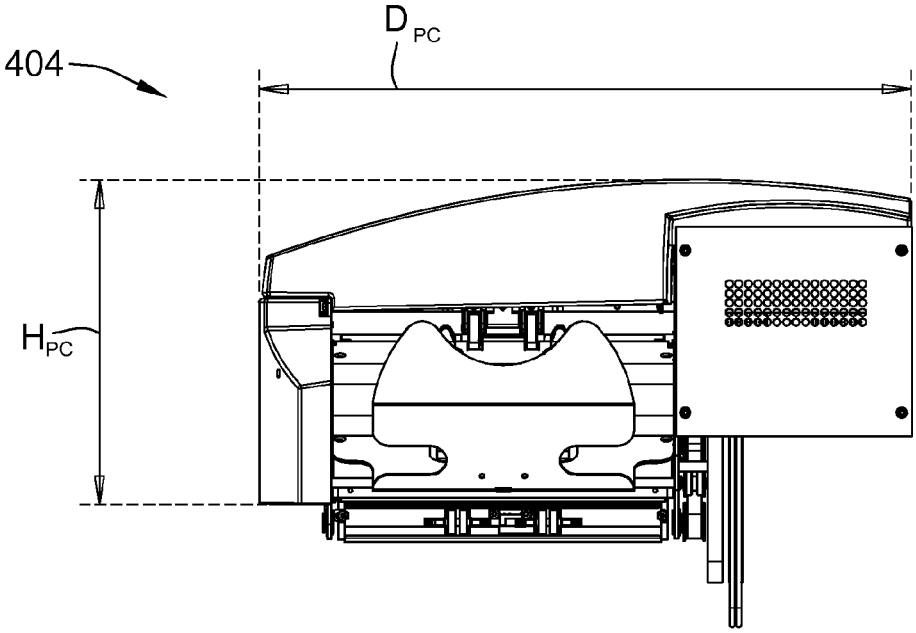
FIG. 6F is a right side view of the pocket module of FIG. 6A.
Figure 6G:
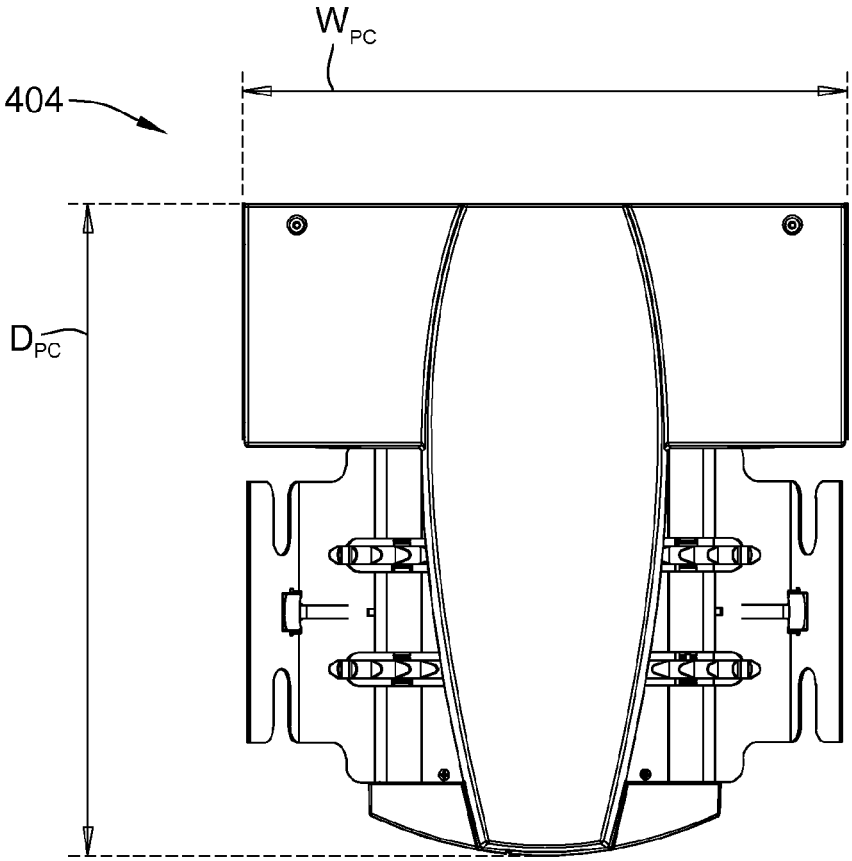
FIG. 6G is a top view of the pocket module of FIG. 6A.
Figure 6H:
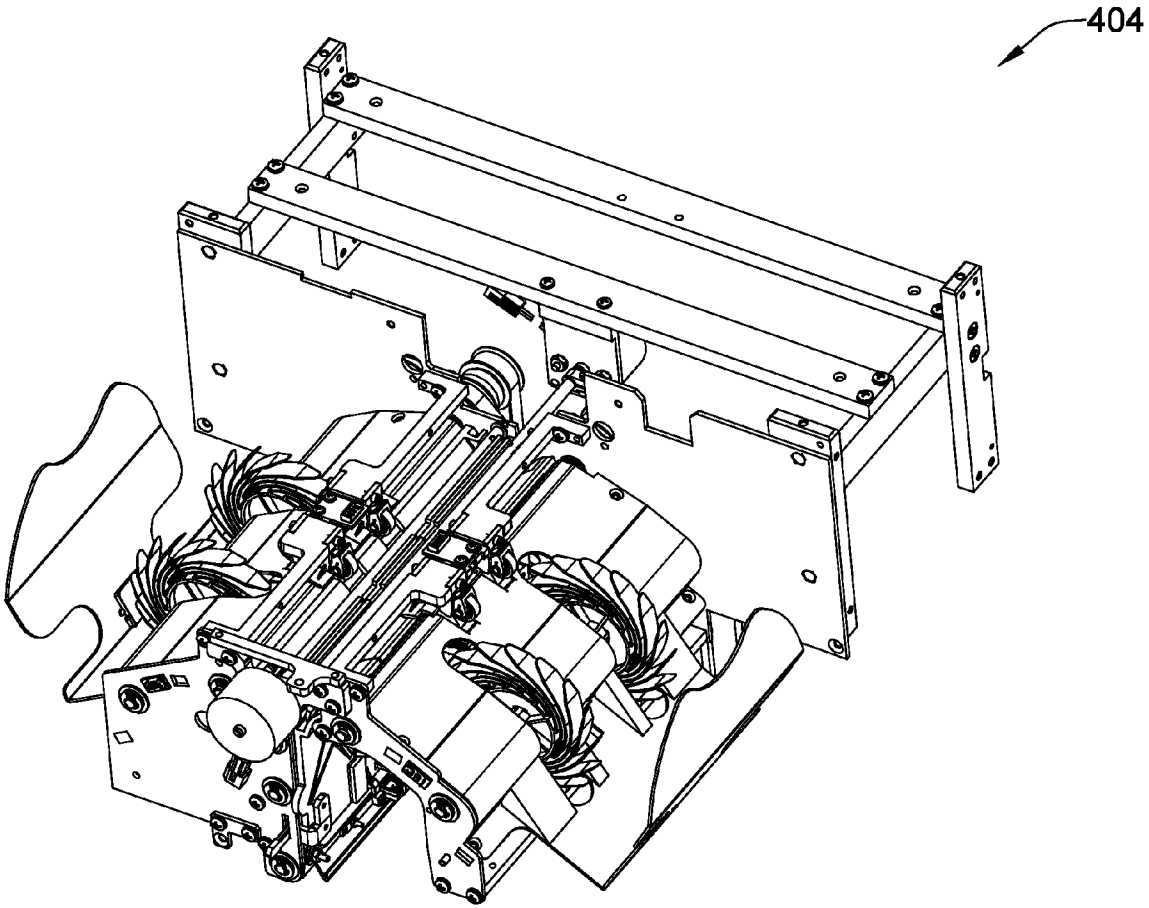
FIG. 6H is a perspective view of the pocket module of FIG. 6A with its covers removed.
Figure 6I:
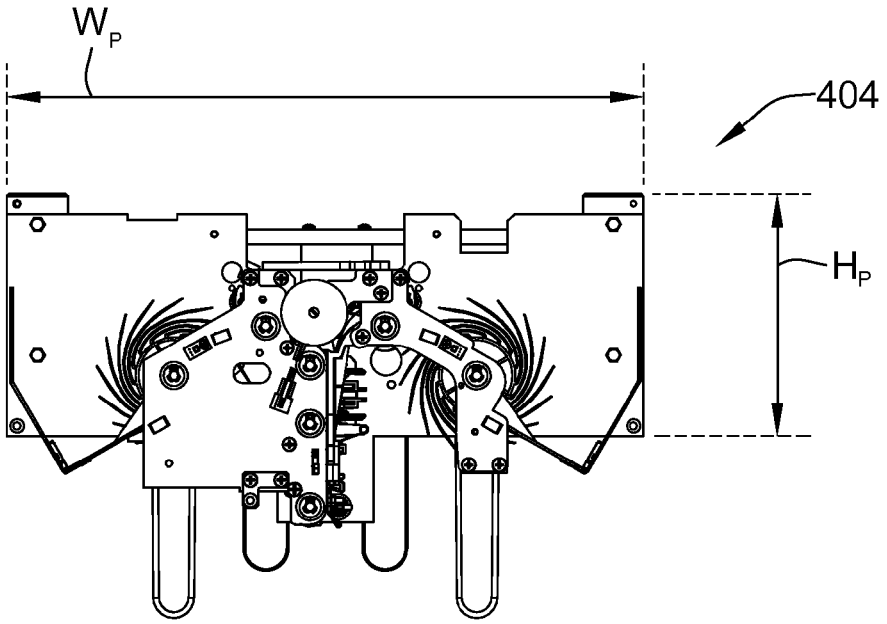
FIG. 6I is a front view of the pocket module of FIG. 6H.
Figure 6J:
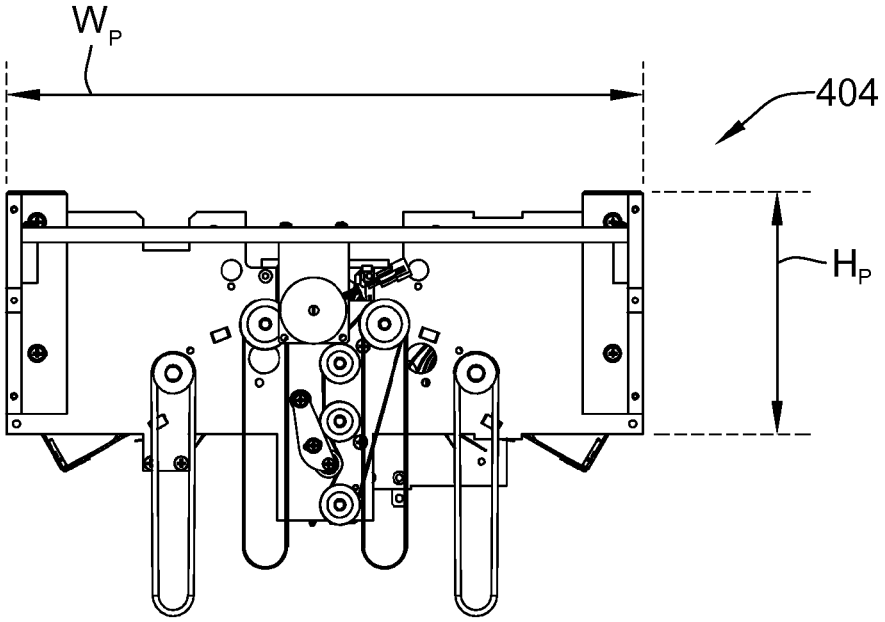
FIG. 6J is a back view of the pocket module of FIG. 6H.
Figure 6K:
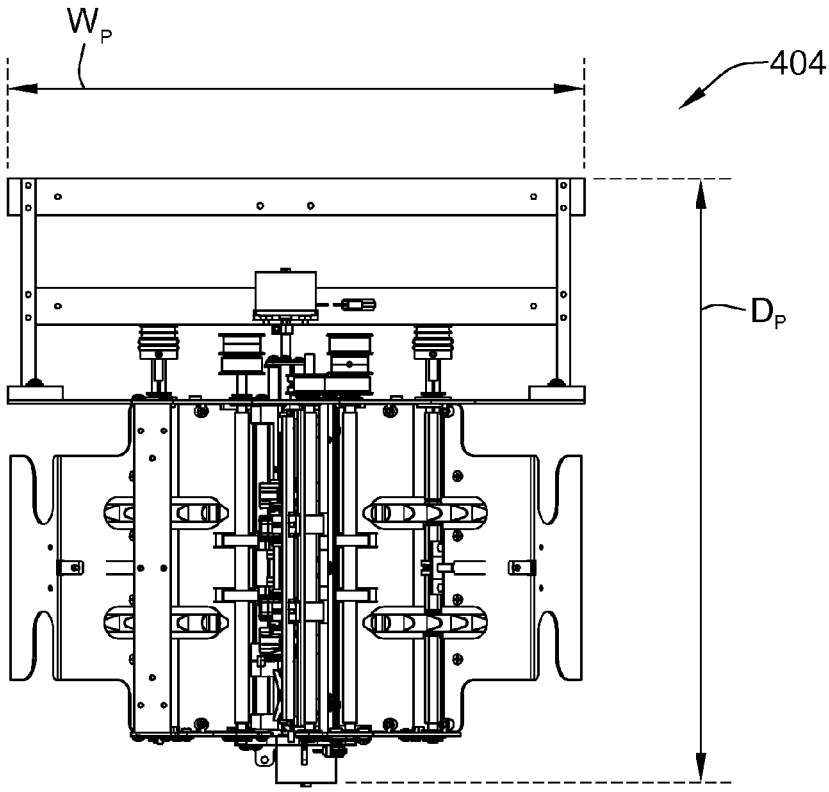
FIG. 6K is a bottom view of the pocket module of FIG. 6H.
Figure 6L:
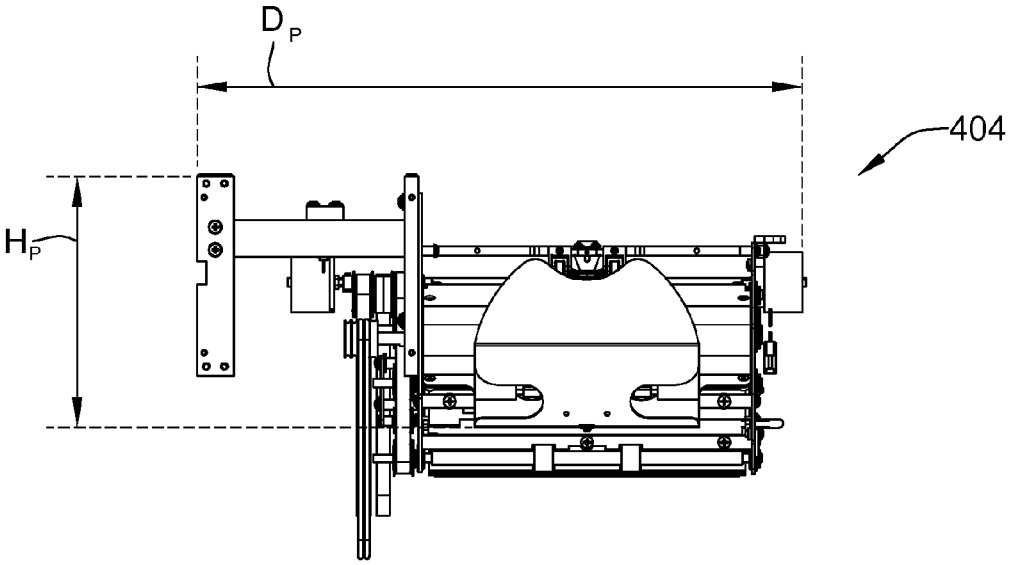
FIG. 6L is a left side view of the pocket module of FIG. 6H.
Figure 6M:
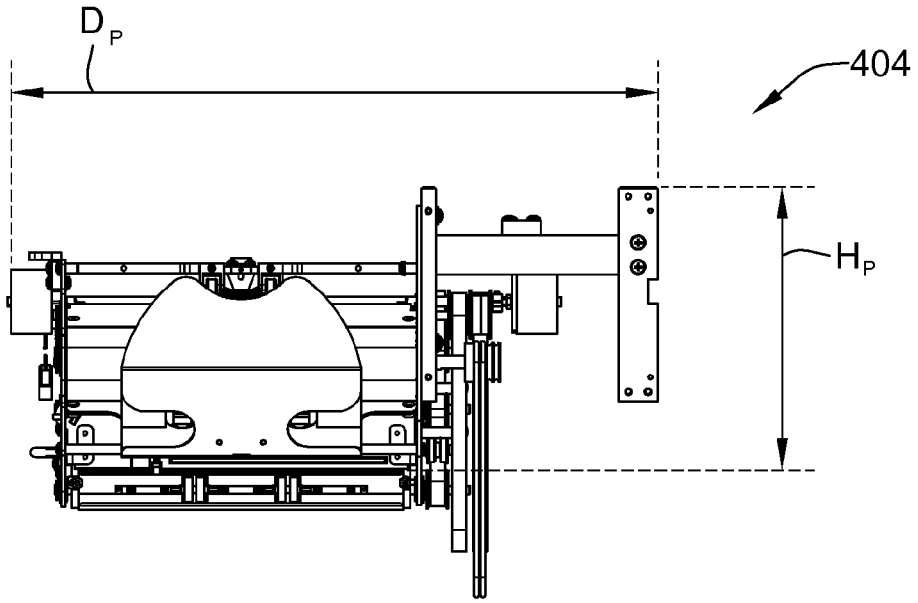
FIG. 6M is a right side view of the pocket module of FIG. 6H.
Figure 6N:
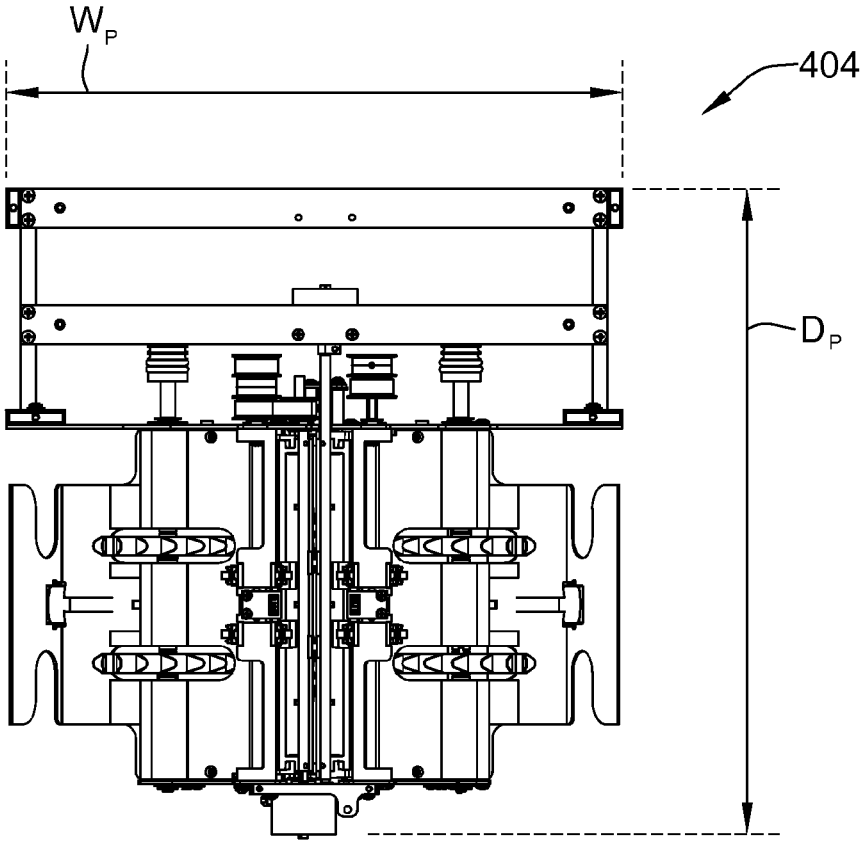
FIG. 6N is a top view of the pocket module of FIG. 6H.
Figure 7A:
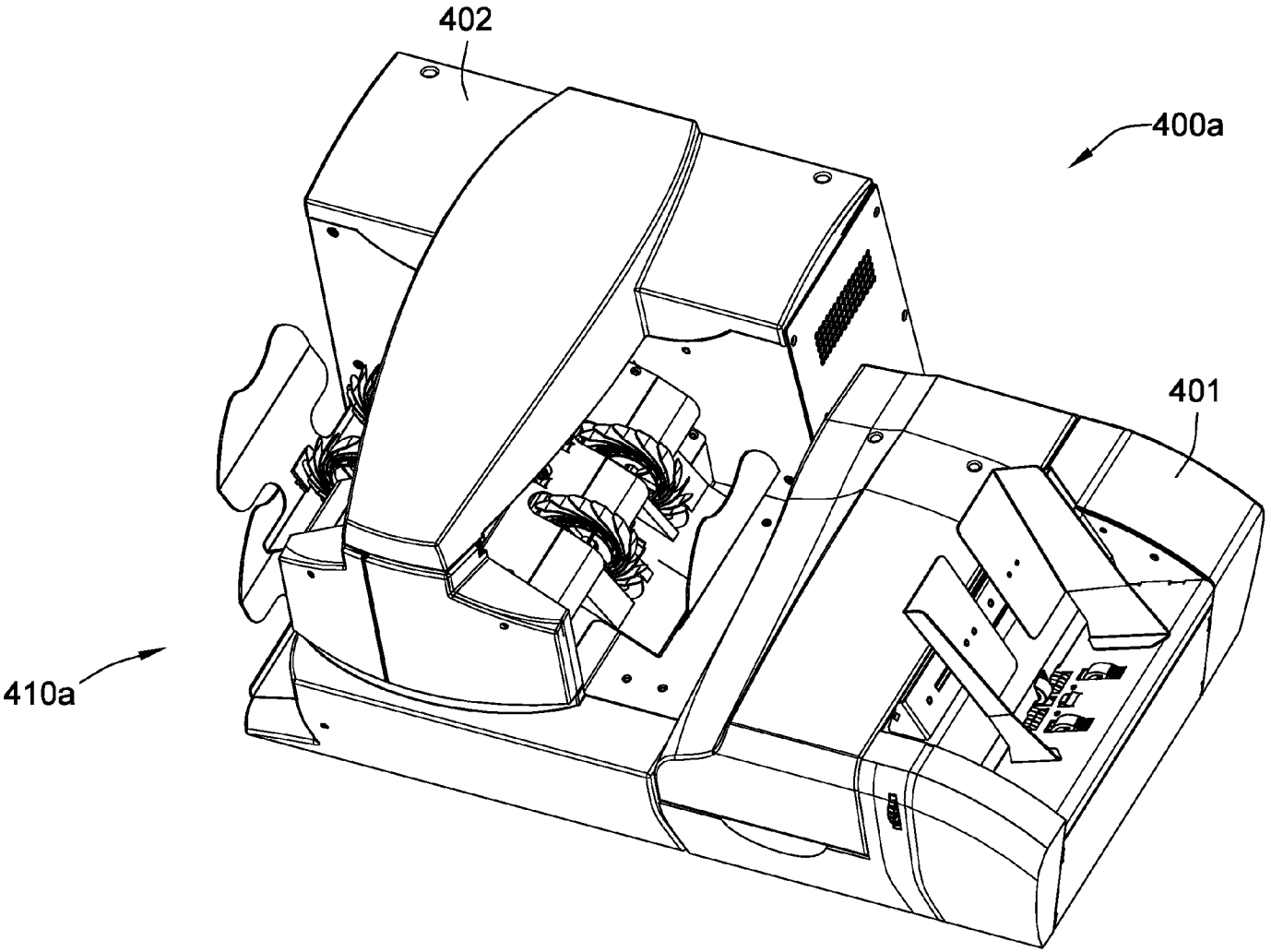
FIG. 7A is a perspective view of a three pocket document processing system according to some embodiments of the present disclosure.
Figure 7B:
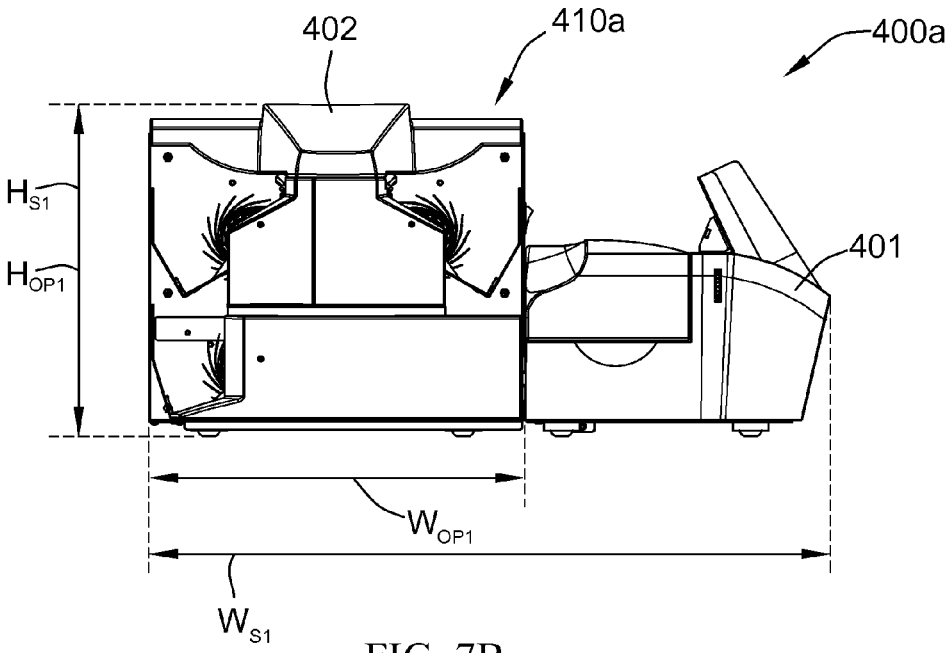
FIG. 7B is a front view of the document processing system of FIG. 7A.
Figure 7C:
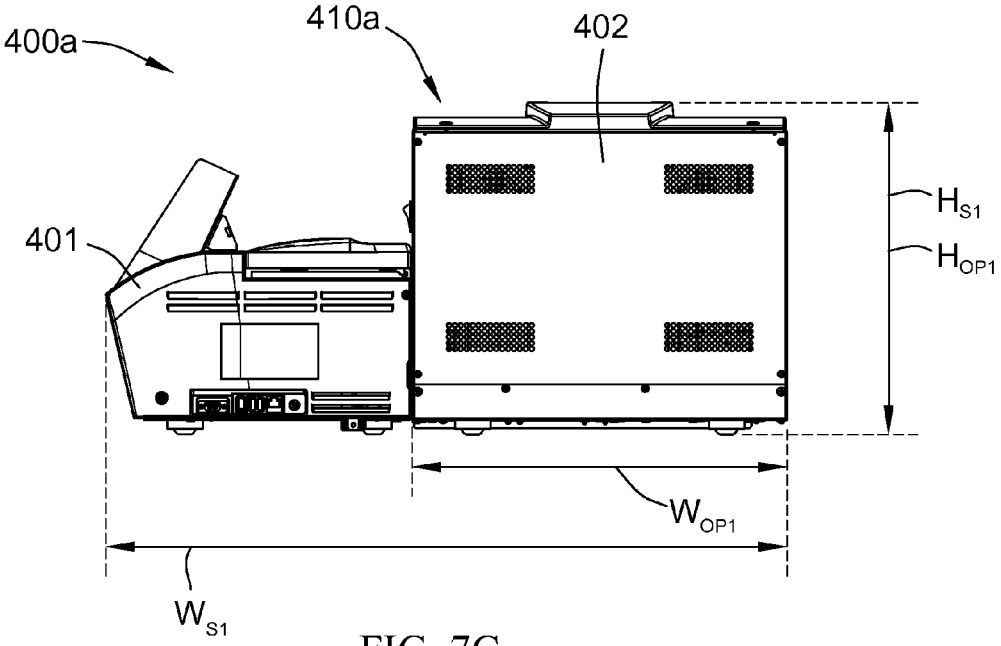
FIG. 7C is a back view of the document processing system of FIG. 7A.
Figure 7D:
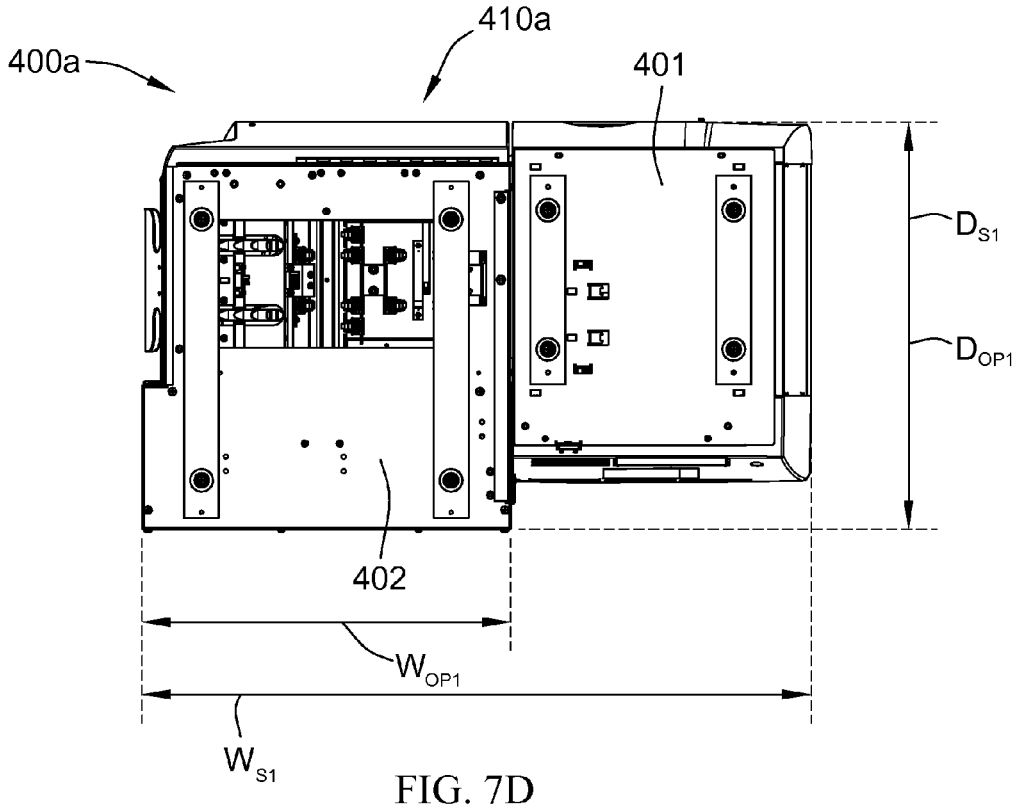
FIG. 7D is a bottom view of the document processing system of FIG. 7A.
Figure 7E:
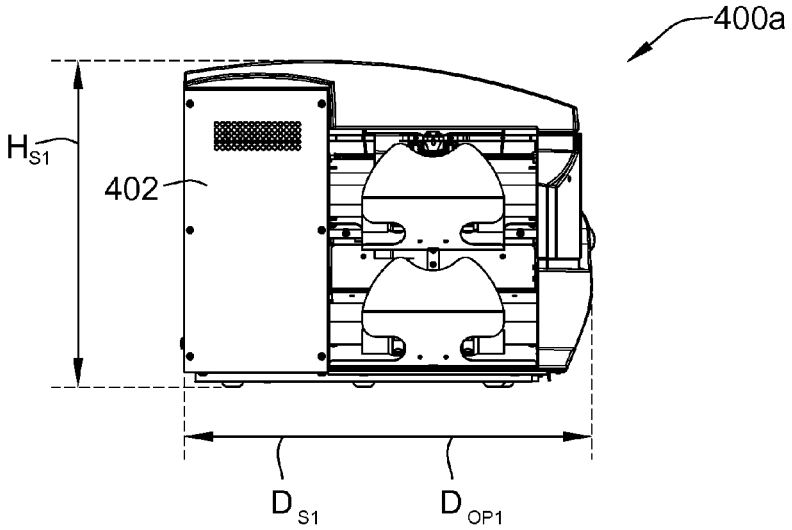
FIG. 7E is a left side view of the document processing system of FIG. 7A.
Figure 7F:
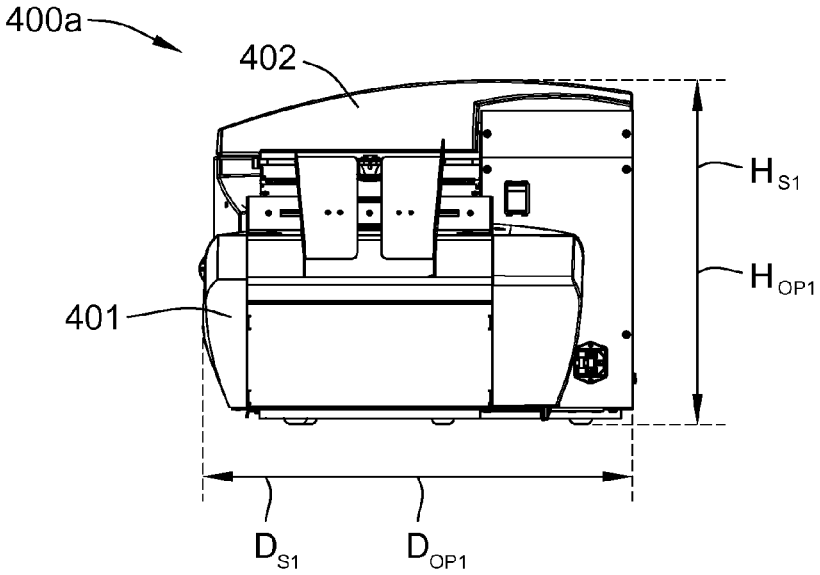
FIG. 7F is a right side view of the document processing system of FIG. 7A.
Figure 7G:
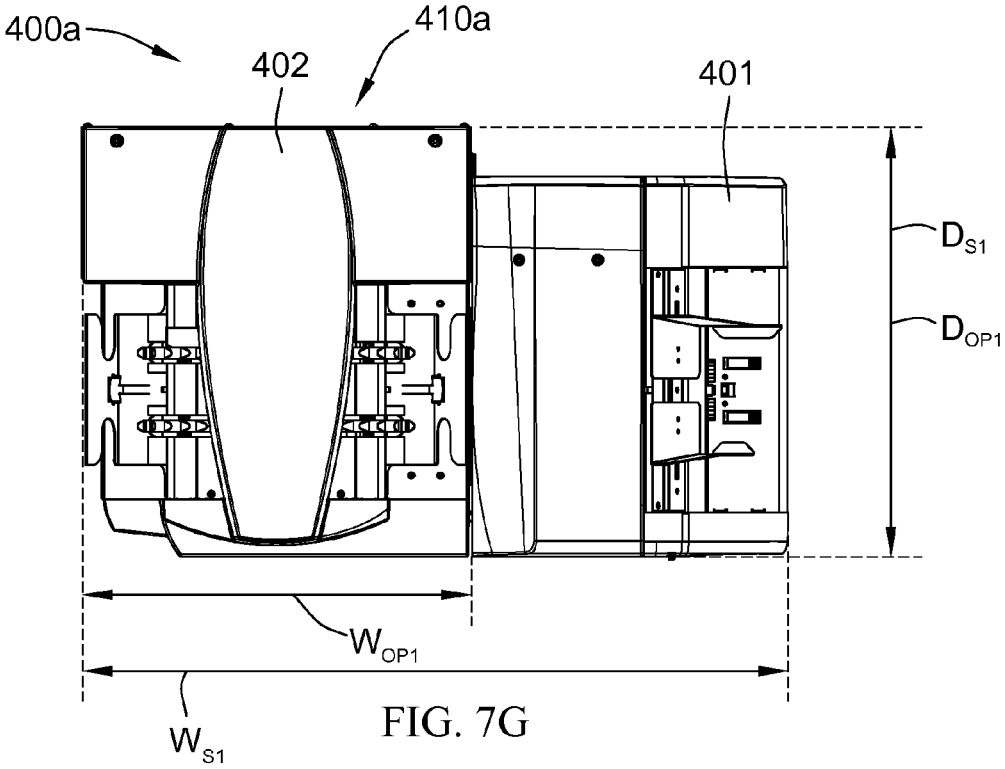
FIG. 7G is a top view of the document processing system of FIG. 7A.
Figure 8A:
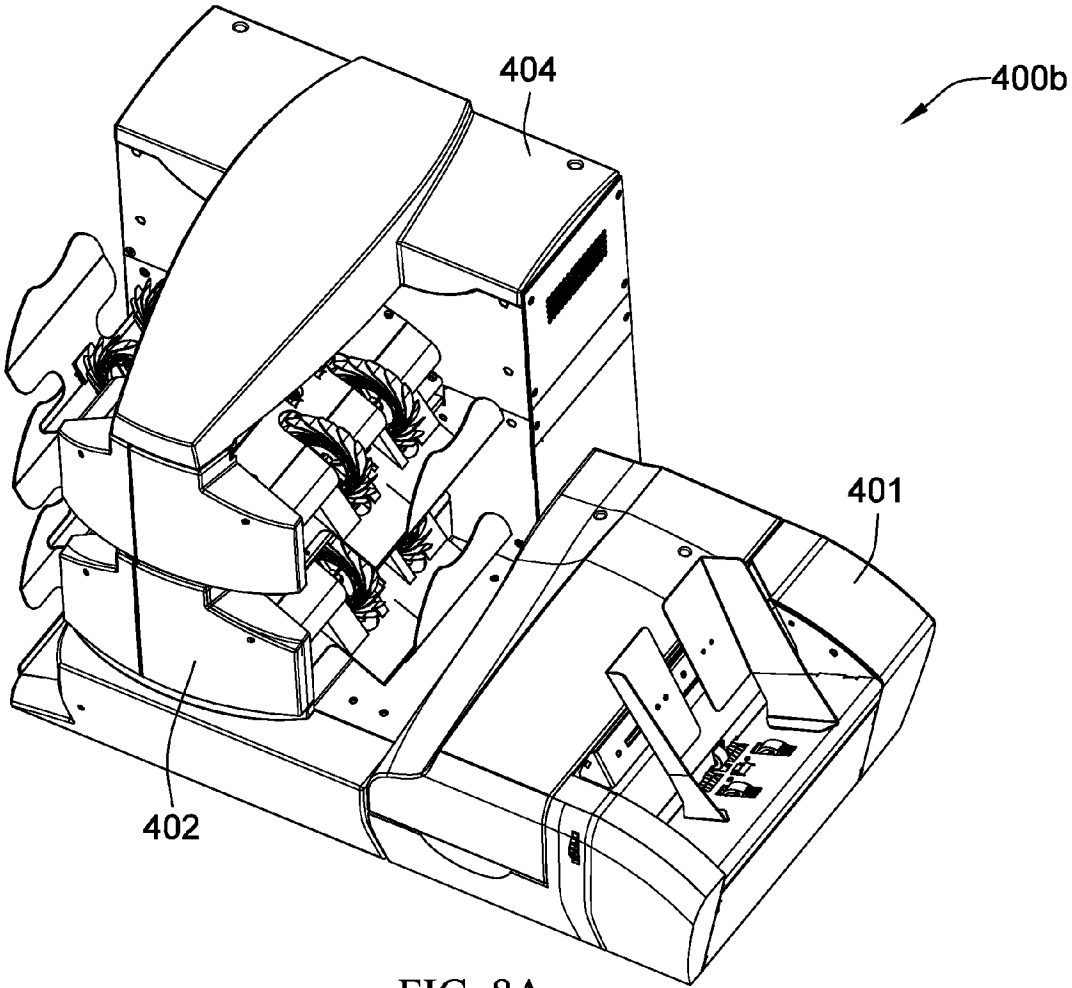
FIG. 8A is a perspective view of a five pocket document processing system according to some embodiments of the present disclosure.
Figure 8B:
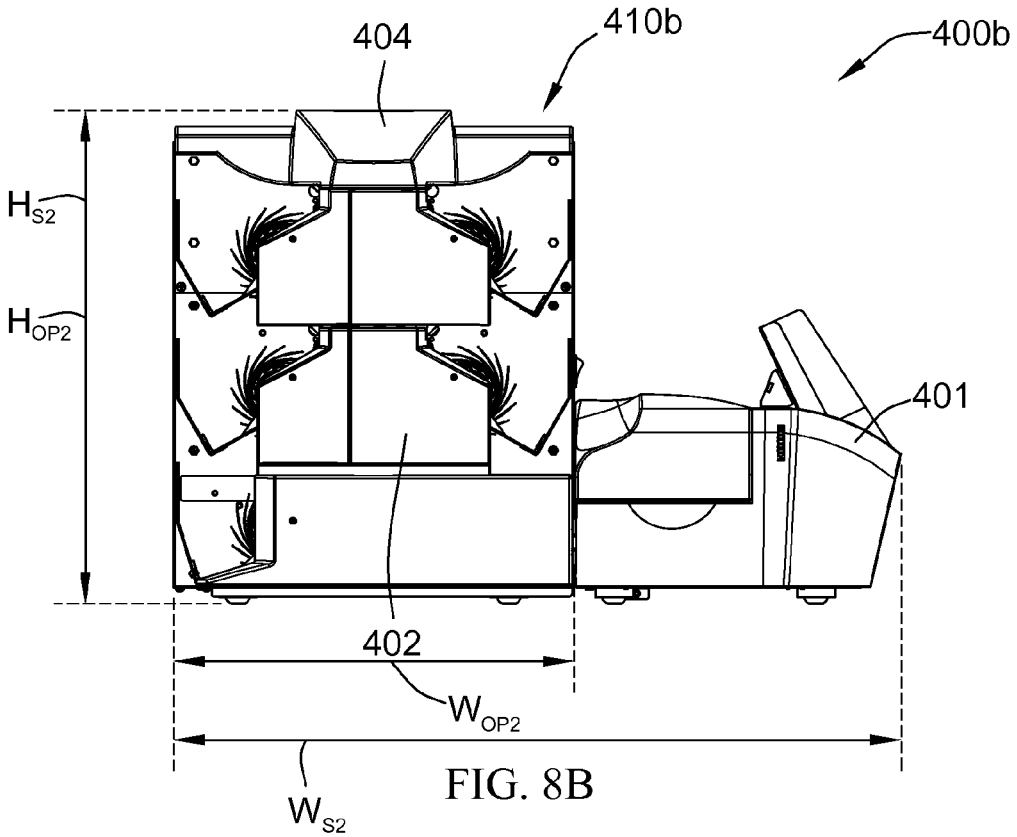
FIG. 8B is a front view of the document processing system of FIG. 8A.
Figure 8C:
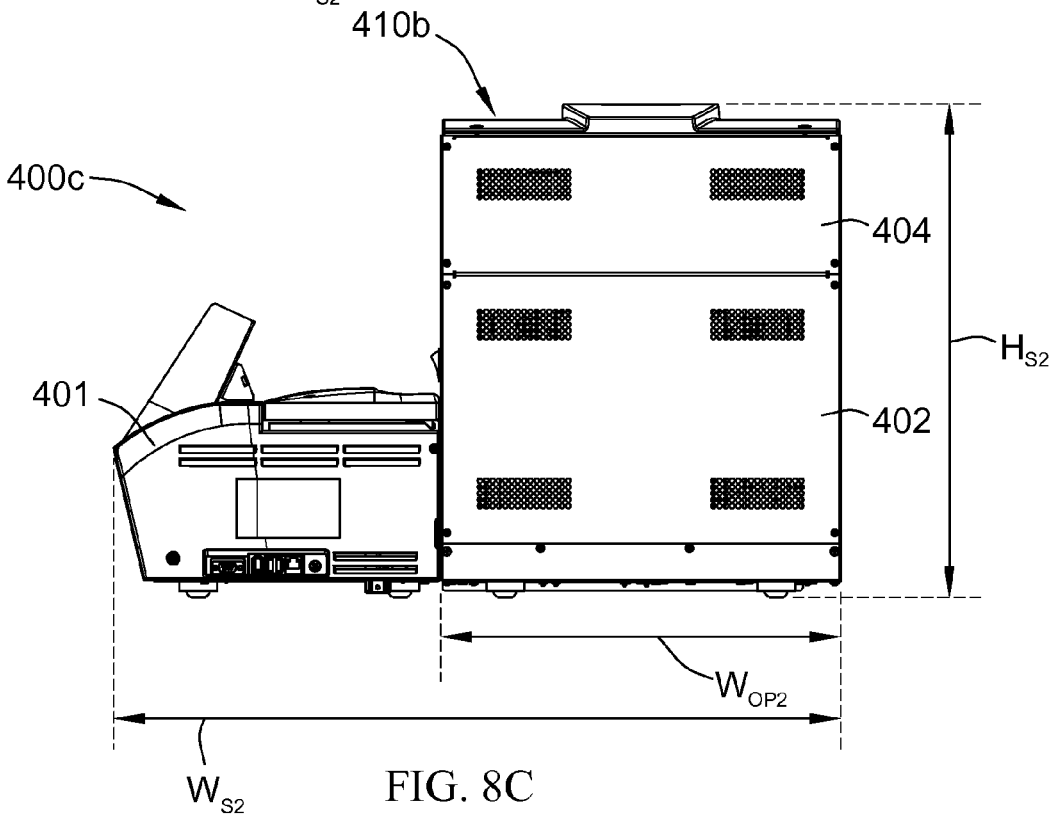
FIG. 8C is a back view of the document processing system of FIG. 8A.
Figure 8D:
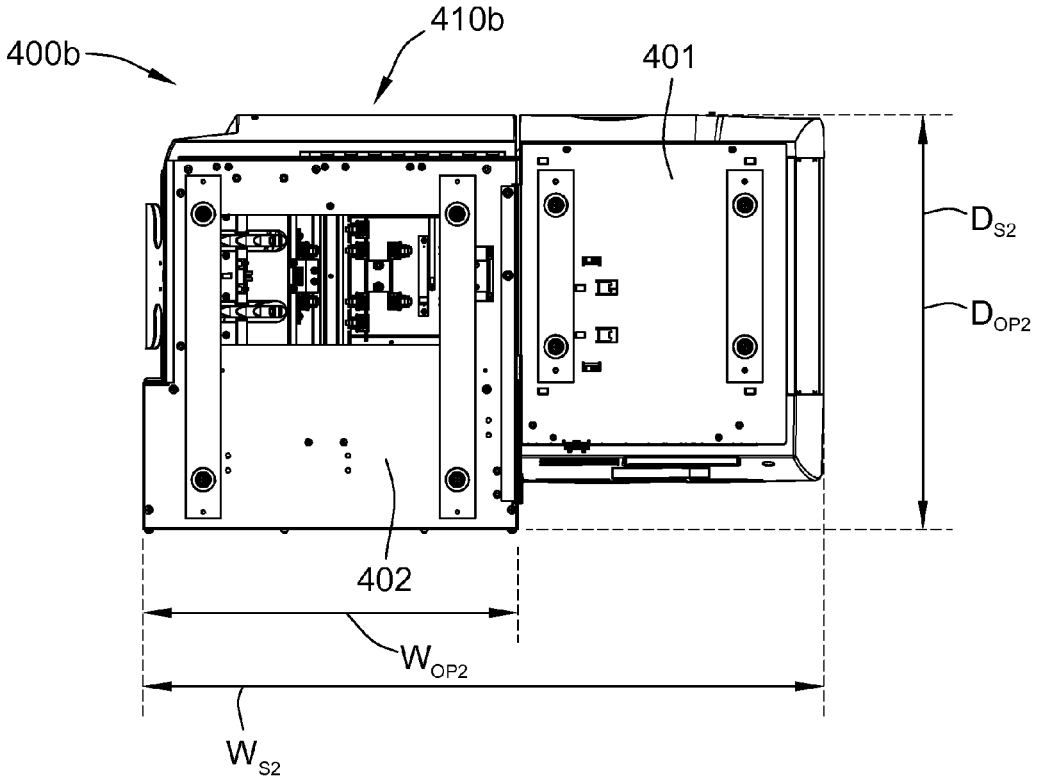
FIG. 8D is a bottom view of the document processing system of FIG. 8A.
Figure 8E:
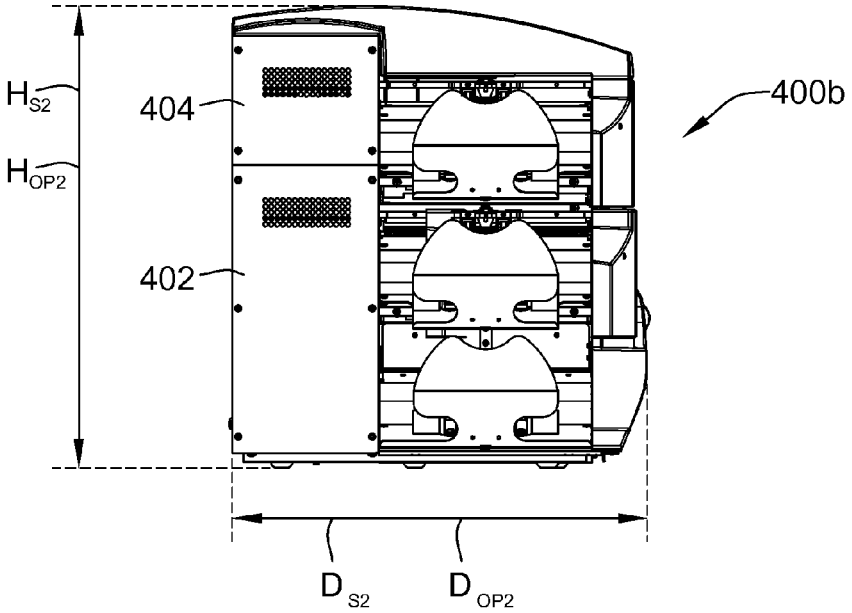
FIG. 8E is a left side view of the document processing system of FIG. 8A.
Figure 8F:
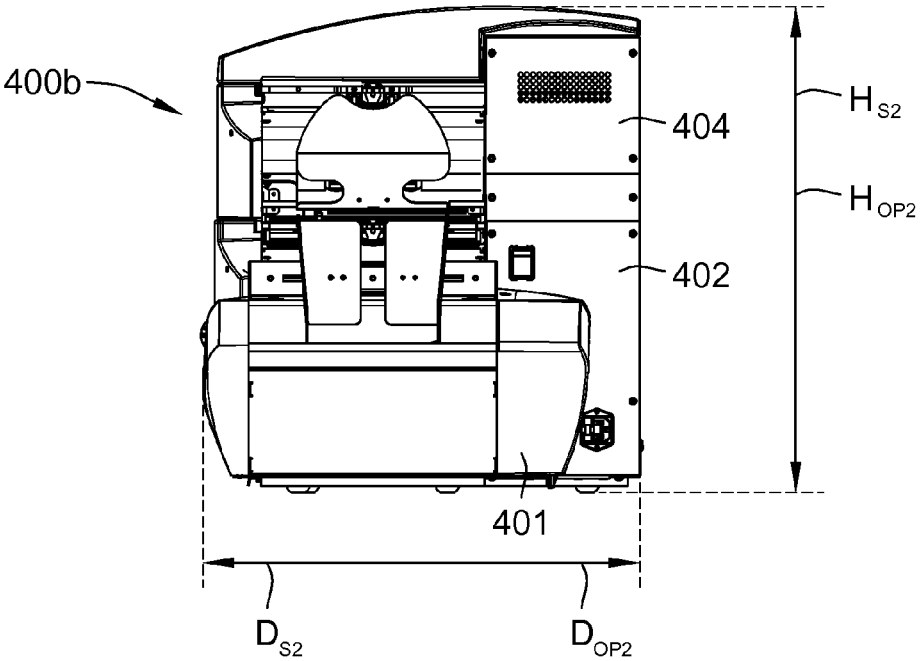
FIG. 8F is a right side view of the document processing system of FIG. 8A.
Figure 8G:
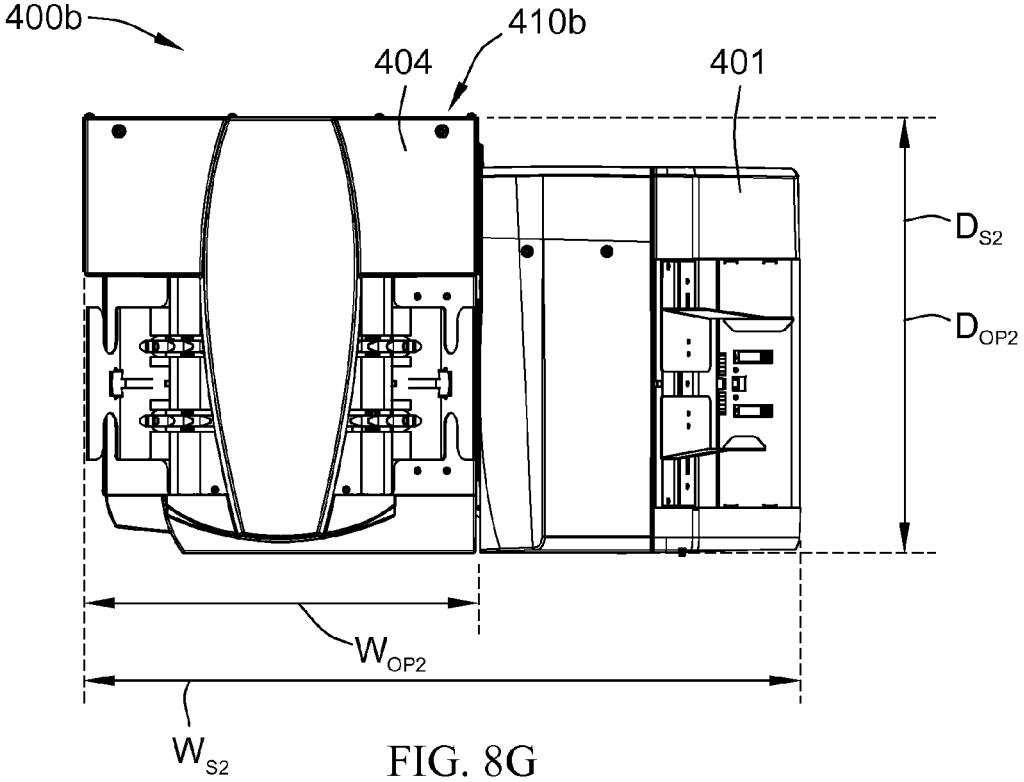
FIG. 8G is a top view of the document processing system of FIG. 8A.
Figure 9A:
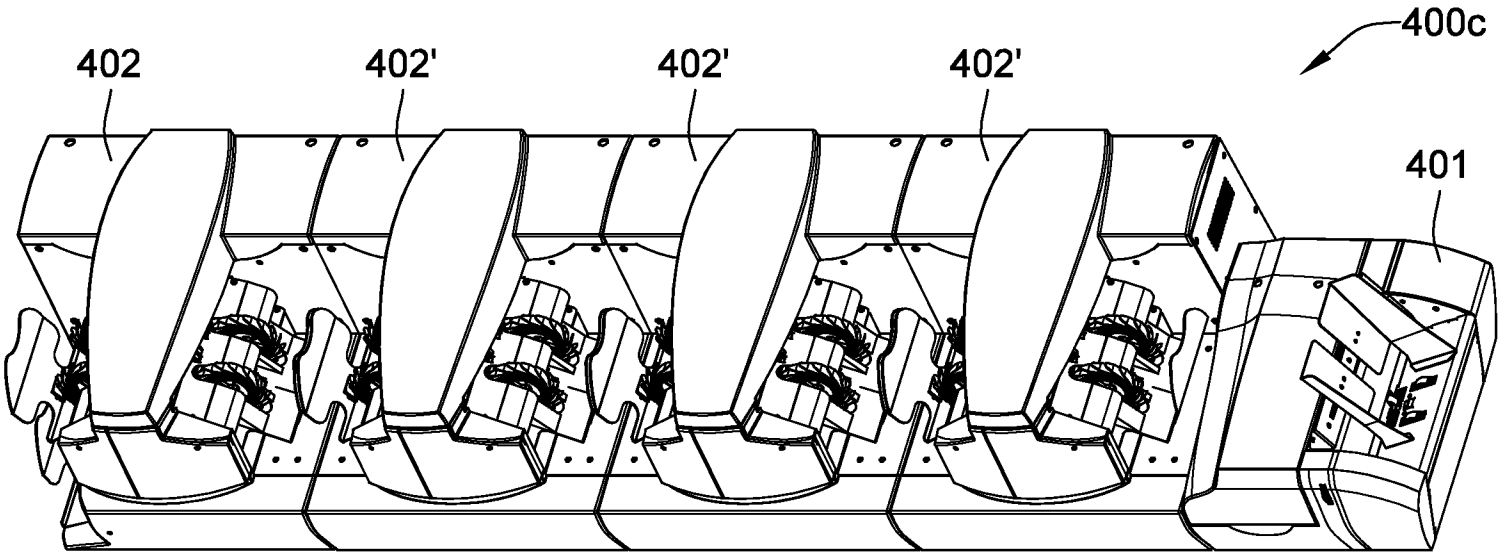
FIG. 9A is a perspective view of a first nine pocket document processing system according to some embodiments of the present disclosure.
Figure 9B:
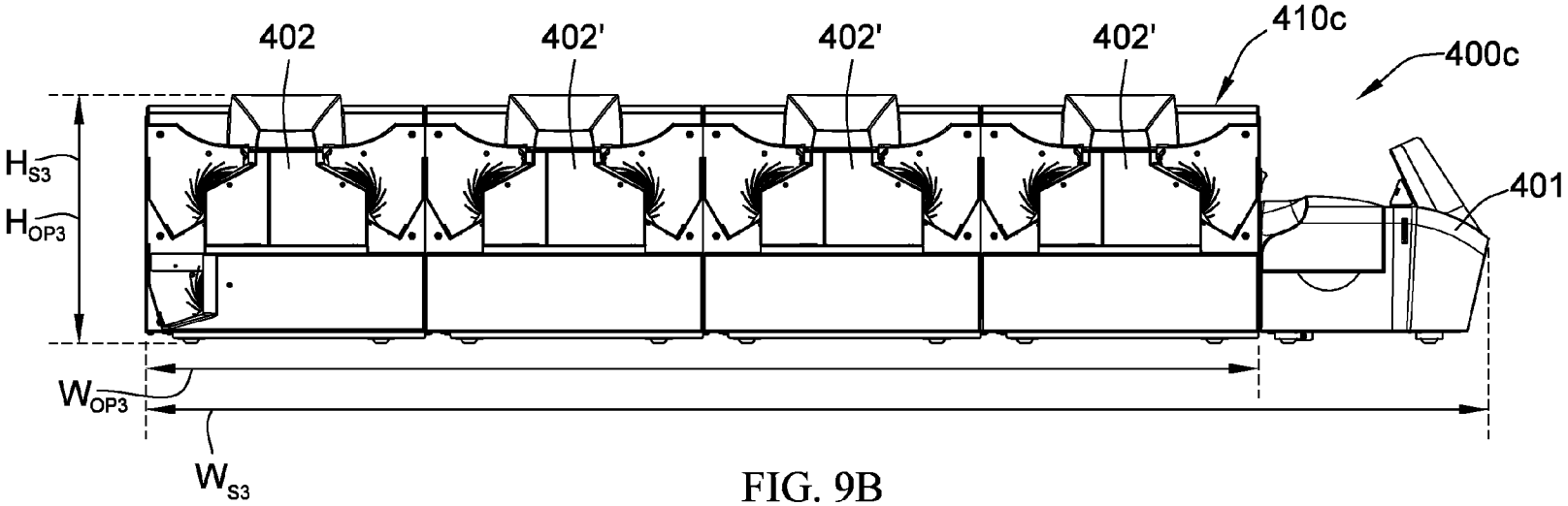
FIG. 9B is a front view of the document processing system of FIG. 9A.
Figure 9C:
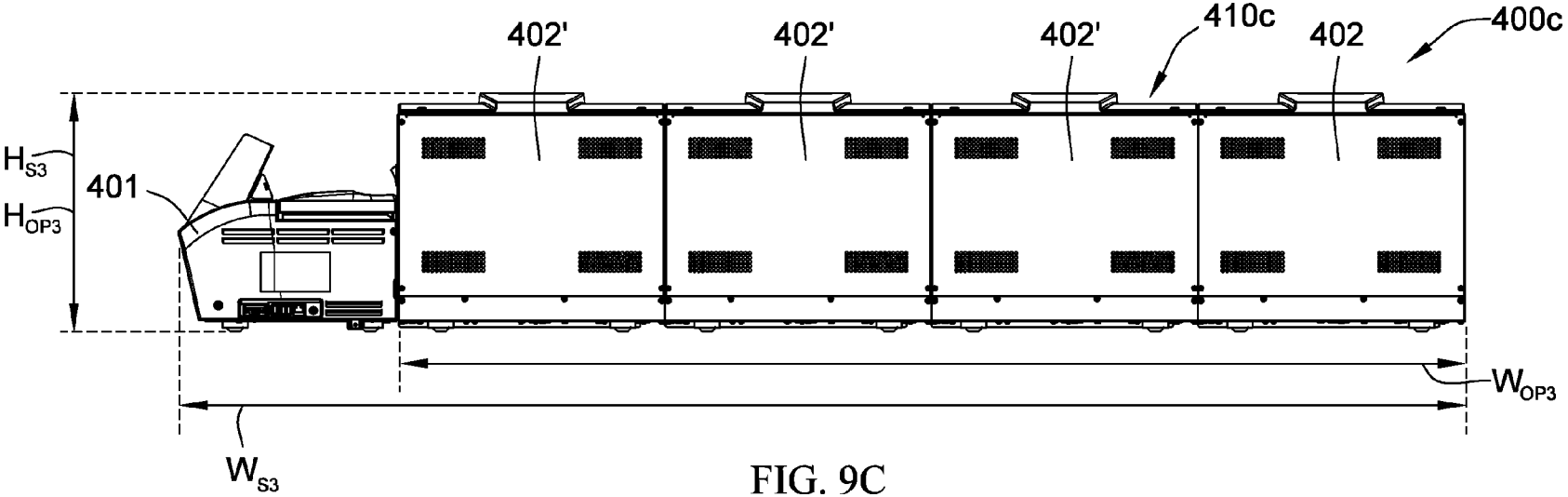
FIG. 9C is a back view of the document processing system of FIG. 9A.
Figure 9D:
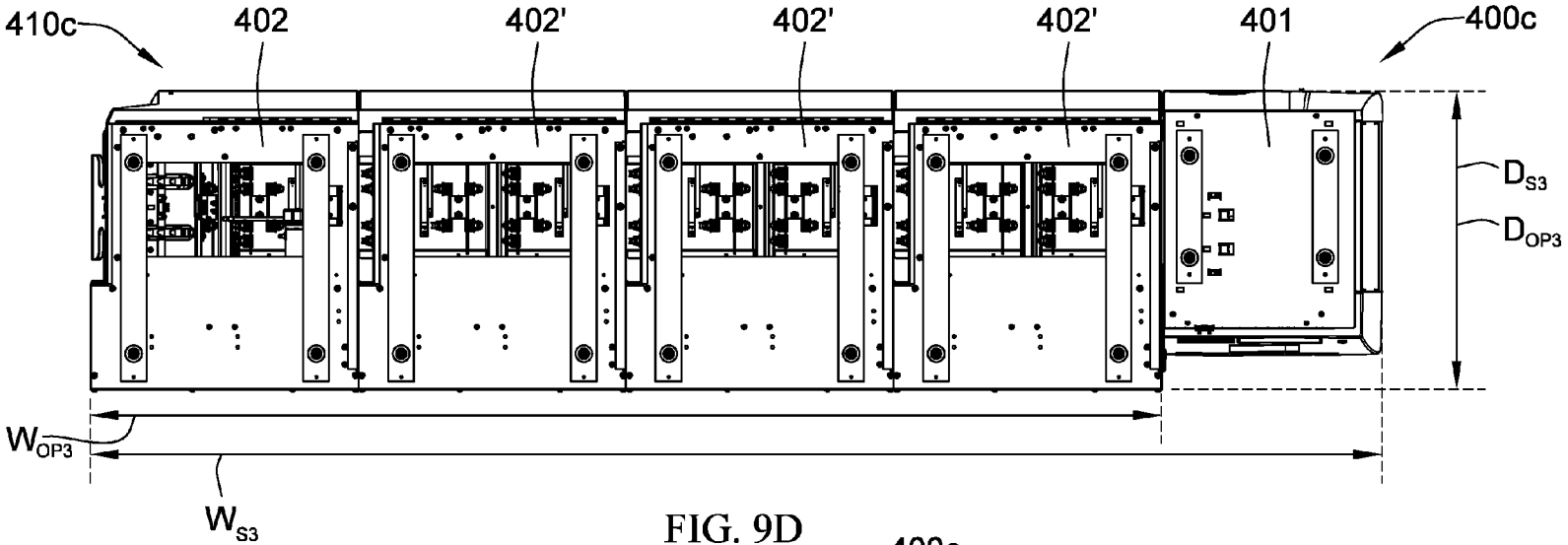
FIG. 9D is a bottom view of the document processing system of FIG. 9A.
Figure 9F:
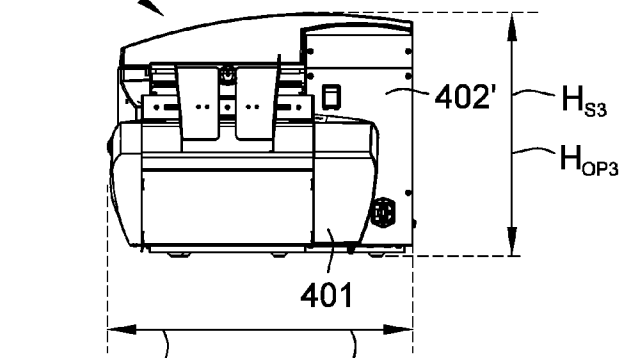
FIG. 9F is a right side view of the document processing system of FIG. 9A.
Figure 9E:
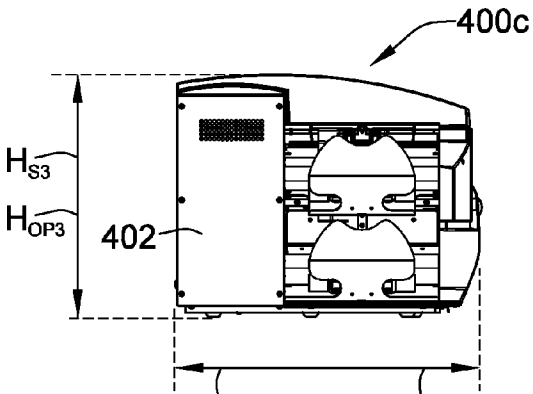
FIG. 9E is a left side view of the document processing system of FIG. 9A.
Figure 9G:
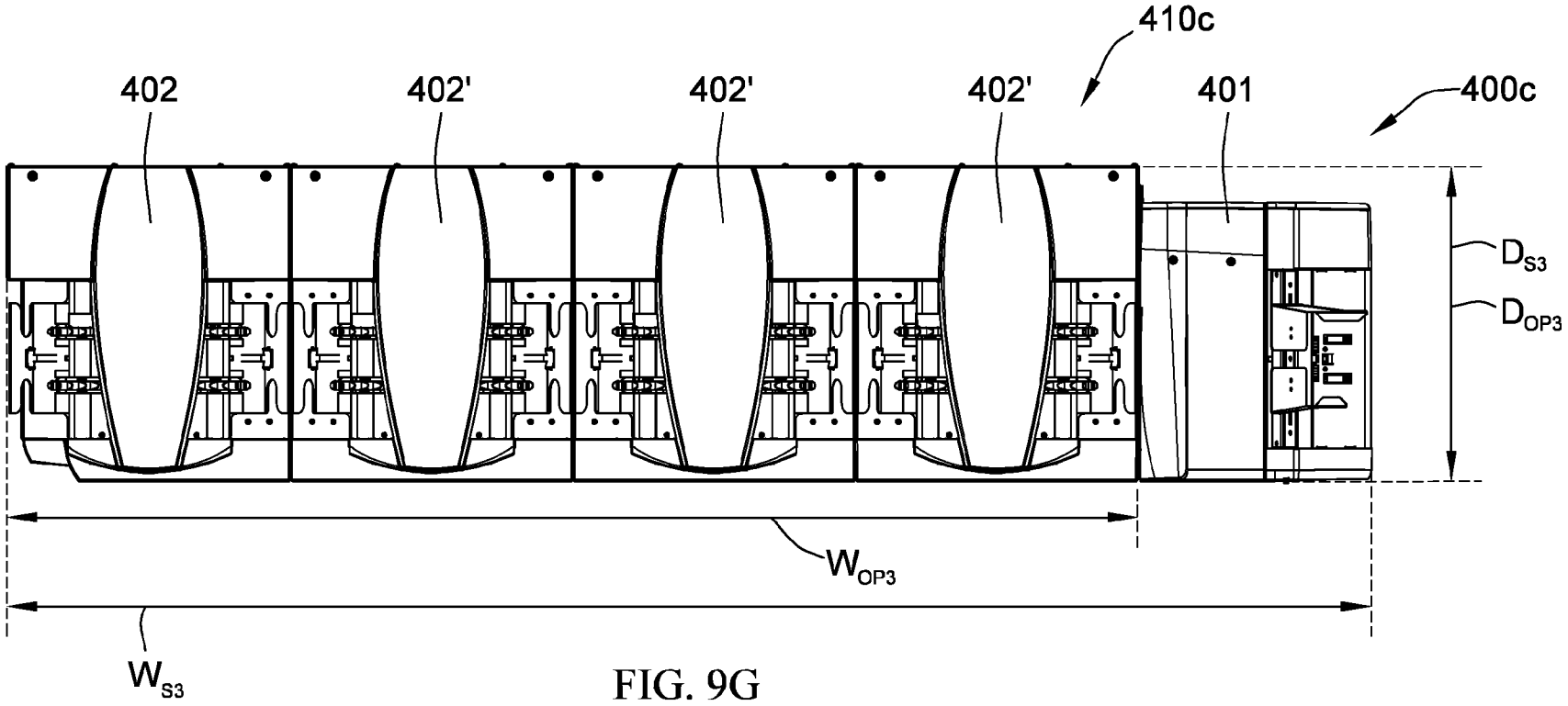
FIG. 9G is a top view of the document processing system of FIG. 9A.
Figure 10A:
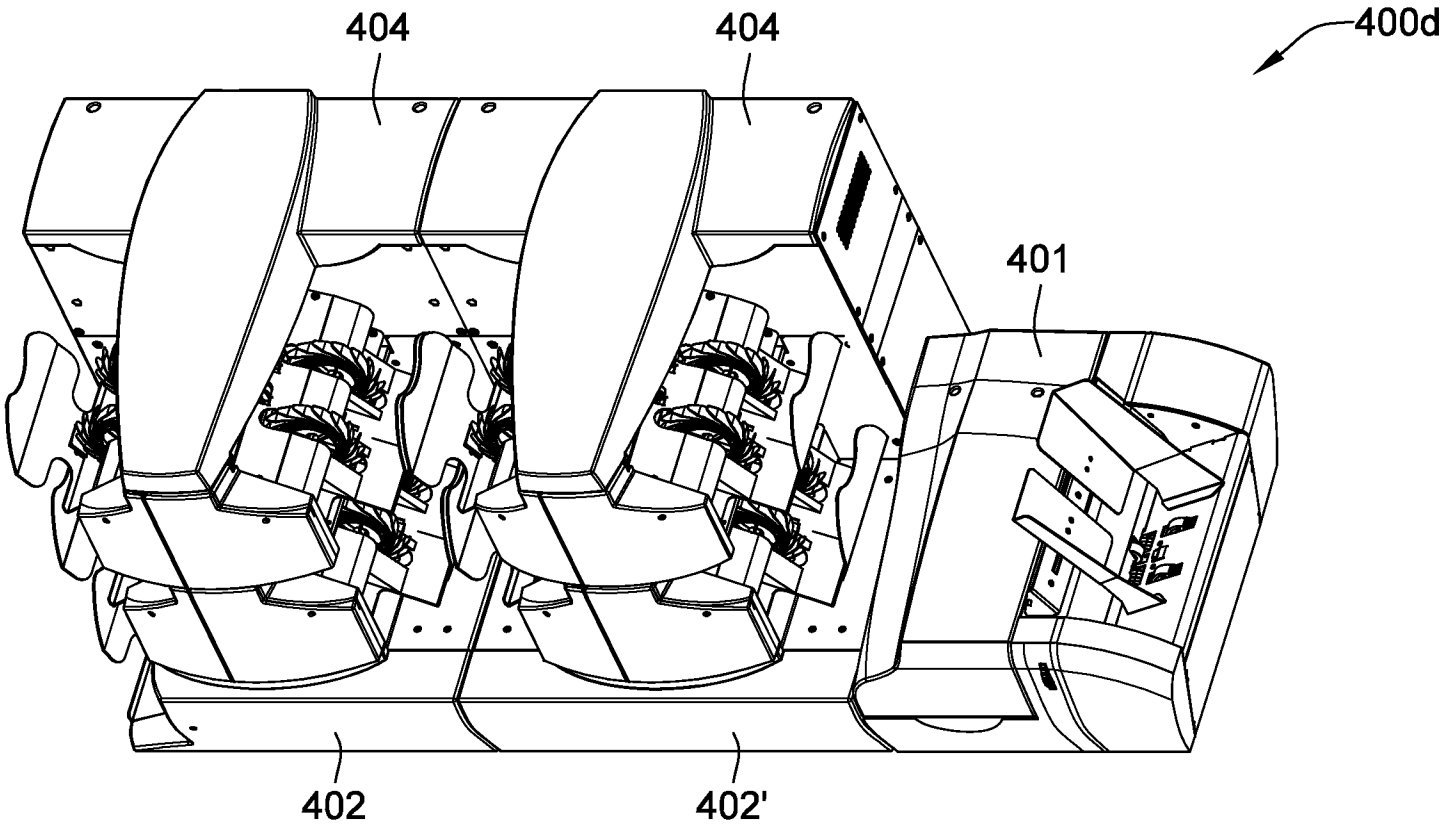
FIG. 10A is a perspective view of a second nine pocket document processing system according to some embodiments of the present disclosure.
Figure 10B:
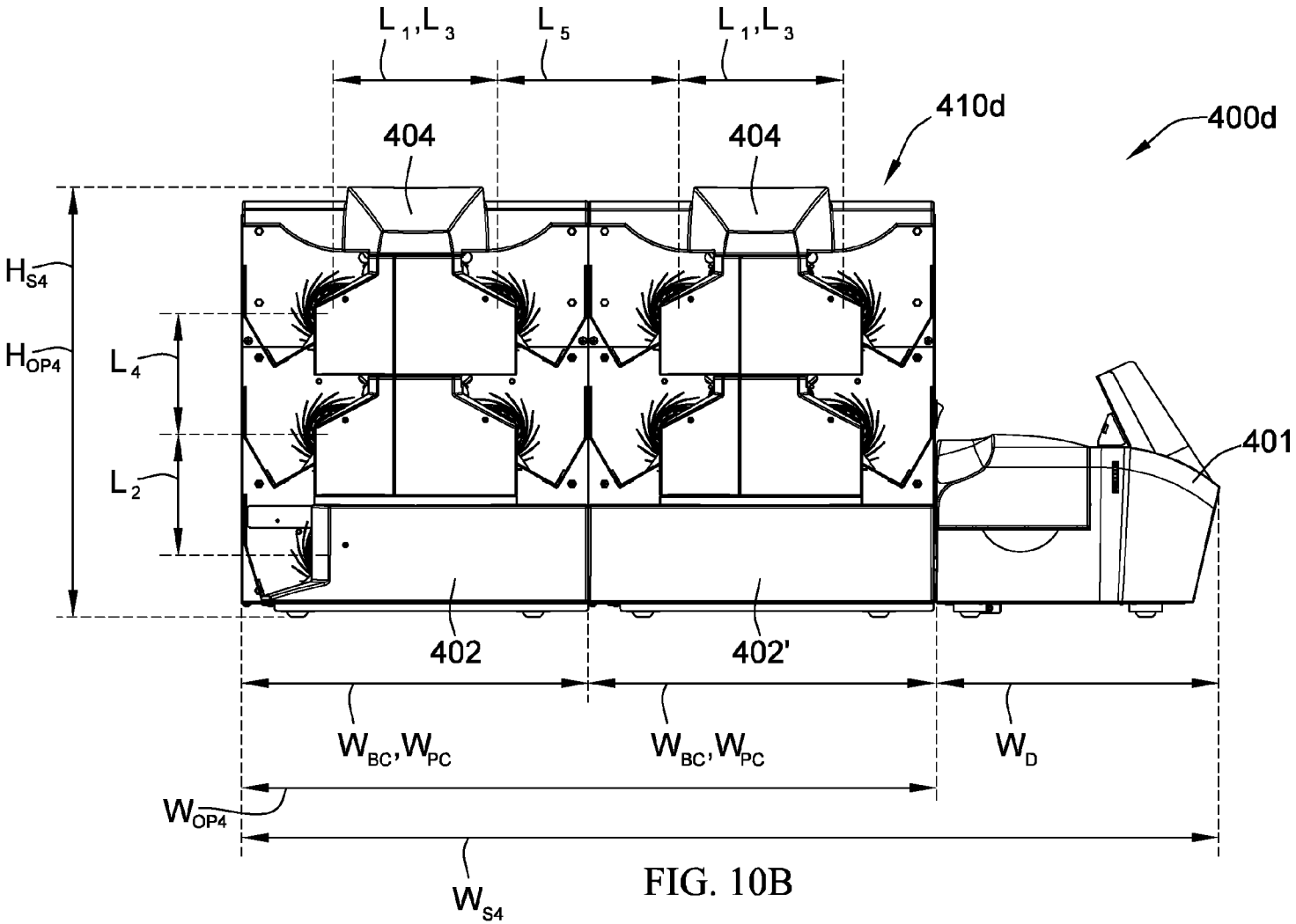
FIG. 10B is a front view of the document processing system of FIG. 10A.
Figure 10C:
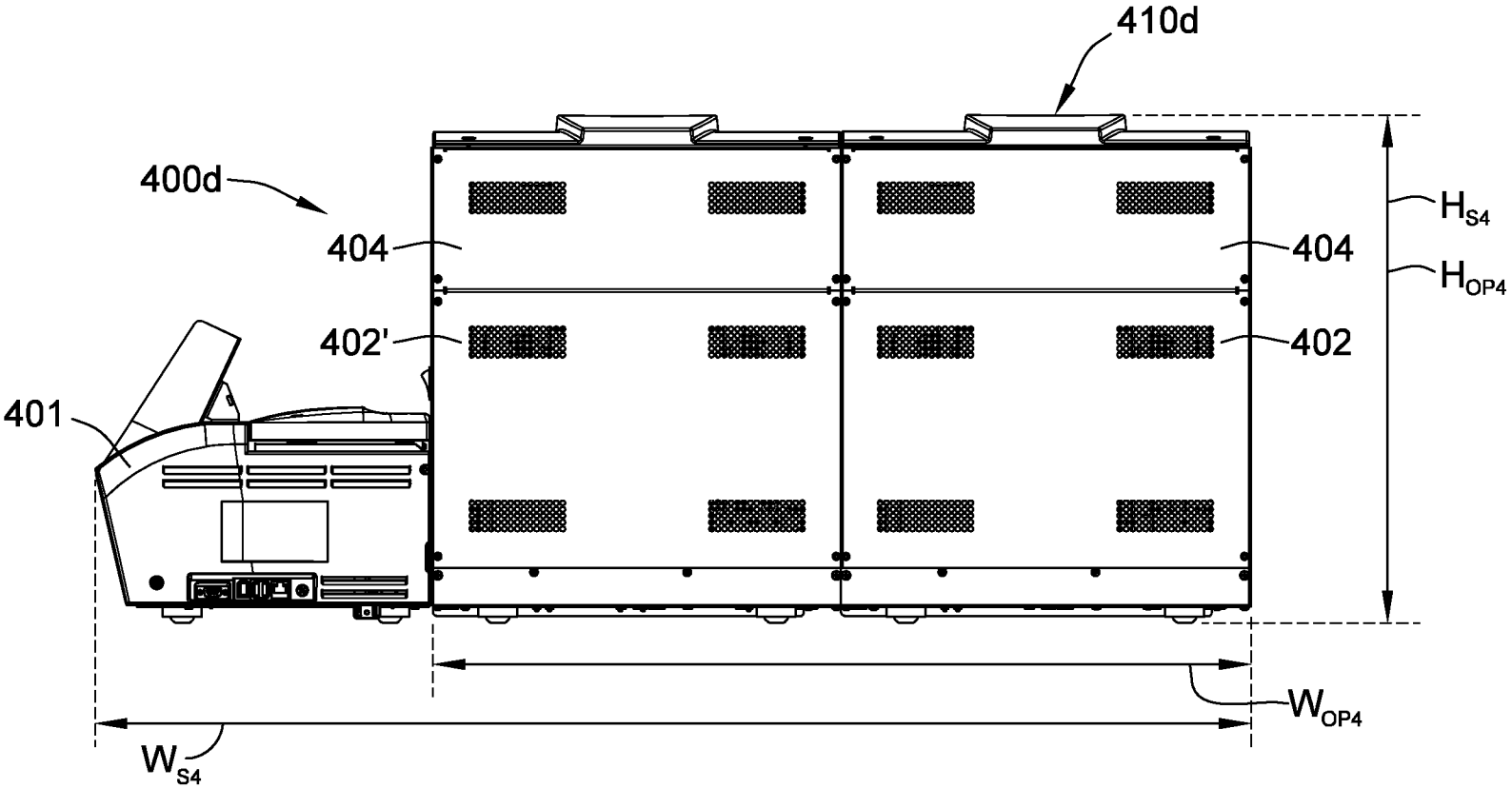
FIG. 10C is a back view of the document processing system of FIG. 10A.
Figure 10D:
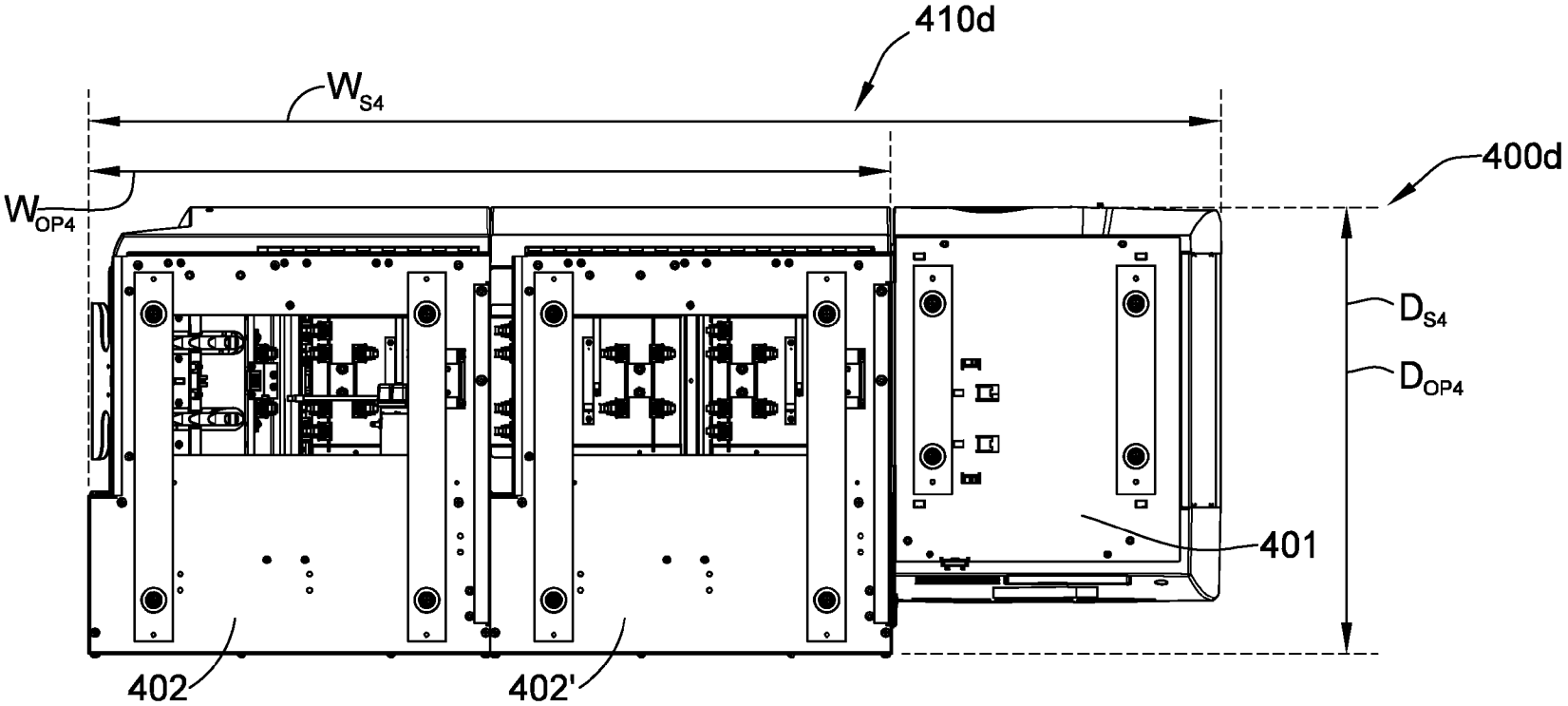
FIG. 10D is a bottom view of the document processing system of FIG. 10A.
Figure 10F:
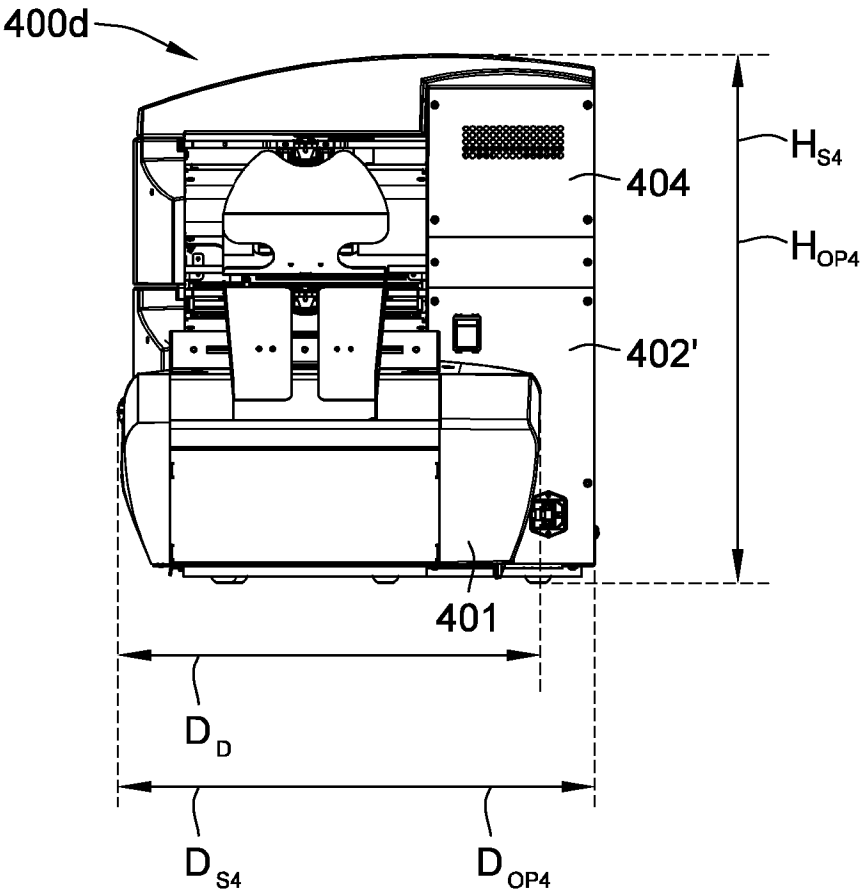
FIG. 10F is a right side view of the document processing system of FIG. 10A.
Figure 10E:
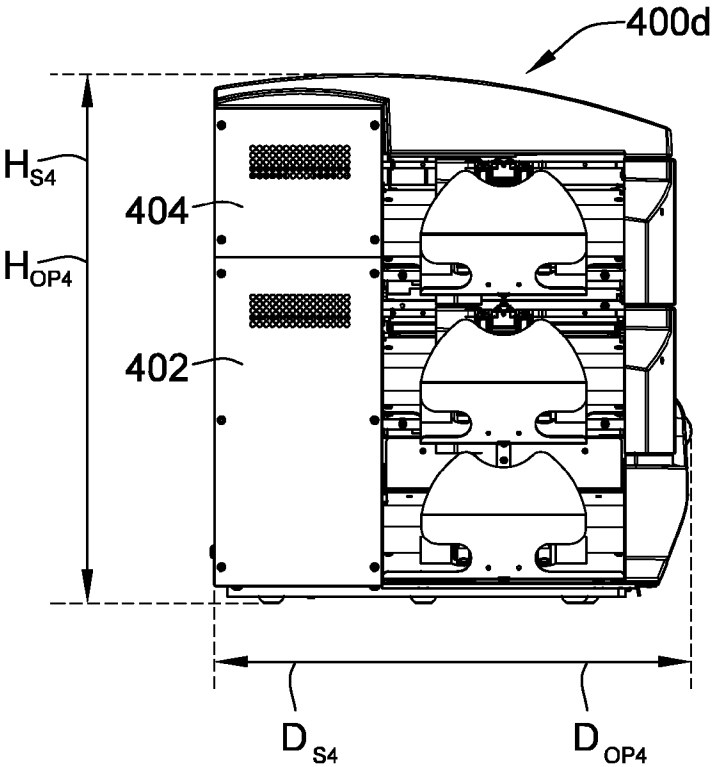
FIG. 10E is a left side view of the document processing system of FIG. 10A.
Figure 10G:
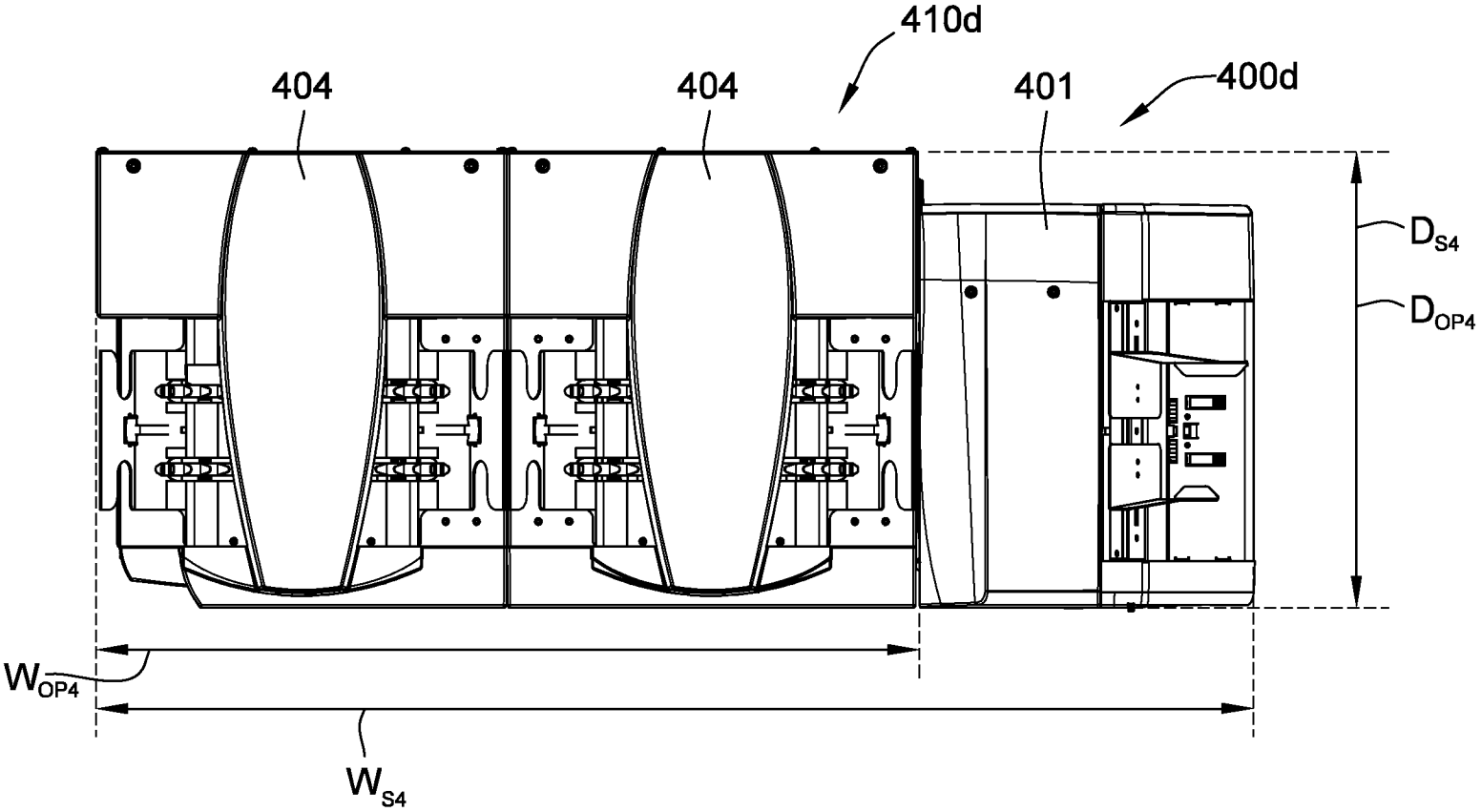
FIG. 10G is a top view of the document processing system of FIG. 10A.
Figure 11A:
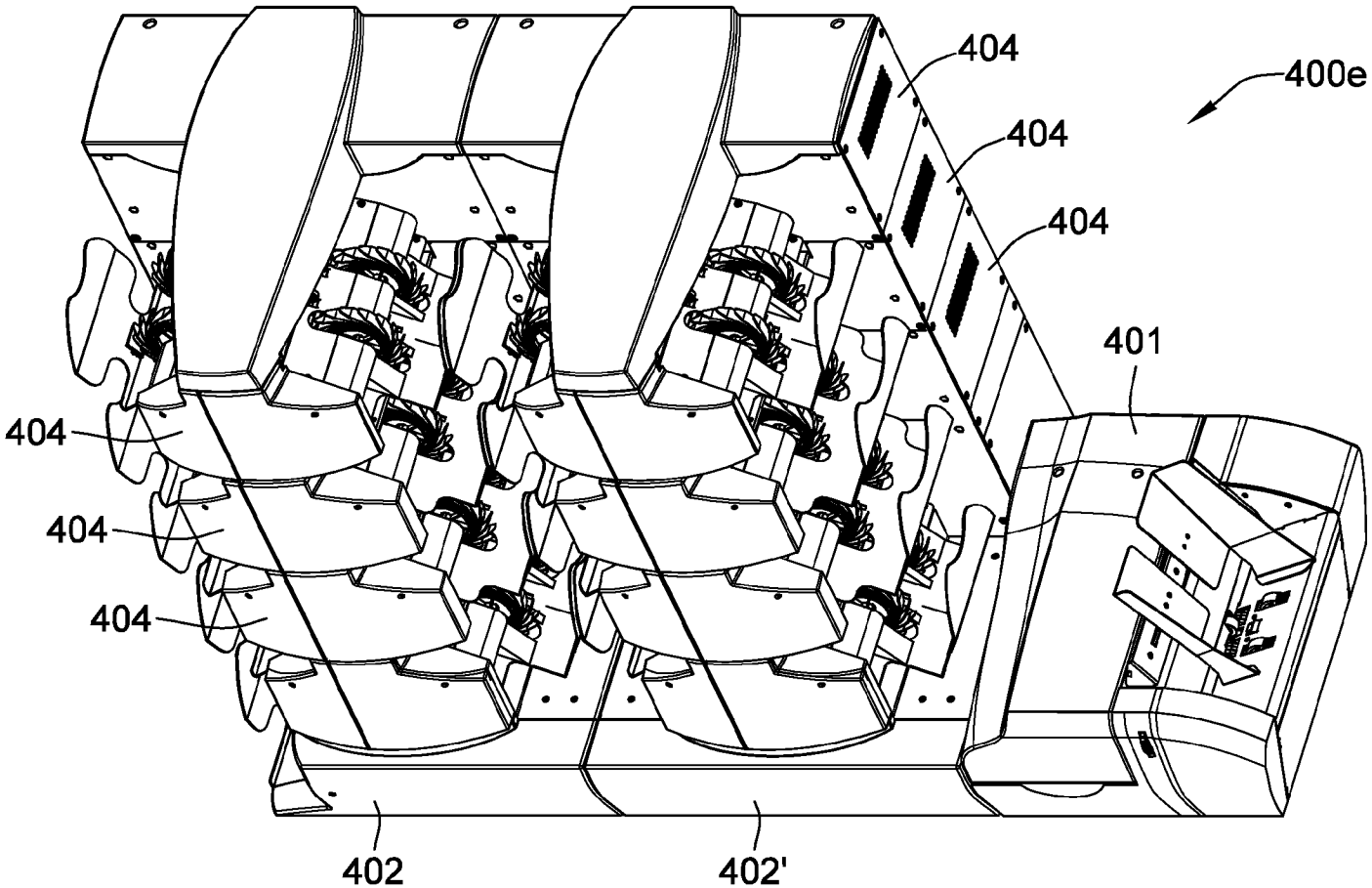
FIG. 11A is a perspective view of a seventeen pocket document processing system according to some embodiments of the present disclosure.
Figure 11B:
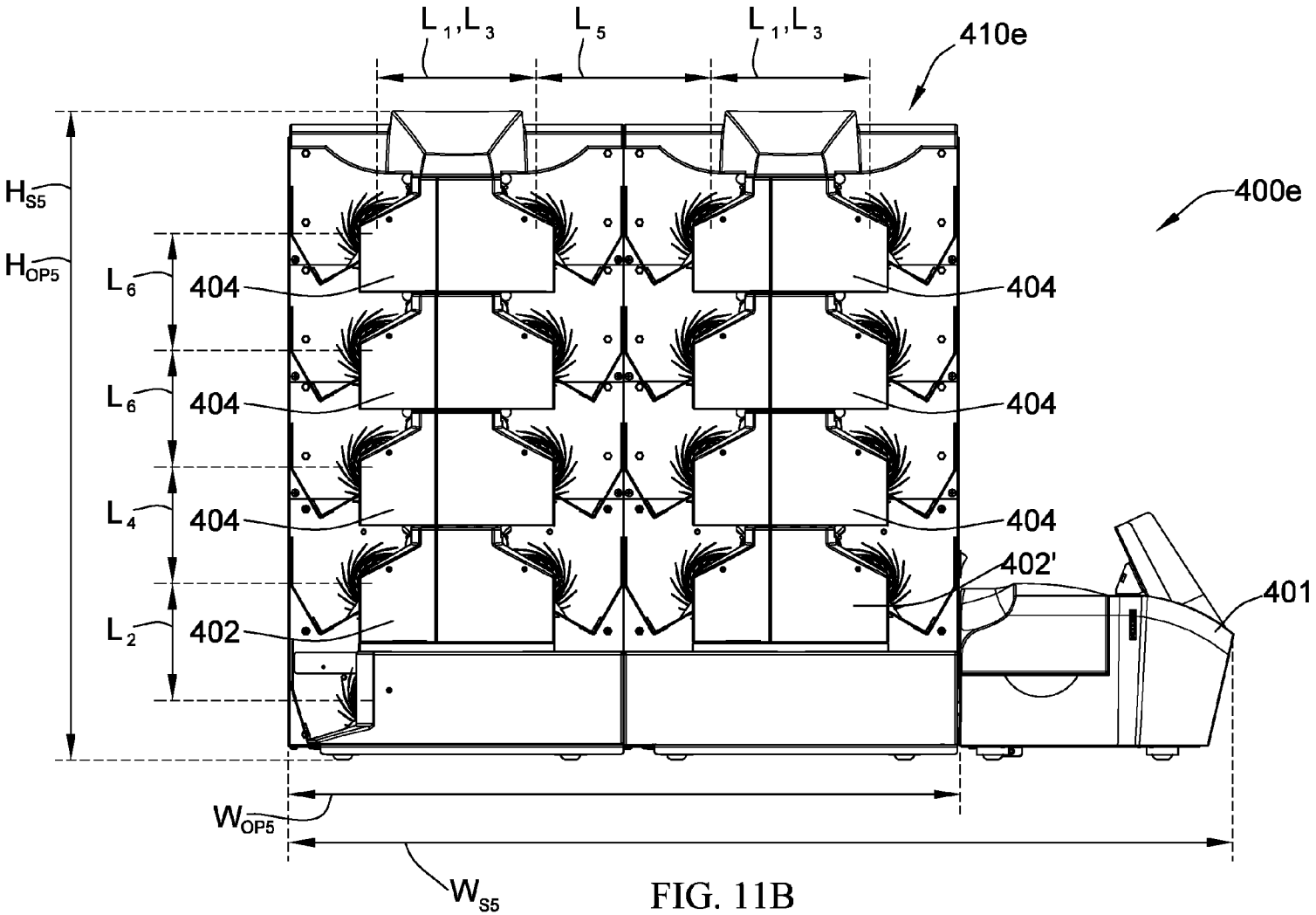
FIG. 11B is a front view of the document processing system of FIG. 11A.
Figure 11C:
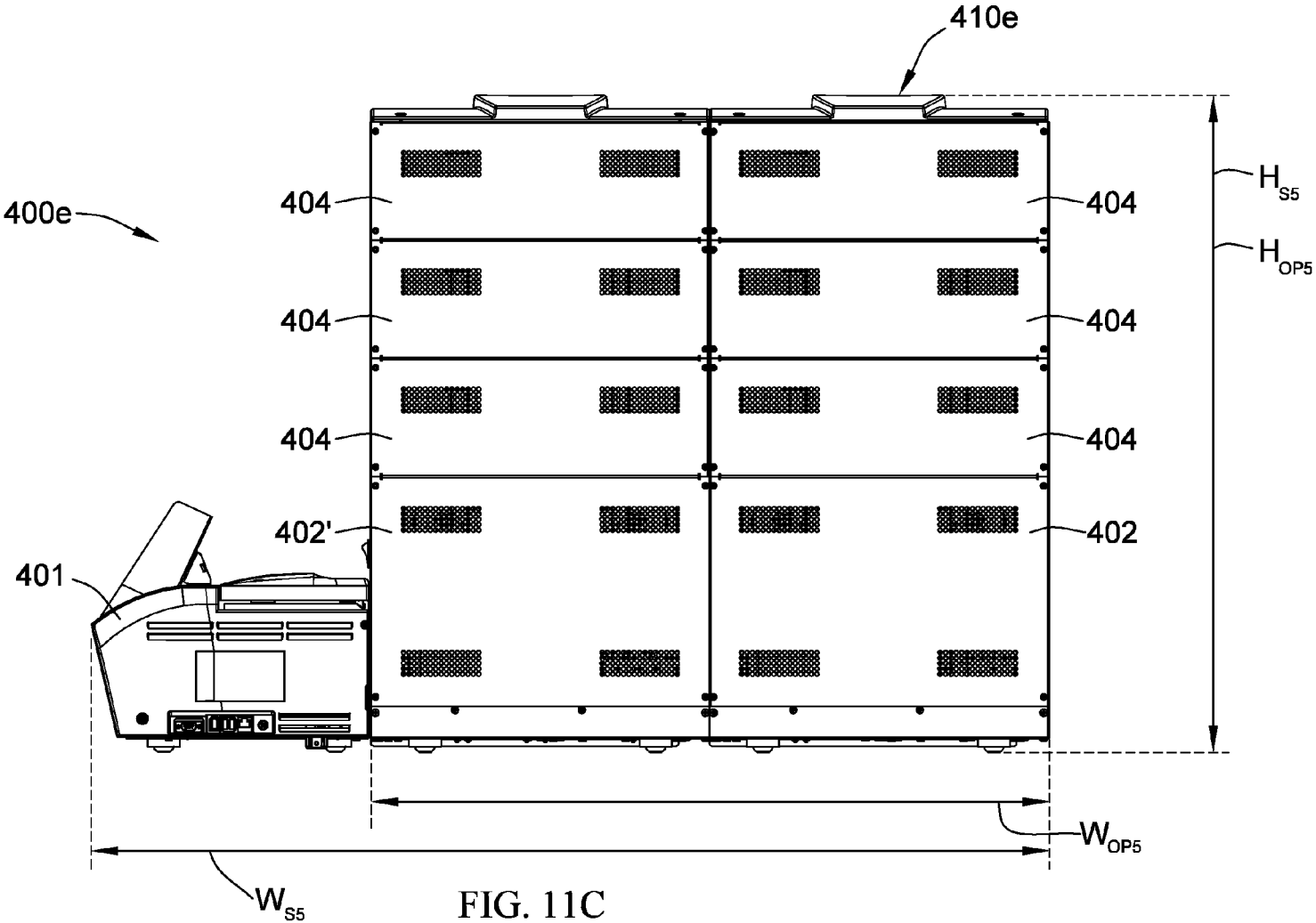
FIG. 11C is a back view of the document processing system of FIG. 11A.
Figure 11D:
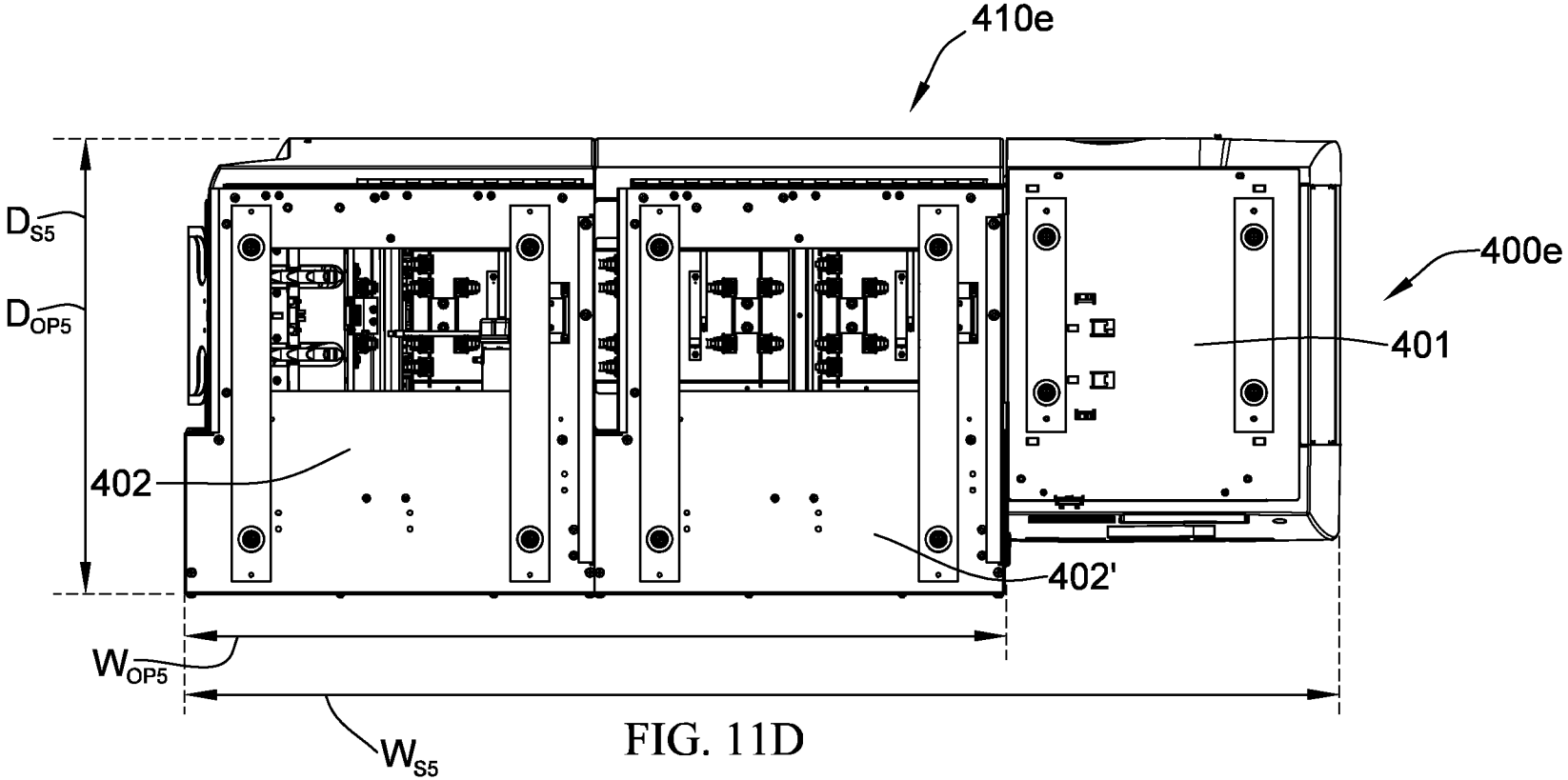
FIG. 11D is a bottom view of the document processing system of FIG. 11A.
Figure 11F:
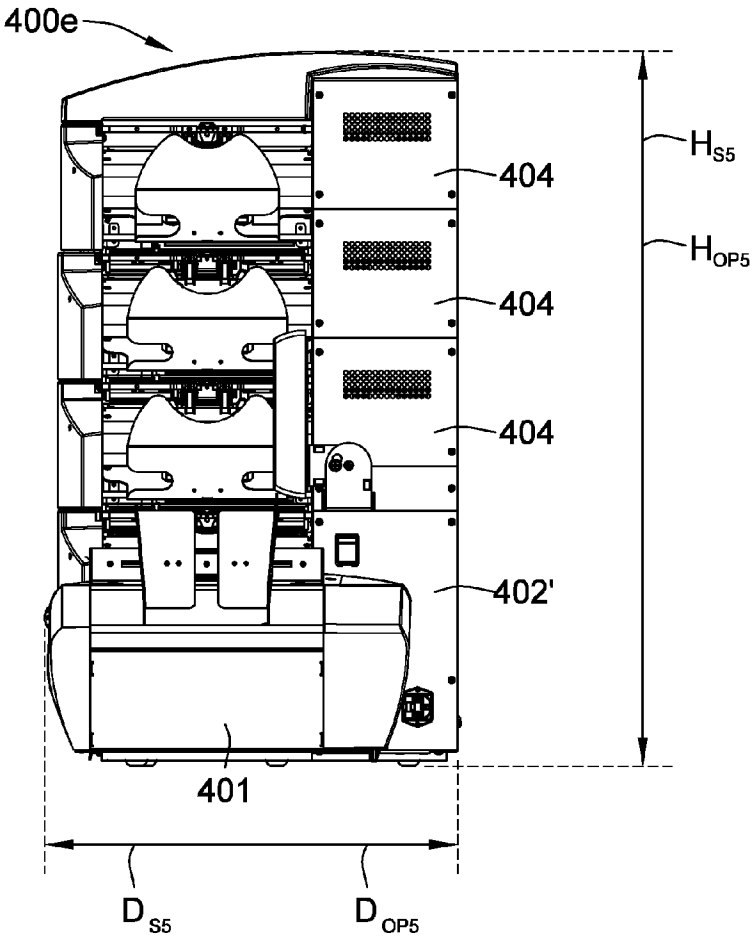
FIG. 11F is a right side view of the document processing system of FIG. 11A.
Figure 11E:
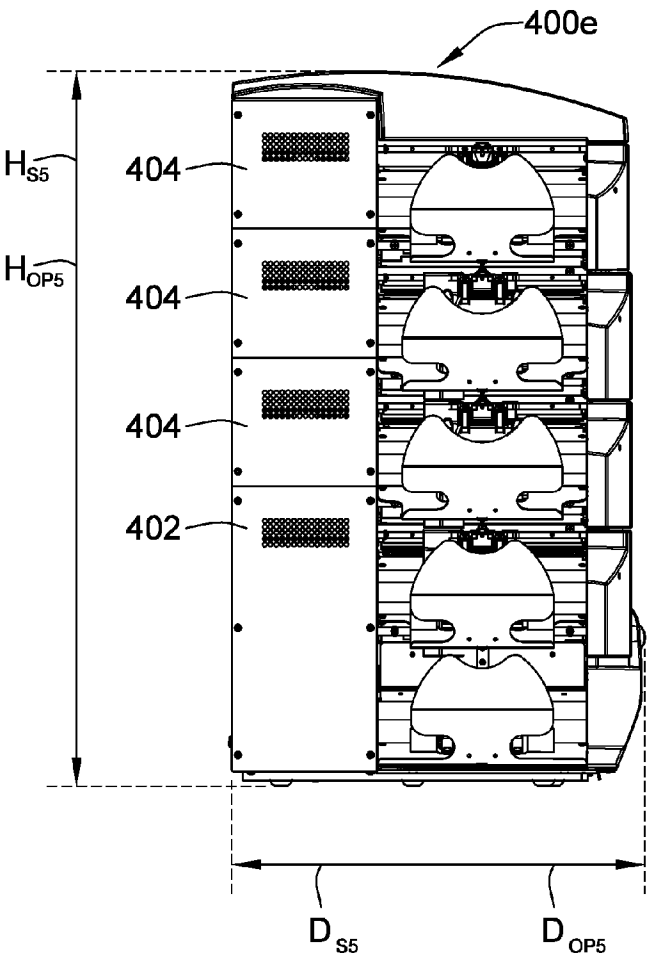
FIG. 11E is a left side view of the document processing system of FIG. 11A.
Figure 11G:
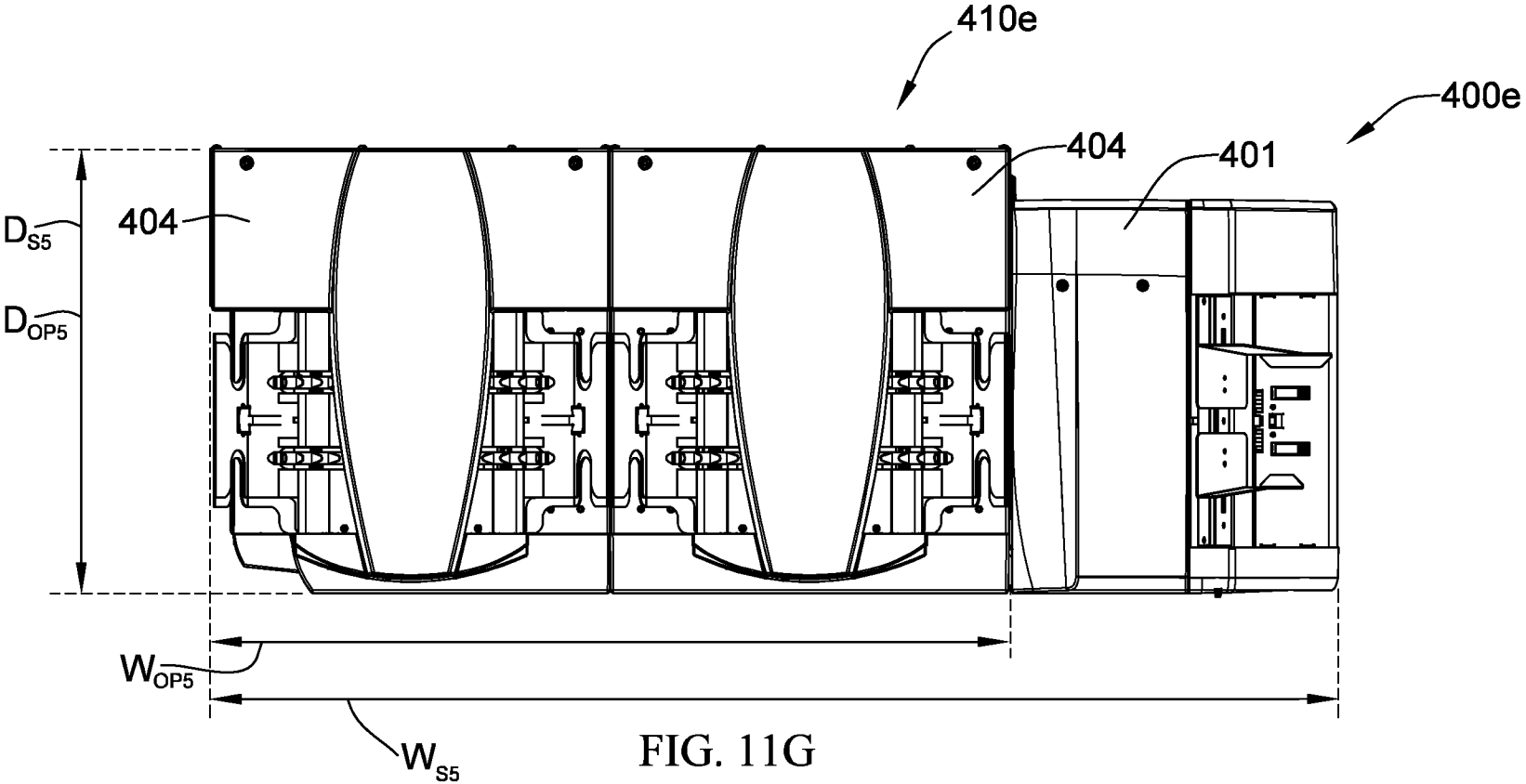
FIG. 11G is a top view of the document processing system of FIG. 11A.

Referring to FIGS. 6A-6N, a pocket module 404 is shown according to some embodiments. The pocket module 404 is the same as, or similar to, the first pocket module 104 and/or the second pocket module 105. The pocket module 404 is shown in FIGS. 6A-6G as including attached covers and in FIGS. 6H-6N without the attached covers for illustrative purposes. The pocket module 404 has a width including attached covers, $W_{PC}$, a width without attached covers, $W_P$, a depth including attached covers, $D_{PC}$, a depth without attached covers, $D_P$, a height including attached covers, $H_{PC}$, and a height without attached covers, H.

According to some embodiments, the width, $W_{PC}$, of the pocket module 404 including the attached covers is between about thirteen inches (33 cm) and about nineteen inches (49 cm). According to some embodiments, the width, $W_{PC}$, of the pocket module 404 including the attached covers is about sixteen inches (41 cm). According to some embodiments, the width, $W_P$, of the pocket module 404 without the attached covers is between about thirteen inches (33 cm) and about nineteen inches (49 cm). According to some embodiments, the width, $W_P$, of the pocket module 404 without the attached covers is about sixteen inches (41 cm). According to some embodiments, the width, $W_{PC}$, of the pocket module 404 including the attached covers is less than about nineteen inches (49 cm). According to some embodiments, the width, $W_{PC}$, of the pocket module 404 including the attached covers is less than about seventeen inches (43 cm). According to some embodiments, the width, $W_P$, of the pocket module 404 without the attached covers is less than about nineteen inches (49 cm). According to some embodiments, the width, $W_P$, of the pocket module 404 without the attached covers is less than about seventeen inches (43 cm).

According to some embodiments, the height, $H_{PC}$, of the pocket module 404 including the attached covers is between about seven inches (17 cm) and about ten inches (26 cm). According to some embodiments, the height, $H_{PC}$, of the pocket module 404 including the attached covers is about eight and a half inches (22 cm). According to some embodiments, the height, $H_P$, of the pocket module 404 without the attached covers is between about five inches (12 cm) and about seven inches (18 cm). According to some embodiments, the height, $H_P$, of the pocket module 404 without the attached covers is about six inches (15 cm). According to some embodiments, the height, $H_{PC}$, of the pocket module 404 including the attached covers is less than about ten inches (26 cm). According to some embodiments, the height, $H_{PC}$, of the pocket module 404 including the attached covers is less than about nine inches (23 cm). According to some embodiments, the height, $H_P$, of the pocket module 404 without the attached covers is less than about seven inches (18 cm).

According to some embodiments, a depth, $D_{PC}$, of the pocket module 404 including the attached covers is between about fourteen inches (35 cm) and about twenty inches (51 cm). According to some embodiments, the depth, $D_{PC}$, of the pocket module 404 including the attached covers is about seventeen inches (43 cm). According to some embodiments, a depth, $D_P$, of the pocket module 404 without the attached covers is between about thirteen inches (33 cm) and about eighteen inches (46 cm). According to some embodiments, the depth, $D_P$, of the pocket module 404 without the attached covers is about fifteen and a half inches (39 cm).

According to some embodiments, a distance or length, $L_3$, between two horizontally adjacent output receptacles of the pocket module 404, such as measured between the stacker wheel shafts, is between about six inches (15 cm) and about nine inches (23 cm). According to some embodiments, the distance or length, $L_3$, is about seven and a half inches (19 cm). According to some embodiments, the distance or length, $L_3$, is substantially the same as the distance or length, $L_1$.

According to some embodiments, a faceprint of the pocket module 404 is between about 0.4 square feet ($ft^2$) and about 1.4 square feet ($ft^2$), where the faceprint of the pocket module 404 is defined as the width, $W_{PC,P}$, multiplied by the height, $H_{PC,P}$, of the pocket module 404 ($W_{PC,P} \times H_{PC,P}$). According to some embodiments, the faceprint of the pocket module 404 without the attached covers is about 0.6 square feet ($ft^2$). According to some embodiments, the faceprint of the pocket module 404 including the attached covers is about 0.9 square feet ($ft^2$). According to some embodiments, the faceprint of the pocket module 404 including the attached covers is less than about 1.4 square feet ($ft^2$). According to some embodiments, the faceprint of the pocket module 404 without the covers is less than about 1.4 square feet ($ft^2$). According to some embodiments, the faceprint of the pocket module 404 without the covers is less than about 1 square feet ($ft^2$).

According to some embodiments, the pocket module 404 has a footprint of less than about three square feet, where the footprint of the pocket module 404 is defined as the width, $W_{PC,P}$, multiplied by the depth, $D_{PC,P}$, of the pocket module 404 ($W_{PC,P} \times D_{PC,P}$). According to some embodiments, the pocket module 404 has a footprint of less than about two square feet. According to some embodiments, the pocket module 404 has a footprint of less than one square foot. According to some embodiments, the pocket module 404 has a footprint of about 1.7 square feet. According to some embodiments, a footprint of the pocket module 404 is between about three square feet ($ft^2$) and about one square feet ($ft^2$).

According to some embodiments, the pocket module 404 has a volume of less than about two and a half cubic feet, where the volume is defined as the width, $W_{PC,P}$, multiplied by the height, $H_{PC,P}$, multiplied by the depth, $D_{PC,P}$, of the pocket module 404 ($W_{PC,P} \times H_{PC,P} \times D_{PC,P}$). According to some embodiments, the pocket module 404 has a volume of less than about one and a half cubic feet. According to some embodiments, the pocket module 404 has a volume of less than about one half cubic feet. According to some embodiments, the pocket module 404 has a volume of about 0.8 cubic feet. According to some embodiments, a volume of the pocket module 404 is between about two and a half cubic feet ($ft^3$) and about one cubic feet ($ft^3$).

According to some embodiments, the pocket module 404 has a pocket density between about 1.5 pockets/square foot of faceprint and about 4.5 pockets/square foot of faceprint. According to some embodiments, the pocket module 404 has a pocket density of about 3.3 pockets/square foot of faceprint. According to some embodiments, the pocket module 404 has a pocket density between about 0.7 pockets/square foot of footprint and about 1.7 pockets/square foot of footprint. According to some embodiments, the pocket module 404 has a pocket density of about 1.2 pockets/square foot of footprint. According to some embodiments, the pocket module 404 has a pocket density between about 0.9 pockets/cubic foot of volume and about 4.1 pockets/cubic foot of volume. According to some embodiments, the pocket module 404 has a pocket density of about 2.6 pockets/cubic foot of volume.

According to some embodiments, the pocket module 404 has a width, $W_{PC,P}$, less than about nineteen inches, a depth, $D_{PC,P}$, less than about twenty inches, and a height, $H_{PC,P}$, less than about ten inches. According to some embodiments, the pocket module 404 has a width, $W_{PC}$, of about 15.9 inches, a depth, $D_{PC}$, of about 17.1 inches, and a height, $H_{PC}$, of about 8.5 inches. According to some embodiments, the pocket module 404 has a pocket density greater than about 1.5 pockets/square foot of faceprint, greater than about 0.7 pockets/square foot of footprint, and greater than about 0.9 pockets/cubic foot of volume.

Referring to FIGS. 7A-7G, a document processing system 400*a* is shown according to some embodiments. The document processing system 400*a* includes the document processing device 401 illustrated and described in reference to FIGS. 4A-4G and an output portion 410*a*. The output portion 410*a* of the document processing system 400*a*, as shown in FIGS. 7A-7G, includes the base module 402 illustrated and described in reference to FIGS. 5A-5N. That is, the document processing system 400*a* includes a document processing device 401 coupled to the output portion 410*a*, where the output portion 410*a* includes one or more modules (e.g., a base module). The document processing system 400*a* includes three output receptacles or three pockets. The document processing system 400*a* has a system width, $W_{S1}$, a system depth, $D_{S1}$, and a system height, $H_{S1}$. The output portion 410*a* has a width, $W_{OP1}$, a depth, $D_{OP1}$, and a height, $H_{OP1}$, where the width, $W_{OP1}$, is the same as the width, $W_{BC}$, or the width, $W_B$, of the base portion 402 described above, the depth, $D_{OP1}$, is the same as the system depth, $D_{S1}$, and the height, $H_{OP1}$, is the same as the system height, $H_{S1}$.

According to some embodiments, the system width, $W_{S1}$, of the document processing system 400*a* is between about twenty-five inches and about thirty-three inches. According to some embodiments, the system width, $W_{S1}$, of the document processing system 400*a* is about twenty-nine inches.

According to some embodiments, the system height, $H_{S1}$, of the document processing system 400*a* is between about eleven inches and about seventeen inches. According to some embodiments, the system height, $H_{S1}$, of the document processing system 400*a* is about fourteen inches.

According to some embodiments, a system depth, $D_{S1}$, of the document processing system 400*a* is between about fifteen inches and about twenty inches. According to some embodiments, the system depth, $D_{S1}$, of the document processing system 400*a* is about seventeen and a half inches.

According to some embodiments, a faceprint of the document processing system 400*a* is between about 1.9 square feet ($ft^2$) and about 3.9 square feet ($ft^2$), where the faceprint of the document processing system 400*a* is defined as the system width, $W_{S1}$, multiplied by the system height, $H_{S1}$, of the document processing system 400*a* ($W_{S1} \times H_{S1}$). According to some embodiments, the faceprint of the document processing system 400*a* is about 2.8 square feet ($ft^2$). According to some embodiments, the faceprint of the document processing system 400*a* is less than about 4.0 square feet ($ft^2$).

According to some embodiments, the document processing system 400*a* has a footprint of less than about five square feet, where the footprint of the document processing system 400*a* is defined as the system width, $W_{S1}$, multiplied by the system depth, $D_{S1}$, of the document processing system 400*a* ($W_{S1} \times D_{S1}$). According to some embodiments, the document processing system 400*a* has a footprint of less than about four square feet. According to some embodiments, the document processing system 400*a* has a footprint of less than two and a half square feet. According to some embodiments, the document processing system 400*a* has a footprint of about 3.5 square feet. According to some embodiments, a footprint of the document processing system 400*a* is between about five square feet ($ft^2$) and about two and a half square feet ($ft^2$).

According to some embodiments, the document processing system 400*a* has a volume of less than about six and a half cubic feet, where the volume is defined as the system width, $W_{S1}$, multiplied by the system height, $H_{S1}$, multiplied by the system depth, $D_{S1}$, of the document processing system 400*a* ($W_{S1} \times H_{S1} \times D_{S1}$). According to some embodiments, the document processing system 400*a* has a volume of less than about five cubic feet. According to some embodiments, the document processing system 400*a* has a volume of less than about three and a half cubic feet. According to some embodiments, the document processing system 400*a* has a volume of less than about two and a half cubic feet. According to some embodiments, the document processing system 400*a* has a volume of about 4.1 cubic feet. According to some embodiments, a volume of the document processing system 400*a* is between about six and a half cubic feet ($ft^3$) and about two and a half cubic feet ($ft^3$).

According to some embodiments, the document processing system 400*a* has a pocket density between about 0.8 pockets/square foot of faceprint and about 1.6 pockets/square foot of faceprint. According to some embodiments, the document processing system 400*a* has a pocket density of about 1.1 pockets/square foot of faceprint. According to some embodiments, the document processing system 400*a* has a pocket density between about 0.6 pockets/square foot of footprint and about 1.2 pockets/square foot of footprint. According to some embodiments, the document processing system 400*a* has a pocket density of about 0.9 pockets/square foot of footprint. According to some embodiments, the document processing system 400*a* has a pocket density between about 0.4 pockets/cubic foot of volume and about 1.3 pockets/cubic foot of volume. According to some embodiments, the document processing system 400*a* has a pocket density of about 0.7 pockets/cubic foot of volume.

According to some embodiments, the document processing system 400*a* has a width, $W_{S1}$, less than about thirty-three inches, a depth, $D_{S1}$, less than about twenty inches, and a height, $H_{S1}$, less than about seventeen inches. According to some embodiments, the document processing system 400*a* has a width, $W_{S1}$, of about 28.8 inches, a depth, $D_{S1}$, of about 17.6 inches, and a height, $H_{S1}$, of about 14.1 inches. According to some embodiments, the document processing system 400*a* has a pocket density greater than about 0.7 pockets/square foot of faceprint, greater than about 0.6 pockets/square foot of footprint, and greater than about 0.4 pockets/cubic foot of volume.

Referring to FIGS. 8A-8G, a document processing system 400*b* is shown according to some embodiments. The document processing system 400*b* includes the document processing device 401 illustrated and described in reference to FIGS. 4A-4G and an output portion 410*b*. The output portion 410*b* of the document processing system 400*b*, as shown in FIGS. 8A-8G, includes the base module 402 illustrated and described in reference to FIGS. 5A-5N and the pocket module 404 illustrated and described in reference to FIGS. 6A-6N. That is, the document processing system 400*b* includes a document processing device 401 coupled to the output portion 410*b*, where the output portion 410*b* includes one or more modules (e.g., a base module and a pocket module). The document processing system 400*b* includes five output receptacles or five pockets. The document processing system 400*b* has a system width, $W_{S2}$, a system depth, $D_{S2}$, and a system height, $H_{S2}$. The output portion 410*b* has a width, $W_{OP2}$, a depth, $D_{OP2}$, and a height, $H_{OP2}$, where the width, $W_{OP2}$, is the same as the width, $W_{BC}$, or the width, $W_B$, of the base portion 402 described above, the depth, $D_{OP2}$, is the same as the system depth, $D_{S2}$, and the height, $H_{OP2}$, is the same as the system height, $H_{S2}$.

According to some embodiments, the system width, $W_{S2}$, of the document processing system 400*b* is between about twenty-five inches and about thirty-three inches. According to some embodiments, the system width, $W_{S2}$, of the document processing system 400*b* is about twenty-nine inches.

According to some embodiments, the system height, $H_{S2}$, of the document processing system 400*b* is between about seventeen inches and about twenty-three inches. According to some embodiments, the system height, $H_{S2}$, of the document processing system 400*b* is about twenty inches.

According to some embodiments, a system depth, $D_{S2}$, of the document processing system 400*b* is between about fifteen inches and about twenty inches. According to some embodiments, the system depth, $D_{S2}$, of the document processing system 400*b* is about seventeen and a half inches.

According to some embodiments, a faceprint of the document processing system 400*b* is between about 3.0 square feet ($ft^2$) and about 5.3 square feet ($ft^2$), where the faceprint of the document processing system 400*b* is defined as the system width, $W_{S2}$, multiplied by the system height, $H_{S2}$, of the document processing system 400*b* ($W_{S2} \times H_{S2}$). According to some embodiments, the faceprint of the document processing system 400*b* is about 4.0 square inches ($in^2$). According to some embodiments, the faceprint of the document processing system 400*b* is less than about 5.3 square feet ($ft^2$).

According to some embodiments, the document processing system 400*b* has a footprint of less than about five square feet, where the footprint of the document processing system 400*b* is defined as the system width, $W_{S2}$, multiplied by the system depth, $D_{S2}$, of the document processing system 400*b* ($W_{S2} \times D_{S2}$). According to some embodiments, the document processing system 400*b* has a footprint of less than about four square feet. According to some embodiments, the document processing system 400*b* has a footprint of less than two and a half square feet. According to some embodiments, the document processing system 400*b* has a footprint of about 3.5 square feet. According to some embodiments, a footprint of the document processing system 400*b* is between about five square feet ($ft^2$) and about two and a half square feet ($ft^2$).

According to some embodiments, the document processing system 400*b* has a volume of less than about nine cubic feet, where the volume is defined as the system width, $W_{S2}$, multiplied by the system height, $H_{S2}$, multiplied by the system depth, $D_{S2}$, of the document processing system 400*b* ($W_{S2} \times H_{S2} \times D_{S2}$). According to some embodiments, the document processing system 400*b* has a volume of less than about seven cubic feet. According to some embodiments, the document processing system 400*b* has a volume of less than about five cubic feet. According to some embodiments, the document processing system 400*b* has a volume of less than about three and a half cubic feet. According to some embodiments, the document processing system 400*b* has a volume of about 5.9 cubic feet. According to some embodiments, a volume of the document processing system 400*b* is between about nine cubic feet ($ft^3$) and about three and a half cubic feet ($ft^3$).

According to some embodiments, the document processing system 400*b* has a pocket density between about 0.9 pockets/square foot of faceprint and about 1.7 pockets/square foot of faceprint. According to some embodiments, the document processing system 400*b* has a pocket density of about 1.2 pockets/square foot of faceprint. According to some embodiments, the document processing system 400*b* has a pocket density between about 1.0 pockets/square foot of footprint and about 1.9 pockets/square foot of footprint. According to some embodiments, the document processing system 400*b* has a pocket density of about 1.4 pockets/square foot of footprint. According to some embodiments, the document processing system 400*b* has a pocket density between about 0.5 pockets/cubic foot of volume and about 1.4 pockets/cubic foot of volume. According to some embodiments, the document processing system 400*b* has a pocket density of about 0.9 pockets/cubic foot of volume.

According to some embodiments, the document processing system 400*b* has a width, $W_{S2}$, less than about thirty-three inches, a depth, $D_{S2}$, less than about twenty inches, and a height, $H_{S2}$, less than about twenty-three inches. According to some embodiments, the document processing system 400*b* has a width, $W_{S2}$, of about 28.8 inches, a depth, $D_{S2}$, of about 17.6 inches, and a height, $H_{S2}$, of about 19.6 inches. According to some embodiments, the document processing system 400*b* has a pocket density greater than about 0.9 pockets/square foot of faceprint, greater than about 1.0 pockets/square foot of footprint, and greater than about 0.5 pockets/cubic foot of volume.

Referring to FIGS. 9A-9G, a document processing system 400*c* is shown according to some embodiments. The document processing system 400*c* includes the document processing device 401 illustrated and described in reference to FIGS. 4A-4G and an output portion 410*c*. The output portion 410*c* of the document processing system 400*c*, as shown in FIGS. 9A-9G, includes the base module 402 (three pockets) illustrated and described in reference to FIGS. 5A-5N and three base modules 402' (two pockets each) described in reference to FIGS. 5A-5N. That is, the document processing system 400*c* includes a document processing device 401 coupled to the output portion 410*c*, where the output portion 410*c* includes one or more modules (e.g., four base modules). The document processing system 400*c* includes nine output receptacles or nine pockets. The document processing system 400*c* has a system width, $W_{S3}$, a system depth, $D_{S3}$, and a system height, $H_{S3}$. The output portion 410*c* has a width, $W_{OP3}$, a depth, $D_{OP3}$, and a height, $H_{OP3}$, where the width, $W_{OP3}$, is the same as, or substantially equal to, four times the width, $W_{BC}$, or the width, $W_B$, of the base portion 402 described above, the depth, $D_{OP3}$, is the same as the system depth, $D_{S3}$, and the height, $H_{OP3}$, is the same as the system height, $H_{S3}$.

According to some embodiments, the system width, $W_{S3}$, of the document processing system 400*c* is between about seventy inches and about eighty-two inches. According to some embodiments, the system width, $W_{S3}$, of the document processing system 400*c* is about seventy-six inches.

According to some embodiments, the system height, $H_{S3}$, of the document processing system 400*c* is between about eleven inches and about seventeen inches. According to some embodiments, the system height, $H_{S3}$, of the document processing system 400*c* is about fourteen inches.

According to some embodiments, a system depth, $D_{S3}$, of the document processing system 400*c* is between about fifteen inches and about twenty inches. According to some embodiments, the system depth, $D_{S3}$, of the document processing system 400*c* is about seventeen and a half inches.

According to some embodiments, a faceprint of the document processing system 400*c* is between about 5.3 square feet ($ft^2$) and about 9.7 square feet ($ft^2$), where the faceprint of the document processing system 400*c* is defined as the system width, $W_{S3}$, multiplied by the system height, $H_{S3}$, of the document processing system 400*c* ($W_{S3} \times H_{S3}$). According to some embodiments, the faceprint of the document processing system 400*c* is about 7.4 square feet ($ft^2$). According to some embodiments, the faceprint of the document processing system 400*c* is less than about 9.7 square feet ($ft^2$).

According to some embodiments, the document processing system 400*c* has a footprint of less than about eleven and a half square feet, where the footprint of the document processing system 400*c* is defined as the system width, $W_{S3}$, multiplied by the system depth, $D_{S3}$, of the document processing system 400*c* ($W_{S3} \times D_{S3}$). According to some embodiments, the document processing system 400*c* has a footprint of less than about ten square feet. According to some embodiments, the document processing system 400*c* has a footprint of less than seven and a quarter square feet. According to some embodiments, the document processing system 400*c* has a footprint of about 9.2 square feet. According to some embodiments, a footprint of the document processing system 400*c* is between about eleven and a half square feet ($ft^2$) and about seven and a quarter square feet ($ft^2$).

According to some embodiments, the document processing system 400*c* has a volume of less than about sixteen and a half cubic feet, where the volume is defined as the system width, $W_{S3}$, multiplied by the system height, $H_{S3}$, multiplied by the system depth, $D_{S3}$, of the document processing system 400*c* ($W_{S3} \times H_{S3} \times D_{S3}$). According to some embodiments, the document processing system 400*c* has a volume of less than about twelve cubic feet. According to some embodiments, the document processing system 400*c* has a volume of less than about eight cubic feet. According to some embodiments, the document processing system 400*c* has a volume of less than about six and a half cubic feet. According to some embodiments, the document processing system 400*c* has a volume of about 10.8 cubic feet. According to some embodiments, a volume of the document processing system 400*c* is between about sixteen and a half cubic feet ($ft^3$) and about six and a half cubic feet ($ft^3$).

According to some embodiments, the document processing system 400*c* has a pocket density between about 0.9 pockets/square foot of faceprint and about 1.7 pockets/square foot of faceprint. According to some embodiments, the document processing system 400*c* has a pocket density of about 1.2 pockets/square foot of faceprint. According to some embodiments, the document processing system 400*c* has a pocket density between about 0.8 pockets/square foot of footprint and about 1.3 pockets/square foot of footprint. According to some embodiments, the document processing system 400*c* has a pocket density of about 1.0 pockets/square foot of footprint. According to some embodiments, the document processing system 400*c* has a pocket density between about 0.5 pockets/cubic foot of volume and about 1.4 pockets/cubic foot of volume. According to some embodiments, the document processing system 400*c* has a pocket density of about 0.8 pockets/cubic foot of volume.

According to some embodiments, the document processing system 400*c* has a width, $W_{S3}$, less than about eighty-two inches, a depth, $D_{S3}$, less than about twenty inches, and a height, $H_{S3}$, less than about seventeen inches. According to some embodiments, the document processing system 400*c* has a width, $W_{S3}$, of about 76.1 inches, a depth, $D_{S3}$, of about 17.6 inches, and a height, $H_{S3}$, of about 14.1 inches. According to some embodiments, the document processing system 400*c* has a pocket density greater than about 0.9 pockets/square foot of faceprint, greater than about 0.7 pockets/square foot of footprint, and greater than about 0.5 pockets/cubic foot of volume.

Referring to FIGS. 10A-10G, a document processing system 400*d* is shown according to some embodiments. The document processing system 400*d* includes the document processing device 401 illustrated and described in reference to FIGS. 4A-4G and an output portion 410*d*. The output portion 410*d* of the document processing system 400*d*, as shown in FIGS. 10A-10G, includes the base module 402 (three pockets) illustrated and described in reference to FIGS. 5A-5N, one base module 402' (two pockets each) described in reference to FIGS. 5A-5N, and two pocket modules 404 (two pockets each) illustrated and described in reference to FIGS. 6A-6N. That is, the document processing system 400*d* includes a document processing device 401 coupled to the output portion 410*d*, where the output portion 410*d* includes one or more modules (e.g., two base modules and two pocket modules). The document processing system 400*d* includes nine output receptacles or nine pockets. The document processing system 400*d* has a system width, $W_{S4}$, a system depth, $D_{S4}$, and a system height, $H_{S4}$. The output portion 410*d* has a width, $W_{OP4}$, a depth, $D_{OP4}$, and a height, $H_{OP4}$, where the width, $W_{OP4}$, is the same as, or substantially equal to, two times the width, $W_{BC}$, or the width, $W_B$, of the base portion 402 described above, the depth, $D_{OP4}$, is the same as the system depth, $D_{S4}$, and the height, $H_{OP4}$, is the same as the system height, $H_{S4}$.

According to some embodiments, the system width, $W_{S4}$, of the document processing system 400*d* is between about forty inches and about fifty inches. According to some embodiments, the system width, $W_{S4}$, of the document processing system 400*d* is about forty-five inches.

According to some embodiments, the system height, $H_{S4}$, of the document processing system 400*d* is between about seventeen inches and about twenty-three inches. According to some embodiments, the system height, $H_{S4}$, of the document processing system 400*d* is about twenty inches.

According to some embodiments, a system depth, $D_{S4}$, of the document processing system 400*d* is between about fifteen inches and about twenty inches. According to some embodiments, the system depth, $D_{S4}$, of the document processing system 400*d* is about seventeen and a half inches.

According to some embodiments, a distance or length, $L_4$, between two vertically adjacent output receptacles of the base module 402/402' and the pocket module 404, such as measured between the stacker wheel shafts, is between about four inches and about seven inches. According to some embodiments, the distance or length, $L_4$, is about five and a half inches. According to some embodiments, the distance or length, $L_4$, is substantially the same as the distance or length, $L_2$. According to some embodiments, a distance or length, $L_5$, between two horizontally adjacent output receptacles of two separate pocket modules 404, such as measured between the stacker wheel shafts, is between about seven inches and about nine inches. According to some embodiments, the distance or length, $L_5$, is about eight and a quarter inches.

According to some embodiments, a faceprint of the document processing system 400*d* is between about 4.7 square feet ($ft^2$) and about 8.0 square feet ($ft^2$), where the faceprint of the document processing system 400*d* is defined as the system width, $W_{S4}$, multiplied by the system height, $H_{S4}$, of the document processing system 400*d* ($W_{S4} \times H_{S4}$). According to some embodiments, the faceprint of the document processing system 400*d* is about 6.3 square feet ($ft^2$). According to some embodiments, the faceprint of the document processing system 400*d* is less than about 8.0 square feet ($ft^2$).

According to some embodiments, the document processing system 400*d* has a footprint of less than about seven square feet, where the footprint of the document processing system 400*d* is defined as the system width, $W_{S4}$, multiplied by the system depth, $D_{S4}$, of the document processing system 400*d* ($W_{S4} \times D_{S4}$). According to some embodiments, the document processing system 400*d* has a footprint of less than about five and a half square feet. According to some embodiments, the document processing system 400*d* has a footprint of less than four square feet. According to some embodiments, the document processing system 400*d* has a footprint of about 5.5 square feet. According to some embodiments, a footprint of the document processing system 400*d* is between about seven square feet ($ft^2$) and about four square feet ($ft^2$).

According to some embodiments, the document processing system 400*d* has a volume of less than about thirteen and a half cubic feet, where the volume is defined as the system width, $W_{S4}$, multiplied by the system height, $H_{S4}$, multiplied by the system depth, $D_{S4}$, of the document processing system 400*d* ($W_{S4} \times H_{S4} \times D_{S4}$). According to some embodiments, the document processing system 400*d* has a volume of less than about ten cubic feet. According to some embodiments, the document processing system 400*d* has a volume of less than about eight cubic feet. According to some embodiments, the document processing system 400*d* has a volume of less than about six cubic feet. According to some embodiments, the document processing system 400*d* has a volume of about 9.1 cubic feet. According to some embodiments, a volume of the document processing system 400*d* is between about thirteen and a half cubic feet ($ft^3$) and about six cubic feet ($ft^3$).

According to some embodiments, the document processing system 400*d* has a pocket density between about 1.1 pockets/square foot of faceprint and about 1.9 pockets/square foot of faceprint. According to some embodiments, the document processing system 400*d* has a pocket density of about 1.4 pockets/square foot of faceprint. According to some embodiments, the document processing system 400*d* has a pocket density between about 1.3 pockets/square foot of footprint and about 2.2 pockets/square foot of footprint. According to some embodiments, the document processing system 400*d* has a pocket density of about 1.6 pockets/square foot of footprint. According to some embodiments, the document processing system 400*d* has a pocket density between about 0.7 pockets/cubic foot of volume and about 1.5 pockets/cubic foot of volume. According to some embodiments, the document processing system 400*d* has a pocket density of about 1.0 pockets/cubic foot of volume.

According to some embodiments, the document processing system 400*d* has a width, $W_{S4}$, less than about fifty inches, a depth, $D_{S4}$, less than about twenty inches, and a height, $H_{S4}$, less than about twenty-three inches. According to some embodiments, the document processing system 400*d* has a width, $W_{S4}$, of about 44.6 inches, a depth, $D_{S4}$, of about 17.7 inches, and a height, $H_{S4}$, of about 19.6 inches. According to some embodiments, the document processing system 400*d* has a pocket density greater than about 1.1 pockets/square foot of faceprint, greater than about 1.3 pockets/square foot of footprint, and greater than about 0.6 pockets/cubic foot of volume.

Referring to FIGS. 11A-11G, a document processing system 400*e* is shown according to some embodiments. The document processing system 400*e* includes the document processing device 401 illustrated and described in reference to FIGS. 4A-4G and an output portion 410*e*. The output portion 410*e* of the document processing system 400*e*, as shown in FIGS. 11A-11G, includes the base module 402 (three pockets) illustrated and described in reference to FIGS. 5A-5N, one base module 402' (two pockets each) described in reference to FIGS. 5A-5N, and six pocket modules 404 (two pockets each) illustrated and described in reference to FIGS. 6A-6N. That is, the document processing system 400*e* includes a document processing device 401 coupled to the output portion 410*e*, where the output portion 410*e* includes one or more modules (e.g., two base modules and six pocket modules). The document processing system 400*e* includes seventeen output receptacles or seventeen pockets. The document processing system 400*e* has a system width, $W_{S5}$, a system depth, $D_{S5}$, and a system height, $H_{S5}$. The output portion 410*e* has a width, $W_{OP5}$, a depth, $D_{OP5}$, and a height, $H_{OP5}$, where the width, $W_{OP5}$, is the same as, or substantially equal to, two times the width, $W_{BC}$, or the width, $W_B$, of the base portion 402 described above, the depth, $D_{OP5}$, is the same as the system depth, $D_{S5}$, and the height, $H_{OP5}$, is the same as the system height, $H_{S5}$.

According to some embodiments, the system width, $W_{S5}$, of the document processing system 400*e* is between about forty inches and about fifty inches. According to some embodiments, the system width, $W_{S5}$, of the document processing system 400*e* is about forty-five inches.

According to some embodiments, the system height, $H_{S5}$, of the document processing system 400*e* is between about twenty-eight inches and about thirty-four inches. According to some embodiments, the system height, $H_{S5}$, of the document processing system 400*e* is about thirty-one inches.

According to some embodiments, a system depth, $D_{S5}$, of the document processing system 400*e* is between about fifteen inches and about twenty inches. According to some embodiments, the system depth, $D_{S5}$, of the document processing system 400*e* is about seventeen and a half inches.

According to some embodiments, a distance or length, $L_6$, between two vertically adjacent output receptacles of two separate pocket modules 404, such as measured between the stacker wheel shafts, is between about four inches and about seven inches. According to some embodiments, the distance or length, $L_6$, is about five and a half inches. According to some embodiments, the distance or length, $L_6$, is substantially the same as the distance or length, $L_4$, and as the distance or length, $L_3$.

According to some embodiments, a faceprint of the document processing system 400*e* is between about 7.7 square feet ($ft^2$) and about 11.8 square feet ($ft^2$), where the faceprint of the document processing system 400*e* is defined as the system width, $W_{S5}$, multiplied by the system height, $H_{S5}$, of the document processing system 400*e* ($W_{S5} \times H_{S5}$). According to some embodiments, the faceprint of the document processing system 400*e* is about 9.7 square feet ($ft^2$). According to some embodiments, the faceprint of the document processing system 400*e* is less than about 11.8 square feet ($ft^2$).

According to some embodiments, the document processing system 400*e* has a footprint of less than about seven square feet, where the footprint of the document processing system 400*e* is defined as the system width, $W_{S5}$, multiplied by the system depth, $D_{S5}$, of the document processing system 400*e* ($W_{S5} \times D_{S5}$). According to some embodiments, the document processing system 400*e* has a footprint of less than about five and a half square feet. According to some embodiments, the document processing system 400*e* has a footprint of less than four square feet. According to some embodiments, the document processing system 400*e* has a footprint of about 5.5 square feet. According to some embodiments, a footprint of the document processing system 400*e* is between about seven square feet ($ft^2$) and about four square feet ($ft^2$).

According to some embodiments, the document processing system 400*e* has a volume of less than about twenty cubic feet, where the volume is defined as the system width, $W_{S5}$, multiplied by the system height, $H_{S5}$, multiplied by the system depth, $D_{S5}$, of the document processing system 400*e* ($W_{S5} \times H_{S5} \times D_{S5}$). According to some embodiments, the document processing system 400*e* has a volume of less than about sixteen cubic feet. According to some embodiments, the document processing system 400*e* has a volume of less than about thirteen cubic feet. According to some embodiments, the document processing system 400*e* has a volume of less than about nine and a half cubic feet. According to some embodiments, the document processing system 400*e* has a volume of about 14.1 cubic feet. According to some embodiments, a volume of the document processing system 400*e* is between about twenty cubic feet ($ft^3$) and about nine and a half cubic feet ($ft^3$).

According to some embodiments, the document processing system 400*e* has a pocket density between about 1.4 pockets/square foot of faceprint and about 2.2 pockets/square foot of faceprint. According to some embodiments, the document processing system 400*e* has a pocket density of about 1.8 pockets/square foot of faceprint. According to some embodiments, the document processing system 400*e* has a pocket density between about 2.4 pockets/square foot of footprint and about 4.1 pockets/square foot of footprint. According to some embodiments, the document processing system 400*e* has a pocket density of about 3.1 pockets/square foot of footprint. According to some embodiments, the document processing system 400*e* has a pocket density between about 0.8 pockets/cubic foot of volume and about 1.8 pockets/cubic foot of volume. According to some embodiments, the document processing system 400*e* has a pocket density of about 1.2 pockets/cubic foot of volume.

According to some embodiments, the document processing system 400*e* has a width, $W_{S5}$, less than about fifty inches, a depth, $D_{S5}$, less than about twenty inches, and a height, $H_{S5}$, less than about thirty-four inches. According to some embodiments, the document processing system 400*e* has a width, $W_{S5}$, of about 44.6 inches, a depth, $D_{S5}$, of about 17.5 inches, and a height, $H_{S5}$, of about 30.6 inches. According to some embodiments, the document processing system 400*e* has a pocket density greater than about 1.4 pockets/square foot of faceprint, greater than about 2.4 pockets/square foot of footprint, and greater than about 0.8 pockets/cubic foot of volume.

Figure 12A:
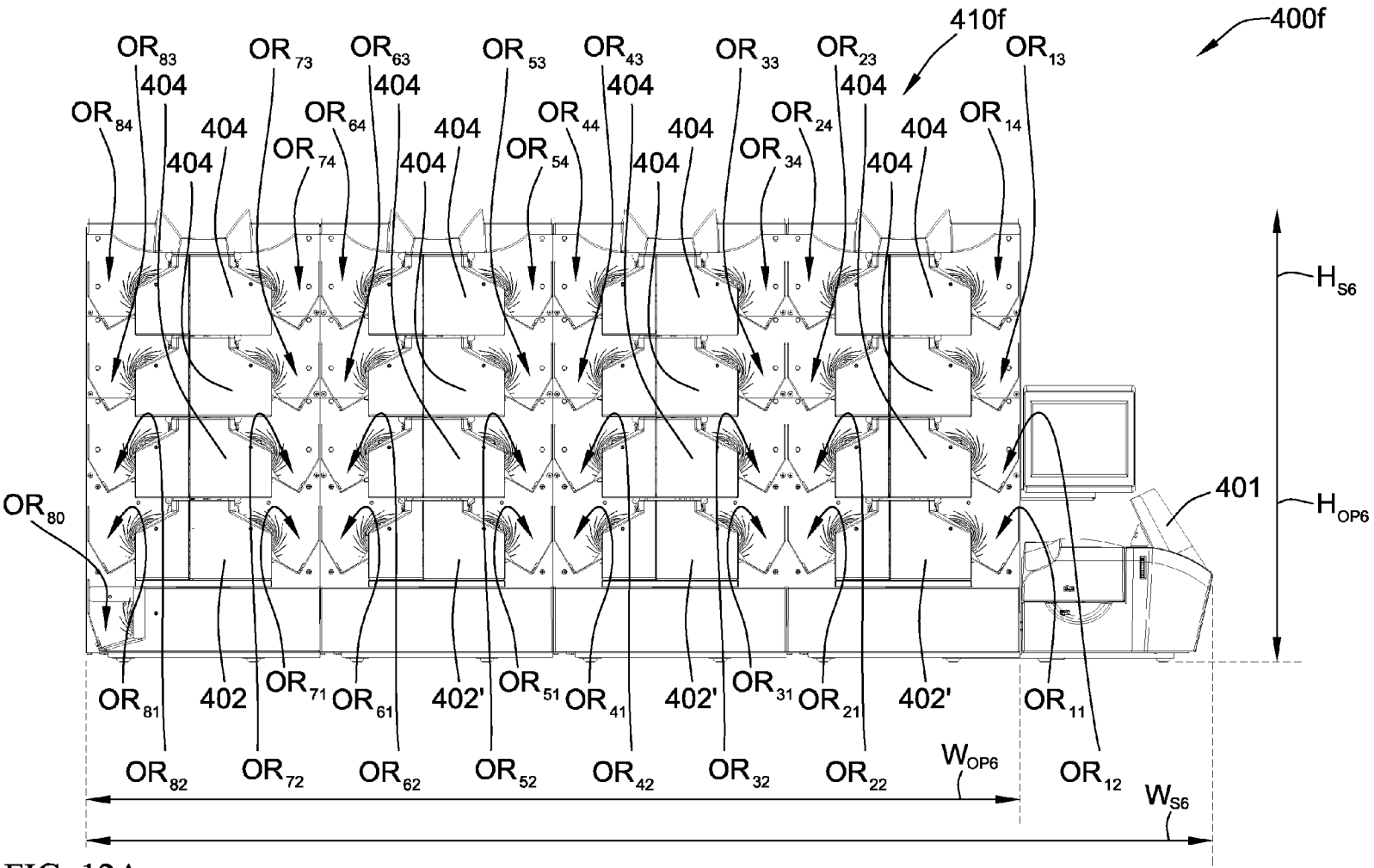
FIG. 12A is a front view of a document processing system according to some embodiments of the present disclosure.

Referring to FIG. 12A, a document processing system 400*f* is shown according to some embodiments. The document processing system 400*f* includes the document processing device 401 illustrated and described in reference to FIGS. 4A-4G and an output portion 410*f*. The output portion 410*f* of the document processing system 400*f*, as shown in FIG. 12A, includes the base module 402 (three pockets) illustrated and described in reference to FIGS. 5A-5N, three base modules 402' (two pockets each) described in reference to FIGS. 5A-5N, and twelve pocket modules 404 (two pockets each) illustrated and described in reference to FIGS. 6A-6N. That is, the document processing system 400*f* includes a document processing device 401 coupled to the output portion 410*f*, where the output portion 410*f* includes one or more modules (e.g., four base modules and twelve pocket modules). The document processing system 400*f* includes thirty-three output receptacles or thirty-three pockets $OR_{11}$-$OR_{84}$. Note, in the nomenclature of FIGS. 12A-12H output receptacles $OR_{11}$, $OR_{21}$, $OR_{12}$, etc. correspond to output receptacles 190*a*, 190*b*, 190*c*, etc. of prior figures. The document processing system 400*f* has a system width, $W_{S6}$, a system depth, $D_{S6}$ (not shown but the same as system width $D_{S5}$ shown in FIGS. 11A-11G), and a system height, $H_{S6}$. The output portion 410*f* has a width, $W_{OP6}$, a depth, $D_{OP6}$ (not shown but the same as the depth $D_{OP5}$ shown in FIGS. 11A-11G), and a height, $H_{OP6}$, where the width, $W_{OP6}$, is the same as, or substantially equal to, four times the width, $W_{BC}$, or the width, $W_B$, of the base portion 402 described above, the depth, $D_{OP6}$, is the same as the system depth, $D_{S6}$, and the height, $H_{OP6}$, is the same as the system height, $H_{S6}$.

According to some embodiments, the system width, $W_{S6}$, of the document processing system 400*f* is between about seventy inches and about eighty-two inches. According to some embodiments, the system width, $W_{S6}$, of the document processing system 400*f* is about seventy-six inches.

According to some embodiments, the system height, $H_{S6}$, of the document processing system 400*f* is between about twenty-eight inches and about thirty-four inches. According to some embodiments, the system height, $H_{S6}$, of the document processing system 400*f* is about thirty-one inches.

According to some embodiments, a system depth, $D_{S6}$ (not shown), of the document processing system 400*f* is between about fifteen inches and about twenty inches. According to some embodiments, the system depth, $D_{S6}$ (not shown), of the document processing system 400*f* is about seventeen and a half inches.

According to some embodiments, a faceprint of the document processing system 400*f* is between about 13.6 square feet ($ft^2$) and about 19.4 square feet ($ft^2$), where the faceprint of the document processing system 400*f* is defined as the system width, $W_{S6}$, multiplied by the system height, $H_{S6}$, of the document processing system 400*f* ($W_{S6} \times H_{S6}$). According to some embodiments, the faceprint of the document processing system 400*f* is about 16.4 square feet ($ft^2$). According to some embodiments, the faceprint of the document processing system 400*f* is less than about 19.4 square feet ($ft^2$).

According to some embodiments, the document processing system 400*f* has a footprint of less than about eleven and a half square feet, where the footprint of the document processing system 400*f* is defined as the system width, $W_{S6}$, multiplied by the system depth, $D_{S6}$ (not shown), of the document processing system 400*f* ($W_{S6} \times D_{S6}$). According to some embodiments, the document processing system 400*f* has a footprint of less than about nine and a quarter square feet. According to some embodiments, the document processing system 400*f* has a footprint of less than seven square feet. According to some embodiments, the document processing system 400*f* has a footprint of about 9.25 square feet. According to some embodiments, a footprint of the document processing system 400*f* is between about eleven and a half square feet ($ft^2$) and about seven square feet ($ft^2$).

According to some embodiments, the document processing system 400*f* has a volume of less than about thirty-three cubic feet, where the volume is defined as the system width, $W_{S6}$, multiplied by the system height, $H_{S6}$, multiplied by the system depth, $D_{S6}$ (not shown), of the document processing system 400*f* ($W_{S6} \times H_{S6} \times D_{S6}$). According to some embodiments, the document processing system 400*f* has a volume of less than about twenty-seven cubic feet. According to some embodiments, the document processing system 400*f* has a volume of less than about twenty-two cubic feet. According to some embodiments, the document processing system 400*f* has a volume of less than about seventeen cubic feet. According to some embodiments, the document processing system 400*f* has a volume of about 23.9 cubic feet. According to some embodiments, a volume of the document processing system 400*f* is between about thirty-three cubic feet ($ft^3$) and about seventeen cubic feet ($ft^3$).

According to some embodiments, the document processing system 400*f* has a pocket density between about 1.7 pockets/square foot of faceprint and about 2.4 pockets/square foot of faceprint. According to some embodiments, the document processing system 400*f* has a pocket density of about 2.0 pockets/square foot of faceprint. According to some embodiments, the document processing system 400*f* has a pocket density of at least about 2.0 pockets/square foot of faceprint. According to some embodiments, the document processing system 400*f* has a pocket density between about 2.9 pockets/square foot of footprint and about 4.5 pockets/square foot of footprint. According to some embodiments, the document processing system 400*f* has a pocket density of about 3.6 pockets/square foot of footprint. According to some embodiments, the document processing system 400*f* has a pocket density between about 1.0 pockets/cubic foot of volume and about 2.0 pockets/cubic foot of volume. According to some embodiments, the document processing system 400*f* has a pocket density of about 1.4 pockets/cubic foot of volume.

According to some embodiments, the document processing system 400*f* has a width, $W_{S6}$, less than about eighty-two inches, a depth, $D_{S6}$ (not shown), less than about twenty inches, and a height, $H_{S6}$, less than about thirty-four inches. According to some embodiments, the document processing system 400*f* has a width, $W_{S6}$, of about 76.1 inches, a depth, $D_{S6}$, of about 17.5 inches, and a height, $H_{S6}$, of about 30.6 inches. According to some embodiments, the document processing system 400*f* has a pocket density greater than about 1.7 pockets/square foot of faceprint, greater than about 2.9 pockets/square foot of footprint, and/or greater than about 1.0 pockets/cubic foot of volume.

According to some embodiments, as described above, the pocket density can be defined as a number of output receptacles enclosed within a specified area. The specified area can be any portion of the faceprint area and/or portion of the footprint area of a document processing system and/or an output portion of a document processing system. The specified area can be defined by, for example, an arc or circle through one or more points on the document processing system. For example, as shown in FIGS. 12B-12G, the specified area can be the area defined by an arc and/or a circle having a radius, r, and having its center at a point, C, on or off the document processing system. The center of the circle, C, can, for example, be positioned at or near a central location of the document processing system or output portion, such as, for example, at the geometric center of the document processing system (including or excluding a document processing device), at or near an outer portion of the document processing system, such as, for example, at the exit point of the input receptacle of the document processing device 401, I, or at the exit point of the first pair of rollers, S, downstream from the last denomination or authentication sensor in the document processing device 401. Exemplary arcs and circles are shown in FIGS. 12B-12G for illustrative purposes and for defining various pocket densities in connection with document processing system 400*f* and/or the output portion 410*f*. Similar arcs and circles can be used to define corresponding pocket densities for any of the other document processing systems (e.g., document processing systems 400*a-e*) described in this disclosure.

According to some embodiments, for purposes of defining pocket density, an output receptacle is considered to be enclosed within the specified area if a portion of the output receptacle is included with the arc or circle defining the specified area. For example, according to some embodiments, an output receptacle is considered to be enclosed within the specified area if at least a portion of the stacker plate is enclosed within the specified area. For another example, according to some embodiments, an output receptacle is considered to be enclosed within the specified area if at least a portion of the stacker wheel is enclosed within the specified area. For yet another example, according to some embodiments, an output receptacle is considered to be enclosed within the specified area if at least a portion of the entry rollers is enclosed within the specified area. For another example, according to some embodiments, an output receptacle is considered to be enclosed within the specified area if the stacker plate, the stacker wheel, and the entry rollers is enclosed within the specified area. For another example, according to some embodiments, an output receptacle is considered to be enclosed within the specified area if a portion of the stacker plate, and a portion of the stacker wheel, and a portion of the entry rollers are enclosed within the specified area.

Figure 12B:
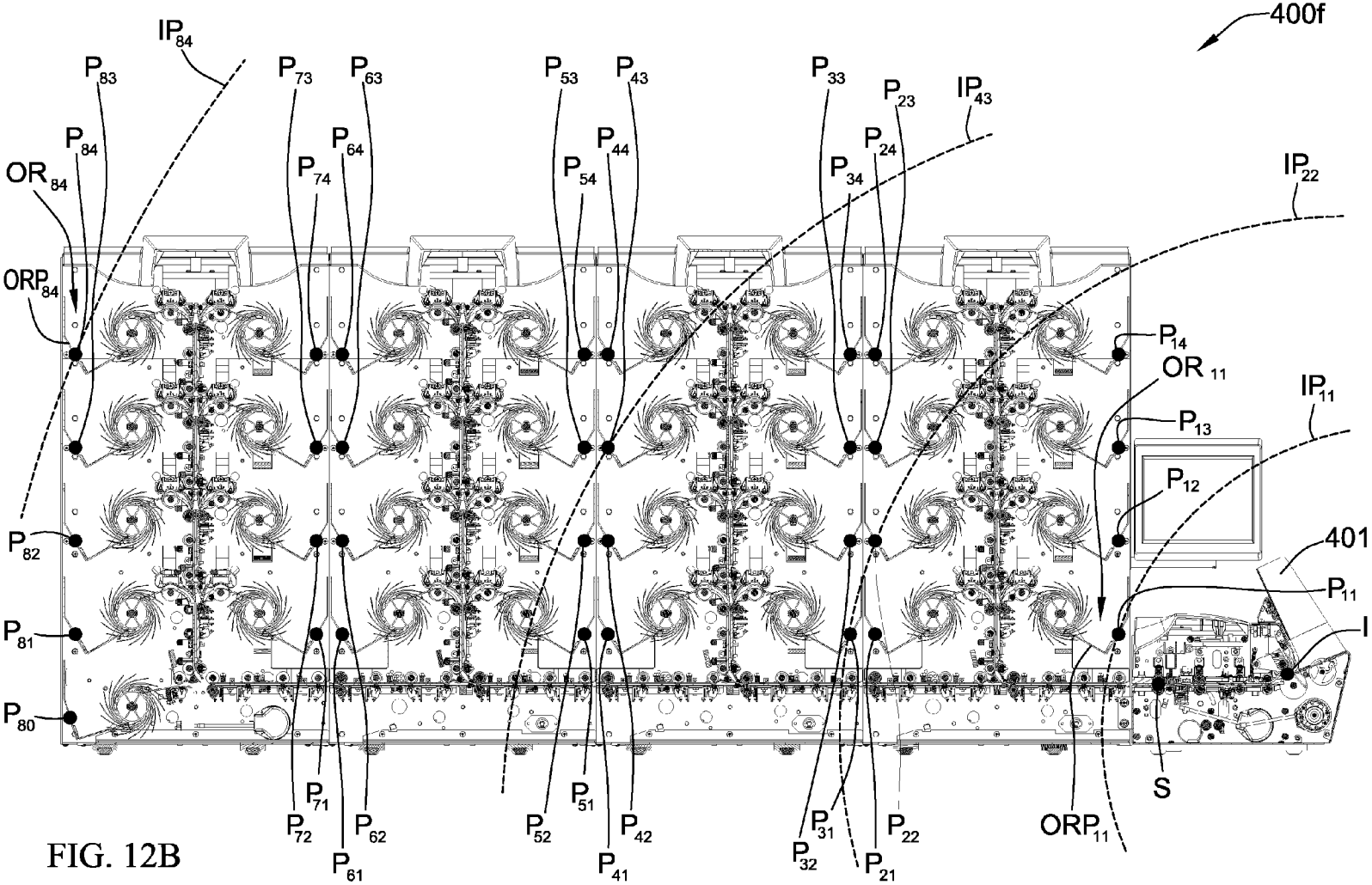
FIGS. 12B-12H are front cross-sectional views of the document processing system of FIG. 12A.

As shown in FIG. 12B, $P_{11}$-$P_{84}$ are points on respective stacker plates that correspond to the location that is adjacent to the position at which the center of a U.S. bill deposited in an output receptacle generally rests in the respective output receptacle (hereinafter, points $P_{11}$-$P_{84}$ are generally referred to as central plate locations). For example, point $P_{11}$ is a central plate location on a stacker plate $ORP_{11}$ that corresponds to the location that is adjacent to the position at which the center of a U.S. bill deposited in a first output receptacle $OR_{11}$ generally rests in the first output receptacle $OR_{11}$. For another example, point $P_{84}$ is a central plate location on a stacker plate $ORP_{84}$ that corresponds to the location that is adjacent to the position at which the center of a U.S. bill deposited in the thirty-third output receptacle $OR_{84}$ generally rests in the thirty-third output receptacle $OR_{84}$.

According to some embodiments, the distance between horizontally adjacent stacker plate locations $P_{XX}$ is between about 1½ inches and about 14½ inches. For example, according to some embodiments, the distance between stacker plate locations $P_{21}$ and $P_{31}$ is about 1½ inches. For another example, according to some embodiments, the distance between stacker plate locations $P_{11}$ and $P_{21}$ is about 14½ inches. According to some embodiments, the distance between vertically adjacent stacker plate locations $P_{XX}$ is between about 5.0 inches and about 10.0 inches. For example, according to some embodiments, the distance between stacker plate locations $P_{11}$ and $P_{12}$ is about 5.5 inches. For another example, according to some embodiments, the distance between stacker plate locations $P_{12}$ and $P_{13}$ is about 5.5 inches.

As shown in FIG. 12B, point I—which is the exit point of the input receptacle located at or near, for example, a pinch point between rollers at an enter point of the transport mechanism of the document processing device 401—is the geometric center of concentric arcs, where each arc passes through and thus encloses within the arc at least one central plate location $P_{xx}$. For example, as shown in FIG. 12B, point I is the geometric center of four concentric arcs $IP_{11}$, $IP_{22}$, $IP_{43}$, and $IP_{84}$ where the first arc $IP_{11}$ passes through and thus encloses within the first arc $IP_{11}$ one central plate location $P_{11}$. Similarly, the second arc $IP_{22}$ passes through and thus encloses within the second arc $IP_{22}$ seven central plate locations $P_{11}$, $P_{12}$, $P_{13}$, $P_{14}$, $P_{21}$, $P_{22}$, and $P_{31}$; the third arc $IP_3$ passes through and thus encloses within the third arc $IP_{43}$ seventeen central plate locations $P_{11}$, $P_{12}$, $P_{13}$, $P_{14}$, $P_{21}$, $P_{22}$, $P_{23}$, $P_{24}$, $P_{31}$, $P_{32}$, $P_{33}$, $P_{34}$, $P_{41}$, $P_{42}$, $P_{43}$, $P_{51}$, and $P_{52}$; the fourth arc $IP_{84}$ passes through and thus encloses within the fourth arc $IP_{84}$ thirty-three central plate locations $P_{11}$-$P_{84}$. These arcs IP illustrate the number of pockets within a certain radial distance of an exit point of the input receptacle.

While not shown as arcs in FIG. 12B, point I may also serve as the geometric center of respective arcs that pass through each of the points $P_{11}$-$P_{84}$. Similarly, Point S—which is located at or near a pinch point of a first pair of rollers downstream from a last denomination and/or authentication sensor in the document processing device 401—may also serve as the geometric center of respective arcs (not shown) that pass through points $P_{11}$-$P_{84}$. According to some embodiments, any of the points $P_{11}$-$P_{84}$ can be used as a center of an arc for purposes of describing pocket densities, such as, for example, point $P_{11}$. Arcs from point S demonstrate the number of pockets within a certain radial distance of a pinch point of a first pair of rollers downstream from a last denomination and/or authentication sensor. Arcs from a given point in an output receptacle such as point $P_{11}$ demonstrate the number of pockets within a certain radial distance of that point.

The following table ("Table 1") provides information, according to some embodiments, concerning distances between point I and each of the points $P_{11}$-$P_{84}$, the number of pockets within a given distance of point I (as determined by pockets having their central plate location $P_{xx}$ within that distance), and pocket density information given in terms of number of pockets per unit distance from point I.

TABLE 1

| From I to Pxx | | | | | | | | |
|---|---|---|---|---|---|---|---|---|
| Point Pxx | Distance (in.) | Distance (ft.) | # Pockets with Pxx within distance | Pockets per Lineal Foot | Distance (cm) | Pockets per lineal cm | Distance (dm) | Pockets per lineal dm |
| P11 | 10.7 | 0.9 | 1 | 1.1 | 4.2 | 0.2 | 0.4 | 2.4 |
| P12 | 13.3 | 1.1 | 2 | 1.8 | 5.2 | 0.4 | 0.5 | 3.8 |
| P13 | 17.7 | 1.5 | 3 | 2.0 | 7.0 | 0.4 | 0.7 | 4.3 |
| P14 | 22.5 | 1.9 | 4 | 2.1 | 8.8 | 0.5 | 0.9 | 4.5 |
| P21 | 25.2 | 2.1 | 5 | 2.4 | 9.9 | 0.5 | 1.0 | 5.0 |
| P31 | 26.1 | 2.2 | 6 | 2.8 | 10.3 | 0.6 | 1.0 | 5.8 |
| P22 | 26.3 | 2.2 | 7 | 3.2 | 10.4 | 0.7 | 1.0 | 6.8 |
| P32 | 27.4 | 2.3 | 8 | 3.5 | 10.8 | 0.7 | 1.1 | 7.4 |
| P23 | 28.9 | 2.4 | 9 | 3.7 | 11.4 | 0.8 | 1.1 | 7.9 |
| P33 | 29.7 | 2.5 | 10 | 4.0 | 11.7 | 0.9 | 1.2 | 8.6 |
| P24 | 32.0 | 2.7 | 11 | 4.1 | 12.6 | 0.9 | 1.3 | 8.7 |
| P34 | 32.7 | 2.7 | 12 | 4.4 | 12.9 | 0.9 | 1.3 | 9.3 |
| P41 | 40.8 | 3.4 | 13 | 3.8 | 16.1 | 0.8 | 1.6 | 8.1 |
| P42 | 41.7 | 3.5 | 15 | 4.3 | 16.4 | 0.9 | 1.6 | 9.1 |
| P51 | 41.7 | 3.5 | 15 | 4.3 | 16.4 | 0.9 | 1.6 | 9.1 |
| P52 | 42.6 | 3.5 | 16 | 4.5 | 16.8 | 1.0 | 1.7 | 9.5 |
| P43 | 43.2 | 3.6 | 17 | 4.7 | 17.0 | 1.0 | 1.7 | 10.0 |
| P53 | 44.1 | 3.7 | 18 | 4.9 | 17.4 | 1.0 | 1.7 | 10.4 |
| P44 | 45.4 | 3.8 | 19 | 5.0 | 17.9 | 1.1 | 1.8 | 10.6 |
| P54 | 46.2 | 3.8 | 20 | 5.2 | 18.2 | 1.1 | 1.8 | 11.0 |
| P61 | 56.5 | 4.7 | 21 | 4.5 | 22.3 | 0.9 | 2.2 | 9.4 |
| P62 | 57.2 | 4.8 | 22 | 4.6 | 22.5 | 1.0 | 2.3 | 9.8 |
| P71 | 57.5 | 4.8 | 23 | 4.8 | 22.6 | 1.0 | 2.3 | 10.2 |
| P72 | 58.1 | 4.8 | 24 | 5.0 | 22.9 | 1.1 | 2.3 | 10.5 |
| P63 | 58.3 | 4.9 | 25 | 5.1 | 22.9 | 1.1 | 2.3 | 10.9 |
| P73 | 59.2 | 4.9 | 26 | 5.3 | 23.3 | 1.1 | 2.3 | 11.2 |
| P64 | 59.9 | 5.0 | 27 | 5.4 | 23.6 | 1.1 | 2.4 | 11.4 |
| P74 | 60.8 | 5.1 | 28 | 5.5 | 23.9 | 1.2 | 2.4 | 11.7 |
| P81 | 72.3 | 6.0 | 30 | 5.0 | 28.5 | 1.1 | 2.8 | 10.5 |
| P80 | 72.3 | 6.0 | 30 | 5.0 | 28.5 | 1.1 | 2.8 | 10.5 |
| P82 | 72.7 | 6.1 | 31 | 5.1 | 28.6 | 1.1 | 2.9 | 10.8 |
| P83 | 73.6 | 6.1 | 32 | 5.2 | 29.0 | 1.1 | 2.9 | 11.0 |
| P84 | 74.9 | 6.2 | 33 | 5.3 | 29.5 | 1.1 | 2.9 | 11.2 |

The following table ("Table 2") provides information, according to some embodiments, concerning distances between point S and each of the points $P_{11}$-$P_{84}$, the number of pockets within a given distance of point S (as determined by pockets having their central plate location $P_{xx}$ within that distance), and pocket density information given in terms of number of pockets per unit distance from point S.

TABLE 2

| From S to Pxx | | | | | | | | |
|---|---|---|---|---|---|---|---|---|
| Point Pxx | Distance (in.) | Distance (ft.) | # Pockets with Pxx within distance | Pockets per Lineal Foot | Distance (cm) | Pockets per lineal cm | Distance (dm) | Pockets per lineal dm |
| P11 | 4.4 | 0.4 | 1 | 2.7 | 1.7 | 0.6 | 0.2 | 5.8 |
| P12 | 9.6 | 0.8 | 2 | 2.5 | 3.8 | 0.5 | 0.4 | 5.3 |
| P13 | 15.0 | 1.2 | 3 | 2.4 | 5.9 | 0.5 | 0.6 | 5.1 |
| P21 | 17.4 | 1.5 | 4 | 2.8 | 6.9 | 0.6 | 0.7 | 5.8 |
| P31 | 18.3 | 1.5 | 5 | 3.3 | 7.2 | 0.7 | 0.7 | 6.9 |
| P22 | 19.4 | 1.6 | 6 | 3.7 | 7.6 | 0.8 | 0.8 | 7.9 |
| P32 | 20.2 | 1.7 | 7 | 4.2 | 7.9 | 0.9 | 0.8 | 8.8 |
| P14 | 20.4 | 1.7 | 8 | 4.7 | 8.0 | 1.0 | 0.8 | 10.0 |
| P23 | 22.5 | 1.9 | 9 | 4.8 | 8.9 | 1.0 | 0.9 | 10.1 |
| P33 | 23.2 | 1.9 | 10 | 5.2 | 9.1 | 1.1 | 0.9 | 10.9 |
| P24 | 26.5 | 2.2 | 11 | 5.0 | 10.4 | 1.1 | 1.0 | 10.6 |
| P34 | 27.1 | 2.3 | 12 | 5.3 | 10.7 | 1.1 | 1.1 | 11.3 |
| P41 | 33.0 | 2.7 | 13 | 4.7 | 13.0 | 1.0 | 1.3 | 10.0 |
| P51 | 33.9 | 2.8 | 14 | 5.0 | 13.3 | 1.1 | 1.3 | 10.5 |
| P42 | 34.0 | 2.8 | 15 | 5.3 | 13.4 | 1.1 | 1.3 | 11.2 |
| P52 | 34.9 | 2.9 | 16 | 5.5 | 13.7 | 1.2 | 1.4 | 11.6 |
| P43 | 35.9 | 3.0 | 17 | 5.7 | 14.1 | 1.2 | 1.4 | 12.0 |
| P53 | 36.8 | 3.1 | 18 | 5.9 | 14.5 | 1.2 | 1.4 | 12.4 |
| P44 | 38.5 | 3.2 | 19 | 5.9 | 15.2 | 1.3 | 1.5 | 12.5 |
| P54 | 39.3 | 3.3 | 20 | 6.1 | 15.5 | 1.3 | 1.5 | 12.9 |
| P61 | 48.6 | 4.1 | 21 | 5.2 | 19.1 | 1.1 | 1.9 | 11.0 |
| P62 | 49.4 | 4.1 | 22 | 5.3 | 19.4 | 1.1 | 1.9 | 11.3 |
| P71 | 49.5 | 4.1 | 23 | 5.6 | 19.5 | 1.2 | 2.0 | 11.8 |
| P72 | 50.3 | 4.2 | 24 | 5.7 | 19.8 | 1.2 | 2.0 | 12.1 |
| P63 | 50.7 | 4.2 | 25 | 5.9 | 20.0 | 1.3 | 2.0 | 12.5 |
| P73 | 51.6 | 4.3 | 26 | 6.1 | 20.3 | 1.3 | 2.0 | 12.8 |
| P64 | 52.6 | 4.4 | 27 | 6.2 | 20.7 | 1.3 | 2.1 | 13.0 |
| P74 | 53.4 | 4.4 | 28 | 6.3 | 21.0 | 1.3 | 2.1 | 13.3 |
| P81 | 64.3 | 5.4 | 29 | 5.4 | 25.3 | 1.1 | 2.5 | 11.4 |
| P80 | 64.4 | 5.4 | 30 | 5.6 | 25.3 | 1.2 | 2.5 | 11.8 |
| P82 | 64.9 | 5.4 | 31 | 5.7 | 25.5 | 1.2 | 2.6 | 12.1 |
| P83 | 65.9 | 5.5 | 32 | 5.8 | 25.9 | 1.2 | 2.6 | 12.3 |
| P84 | 67.4 | 5.6 | 33 | 5.9 | 26.5 | 1.2 | 2.7 | 12.4 |

The following table ("Table 3") provides information, according to some embodiments, concerning distances between point $P_{11}$ and each of the points $P_{11}$-$P_{84}$, the number of pockets within a given distance of point $P_{11}$ (as determined by pockets having their central plate location $P_{xx}$ within that distance), and pocket density information given in terms of number of pockets per unit distance from point $P_{11}$.

TABLE 3

| From P11 to Pxx | | | | | | | | |
|---|---|---|---|---|---|---|---|---|
| Point Pxx | Distance (in.) | Distance (ft.) | # Pockets with Pxx within distance | Pockets per Lineal Foot | Distance (cm) | Pockets per lineal cm | Distance (dm) | Pockets per lineal dm |
| P11 | 0.0 | 0.0 | 1 | — | 0.0 | — | 0.0 | — |
| P12 | 5.5 | 0.5 | 2 | 4.4 | 2.2 | 0.9 | 0.2 | 9.2 |
| P13 | 11.0 | 0.9 | 3 | 3.3 | 4.3 | 0.7 | 0.4 | 6.9 |
| P21 | 14.2 | 1.2 | 4 | 3.4 | 5.6 | 0.7 | 0.6 | 7.2 |
| P22 | 15.2 | 1.3 | 5 | 3.9 | 6.0 | 0.8 | 0.6 | 8.3 |
| P31 | 15.8 | 1.3 | 6 | 4.6 | 6.2 | 1.0 | 0.6 | 9.7 |
| P14 | 16.5 | 1.4 | 7 | 5.1 | 6.5 | 1.1 | 0.6 | 10.8 |
| P32 | 16.7 | 1.4 | 8 | 5.8 | 6.6 | 1.2 | 0.7 | 12.2 |
| P23 | 18.0 | 1.5 | 9 | 6.0 | 7.1 | 1.3 | 0.7 | 12.7 |
| P33 | 19.2 | 1.6 | 10 | 6.2 | 7.6 | 1.3 | 0.8 | 13.2 |
| P24 | 21.8 | 1.8 | 11 | 6.1 | 8.6 | 1.3 | 0.9 | 12.8 |
| P34 | 22.8 | 1.9 | 12 | 6.3 | 9.0 | 1.3 | 0.9 | 13.4 |
| P41 | 29.9 | 2.5 | 13 | 5.2 | 11.8 | 1.1 | 1.2 | 11.0 |

TABLE 3-continued

| From P11 to Pxx | | | | | | | | |
|---|---|---|---|---|---|---|---|---|
| Point Pxx | Distance (in.) | Distance (ft.) | # Pockets with Pxx within distance | Pockets per Lineal Foot | Distance (cm) | Pockets per lineal cm | Distance (dm) | Pockets per lineal dm |
| P42 | 30.4 | 2.5 | 14 | 5.5 | 12.0 | 1.2 | 1.2 | 11.7 |
| P51 | 31.5 | 2.6 | 15 | 5.7 | 12.4 | 1.2 | 1.2 | 12.1 |
| P43 | 31.9 | 2.7 | 16 | 6.0 | 12.6 | 1.3 | 1.3 | 12.7 |
| P52 | 32.0 | 2.7 | 17 | 6.4 | 12.6 | 1.4 | 1.3 | 13.5 |
| P53 | 33.4 | 2.8 | 18 | 6.5 | 13.1 | 1.4 | 1.3 | 13.7 |
| P44 | 34.2 | 2.8 | 19 | 6.7 | 13.5 | 1.4 | 1.3 | 14.1 |
| P54 | 35.6 | 3.0 | 20 | 6.7 | 14.0 | 1.4 | 1.4 | 14.3 |
| P61 | 45.7 | 3.8 | 21 | 5.5 | 18.0 | 1.2 | 1.8 | 11.7 |
| P62 | 46.0 | 3.8 | 22 | 5.7 | 18.1 | 1.2 | 1.8 | 12.1 |
| P63 | 47.0 | 3.9 | 23 | 5.9 | 18.5 | 1.2 | 1.9 | 12.4 |
| P71 | 47.3 | 3.9 | 24 | 6.1 | 18.6 | 1.3 | 1.9 | 12.9 |
| P72 | 47.6 | 4.0 | 25 | 6.3 | 18.7 | 1.3 | 1.9 | 13.3 |
| P73 | 48.5 | 4.0 | 26 | 6.4 | 19.1 | 1.4 | 1.9 | 13.6 |
| P64 | 48.6 | 4.0 | 27 | 6.7 | 19.1 | 1.4 | 1.9 | 14.1 |
| P74 | 50.0 | 4.2 | 28 | 6.7 | 19.7 | 1.4 | 2.0 | 14.2 |
| P81 | 61.4 | 5.1 | 29 | 5.7 | 24.2 | 1.2 | 2.4 | 12.0 |
| P82 | 61.7 | 5.1 | 30 | 5.8 | 24.3 | 1.2 | 2.4 | 12.4 |
| P80 | 61.9 | 5.2 | 31 | 6.0 | 24.4 | 1.3 | 2.4 | 12.7 |
| P83 | 62.4 | 5.2 | 32 | 6.2 | 24.6 | 1.3 | 2.5 | 13.0 |
| P84 | 63.6 | 5.3 | 33 | 6.2 | 25.0 | 1.3 | 2.5 | 13.2 |

The first arc $IP_{11}$ defines a first specified circular area having a radius of about 10.7 inches with one central plate location contained therein. Thus, the arc $IP_{11}$ has a pocket density of about 1.1 central plate locations/per lineal foot from point I. The second arc $IP_{22}$ defines a second specified circular area having a radius of about 26.3 inches with seven central plate locations contained therein. Thus, the arc $IP_{22}$ has a pocket density of about 3.2 central plate locations/per lineal foot from point I. The third arc $IP_{43}$ defines a third specified circular area having a radius of about 43.2 inches with seventeen central plate locations contained therein. Thus, the arc $IP_{43}$ has a pocket density of about 4.7 central plate locations/per lineal foot from point I. The fourth arc $IP_{84}$ defines a fourth specified circular area having a radius of about 74.9 inches with thirty-three central plate locations contained therein. Thus, the arc $IP_{84}$ has a pocket density of about 5.3 central plate locations/per lineal foot from point I. Similar calculations can be made for determining the pocket densities (central plate locations/per lineal foot from point I, point S, or any of the points $P_{11}$-$P_{84}$) associated with any of the other distances in Table 1, Table 2, and Table 3.

Figure 12C:
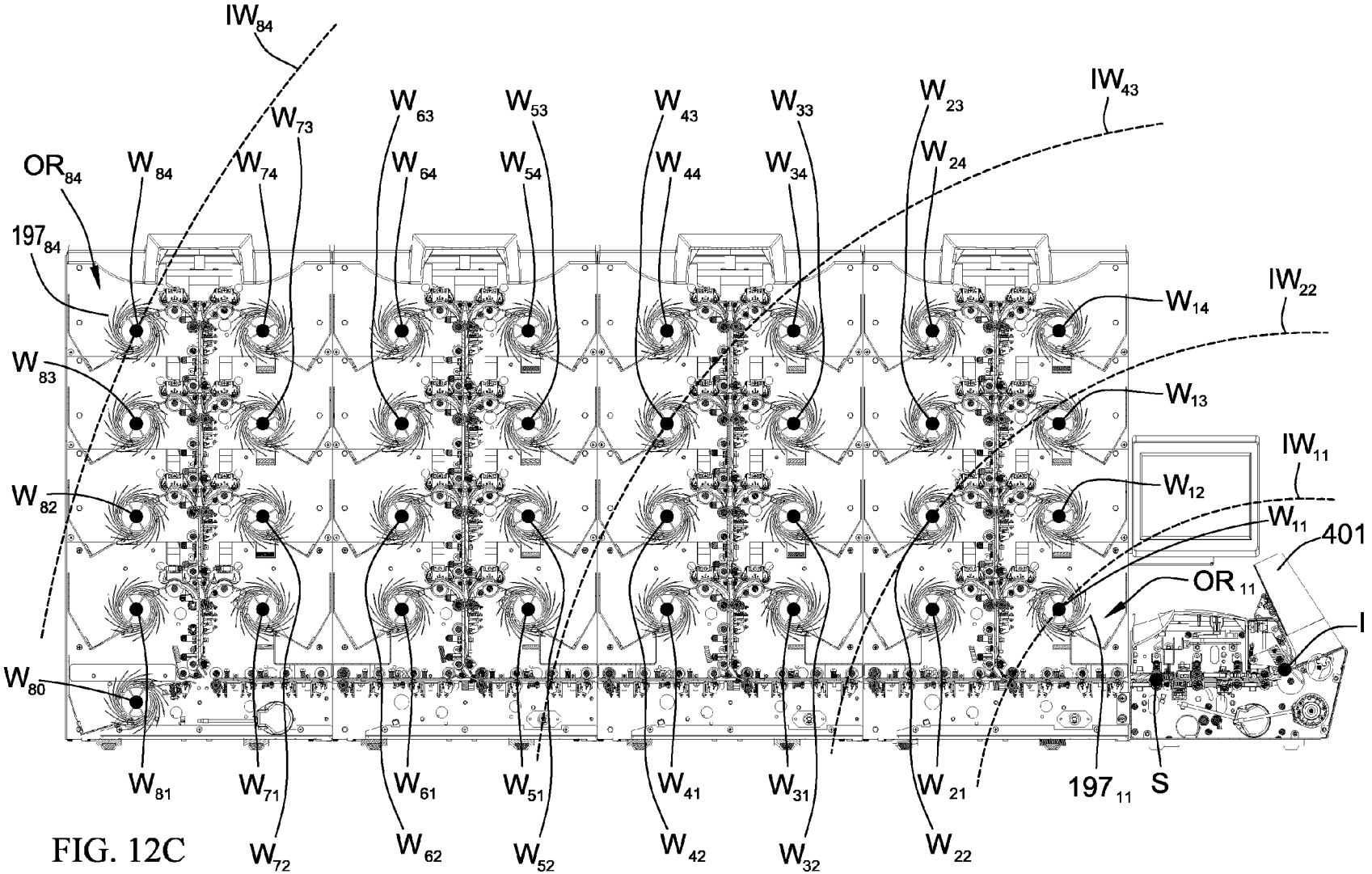

As shown in FIG. 12C, points $W_{11}$-$W_{84}$ are the center points or axes of respective shafts upon which respective stacker wheels, associated with respective output receptacles, rotate (hereinafter, points $W_{11}$-$W_{84}$ are generally referred to as stacker wheel axes). For example, point $W_{11}$ is a stacker wheel axis of the shaft upon which the stacker wheel $\mathbf{197}_{11}$, associated with the first output receptacle $OR_{11}$, rotates. For another example, point $W_{84}$ is a stacker wheel axis of the shaft upon which the stacker wheel $\mathbf{197}_{84}$, associated with the thirty-third output receptacle $OR_{84}$, rotates.

As shown in FIG. 12C, point I is the geometric center of concentric arcs, where each arc passes through and thus encloses within the arc at least one stacker wheel axis $W_{xx}$. For example, as shown in FIG. 12C, point I is the geometric center of four concentric arcs $IW_{11}$, $IW_{22}$, $IW_{43}$, and $IW_{84}$ where the first arc $IW_{11}$ passes through and thus encloses within the first arc $IW_{11}$ one stacker wheel axis $W_{11}$. Similarly, the second arc $IW_{22}$ passes through and thus encloses within the second arc $IW_{2s}$ six stacker wheel axes $W_{11}$, $W_{12}$, $W_{13}$, $W_{14}$, $W_{21}$, and $W_{22}$; the third arc $IW_{43}$ passes through and thus encloses within the third arc $IW_{43}$ fifteen stacker wheel axes $W_{11}$, $W_{12}$, $W_{13}$, $W_{14}$, $W_{21}$, $W_{22}$, $W_{23}$, $W_{24}$, $W_{31}$, $W_{32}$, $W_{33}$, $W_{34}$, $W_{41}$, $W_{42}$, and $W_{43}$; the fourth arc $IW_{84}$ passes through and thus encloses within the fourth arc $IW_{84}$ thirty-three stacker wheel axes $W_{11}$-$W_{84}$.

While not shown as arcs in FIG. 12C, point I may also serve as the geometric center of respective arcs that pass through each of the points $W_{11}$-$W_{84}$. Similarly, Point S may also serve as the geometric center of respective arcs (not shown) that pass through points $W_{11}$-$W_{84}$. According to some embodiments, any of the points $W_{11}$-$W_{84}$ can be used as a center of an arc for purposes of describing pocket densities, such as, for example, point $W_{11}$.

The following table ("Table 4") provides information, according to some embodiments, concerning distances between point I and each of the points $W_{11}$-$W_{84}$, the number of pockets within a given distance of point I (as determined by pockets having their stacker wheel axes $W_{xx}$ within that distance), and pocket density information given in terms of number of pockets per unit distance from point I.

TABLE 4

| From I to Wxx | | | | | | | | |
|---|---|---|---|---|---|---|---|---|
| Point Wxx | Distance (in.) | Distance (ft.) | # Pockets with Wxx within distance | Pockets per Lineal Foot | Distance (cm) | Pockets per lineal cm | Distance (dm) | Pockets per lineal dm |
| W11 | 14.4 | 1.2 | 1 | 0.8 | 5.7 | 0.2 | 0.6 | 1.8 |
| W12 | 16.9 | 1.4 | 2 | 1.4 | 6.6 | 0.3 | 0.7 | 3.0 |

TABLE 4-continued

| From I to Wxx | | | | | | | | |
|---|---|---|---|---|---|---|---|---|
| Point Wxx | Distance (in.) | Distance (ft.) | # Pockets with Wxx within distance | Pockets per Lineal Foot | Distance (cm) | Pockets per lineal cm | Distance (dm) | Pockets per lineal dm |
| W13 | 20.6 | 1.7 | 3 | 1.8 | 8.1 | 0.4 | 0.8 | 3.7 |
| W21 | 21.7 | 1.8 | 4 | 2.2 | 8.5 | 0.5 | 0.9 | 4.7 |
| W22 | 23.4 | 1.9 | 5 | 2.6 | 9.2 | 0.5 | 0.9 | 5.4 |
| W14 | 24.9 | 2.1 | 6 | 2.9 | 9.8 | 0.6 | 1.0 | 6.1 |
| W23 | 26.2 | 2.2 | 7 | 3.2 | 10.3 | 0.7 | 1.0 | 6.8 |
| W24 | 29.7 | 2.5 | 8 | 3.2 | 11.7 | 0.7 | 1.2 | 6.8 |
| W31 | 29.8 | 2.5 | 9 | 3.6 | 11.7 | 0.8 | 1.2 | 7.7 |
| W32 | 31.1 | 2.6 | 10 | 3.9 | 12.2 | 0.8 | 1.2 | 8.2 |
| W33 | 33.2 | 2.8 | 11 | 4.0 | 13.1 | 0.8 | 1.3 | 8.4 |
| W34 | 36.1 | 3.0 | 12 | 4.0 | 14.2 | 0.8 | 1.4 | 8.4 |
| W41 | 37.3 | 3.1 | 13 | 4.2 | 14.7 | 0.9 | 1.5 | 8.9 |
| W42 | 38.3 | 3.2 | 14 | 4.4 | 15.1 | 0.9 | 1.5 | 9.3 |
| W43 | 40.0 | 3.3 | 15 | 4.5 | 15.8 | 1.0 | 1.6 | 9.5 |
| W44 | 42.4 | 3.5 | 16 | 4.5 | 16.7 | 1.0 | 1.7 | 9.6 |
| W51 | 45.5 | 3.8 | 17 | 4.5 | 17.9 | 0.9 | 1.8 | 9.5 |
| W52 | 46.3 | 3.9 | 18 | 4.7 | 18.2 | 1.0 | 1.8 | 9.9 |
| W53 | 47.8 | 4.0 | 19 | 4.8 | 18.8 | 1.0 | 1.9 | 10.1 |
| W54 | 49.8 | 4.2 | 20 | 4.8 | 19.6 | 1.0 | 2.0 | 10.2 |
| W61 | 52.9 | 4.4 | 21 | 4.8 | 20.8 | 1.0 | 2.1 | 10.1 |
| W62 | 53.7 | 4.5 | 22 | 4.9 | 21.1 | 1.0 | 2.1 | 10.4 |
| W63 | 54.9 | 4.6 | 23 | 5.0 | 21.6 | 1.1 | 2.2 | 10.6 |
| W64 | 56.7 | 4.7 | 24 | 5.1 | 22.3 | 1.1 | 2.2 | 10.8 |
| W71 | 61.2 | 5.1 | 25 | 4.9 | 24.1 | 1.0 | 2.4 | 10.4 |
| W72 | 61.8 | 5.1 | 26 | 5.1 | 24.3 | 1.1 | 2.4 | 10.7 |
| W73 | 62.9 | 5.2 | 27 | 5.2 | 24.8 | 1.1 | 2.5 | 10.9 |
| W74 | 64.4 | 5.4 | 28 | 5.2 | 25.4 | 1.1 | 2.5 | 11.0 |
| W80 | 68.5 | 5.7 | 29 | 5.1 | 27.0 | 1.1 | 2.7 | 10.8 |
| W81 | 68.6 | 5.7 | 30 | 5.2 | 27.0 | 1.1 | 2.7 | 11.1 |
| W82 | 69.2 | 5.8 | 31 | 5.4 | 27.2 | 1.1 | 2.7 | 11.4 |
| W83 | 70.2 | 5.8 | 32 | 5.5 | 27.6 | 1.2 | 2.8 | 11.6 |
| W84 | 71.6 | 6.0 | 33 | 5.5 | 28.2 | 1.2 | 2.8 | 11.7 |

The following table ("Table 5") provides information, according to some embodiments, concerning distances between point S and each of the points $W_{11}$-$W_{84}$, the number of pockets within a given distance of point S (as determined by pockets having their stacker wheel axes $W_{xx}$ within that distance), and pocket density information given in terms of number of pockets per unit distance from point S.

TABLE 5

| From S to Wxx | | | | | | | | |
|---|---|---|---|---|---|---|---|---|
| Point Wxx | Distance (in.) | Distance (ft.) | # Pockets with Wxx within distance | Pockets per Lineal Foot | Distance (cm) | Pockets per lineal cm | Distance (dm) | Pockets per lineal dm |
| W11 | 7.4 | 0.6 | 1 | 1.6 | 2.9 | 0.3 | 0.3 | 3.5 |
| W12 | 11.6 | 1.0 | 2 | 2.1 | 4.6 | 0.4 | 0.5 | 4.4 |
| W21 | 14.1 | 1.2 | 3 | 2.6 | 5.5 | 0.5 | 0.6 | 5.4 |
| W13 | 16.6 | 1.4 | 5 | 3.6 | 6.5 | 0.8 | 0.7 | 7.7 |
| W22 | 16.6 | 1.4 | 5 | 3.6 | 6.6 | 0.8 | 0.7 | 7.6 |
| W23 | 20.4 | 1.7 | 6 | 3.5 | 8.0 | 0.7 | 0.8 | 7.5 |
| W14 | 21.8 | 1.8 | 7 | 3.9 | 8.6 | 0.8 | 0.9 | 8.2 |
| W31 | 22.0 | 1.8 | 8 | 4.4 | 8.7 | 0.9 | 0.9 | 9.2 |
| W32 | 23.8 | 2.0 | 9 | 4.5 | 9.4 | 1.0 | 0.9 | 9.6 |
| W24 | 24.9 | 2.1 | 10 | 4.8 | 9.8 | 1.0 | 1.0 | 10.2 |
| W33 | 26.6 | 2.2 | 11 | 5.0 | 10.5 | 1.1 | 1.0 | 10.5 |
| W41 | 29.4 | 2.5 | 12 | 4.9 | 11.6 | 1.0 | 1.2 | 10.4 |
| W34 | 30.1 | 2.5 | 13 | 5.2 | 11.8 | 1.1 | 1.2 | 11.0 |
| W42 | 30.7 | 2.6 | 14 | 5.5 | 12.1 | 1.2 | 1.2 | 11.6 |
| W43 | 32.9 | 2.7 | 15 | 5.5 | 13.0 | 1.2 | 1.3 | 11.6 |
| W44 | 35.9 | 3.0 | 16 | 5.4 | 14.1 | 1.1 | 1.4 | 11.3 |
| W51 | 37.6 | 3.1 | 17 | 5.4 | 14.8 | 1.1 | 1.5 | 11.5 |
| W52 | 38.6 | 3.2 | 18 | 5.6 | 15.2 | 1.2 | 1.5 | 11.8 |
| W53 | 40.4 | 3.4 | 19 | 5.6 | 15.9 | 1.2 | 1.6 | 11.9 |
| W54 | 42.8 | 3.6 | 20 | 5.6 | 16.9 | 1.2 | 1.7 | 11.9 |
| W61 | 45.0 | 3.8 | 21 | 5.6 | 17.7 | 1.2 | 1.8 | 11.8 |
| W62 | 45.9 | 3.8 | 22 | 5.8 | 18.1 | 1.2 | 1.8 | 12.2 |
| W63 | 47.1 | 3.9 | 23 | 5.9 | 18.5 | 1.2 | 1.9 | 12.4 |
| W64 | 49.5 | 4.1 | 24 | 5.8 | 19.5 | 1.2 | 1.9 | 12.3 |

TABLE 5-continued

| From S to Wxx | | | | | | | | |
|---|---|---|---|---|---|---|---|---|
| Point Wxx | Distance (in.) | Distance (ft.) | # Pockets with Wxx within distance | Pockets per Lineal Foot | Distance (cm) | Pockets per lineal cm | Distance (dm) | Pockets per lineal dm |
| W71 | 53.2 | 4.4 | 25 | 5.6 | 21.0 | 1.2 | 2.1 | 11.9 |
| W72 | 54.0 | 4.5 | 26 | 5.8 | 21.3 | 1.2 | 2.1 | 12.2 |
| W73 | 55.3 | 4.6 | 27 | 5.9 | 21.8 | 1.2 | 2.2 | 12.4 |
| W74 | 57.1 | 4.8 | 28 | 5.9 | 22.5 | 1.2 | 2.2 | 12.5 |
| W80 | 60.6 | 5.0 | 29 | 5.7 | 23.8 | 1.2 | 2.4 | 12.2 |
| W81 | 60.7 | 5.1 | 30 | 5.9 | 23.9 | 1.3 | 2.4 | 12.5 |
| W82 | 61.4 | 5.1 | 31 | 6.1 | 24.2 | 1.3 | 2.4 | 12.8 |
| W83 | 62.5 | 5.2 | 32 | 6.1 | 24.6 | 1.3 | 2.5 | 13.0 |
| W84 | 64.1 | 5.3 | 33 | 6.2 | 25.2 | 1.3 | 2.5 | 13.1 |

According to some embodiments, the distance between horizontally adjacent stacker wheel locations $W_{XX}$ is between about 7½ inches and about 8¼ inches. For example, according to some embodiments, the distance between stacker wheel locations $W_{21}$ and $W_{31}$ is about 8¼ inches. For another example, according to some embodiments, the distance between stacker wheel locations $W_{11}$ and $W_{21}$ is about 7½ inches. According to some embodiments, the distance between vertically adjacent stacker wheel locations $W_{XX}$ is between about 5.0 inches and about 10.0 inches. For example, according to some embodiments, the distance between stacker wheel locations $W_{11}$ and $W_{12}$ is about 5.5 inches. For another example, according to some embodiments, the distance between stacker wheel locations $W_{12}$ and $W_{13}$ is about 5.5 inches.

The first arc $IW_{11}$ defines a first specified circular area having a radius of about 14.4 inches with one stacker wheel axis contained therein. Thus, the arc $IW_{11}$ has a pocket density of about 0.8 stacker wheel axes/per lineal foot from point I. The second arc $IW_{22}$ defines a second specified circular area having a radius of about 23.4 inches with five stacker wheel axes contained therein. Thus, the arc $IW_{22}$ has a pocket density of about 2.6 stacker wheel axes/per lineal foot from point I. The third arc $IW_{43}$ defines a third specified circular area having a radius of about 40.0 inches with fifteen stacker wheel axes contained therein. Thus, the arc $IW_{43}$ has a pocket density of about 4.5 stacker wheel axes/per lineal foot from point I. The fourth arc $IW_{84}$ defines a fourth specified circular area having a radius of about 71.6 inches with thirty-three stacker wheel axes contained therein. Thus, the arc $IW_{84}$ has a pocket density of about 5.5 stacker wheel axes/per lineal foot from point I. Similar calculations can be made for determining the pocket densities (stacker wheel axes/per lineal foot from point I, point S, or any of the points $W_{11}$-$W_{84}$) associated with any of the other distances in Table 4 and Table 5.

Figure 12D:
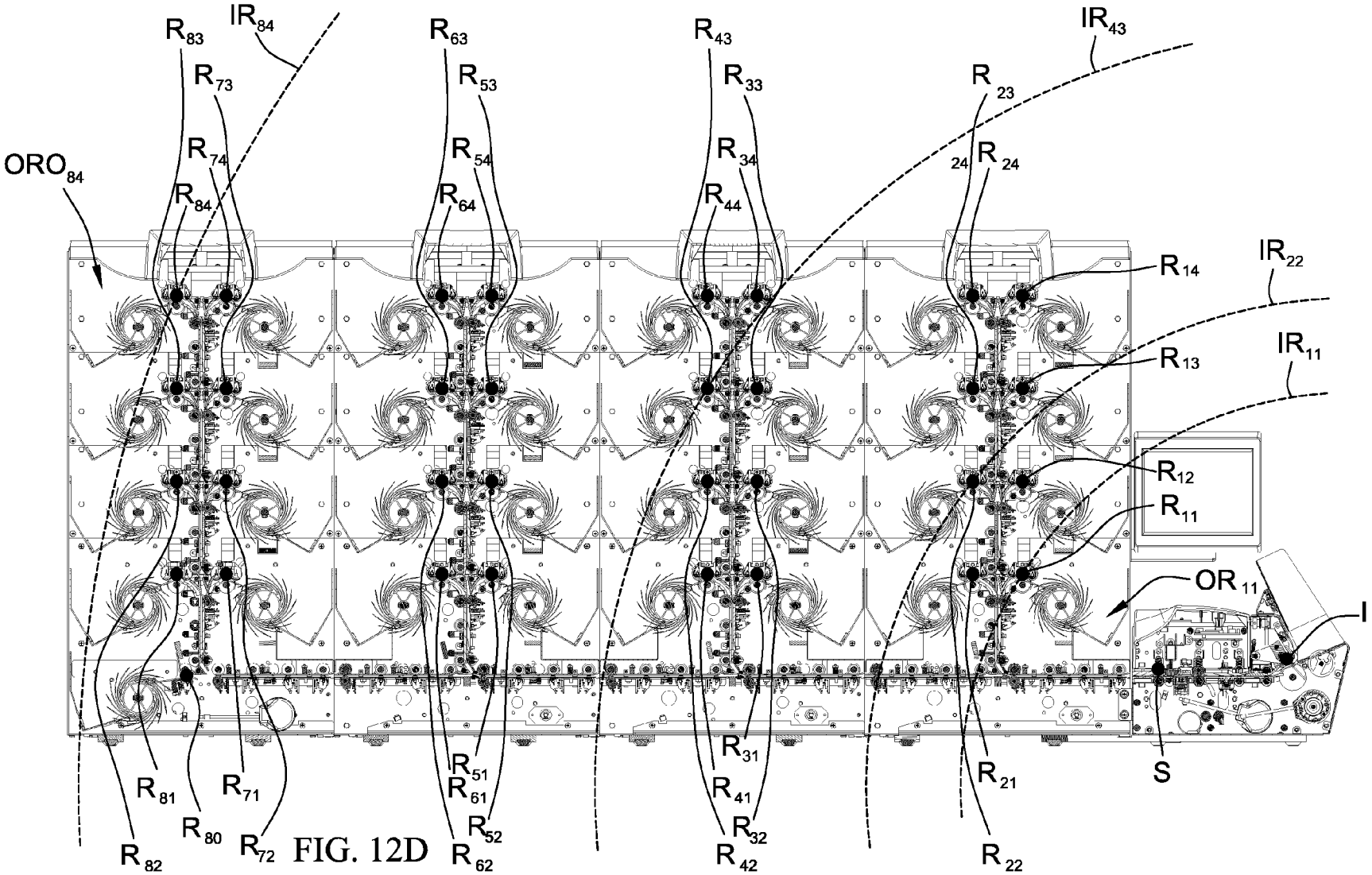

As shown in FIG. 12D, points $R_{11}$-$R_{84}$ are pinch points between respective entry rollers through which bills are directed into respective output receptacles (hereinafter, points $R_{11}$-$R_{84}$ are generally referred to as entry roller locations or a central pinch points). For example, point $R_{11}$ is an entry roller location between the entry rollers through which bills are directed into the first output receptacle $OR_{11}$. For another example, point $R_{84}$ is an entry roller location between the entry rollers through which bills are directed into the thirty-third output receptacle $OR_{84}$.

As shown in FIG. 12D, point I is the geometric center of concentric arcs, where each arc passes through and thus encloses within the arc at least one entry roller location $R_{xx}$. For example, as shown in FIG. 12D, point I is the geometric center of four concentric arcs $IR_{11}$, $IR_{22}$, $IR_{43}$, and $IR_{84}$ where the first arc $IR_{11}$ passes through and thus encloses within the first arc $IR_{11}$ one entry roller location $R_{11}$. Similarly, the second arc $IR_{22}$ passes through and thus encloses within the second arc $IR_{22}$ four entry roller locations $R_{11}$, $R_{12}$, $R_{21}$, and $R_{22}$; the third arc $IR_{43}$ passes through and thus encloses within the third arc $IR_{43}$ fourteen entry roller locations $R_{11}$, $R_{12}$, $R_{13}$, $R_{14}$, $R_{21}$, $R_{22}$, $R_{23}$, $R_{24}$, $R_{31}$, $R_{32}$, $R_{33}$, $R_{41}$, $R_{42}$, and $R_{43}$; the fourth arc $IR_{84}$ passes through and thus encloses within the fourth arc $IR_{84}$ thirty-three entry roller locations $R_{11}$-$R_{84}$.

While not shown as arcs in FIG. 12D, point I may also serve as the geometric center of respective arcs that pass through each of the points $R_{11}$-$R_{84}$. Similarly, Point S may also serve as the geometric center of respective arcs (not shown) that pass through points $R_{11}$-$R_{84}$. According to some embodiments, any of the points $R_{11}$-$R_{84}$ can be used as a center of an arc for purposes of describing pocket densities, such as, for example, point $R_{11}$.

The following table ("Table 6") provides information, according to some embodiments, concerning distances between point I and each of the points $R_{11}$-$R_{84}$, the number of pockets within a given distance of point I (as determined by pockets having their entry roller locations $R_{xx}$ within that distance), and pocket density information given in terms of number of pockets per unit distance from point I.

TABLE 6

| From I to Rxx | | | | | | | | |
|---|---|---|---|---|---|---|---|---|
| Point Rxx | Distance (in.) | Distance (ft.) | # Pockets with Rxx within distance | Pockets per Lineal Foot | Distance (cm) | Pockets per lineal cm | Distance (dm) | Pockets per lineal dm |
| R11 | 17.0 | 1.4 | 1 | 0.7 | 6.7 | 0.1 | 0.7 | 1.5 |
| R12 | 19.4 | 1.6 | 2 | 1.2 | 7.7 | 0.3 | 0.8 | 2.6 |
| R21 | 19.8 | 1.6 | 3 | 1.8 | 7.8 | 0.4 | 0.8 | 3.9 |
| R22 | 21.9 | 1.8 | 4 | 2.2 | 8.6 | 0.5 | 0.9 | 4.6 |

TABLE 6-continued

| From I to Rxx | | | | | | | | |
|---|---|---|---|---|---|---|---|---|
| Point Rxx | Distance (in.) | Distance (ft.) | # Pockets with Rxx within distance | Pockets per Lineal Foot | Distance (cm) | Pockets per lineal cm | Distance (dm) | Pockets per lineal dm |
| R13 | 23.0 | 1.9 | 5 | 2.6 | 9.1 | 0.6 | 0.9 | 5.5 |
| R23 | 25.1 | 2.1 | 6 | 2.9 | 9.9 | 0.6 | 1.0 | 6.1 |
| R14 | 27.2 | 2.3 | 7 | 3.1 | 10.7 | 0.7 | 1.1 | 6.5 |
| R24 | 29.1 | 2.4 | 8 | 3.3 | 11.4 | 0.7 | 1.1 | 7.0 |
| R31 | 32.3 | 2.7 | 9 | 3.3 | 12.7 | 0.7 | 1.3 | 7.1 |
| R32 | 33.6 | 2.8 | 10 | 3.6 | 13.2 | 0.8 | 1.3 | 7.6 |
| R41 | 35.2 | 2.9 | 11 | 3.8 | 13.8 | 0.8 | 1.4 | 7.9 |
| R33 | 35.8 | 3.0 | 12 | 4.0 | 14.1 | 0.9 | 1.4 | 8.5 |
| R42 | 36.4 | 3.0 | 13 | 4.3 | 14.3 | 0.9 | 1.4 | 9.1 |
| R43 | 38.5 | 3.2 | 14 | 4.4 | 15.1 | 0.9 | 1.5 | 9.2 |
| R34 | 38.7 | 3.2 | 15 | 4.7 | 15.2 | 1.0 | 1.5 | 9.9 |
| R44 | 41.1 | 3.4 | 16 | 4.7 | 16.2 | 1.0 | 1.6 | 9.9 |
| R51 | 47.9 | 4.0 | 17 | 4.3 | 18.8 | 0.9 | 1.9 | 9.0 |
| R52 | 48.8 | 4.1 | 18 | 4.4 | 19.2 | 0.9 | 1.9 | 9.4 |
| R53 | 50.3 | 4.2 | 19 | 4.5 | 19.8 | 1.0 | 2.0 | 9.6 |
| R61 | 50.8 | 4.2 | 20 | 4.7 | 20.0 | 1.0 | 2.0 | 10.0 |
| R62 | 51.7 | 4.3 | 21 | 4.9 | 20.3 | 1.0 | 2.0 | 10.3 |
| R54 | 52.4 | 4.4 | 22 | 5.0 | 20.6 | 1.1 | 2.1 | 10.7 |
| R63 | 53.1 | 4.4 | 23 | 5.2 | 20.9 | 1.1 | 2.1 | 11.0 |
| R64 | 55.1 | 4.6 | 24 | 5.2 | 21.7 | 1.1 | 2.2 | 11.1 |
| R71 | 63.5 | 5.3 | 25 | 4.7 | 25.0 | 1.0 | 2.5 | 10.0 |
| R72 | 64.3 | 5.4 | 26 | 4.9 | 25.3 | 1.0 | 2.5 | 10.3 |
| R73 | 65.4 | 5.4 | 27 | 5.0 | 25.7 | 1.0 | 2.6 | 10.5 |
| R80 | 65.6 | 5.5 | 28 | 5.1 | 25.8 | 1.1 | 2.6 | 10.8 |
| R81 | 66.5 | 5.5 | 29 | 5.2 | 26.2 | 1.1 | 2.6 | 11.1 |
| R74 | 67.0 | 5.6 | 30 | 5.4 | 26.4 | 1.1 | 2.6 | 11.4 |
| R82 | 67.1 | 5.6 | 31 | 5.5 | 26.4 | 1.2 | 2.6 | 11.7 |
| R83 | 68.3 | 5.7 | 32 | 5.6 | 26.9 | 1.2 | 2.7 | 11.9 |
| R84 | 69.8 | 5.8 | 33 | 5.7 | 27.5 | 1.2 | 2.7 | 12.0 |

The following table ("Table 7") provides information, according to some embodiments, concerning distances between point S and each of the points $R_{11}$-$R_{84}$, the number of pockets within a given distance of point S (as determined by pockets having their entry roller locations $R_{xx}$ within that distance), and pocket density information given in terms of number of pockets per unit distance from point S.

TABLE 7

| From S to Rxx | | | | | | | | |
|---|---|---|---|---|---|---|---|---|
| Point Rxx | Distance (in.) | Distance (ft.) | # Pockets with Rxx within distance | Pockets per Lineal Foot | Distance (cm) | Pockets per lineal cm | Distance (dm) | Pockets per lineal dm |
| R11 | 9.9 | 0.8 | 1 | 1.2 | 3.9 | 0.3 | 0.4 | 2.6 |
| R21 | 12.4 | 1.0 | 2 | 1.9 | 4.9 | 0.4 | 0.5 | 4.1 |
| R12 | 13.8 | 1.2 | 3 | 2.6 | 5.4 | 0.6 | 0.5 | 5.5 |
| R22 | 15.7 | 1.3 | 4 | 3.1 | 6.2 | 0.6 | 0.6 | 6.5 |
| R13 | 18.6 | 1.5 | 5 | 3.2 | 7.3 | 0.7 | 0.7 | 6.8 |
| R23 | 20.0 | 1.7 | 6 | 3.6 | 7.9 | 0.8 | 0.8 | 7.6 |
| R14 | 23.6 | 2.0 | 7 | 3.6 | 9.3 | 0.8 | 0.9 | 7.5 |
| R31 | 24.5 | 2.0 | 8 | 3.9 | 9.6 | 0.8 | 1.0 | 8.3 |
| R24 | 24.8 | 2.1 | 9 | 4.4 | 9.8 | 0.9 | 1.0 | 9.2 |
| R32 | 26.3 | 2.2 | 10 | 4.6 | 10.4 | 1.0 | 1.0 | 9.6 |
| R41 | 27.4 | 2.3 | 11 | 4.8 | 10.8 | 1.0 | 1.1 | 10.2 |
| R42 | 29.0 | 2.4 | 12 | 5.0 | 11.4 | 1.0 | 1.1 | 10.5 |
| R33 | 29.1 | 2.4 | 13 | 5.4 | 11.5 | 1.1 | 1.1 | 11.3 |
| R43 | 31.6 | 2.6 | 14 | 5.3 | 12.4 | 1.1 | 1.2 | 11.3 |
| R34 | 32.6 | 2.7 | 15 | 5.5 | 12.8 | 1.2 | 1.3 | 11.7 |
| R44 | 34.8 | 2.9 | 16 | 5.5 | 13.7 | 1.2 | 1.4 | 11.7 |
| R51 | 40.0 | 3.3 | 17 | 5.1 | 15.7 | 1.1 | 1.6 | 10.8 |
| R52 | 41.1 | 3.4 | 18 | 5.3 | 16.2 | 1.1 | 1.6 | 11.1 |
| R61 | 42.9 | 3.6 | 19 | 5.3 | 16.9 | 1.1 | 1.7 | 11.2 |
| R53 | 43.0 | 3.6 | 20 | 5.6 | 16.9 | 1.2 | 1.7 | 11.8 |
| R62 | 44.0 | 3.7 | 21 | 5.7 | 17.3 | 1.2 | 1.7 | 12.1 |
| R54 | 45.4 | 3.8 | 22 | 5.8 | 17.9 | 1.2 | 1.8 | 12.3 |
| R63 | 45.7 | 3.8 | 23 | 6.0 | 18.0 | 1.3 | 1.8 | 12.8 |
| R64 | 48.0 | 4.0 | 24 | 6.0 | 18.9 | 1.3 | 1.9 | 12.7 |
| R71 | 55.6 | 4.6 | 25 | 5.4 | 21.9 | 1.1 | 2.2 | 11.4 |
| R72 | 56.5 | 4.7 | 26 | 5.5 | 22.2 | 1.2 | 2.2 | 11.7 |

TABLE 7-continued

| From S to Rxx | | | | | | | | |
|---|---|---|---|---|---|---|---|---|
| Point Rxx | Distance (in.) | Distance (ft.) | # Pockets with Rxx within distance | Pockets per Lineal Foot | Distance (cm) | Pockets per lineal cm | Distance (dm) | Pockets per lineal dm |
| R80 | 57.6 | 4.8 | 27 | 5.6 | 22.7 | 1.2 | 2.3 | 11.9 |
| R73 | 57.8 | 4.8 | 28 | 5.8 | 22.8 | 1.2 | 2.3 | 12.3 |
| R81 | 58.6 | 4.9 | 29 | 5.9 | 23.1 | 1.3 | 2.3 | 12.6 |
| R82 | 59.4 | 4.9 | 30 | 6.1 | 23.4 | 1.3 | 2.3 | 12.8 |
| R74 | 59.6 | 5.0 | 31 | 6.2 | 23.5 | 1.3 | 2.3 | 13.2 |
| R83 | 60.6 | 5.1 | 32 | 6.3 | 23.9 | 1.3 | 2.4 | 13.4 |
| R84 | 62.4 | 5.2 | 33 | 6.3 | 24.6 | 1.3 | 2.5 | 13.4 |

According to some embodiments, the distance between horizontally adjacent entry roller locations $R_{XX}$ is between about 3 inches and about 12.8 inches. For example, according to some embodiments, the distance between entry roller locations $R_{31}$ and $R_{41}$ is about 3 inches. For another example, according to some embodiments, the distance between entry roller locations $R_{21}$ and $R_{31}$ is about 12.8 inches. According to some embodiments, the distance between vertically adjacent entry roller locations $R_{XX}$ is between about 5.0 inches and about 10.0 inches. For example, according to some embodiments, the distance between entry roller locations $R_{11}$ and $R_{12}$ is about 5.5 inches. For another example, according to some embodiments, the distance between entry roller locations $R_{12}$ and $R_{13}$ is about 5.5 inches.

The first arc $IR_{11}$ defines a first specified circular area having a radius of about 17.0 inches with one entry roller location contained therein. Thus, the arc $IR_{11}$ has a pocket density of about 0.7 entry roller locations/per lineal foot from point I. The second arc $IR_{22}$ defines a second specified circular area having a radius of about 21.9 inches with four entry roller locations contained therein. Thus, the arc $IR_{22}$ has a pocket density of about 2.2 entry roller locations/per lineal foot from point I. The third arc $IR_{43}$ defines a third specified circular area having a radius of about 38.5 inches with fourteen entry roller locations contained therein. Thus, the arc $IR_{43}$ has a pocket density of about 4.4 entry roller locations/per lineal foot from point I. The fourth arc $IR_{84}$ defines a fourth specified circular area having a radius of about 69.8 inches with thirty-three entry roller locations contained therein. Thus, the arc $IR_{84}$ has a pocket density of about 5.7 entry roller locations/per lineal foot from point I. Similar calculations can be made for determining the pocket densities (entry roller locations/per lineal foot from point I, point S, or any of the points $R_{11}$-$R_{84}$) associated with any of the other distances in Table 6 and Table 7.

Figure 12E:
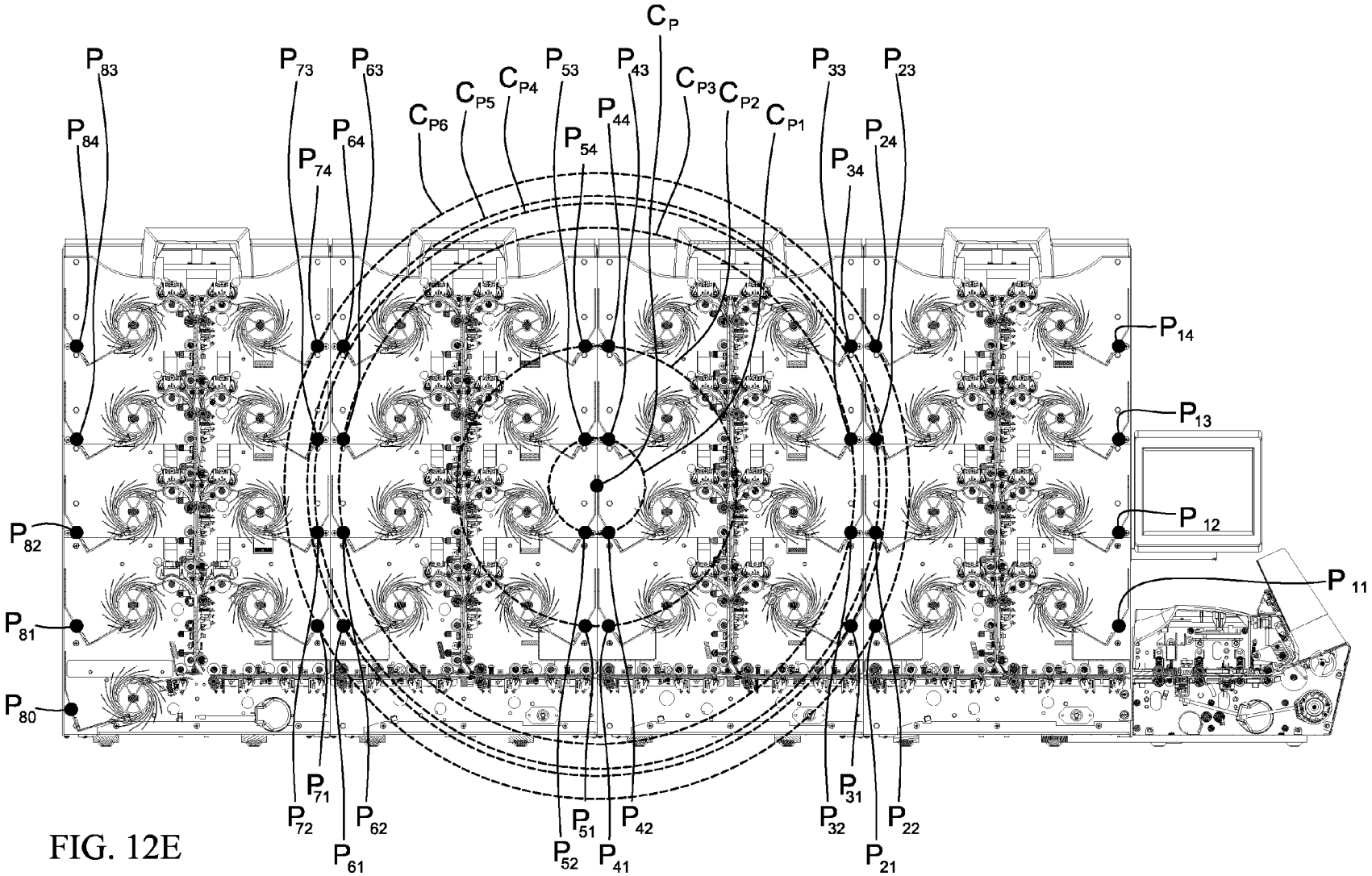

As shown in FIG. 12E, $C_p$ is the geometric center of concentric circles, where each circle passes through and thus encloses within the circle at least four central plate locations $P_{xx}$. For example, as shown in FIG. 12E, $C_p$ is the geometric center of six concentric circles $C_{p1}$, $C_{p2}$, $C_{p3}$, $C_{p4}$, $C_{p5}$, and $C_{p6}$. The first circle $C_{p1}$ passes through and thus encloses within the first circle $C_{p1}$ four central plate locations $P_{42}$, $P_{43}$, $P_{52}$, and $P_{53}$. Similarly, the second circle $C_{p2}$ passes through and thus encloses within the second circle $C_{p2}$ eight central plate locations $P_{41}$, $P_{42}$, $P_{43}$, $P_{44}$, $P_{51}$, $P_{52}$, $P_{53}$, and $P_{54}$; the third circle $C_{p3}$ passes through and thus encloses within the third circle $C_{p3}$ twelve central plate locations $P_{32}$, $P_{33}$, $P_{41}$, $P_{42}$, $P_{43}$, $P_{44}$, $P_{51}$, $P_{52}$, $P_{53}$, $P_{54}$, $P_{62}$, and $P_{63}$; the fourth circle $C_{p4}$ passes through and thus encloses within the fourth circle $C_{p4}$ sixteen central plate locations $P_{22}$, $P_{23}$, $P_{32}$, $P_{33}$, $P_{41}$, $P_{42}$, $P_{43}$, $P_{44}$, $P_{51}$, $P_{52}$, $P_{53}$, $P_{54}$, $P_{62}$, $P_{63}$, $P_{72}$, and $P_{73}$; the fifth circle $C_{p5}$ passes through and thus encloses within the fifth circle $C_{p5}$ twenty central plate locations $P_{22}$, $P_{23}$, $P_{31}$, $P_{32}$, $P_{33}$, $P_{34}$, $P_{41}$, $P_{42}$, $P_{43}$, $P_{44}$, $P_{51}$, $P_{52}$, $P_{53}$, $P_{54}$, $P_{61}$, $P_{62}$, $P_{63}$, $P_{64}$, $P_{72}$, $P_{73}$; the sixth circle $C_{p6}$ passes through and thus encloses within the sixth circle $C_{p6}$ twenty-four central plate locations $P_{21}$, $P_{22}$, $P_{23}$, $P_{24}$, $P_{31}$, $P_{32}$, $P_{33}$, $P_{34}$, $P_{41}$, $P_{42}$, $P_{43}$, $P_{44}$, $P_{51}$, $P_{52}$, $P_{53}$, $P_{54}$, $P_{61}$, $P_{62}$, $P_{63}$, $P_{64}$, $P_{71}$, $P_{72}$, $P_{73}$, and $P_{74}$.

While not shown as circles in FIG. 12E, $C_p$ is also the geometric center of a circle, $C_{p7}$, that passes through points $P_{12}$, $P_{13}$, $P_{82}$, and $P_{83}$, which thus encloses within the circle twenty-eight central plate locations. Similarly, $C_p$ is also the geometric center of a circle, $C_{p8}$, that passes through points $P_{11}$, $P_{14}$, $P_{81}$, and $P_{84}$, which thus encloses within the circle thirty-two central plate locations and $C_p$ is also the geometric center of a circle, $C_{p9}$, that passes through point $P_{80}$, which thus encloses within the circle thirty-three central plate locations.

The first circle $C_{p1}$ defines a first specified circular area having a radius of about 2.9 inches with four central plate locations contained therein. Thus, the circle $C_{p1}$ has a pocket density of about 22.4 central plate locations/square foot of circular area. The second circle $C_{p2}$ defines a second specified circular area having a radius of about 8.3 inches with eight central plate locations contained therein. Thus, the circle $C_{p2}$ has a pocket density of about 5.3 central plate locations/square foot of circular area. The third circle $C_{p3}$ defines a third specified circular area having a radius of about 15.2 inches with twelve central plate locations contained therein. Thus, the circle $C_{p3}$ has a pocket density of about 2.4 central plate locations/square foot of circular area. The fourth circle $C_{p4}$ defines a fourth specified circular area having a radius of about 16.8 inches with sixteen central plate locations contained therein. Thus, the circle $C_{p4}$ has a pocket density of about 2.6 central plate locations/square foot of circular area. The fifth circle $C_{p5}$ defines a fifth specified circular area having a radius of about 17.1 inches with twenty central plate locations contained therein. Thus, the circle $C_{p5}$ has a pocket density of about 3.1 central plate locations/square foot of circular area. The sixth circle $C_{p6}$ defines a sixth specified circular area having a radius of about 18.5 inches with twenty-four central plate locations contained therein. Thus, the circle $C_{p6}$ has a pocket density of about 3.2 central plate locations/square foot of circular area. The seventh circle $C_{p7}$ defines a seventh specified circular area having a radius of about 30.8 inches with twenty-eight central plate locations contained therein. Thus, the circle $C_{p7}$ has a pocket density of about 1.4 central plate locations/square foot of circular area. The eighth circle $C_{p8}$ defines an eighth specified circular area having a radius of about 31.8 inches with thirty-two central plate locations contained therein. Thus, the circle $C_{p8}$ has a pocket density of about 1.5 central plate locations/square foot of circular area. The ninth circle $C_{p9}$ defines a ninth specified circular area having a radius of about 33.7 inches with thirty-three central plate locations contained therein. Thus, the circle $C_{p9}$ has a pocket density of about 1.3 central plate locations/square foot of circular area.

FIG. 13A is a table ("Table 9") providing information, according to some embodiments, concerning distances between point $C_P$ and each of the points $P_{11}$-$P_{84}$ illustrated in FIG. 12E, the number of pockets within a given distance of point $C_P$ (as determined by pockets having their central plate locations $P_{xx}$ within that distance), and pocket density information given in terms of number of pockets per unit distance from point $C_P$, pocket density information given in terms of pockets per area, distances between the furthest points $P_{xx}$-$P_{xx}$ which are equidistant from point $C_P$ (e.g., for circle $C_{P1}$, and points $P_{42}$ and $P_{53}$ are furthest apart—they are spaced apart by the diameter of the circle $C_{P1}$), and pocket density information given in terms of number of pockets per unit maximum distance between a set of points $P_{xx}$-$P_{xx}$ which are equidistant from point $C_P$. For example, According to some embodiments, document processing systems and output portions of document processing systems are provided that have at least 4 pockets having central plate locations within about 5.7 inches of each other. According to some embodiments, document processing systems and output portions of document processing systems are provided that have at least 4 pockets having central plate locations within about 6 inches of each other. According to some embodiments, document processing systems and output portions of document processing systems are provided that have at least 4 pockets having central plate locations within about 7 inches of each other.

According to some embodiments, document processing systems and output portions of document processing systems are provided that have at least 8 pockets having central plate locations within about 16.6 inches of each other. According to some embodiments, document processing systems and output portions of document processing systems are provided that have at least 8 pockets having central plate locations within about 17 inches of each other. According to some embodiments, document processing systems and output portions of document processing systems are provided that have at least 8 pockets having central plate locations within about 20 inches of each other.

According to some embodiments, document processing systems and output portions of document processing systems are provided that have a pocket density about a given point in terms of compactness of the central plate locations of pockets of at least 0.8 pockets per inch or that have a pocket density about a given point in terms of compactness of the central plate locations of pockets of at least 9.5 pockets per foot.

Figure 12F:
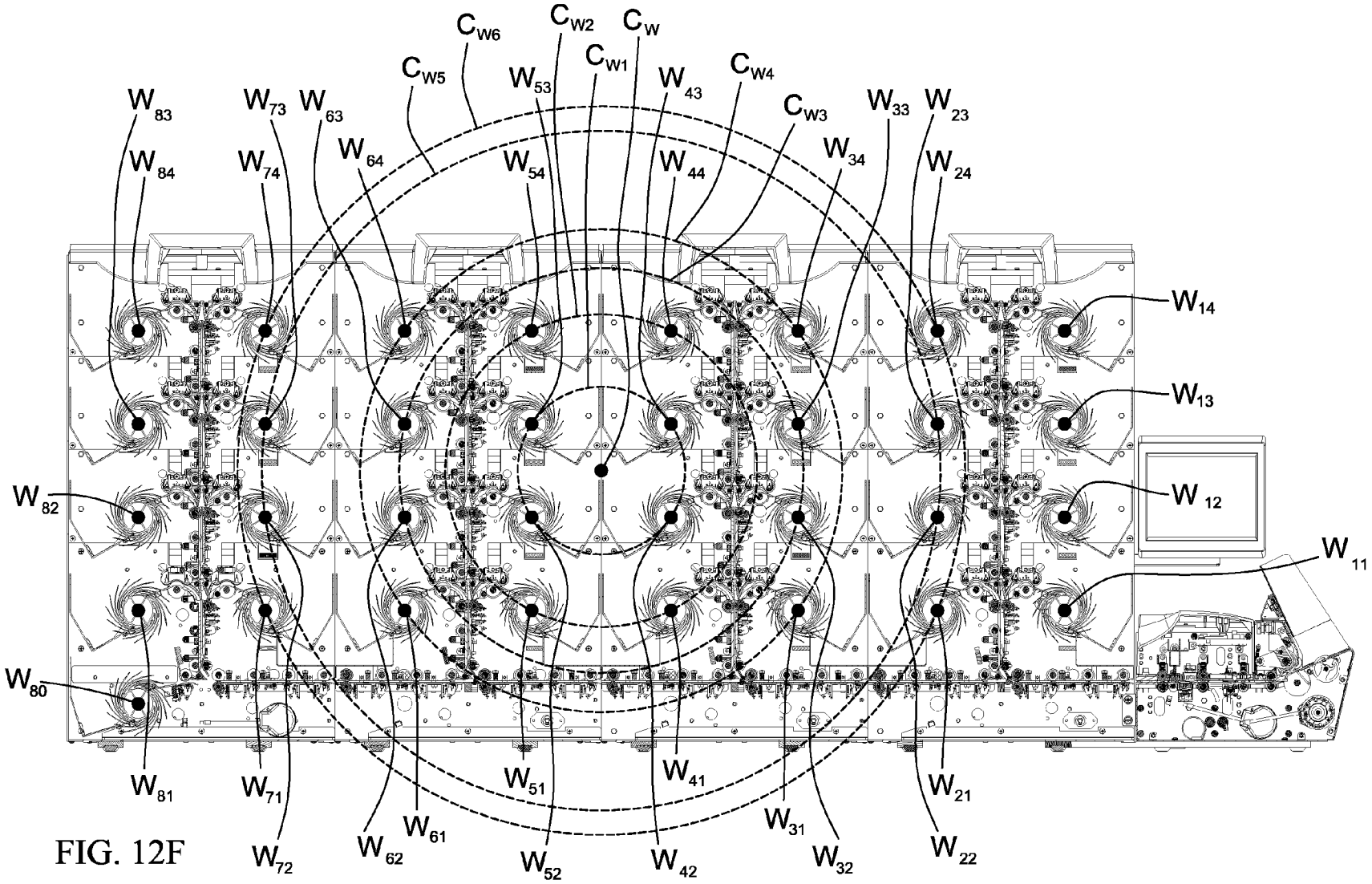

As shown in FIG. 12F, $C_w$ is the geometric center of concentric circles, where each circle passes through and thus encloses within the circle at least four stacker wheel axes $W_{xx}$. For example, as shown in FIG. 12F, $C_w$ is the geometric center of six concentric circles $C_{w1}$, $C_{w2}$, $C_{w3}$, $C_{w4}$, $C_{w5}$, and $C_{w6}$ where the first circle $C_{w1}$ passes through and thus encloses within the first circle $C_{w1}$ four stacker wheel axes $W_{42}$, $W_{43}$, $W_{52}$, and $W_{53}$. Similarly, the second circle $C_{w2}$ passes through and thus encloses within the second circle $C_{w2}$ eight stacker wheel axes $W_{41}$, $W_{42}$, $W_{43}$, $W_{44}$, $W_{51}$, $W_{52}$, $W_{53}$, and $W_{54}$; the third circle $C_{w3}$ passes through and thus encloses within the third circle $C_{w3}$ twelve stacker wheel axes $W_{32}$, $W_{33}$, $W_{41}$, $W_{42}$, $W_{43}$, $W_{44}$, $W_{51}$, $W_{52}$, $W_{53}$, $W_{54}$, $W_{62}$, and $W_{63}$; the fourth circle $C_{w4}$ passes through and thus encloses within the fourth circle $C_{w4}$ sixteen stacker wheel axes $W_{31}$, $W_{32}$, $W_{33}$, $W_{34}$, $W_{41}$, $W_{42}$, $W_{43}$, $W_{44}$, $W_{51}$, $W_{52}$, $W_{53}$, $W_{54}$, $W_{61}$, $W_{62}$, $W_{63}$, and $W_{64}$; the fifth circle $C_{w5}$ passes through and thus encloses within the fifth circle $C_{w5}$ twenty stacker wheel axes $W_{22}$, $W_{23}$, $W_{31}$, $W_{32}$, $W_{33}$, $W_{34}$, $W_{41}$, $W_{42}$, $W_{43}$, $W_{44}$, $W_{51}$, $W_{52}$, $W_{53}$, $W_{54}$, $W_{61}$, $W_{62}$, $W_{63}$, $W_{64}$, $W_{72}$, and $W_{73}$; the sixth circle $C_{w6}$ passes through and thus encloses within the sixth circle $C_{w6}$ twenty-four stacker wheel axes $W_{21}$, $W_{22}$, $W_{23}$, $W_{24}$, $W_{31}$, $W_{32}$, $W_{33}$, $W_{34}$, $W_{41}$, $W_{42}$, $W_{43}$, $W_{44}$, $W_{51}$, $W_{52}$, $W_{53}$, $W_{54}$, $W_{61}$, $W_{62}$, $W_{63}$, $W_{64}$, $W_{71}$, $W_{72}$, $W_{73}$, and $W_{22}$.

While not shown as circles in FIG. 12F, $C_w$ is also the geometric center of a circle, $C_{w7}$, that passes through points $W_{12}$, $W_{13}$, $W_{82}$, and $W_{83}$, which thus encloses within the circle twenty-eight stacker wheel axes. Similarly, $C_w$ is also the geometric center of a circle, $C_{w8}$, that passes through points $W_{11}$, $W_{14}$, $W_{81}$, and $W_{84}$, which thus encloses within the circle thirty-two stacker wheel axes and $C_w$ is also the geometric center of a circle, $C_{w9}$, that passes through point $W_{80}$, which thus encloses within the circle thirty-three stacker wheel axes.

The first circle $C_{w1}$ defines a first specified circular area having a radius of about 5.0 inches with four stacker wheel axes contained therein. Thus, the circle $C_{w1}$ has a pocket density of about 7.5 stacker wheel axes/square foot of circular area. The second circle $C_{w2}$ defines a second specified circular area having a radius of about 9.2 inches with eight stacker wheel axes contained therein. Thus, the circle $C_{w2}$ has a pocket density of about 4.3 stacker wheel axes/square foot of circular area. The third circle $C_{w3}$ defines a third specified circular area having a radius of about 12.0 inches with twelve stacker wheel axes contained therein. Thus, the circle $C_{w3}$ has a pocket density of about 3.9 stacker wheel axes/square foot of circular area. The fourth circle $C_{w4}$ defines a fourth specified circular area having a radius of about 14.3 inches with sixteen stacker wheel axes contained therein. Thus, the circle $C_{w4}$ has a pocket density of about 3.6 stacker wheel axes/square foot of circular area. The fifth circle $C_{w5}$ defines a fifth specified circular area having a radius of about 20.1 inches with twenty stacker wheel axes contained therein. Thus, the circle $C_{w5}$ has a pocket density of about 2.3 stacker wheel axes/square foot of circular area. The sixth circle $C_{w6}$ defines a sixth specified circular area having a radius of about 21.5 inches with twenty-four stacker wheel axes contained therein. Thus, the circle $C_{w6}$ has a pocket density of about 2.4 stacker wheel axes/square foot of circular area. The seventh circle $C_{w7}$ defines a seventh specified circular area having a radius of about 27.5 inches with twenty-eight stacker wheel axes contained therein. Thus, the circle $C_{w7}$ has a pocket density of about 1.7 stacker wheel axes/square foot of circular area. The eighth circle $C_{w8}$ defines an eighth specified circular area having a radius of about 28.6 inches with thirty-two stacker wheel axes contained therein. Thus, the circle $C_{w8}$ has a pocket density of about 1.8 stacker wheel axes/square foot of circular area. The ninth circle $C_{w9}$ defines a ninth specified circular area having a radius of about 30.6 inches with thirty-three stacker wheel axes contained therein. Thus, the circle $C_{w9}$ has a pocket density of about 1.6 stacker wheel axes/square foot of circular area.

Figure 12G:
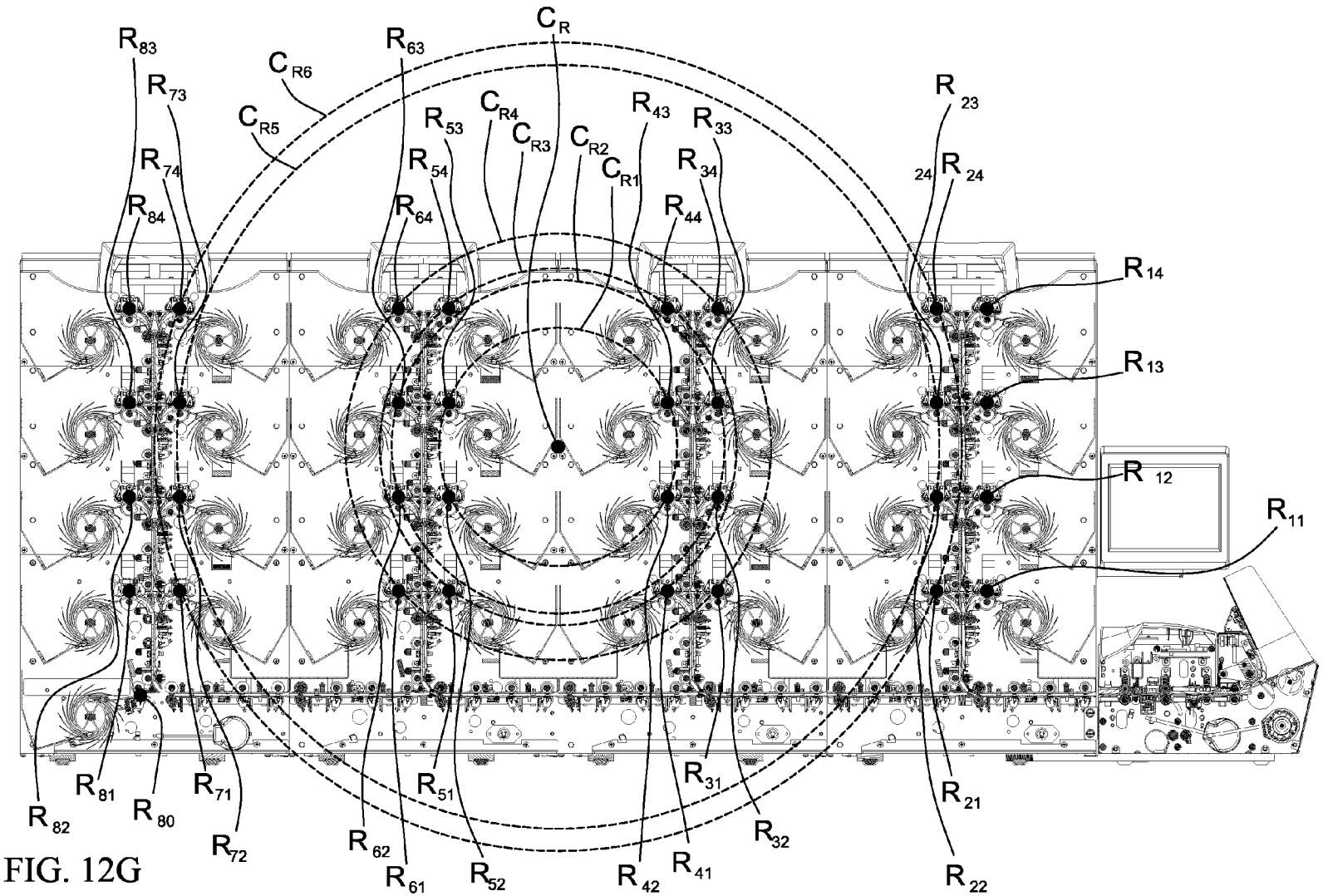

As shown in FIG. 12G, $C_R$ is the geometric center of concentric circles, where each circle passes through and thus encloses within the circle at least four entry roller locations $R_{xx}$. For example, as shown in FIG. 12G, $C_R$ is the geometric center of six concentric circles $C_{R1}$, $C_{R2}$, $C_{R3}$, $C_{R4}$, $C_{R5}$, and $C_{R6}$ where the first circle $C_{R1}$ passes through and thus encloses within the first circle $C_{R1}$ four entry roller locations $R_{42}$, $R_{43}$, $R_{52}$, and $R_{53}$. Similarly, the second circle $C_{R2}$ passes through and thus encloses within the second circle $C_{R2}$ eight entry roller locations $R_{32}$, $R_{33}$, $R_{42}$, $R_{43}$, $R_{52}$, $R_{53}$, $R_{62}$, and $R_{63}$; the third circle $C_{R3}$ passes through and thus encloses within the third circle $C_{R3}$ twelve entry roller locations $R_{32}$, $R_{33}$, $R_{41}$, $R_{42}$, $R_{43}$, $R_{44}$, $R_{51}$, $R_{52}$, $R_{53}$, $R_{54}$, $R_{62}$, and $R_{63}$; the fourth circle $C_{R4}$ passes through and thus encloses within the fourth circle $C_{R4}$ sixteen entry roller locations $R_{31}$, $R_{32}$, $R_{33}$, $R_{34}$, $R_{41}$, $R_{42}$, $R_{43}$, $R_{44}$, $R_{51}$, $R_{52}$, $R_{53}$, $R_{54}$, $R_{61}$, $R_{62}$, $R_{63}$, and $R_{64}$; the fifth circle $C_{R5}$ passes through and thus encloses within the fifth circle $C_{R5}$ twenty entry roller locations $R_{22}$, $R_{23}$, $R_{31}$, $R_{32}$, $R_{33}$, $R_{34}$, $R_{41}$, $R_{42}$, $R_{43}$, $R_{44}$, $R_{51}$, $R_{52}$, $R_{53}$, $R_{54}$, $R_{61}$, $R_{62}$, $R_{63}$, $R_{64}$, $R_{72}$, and $R_{73}$; the sixth circle $C_{R6}$ passes through and thus encloses within the sixth circle $C_{R6}$ twenty-four entry roller locations $R_{21}$, $R_{22}$, $R_{23}$, $R_{24}$, $R_{31}$, $R_{32}$, $R_{33}$, $R_{34}$, $R_{41}$, $R_{42}$, $R_{43}$, $R_{44}$, $R_{51}$, $R_{52}$, $R_{53}$, $R_{54}$, $R_{61}$, $R_{62}$, $R_{63}$, $R_{64}$, $R_{71}$, $R_{72}$, $R_{73}$, and $R_{74}$.

While not shown as circles in FIG. 12G, $C_R$ is also the geometric center of a circle, $C_{R7}$, that passes through points $R_{12}$, $R_{13}$, $R_{82}$, and $R_{83}$, which thus encloses within the circle twenty-eight entry roller locations. Similarly, $C_R$ is also the geometric center of a circle, $C_{R8}$, that passes through points $R_{11}$, $R_{14}$, $R_{81}$, and $R_{84}$, which thus encloses within the circle thirty-two entry roller locations and $C_R$ is also the geometric center of a circle, $C_{R9}$, that passes through point $R_{80}$, which thus encloses within the circle thirty-three entry roller locations The first circle $C_{R1}$ defines a first specified circular area having a radius of about 7.0 inches with four entry roller locations contained therein. Thus, the circle $C_{R1}$ has a pocket density of about 3.8 entry roller locations/square foot of circular area. The second circle $C_{R2}$ defines a second specified circular area having a radius of about 9.7 inches with eight entry roller locations contained therein. Thus, the circle $C_{R2}$ has a pocket density of about 3.9 entry roller locations/square foot of circular area. The third circle $C_{R3}$ defines a third specified circular area having a radius of about 10.4 inches with twelve entry roller locations contained therein. Thus, the circle $C_{R3}$ has a pocket density of about 5.1 entry roller locations/square foot of circular area. The fourth circle $C_{R4}$ defines a fourth specified circular area having a radius of about 12.5 inches with sixteen entry roller locations contained therein. Thus, the circle $C_{R4}$ has a pocket density of about 4.7 entry roller locations/square foot of circular area. The fifth circle $C_{R5}$ defines a fifth specified circular area having a radius of about 22.3 inches with twenty entry roller locations contained therein. Thus, the circle $C_{R5}$ has a pocket density of about 1.8 entry roller locations/square foot of circular area. The sixth circle $C_{R6}$ defines a sixth specified circular area having a radius of about 23.6 inches with twenty-four entry roller locations contained therein. Thus, the circle $C_{R6}$ has a pocket density of about 2.0 entry roller locations/square foot of circular area. The seventh circle $C_{R7}$ defines a seventh specified circular area having a radius of about 25.3 inches with twenty-eight entry roller locations contained therein. Thus, the circle $C_{R7}$ has a pocket density of about 2.0 entry roller locations/square foot of circular area. The eighth circle $C_{R8}$ defines an eighth specified circular area having a radius of about 27.4 inches with thirty-two entry roller locations contained therein. Thus, the circle $C_{R8}$ has a pocket density of about 2.0 entry roller locations/square foot of circular area. The ninth circle $C_{R9}$ defines a ninth specified circular area having a radius of about 28.3 inches with thirty-three entry roller locations contained therein. Thus, the circle $C_{R9}$ has a pocket density of about 1.9 entry roller locations/square foot of circular area.

Figure 12H:
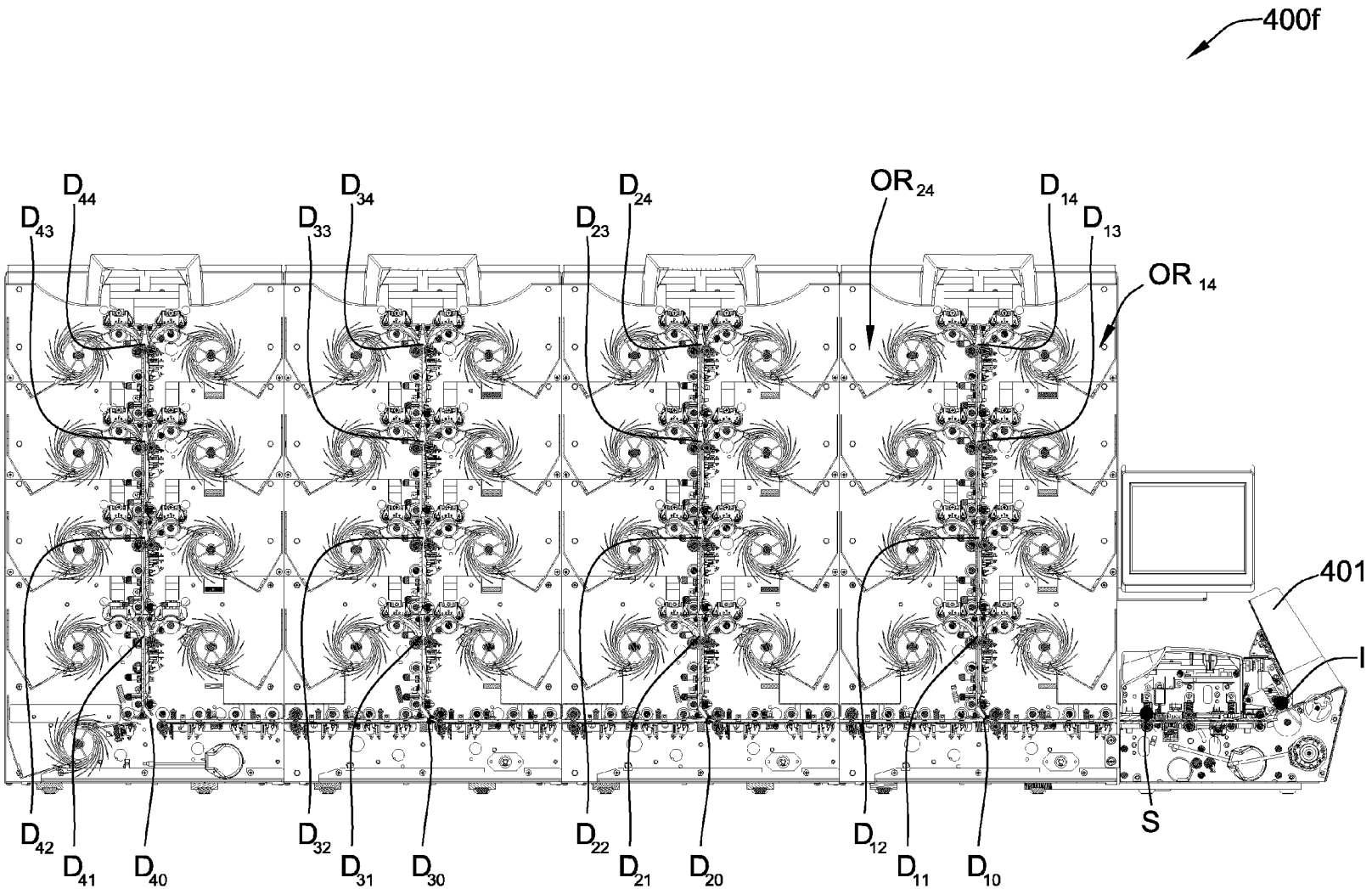

As shown in FIG. 12H, the transport mechanism(s) of the document processing system 400*f* includes various segments or portions located throughout the modules 402, 402', 404, and/or device 401. Each of the base modules 402 and 402' include horizontal and vertical transport path segments. Each of the pocket modules 404 include vertical transport path segments. The portions of the transport mechanism(s) include diverters $D_{10}$-$D_{44}$ as shown in FIG. 12H.

The following table ("Table 8") provides information, according to some embodiments, concerning distances between the tip of diverter $D_{10}$ (the decision point associated with diverter $D_{10}$ along the transport path) to the tip of each of the other diverters $D_{XX}$ (the decision points associated with diverters $D_{xx}$ along the transport path), the number of pockets within a given distance of the tip of diverter $D_{10}$ (as determined by pockets having the tip of a corresponding output diverter $R_{xx}$ within that distance), and pocket density information given in terms of number of pockets per unit distance from point $D_{10}$ as well as other exemplary information associated with transport path lengths between other diverters.

TABLE 8

| Dxx | Distance (in.) | # Pockets within distance | Pockets per distance (in.) | Pockets per distance (ft.) | Distance (cm) | Pockets per distance (cm) | Distance (dm) | Pockets per distance (dm) |
|---|---|---|---|---|---|---|---|---|
| Transport Path Distances from Diverter D10 to Dxx | | | | | | | | |
| D10 | 0.0 | 0 | — | — | — | — | — | — |
| D11 | 4.7 | 2 | 0.4 | 5.1 | 11.9 | 0.2 | 1.2 | 1.7 |
| D12 | 10.2 | 4 | 0.4 | 4.7 | 25.9 | 0.2 | 2.6 | 1.5 |
| D13 | 15.7 | 6 | 0.4 | 4.6 | 39.9 | 0.2 | 4.0 | 1.5 |
| D20 | 15.8 | 6 | 0.4 | 4.6 | 40.1 | 0.1 | 4.0 | 1.5 |
| D21 | 20.5 | 8 | 0.4 | 4.7 | 52.1 | 0.2 | 5.2 | 1.5 |
| D14 | 21.2 | 10 | 0.5 | 5.7 | 53.8 | 0.2 | 5.4 | 1.9 |
| D22 | 26.0 | 12 | 0.5 | 5.5 | 66.0 | 0.2 | 6.6 | 1.8 |
| D23 | 31.5 | 14 | 0.4 | 5.3 | 80.0 | 0.2 | 8.0 | 1.7 |
| D30 | 31.6 | 14 | 0.4 | 5.3 | 80.3 | 0.2 | 8.0 | 1.7 |
| D31 | 36.3 | 16 | 0.4 | 5.3 | 92.2 | 0.2 | 9.2 | 1.7 |
| D24 | 37.0 | 18 | 0.5 | 5.8 | 94.0 | 0.2 | 9.4 | 1.9 |
| D32 | 42.5 | 20 | 0.5 | 5.6 | 108.0 | 0.2 | 10.8 | 1.9 |
| D33 | 48.0 | 22 | 0.5 | 5.5 | 121.9 | 0.2 | 12.2 | 1.8 |
| D40 | 47.4 | 23 | 0.5 | 5.8 | 120.4 | 0.2 | 12.0 | 1.9 |
| D41 | 52.1 | 25 | 0.5 | 5.8 | 132.3 | 0.2 | 13.2 | 1.9 |
| D34 | 57.6 | 27 | 0.5 | 5.6 | 146.3 | 0.2 | 14.6 | 1.8 |
| D42 | 63.1 | 29 | 0.5 | 5.5 | 160.3 | 0.2 | 16.0 | 1.8 |
| D43 | 68.6 | 31 | 0.5 | 5.4 | 174.2 | 0.2 | 17.4 | 1.8 |
| D44 | 74.1 | 33 | 0.4 | 5.3 | 188.2 | 0.2 | 18.8 | 1.8 |

TABLE 8-continued

| Dxx | Distance (in.) | # Pockets within distance | Pockets per distance (in.) | Pockets per distance (ft.) | Distance (cm) | Pockets per distance (cm) | Distance (dm) | Pockets per distance (dm) |
|---|---|---|---|---|---|---|---|---|
| Transport Path Distances from Diverter Dxx to Dxx | | | | | | | | |
| D11-D12 | 5.5 | 4 | 0.7 | 8.7 | 14.0 | 0.3 | 1.4 | 2.9 |
| D12-D13 | 5.5 | 4 | 0.7 | 8.7 | 14.0 | 0.3 | 1.4 | 2.9 |
| D11-D13 | 11.0 | 6 | 0.5 | 6.5 | 27.9 | 0.2 | 2.8 | 2.1 |
| D11-D14 | 16.5 | 8 | 0.5 | 5.8 | 41.9 | 0.2 | 4.2 | 1.9 |

Various transport path distances can be obtained and/or calculated from table 8. For example, according to some embodiments, the transport path length between the diverter $D_{10}$ and the diverter $D_{14}$ is about 21 inches. For another example, according to some embodiments, the transport path length between the diverter $D_{12}$ and the diverter $D_{13}$ is about 5.5 inches. For yet another example, according to some embodiments, the transport path length between the diverter $D_{21}$ and the diverter $D_{22}$ is about 5.5 inches.

Each of the diverters $D_{10}$-$D_{44}$ is configured to selectively intersect adjacent transport path segments at a decision point. Each diverter is configured to selectively divert documents, such as currency bills, being transported along a transport path segment to another transport path segment or into an output receptacle. Each of the output receptacles (e.g., output receptacles $OR_{24}$ and $OR_{14}$) is associated with an output receptacle diverter (e.g., diverters $D_{11}$-$D_{14}$, $D_{21}$-$D_{24}$, $D_{31}$-$D_{34}$, and $D_{41}$-$D_{44}$) that is configured to selectively divert bills into one or more output receptacles. For example, the output receptacle diverter $D_{14}$ is configured to selectively divert bills into output receptacle $OR_{14}$ or into output receptacle $OR_{24}$. Each of the output receptacle diverters is the last diverter that acts upon a bill prior to the bill entering its associated output receptacle(s). Accordingly, an output receptacle diverter associated with a particular output receptacle is the last diverter acting upon a bill prior to the bill entering the particular output receptacle. In FIG. 12H, diverters $D_{10}$, $D_{20}$, and $D_{30}$ are not output receptacle diverters as bills must be acted upon by additional diverters prior to entering any of the output receptacles $OR_{11}$-$OR_{84}$.

According to some embodiments, document processing systems and output portions of document processing systems are provided that have transport path segments having output pocket densities of at least 0.3 pockets per inch or at least 0.4 pockets per foot. According to some embodiments, document processing systems and output portions of document processing systems are provided that have transport path segments having output pocket densities of at least 0.4 pockets per inch or at least 4½ pockets per foot. According to some embodiments, document processing systems and output portions of document processing systems are provided that have transport path segments having output pocket densities of at least 0.5 pockets per inch or at least 5.8 pockets per foot. According to some embodiments, document processing systems and output portions of document processing systems are provided that have transport path segments having output pocket densities of at least 0.6 pockets per inch or at least 6 pockets per foot or at least 7 pockets per foot or at least 8 pockets per foot or at least 8.5 pockets per foot. According to some embodiments, document processing systems and output portions of document processing systems are provided that have transport path segments having output pocket densities of between about 0.4 pockets per inch and about 0.5 pockets per inch or between about 4½ pockets per foot and about 5.8 pockets per foot. According to some embodiments, document processing systems and output portions of document processing systems are provided that have transport path segments having output pocket densities of between about 0.4 pockets per inch and about 0.7 pockets per inch or between about 4½ pockets per foot and about 8.7 pockets per foot.

According to some embodiments, the document processing system 400*f* is a modular system, where one or more of the modules 402, 402', and/or 404 can be removed to result in a different system configuration. Accordingly, the relationships, measurements, distances, and ratios, described herein in relation to the document processing system 400*f* in FIGS. 12A-12H, can be applied to the other document processing systems of the present disclosure.

Single Drive Motor for Plurality of Modules

According to some embodiments, the document processing systems of the present disclosure include a single motor 250 (FIGS. 2B-2C) for moving each of the transport mechanisms of the various modules. For example, according to some embodiments, the document processing system 100, which includes the first base module 102, the second base module 103, the first pocket module 104, and the second pocket module 105, only includes a single prime mover, such as an electric motor, that causes the first base module transport mechanism 121*a*, the second base module transport mechanism 121*b*, the first pocket module transport mechanism 122*a*, and the second pocket module transport mechanism 122*b* to transport documents.

According to some embodiments, the first base module transport mechanism 121*a*, the second base module transport mechanism 121*b*, the first pocket module transport mechanism 122*a*, and the second pocket module transport mechanism 122*b* each includes at least one driver. It is contemplated that the at least one driver can be a gear, a wheel, a sprocket, or a combination thereof. According to some embodiments, the prime mover 250 only directly engages the at least one driver of one of the transport mechanisms, such as, for example, the first pocket module transport mechanism 122*a*. According to such embodiments, the prime mover 250 indirectly engages the at least one driver of the other transport mechanisms via one or more gears, belts, or a combination thereof. According to some alternative embodiments, the prime mover 250 directly engages the at least one driver of all of the transport mechanisms.

It is contemplated that the prime mover 250 can be positioned in various positions of the document processing system 100, 200. For example, as shown in FIGS. 2B and 2C, the prime mover 250 can be positioned within the first pocket module 104. For another example, according to some embodiments, the prime mover 250 can be adjacent to the bottom of the first base module 102, the bottom of the second base module 103, the top of the first pocket module 104, or the top of the second pocket module 105.

According to some embodiments, the document processing systems of the present disclosure include one prime mover for each column of modules. For example, in FIG. 3D, the currency processing system 300*d* includes a first prime mover (not shown) for engaging and moving the transport mechanisms within the first base module 302*a* and the first pocket module 304*a* and a second prime mover (not shown) for engaging and moving the transport mechanisms within the second base module 302*b* and the second pocket module 304*b*. For another example, in FIG. 3F, the currency processing system 300*f* includes (1) a first prime mover (not shown) for engaging and moving the transport mechanisms within a first column of modules including the first base module 302*a*, the first pocket module 304*a*, the fifth pocket module 304*e*, and the ninth pocket module 304*i*; (2) a second prime mover (not shown) for engaging and moving the transport mechanisms within a second column of modules including the second base module 302*b*, the second pocket module 304*b*, the sixth pocket module 304*f*, and the tenth pocket module 304*j*; (3) a third prime mover (not shown) for engaging and moving the transport mechanisms within a third column of modules including the third base module 302*c*, the third pocket module 304*c*, the seventh pocket module 304*g*, and the eleventh pocket module 304*k*; and (4) a fourth prime mover (not shown) for engaging and moving the transport mechanisms within a fourth column of modules including the fourth base module 302*d*, the fourth pocket module 304*d*, the eighth pocket module 304*h*, and the twelfth pocket module 304*i*.

According to some alternative embodiments, the at least one driver of each of the modules is driven by a motor included in the document processing device 101. That is, in these alternative embodiments, none of the modules includes a prime mover.

According to some alternative embodiments, it is contemplated that each of the modules of the present disclosure includes at least one driver positioned such that in response to the modules being connected (e.g., stacked as described herein), the respective at least one drivers engage each other such that rotational movement of one driver is transferred therebetween to the other driver.

Driven Rollers

According to some embodiments, the document processing systems of the present disclosure are configured to transport documents without contacting the documents with a driven belt. That is, according to some embodiments, documents are transported from the input receptacle 110 to one of the output receptacles 109*a-h* without being touched by a continuous belt driven by a motor. Rather, according to some embodiments, the documents are transported using driven rollers. It is contemplated that such a system using driven rollers without driven belts to contact and physically move documents along the transport path is advantageous at least because rollers are generally more durable and can last longer than similarly situated driven belts. Additionally, it is contemplated that rollers can transport documents along the transport path more efficiently, which results in fewer jams and less service downtime as compared to a driven belt system. Driven rollers are also advantageous over driven belts because driven belts are more prone to being dislodged off track during a document jam and/or during jam clearing by an operator.

Multi-Way Diverters

According to some alternative embodiments, the first base module 3-way diverter 195*a* is a multi-way diverter such that the diverter 195*a* can direct documents to one of 2, 3, 4, 5, 6, etc. directions. That is, according to some alternative embodiments, for example, the diverter 195*a* can direct bills to one of 2, 3, 4, 5, 6, etc. output receptacles contained within the first base module 102. Similarly, according to some alternative embodiments, the second base module 3-way diverter 195*b*, the first pocket module 3-way diverter 196*a*, and the second pocket module 3-way diverter 196*b* are multi-way diverters such that the diverters 195*b*, 196*a,b* can direct documents to one of 2, 3, 4, 5, 6, etc. directions in the same or similar fashion as described in reference to the diverter 195*a*.

Configurable Systems

It is contemplated that the document processing systems of the present disclosure are advantageous because the various base modules and pocket modules are highly configurable to the specific needs of a variety of customers. For example, a currency processing system according to aspects of the present disclosure can include a currency processing device, between 1 and 10 base modules, and between 0 and 50 pocket modules. Additionally, the document processing systems of the present disclosure are advantageous because they are configurable in the field. That is, an operator of the document processing systems of the present disclosure can configure and reconfigure a document processing system to include more or less base modules and/or more or less pocket modules as needed depending on the immediate requirements for document processing.

According to some alternative embodiments, the document processing systems of the present disclosure can be configured to include pocket modules that are physically coupled with and abutting the bottom of the respective base modules such that documents can be transported vertically in a downward direction, such as, for example in a direction opposite that of the direction of arrows C and J. For example, it is contemplated that a pocket module can be positioned below the first base module 102 and adjacent the bottom 102*d*. According to such embodiments, the first base module 102 is modified and configured to transport documents from the second segment 125*b* of the transport path to an extension (not shown) of the third segment of the transport path that extends generally-vertically downward from the second segment 125*b* of the transport path in the direction opposite that of arrow C.

According to some alternative embodiments, a document processing device and a base module of the present disclosure are integrated within a single housing. According to some such alternative embodiments, the housing includes an input receptacle positioned on a first end of the housing that is the same as, or similar to the input receptacle 110. Within the housing is at least two output receptacles or pockets configured to receive and store documents therein, at least one detector such as an image scanner, and a transport mechanism the same as, or similar to, the device transport mechanism 120 and the first base module transport mechanism 121*a*.

System Speeds

According to some embodiments, the document processing device 101, 401 and/or the systems 100, 200, 300*a-f*, and 400*a-f* described above are each configured to perform the following processing operations: transport a plurality of currency bills one at a time, with a wide edge leading, past one or more image scanners, such as image scanner(s) 140*a*, and/or 140*b*, scan each currency bill to produce a visually readable image, denominate each of the currency bills based on the produced visually readable images, and/or deliver each currency bill to an output receptacle, such as, for example, output receptacle 190*a*, at a rate of at least about 800 currency bills per minute. According to some embodiments, the document processing devices and systems of the present disclosure can perform one or more or all of the above stated processing operations at a rate of at least about 400 currency bills per minute. According to some embodiments, the document processing devices and systems of the present disclosure can perform one or more or all of the above stated processing operations at a rate of at least about 600 currency bills per minute. According to some embodiments, the document processing devices and systems of the present disclosure can perform one or more or all of the above stated processing operations at a rate of at least about 1000 currency bills per minute. According to some embodiments, the document processing devices and systems of the present disclosure can perform one or more or all of the above stated processing operations at a rate of at least about 1200 currency bills per minute. According to some embodiments, the document processing devices and systems of the present disclosure can perform one or more or all of the above stated processing operations at a rate of at least about 1500 currency bills per minute. According to some embodiments, the document processing devices and systems of the present disclosure can each perform one or more or all of the above stated processing operations at any of the above stated rates for the plurality of currency bills, where the plurality of currency bills are U.S. currency bills. According to some such embodiments, the document processing devices and systems of the present disclosure can each perform one or more or all of the above stated processing operations at any of the above stated rates where the document processing device 101, 401 has a footprint of less than about two square feet and/or a weight of less than about 30 pounds.

Further Embodiments

Embodiment 1: According to some embodiments, a currency bill processing device is provided comprising a housing having a front side in opposing spaced relation to a back side, and a first end in opposing spaced relation to a second end, the front and the back sides being generally orthogonal with respect to the first and the second ends; an input receptacle positioned proximate the first end of the housing, the input receptacle being configured to receive a stack of bills; a second output receptacle proximate the second end of the housing and a first output receptacle horizontally offset from the second output receptacle in a direction toward the first end of the housing, the housing being configured to provide access openings in the front side, the access openings being proximate the first and the second output receptacles thereby permitting operator access into the first and the second output receptacles from the front side of the housing; at least one detector positioned between the input receptacle and the first output receptacle; and a transport mechanism configured to transport bills from the input receptacle, one at a time, along a transport path originating at the input receptacle proximate the first end of the housing, the transport path extending generally horizontally past the at least one detector toward the second end of the housing, the transport path transitioning generally-vertically upward between the first and the second output receptacles, the transport mechanism being further configured to deliver some of the bills toward the first end into the first output receptacle and some of the bills toward the second end into the second output receptacle.

Embodiment 2: The currency bill processing device of embodiment 1, wherein the first and the second output receptacles each have a receiving opening associated therewith, the receiving openings being configured to permit bills from the transport mechanism to be passed therethrough, and the receiving openings being positioned adjacent to and on opposite sides of the generally-vertical portion of the transport path.

Embodiment 3: The currency bill processing device according to any of embodiments 1-2, wherein the first and the second output receptacles each have a receiving opening associated therewith, the receiving openings being configured to permit bills from the transport mechanism to be passed therethrough, and the receiving opening of the first output receptacle facing the receiving opening of the second output receptacle.

Embodiment 4: The currency bill processing device according to any of embodiments 1-3, further comprising a diverter located along the transport path and between the first and the second output receptacles, the diverter being configured to selectively direct bills being transported by the transport mechanism into the first and the second output receptacles.

Embodiment 5: The currency bill processing device according to any of embodiments 1-4, further comprising a pocket module positioned adjacent to a top of the housing, the pocket module including a third and a fourth output receptacle, the third and the fourth output receptacles being horizontally offset from one another.

Embodiment 6: The currency bill processing device of embodiment 5, wherein the transport path extends generally-vertically upward past the first and the second output receptacles and between the third and the fourth output receptacles, the transport mechanism being further configured to deliver some of the bills toward the first end into the third output receptacle and some of the bills toward the second end into the fourth output receptacle.

Embodiment 7: The currency bill processing device according to any of embodiments 1-7, wherein each output receptacle includes a transition surface upon which bills pass as delivered from the transport path into a respective one of the output receptacles, the bills transitioning at least about 90 degrees from the transport path into the respective output receptacle.

Embodiment 8: The currency bill processing device of embodiment 7, wherein the bills transition between about 100 degrees to about 140 degrees from the transport path to the respective output receptacle.

Embodiment 9: The currency bill processing device according to any of embodiments 7-8, wherein each output receptacle includes a belt configured to engage and press bills against a respective one of the transition surfaces as the bills are delivered from the transport path into a respective one of the output receptacles.

Embodiment 10: The currency bill processing device according to any of embodiments 1-9, wherein the transport mechanism transports the bills from the input receptacle to one of the output receptacles without contacting the bills with a driven belt.

Embodiment 11: According to some embodiments, a currency bill processing device for processing a stack of currency bills is provided. The currency bill processing device comprising: an input receptacle configured to receive the stack of currency bills; a first output receptacle and a second output receptacle, each output receptacle having a receiving opening and an access opening associated therewith, the receiving openings being configured to receive bills therethrough, and the access openings being proximate a front side of the currency bill processing device thereby permitting operator access into the first and the second output receptacles from the front side of the currency bill processing device, and the receiving opening of the first output receptacle facing the receiving opening of the second output receptacle such that the first and the second output receptacles are oriented in a back-to-back manner with respect to each other; at least one detector positioned between the input receptacle and the output receptacles; and a transport mechanism configured to transport currency bills, one at a time, from the input receptacle past the at least one detector to one of the output receptacles.

Embodiment 12: The currency bill processing device of embodiment 11, wherein the transport mechanism transports the bills along a transport path originating at the input receptacle proximate a first end of the currency bill processing device, the transport path extending generally horizontally past the at least one detector, the transport path transitioning generally vertically between the first and second output receptacles.

Embodiment 13: The currency bill processing device according to any of embodiments 11-12, further comprising a controller and a diverter, the diverter being positioned between the receiving openings of the first and the second output receptacles, the controller being configured to selectively cause the diverter to direct bills being transported via the transport mechanism into the first and the second output receptacles.

Embodiment 14: The currency bill processing device of embodiment 13, wherein the diverter is configured to transition between at least three positions, the diverter directing bills into the first output receptacle in response to being in a first position, directing bills into the second output receptacle in response to being in a second position, and directing bills past both the first and second output receptacles in response to being in a third position.

Embodiment 15: The currency bill processing device of embodiment 14, wherein the diverter has a slot configured to pass bills therethrough past the first and the second output receptacles in response to the diverter being in the third position.

Embodiment 16: The currency bill processing device according to any of embodiments 1-15, further comprising a controller, a first diverter, and a second diverter, the first and the second diverters being positioned adjacent one another and between the receiving openings of the first and the second output receptacles, the controller being configured to cooperatively control the first and the second diverters to selectively direct bills being transported via the transport mechanism into one of the first and the second output receptacles and past the first and the second output receptacles.

Embodiment 17: The currency bill processing device according to any of embodiments 1-16, wherein each of the bills in the stack of bills has two parallel wide edges, and wherein the transport mechanism transports the bills in a wide-edge leading manner such that one of the wide edges is the sole leading edge during transport from the input receptacle to one of the output receptacles.

Embodiment 18: The currency bill processing device according to any of embodiments 1-17, wherein each of the bills is moved from the input receptacle to one of the plurality of output receptacles without rotating the bill around an axis passing through a leading edge and a trailing edge of the bill.

Embodiment 19: The currency bill processing device according to any of embodiments 1-18, wherein the transport mechanism transports the bills from the input receptacle to one of the output receptacles without contacting the bills with a driven belt.

Embodiment 20: The currency bill processing device according to any of embodiments 1-19, wherein the transport mechanism includes a moveable transport plate and a stationary transport plate, wherein the moveable transport plate is pivotably within the device, the moveable transport plate having an open position and a closed position, the moveable transport plate being generally parallel to the stationary transport plate in the closed position, and the moveable transport plate being generally oblique with respect to the stationary transport plate in the open position such that bills remaining on the moveable transport plate slide toward the front side of the currency bill processing device in response to the moveable transport plate being in the open position.

Embodiment 21:The currency bill processing device of embodiment 20, wherein the transport mechanism further comprises a latch assembly configured to selectively retain the moveable transport plate in the closed position.

Embodiment 22: The currency bill processing device of embodiment 21, wherein the latch assembly includes a knob rigidly mounted to the moveable transport plate, and a latch pivotably mounted to the stationary transport plate, the latch including a roller mounted at one end thereof, the knob being configured to receive and mate with the roller and thereby lock the latch to the knob whereby the moveable transport plate is retained in the closed position.

Embodiment 23: The currency bill processing device of embodiment 22, wherein the latch is moveable from a latched orientation to an unlatched orientation, the latch assembly further comprising a biasing member biasing the latch into the latched orientation.

Embodiment 24: The currency bill processing device according to any of embodiments 1-23, wherein the currency bill processing device has a pocket density of about 1.5 output receptacles per cubic foot.

Embodiment 25: The currency bill processing device according to any of embodiments 1-24, wherein the transport mechanism is configured to transport currency bills, one at a time, from the input receptacle at a rate of at least about 400 bills per minute.

Embodiment 26: The currency bill processing device according to any of embodiments 1-24, wherein the transport mechanism is configured to transport currency bills, one at a time, from the input receptacle at a rate of at least about 800 bills per minute.

Embodiment 27: The currency bill processing device according to any of embodiments 1-24, wherein the transport mechanism is configured to transport currency bills, one at a time, from the input receptacle at a rate of at least about 1000 bills per minute.

Embodiment 28: The currency bill processing device according to any of embodiments 1-24, wherein the transport mechanism is configured to transport currency bills, one at a time, from the input receptacle at a rate of at least about 1200 currency bills per minute.

Embodiment 29: According to some embodiment a method of transporting bills from a stack of bills in an input receptacle of a currency bill processing device to at least one of a plurality of output receptacles including first and second horizontally-offset output receptacles is provided. The method comprises: receiving a stack of bills in the input receptacle of the currency bill processing device; transporting the bills, one at a time, from the input receptacle along a first segment of a transport path past at least one detector, the first segment including a generally-horizontal portion; generating data associated with the bills via the at least one detector; transporting the bills from the first segment along a second segment of the transport path, the second segment extending in a generally horizontal direction beneath the first and the second output receptacles; transporting the bills from the second segment along a third segment of the transport path that extends generally vertically from the second segment between the first and the second output receptacles; delivering some of the bills from third segment into the first output receptacle; and delivering some of the bills from third segment into the second output receptacle, wherein the bills are delivered to one of the plurality of output receptacles based in part on the generated data.

Embodiment 30: The method of embodiment 29, wherein the bills are transported from the input receptacle to one of the plurality of output receptacles without changing a leading edge of the bill and without rotating the bill around an axis passing through the leading edge and a trailing edge of the bill.

Embodiment 31: The method according to any of embodiments 29-30, wherein the plurality of output receptacles further comprises third and fourth horizontally-offset output receptacles, the third and the fourth output receptacles being vertically offset from the first and the second output receptacles, the method further comprising: transporting bills not delivered to one of the first and the second output receptacles along a fourth segment of the transport path that extends generally vertically from the third segment between the third and the fourth output receptacles; delivering some of the bills from the fourth segment to the third output receptacle; and delivering some of the bills from the fourth segment to the fourth output receptacle.

Embodiment 32: The method of embodiment 31, wherein the currency bill processing device has a pocket density between about 0.9 and about 1.7 output receptacles per square foot of faceprint.

Embodiment 33: The method according to any of embodiments 31-32, wherein the plurality of output receptacles further comprises fifth and sixth horizontally-offset output receptacles, the fifth and the sixth output receptacles being vertically offset from the first and the second output receptacles and the third and the fourth output receptacles, the method further comprising: transporting bills not delivered to one of the first, the second, the third, and the fourth output receptacles along a fifth segment of the transport path that extends generally vertically from the fourth segment between the fifth and the sixth output receptacles; delivering some of the bills from the fifth segment to the fifth output receptacle; and delivering some of the bills from the fifth segment to the sixth output receptacle.

Embodiment 34: The method according to any of embodiments 29-33, wherein the currency bill processing device has a pocket density between about 1.0 and about 1.9 output receptacles per square foot of faceprint.

Embodiment 35: The method according to any of embodiments 29-34, wherein the bills transition through an angle between about 100 degrees and about 140 degrees while being delivered from the transport path into one of the plurality of output receptacles.

Embodiment 36: The method of embodiment 35, wherein each of the bills is transported from the input receptacle to one of the plurality of output receptacles without touching a continuous belt driven by a motor.

Embodiment 37: The method of embodiment 29, wherein the first and the second output receptacles each have a receiving opening in a respective side portion, the side portions laying in one or more planes parallel to a first plane, the first and the second output receptacles each have an access opening in a respective front portion, the front portions laying in one or more planes parallel to a second plane, the second plane being generally orthogonal with respect to the first plane, the receiving openings being configured to receive therethrough bills from the third segment of the transport path, and the access openings configured to provide operator access to retrieve bills from associated output receptacles, the receiving opening of the first output receptacle facing the receiving opening of the second output receptacle across the third segment of the transport path.

Embodiment 38: The method according to any of embodiments 29-37 wherein the act of transport bills from the input receptacle comprises transporting bills at a rate of at least about 400 bills per minute.

Embodiment 39: The method according to any of embodiments 29-37 wherein the act of transport bills from the input receptacle comprises transporting bills at a rate of at least about 800 bills per minute.

Embodiment 40: The method according to any of embodiments 29-37 wherein the act of transport bills from the input receptacle comprises transporting bills at a rate of at least about 1000 bills per minute.

Embodiment 41: The method according to any of embodiments 29-37 wherein the act of transport bills from the input receptacle comprises transporting bills at a rate of at least about 1200 bills per minute.

Embodiment 42: According to some embodiments, a currency processing system is provided comprising: a currency processing device having a first end and a second opposing end, the currency processing device including: an input receptacle configured to receive a plurality of bills, the input receptacle being positioned proximate to the first end; at least one detector configured to detect characteristic information from the bills and to generate data associated with each bill, the at least one detector being positioned between the first and the second ends of the currency processing device; and a device transport mechanism configured to transport the plurality of bills, one at a time, along a first segment of a transport path, the first segment of the transport path extending from the input receptacle past the at least one detector to a device outlet opening, the device outlet opening being located in the second end of the currency processing device; and a first base module configured to detachably connect to the second end of the currency processing device, the first base module including: a first end and a second opposing end; a top and an opposing bottom; a first base module inlet opening in operative communication with the device outlet opening of the currency processing device such that the first base module inlet opening receives bills transported through the device outlet opening via the device transport mechanism, the first base module inlet opening being located in the first end of the first base module; a first outlet opening of the first base module located in the second end of the first base module; a second outlet opening of the first base module located in the top of the first base module; a first and a second output receptacle configured to receive bills, the first and the second output receptacles being positioned between the first and the second ends and between the top and the bottom of the first base module; and a first base module transport mechanism configured to selectively transport bills received through the first base module inlet opening along a second segment of the transport path, the second segment of the transport path extending from the first base module inlet opening to the first outlet opening of the first base module, the second segment being positioned beneath the first and the second output receptacles, a third segment of the transport path extending generally-vertically upward from the second segment of the transport path between the first and the second output receptacles, the first base module transport mechanism being further configured to selectively deliver some of the bills from the third segment into the first output receptacle, some of the bills from the third segment into the second output receptacle, some of the bills from the second segment to the first outlet opening of the first base module, and some of the bills from the third segment to the second outlet opening of the first base module.

Embodiment 43: The currency processing system of embodiment 42, further comprising a first pocket module having a first pocket module inlet opening and a first pocket module outlet opening, the first pocket module being detachably connected to the first base module, the first pocket module being positioned adjacent to the top of the first base module in response to being connected thereto such that the first pocket module inlet opening is in operative communication with the second outlet opening of the first base module, the first pocket module being configured to receive bills transported through the second outlet opening of the first base module via the first pocket module inlet opening, the first pocket module including a third and a fourth output receptacle, the third and the fourth output receptacles each being configured to receive at least some of the bills received through the first pocket module inlet opening.

Embodiment 44: The currency processing system of embodiment 43, wherein the first pocket module further includes a first pocket module transport mechanism, the first pocket module transport mechanism being configured to transport bills received through the first pocket module inlet opening along a fourth segment of the transport path, the fourth segment of the transport path extending generally vertically from the first pocket module inlet opening between the third and the fourth output receptacles to the first pocket module outlet opening, the first pocket module further comprising one or more diverters configured to selectively direct bills being transported by the first pocket module transport mechanism from the fourth segment of the transport path into the third and the fourth output receptacles, the first pocket module transport mechanism being configured to transport undiverted bills along the fourth segment past the third and the fourth output receptacles and through the first pocket module outlet opening.

Embodiment 45: The currency processing system according to any of embodiments 42-44, further comprising a second base module configured to detachably connect to the second end of the first base module, the second base module including: a first end and a second opposing end; a top and an opposing bottom; a second base module inlet opening in operative communication with the first outlet opening of the first base module such that the second base module inlet opening receives bills transported through the first outlet opening of the first base module, the second base module inlet opening being located in the first end of the second base module; a first outlet opening of the second base module located in the second end of the second base module; a second outlet opening of the second base module located in the top of the second base module; a fifth and a sixth output receptacle configured to receive bills, the fifth and the sixth output receptacles being positioned between the first and the second ends and between the top and the bottom of the second base module; and a second base module transport mechanism configured to selectively transport bills received through the second base module inlet opening along a fifth segment of the transport path, the fifth segment of the transport path extending from the second base module inlet opening to the first outlet opening of the second base module, the fifth segment being positioned beneath the fifth and the sixth output receptacles, a sixth segment of the transport path extending generally-vertically upward from the fifth segment of the transport path between the fifth and the sixth output receptacles, the second base module transport mechanism being further configured to selectively deliver bills from the sixth segment into the fifth and the sixth output receptacles, from the sixth segment to the second outlet opening of the second base module, and from the fifth segment to the first outlet opening of the second base module.

Embodiment 46: The currency processing system of embodiment 45, wherein the first and the second base modules are structurally identical and operatively interchangeable.

Embodiment 47: The currency processing system according to any of embodiments 45-46, further comprising a first pocket module having a first pocket module inlet opening and a first pocket module outlet opening, the first pocket module being positioned adjacent to the top of the first base module such that the first pocket module inlet opening is in operative communication with the second outlet opening of the first base module, the first pocket module being detachably connected to the first base module, the first pocket module being configured to receive bills through the first pocket module inlet opening, the first pocket module including a third and a fourth output receptacle, the third and the fourth output receptacles each being configured to receive at least some of the bills transported through the first pocket module inlet opening.

Embodiment 48: The currency processing system of embodiment 47, further comprising a second pocket module having a second pocket module inlet opening and a second pocket module outlet opening, the second pocket module being positioned adjacent to the top of the of the second base module such that the second pocket module inlet opening is in operative communication with the second outlet opening of the second base module, the second pocket module being detachably connected to the second base module, the second pocket module being configured to receive bills through the second pocket module inlet opening, the second pocket module including a seventh and an eighth output receptacle, the seventh and the eighth output receptacles each being configured to receive at least some of the bills transported through the second pocket module inlet opening.

Embodiment 49: The currency bill processing system of embodiment 48, wherein the first and the second pocket modules are structurally identical and operatively interchangeable.

Embodiment 50: The currency processing system according to any of embodiments 48-49, wherein the first pocket module is further configured to detachably connect to the top of the second base module and receive bills transported through the second outlet opening of the second base module.

Embodiment 51: The currency processing system of embodiment 50, wherein the second pocket module is further configured to detachably connect to the top of the first base module and receive bills transported through the second outlet opening of the first base module.

Embodiment 52: The currency processing system of embodiment 48, wherein the first pocket module is further configured to detachably connect to a top of the second pocket module and receive bills therefrom, and wherein the second pocket module is further configured to detachably connect to a top of the first pocket module and receive bills therefrom.

Embodiment 53: The currency processing system of embodiment 52, wherein the first pocket module is further configured to detachably connect to the second pocket module such that the first pocket module inlet opening mates with the second pocket module outlet opening to receive bills therefrom.

Embodiment 54: The currency processing system of embodiment 53, wherein the second pocket module is further configured to detachably connect to the first pocket module such that the second pocket module inlet opening mates with the first pocket module outlet opening to receive bills therefrom.

Embodiment 55: The currency processing system of embodiment 48, further comprising a third pocket module having a third pocket module inlet opening and a third pocket module outlet opening, the third pocket module being configured to detachably connect to a top of the first pocket module or a top of the second pocket module such that the third pocket module inlet opening is in operative communication with the first pocket module outlet opening or the second pocket module outlet opening to receive bills through the third pocket module inlet opening, the third pocket module including a ninth and a tenth output receptacle, the ninth and the tenth output receptacles being configured to receive at least some of the bills received through the third pocket module inlet opening.

Embodiment 56: The currency processing system according to any of embodiments 42-55, wherein the first base module further comprises a diverter located along the third segment of the transport path between the first and the second output receptacles, the diverter being configured to selectively direct some of the bills being transported by the first base module transport mechanism from the third segment into the first output receptacle and the second output receptacle.

Embodiment 57: The currency processing system of embodiment 56, wherein the diverter is configured to transition between at least three positions, the diverter directing bills into the first output receptacle in response to the diverter being in the first position, directing bills into the second output receptacle in response to the diverter being in the second position, and directing bills past both the first and the second output receptacles in response to the diverter being in the third position.

Embodiment 58: The currency processing system according to any of embodiments 42-57, wherein the first base module further comprises a first and a second diverter positioned adjacent one another, the first and the second diverters being located along the third segment of the transport path between the first and the second output receptacles, the first and the second diverters being cooperatively configured to selectively direct some of the bills being transported by the first base module transport mechanism from the third segment into the first output receptacle and the second output receptacle, and some of the bills past the first and the second output receptacles toward the second outlet opening of the first base module.

Embodiment 59: The currency processing system of embodiment 45, further comprising a first pocket module, a second pocket module, and a third pocket module, each pocket module being configured to detachably connect to and receive bills from the first base module, the second base module, or one of the pocket modules, each of the pocket modules including at least one output receptacle configured to receive bills.

Embodiment 60: The currency processing system of embodiment 59, wherein the first, the second, and the third pocket modules are structurally identical and operatively interchangeable.

Embodiment 61: The currency processing system according to any of embodiments 59-60, wherein the first pocket module includes a first pocket module transport mechanism configured to transport bills along a fourth segment of the transport path, the second pocket module includes a second pocket module transport mechanism configured to transport bills along a seventh segment of the transport path, and the third pocket module includes a third pocket module transport mechanism configured to transport bills along an eighth segment of the transport path, and wherein the first base module transport mechanism, the second base module transport mechanism, the first pocket module transport mechanism, the second pocket module transport mechanism, and the third pocket module transport mechanism each include at least one driver.

Embodiment 62: The currency processing system of embodiment 61, wherein the at least one driver is a gear, a wheel, a sprocket, or a combination thereof.

Embodiment 63: The currency processing system according to any of embodiments 61-62, further comprising a prime mover configured to drive one or more of the at least one drivers of the first base module transport mechanism, the second base module transport mechanism, the first pocket module transport mechanism, the second pocket module transport mechanism, and the third pocket module transport mechanism such that the prime mover causes the first base module transport mechanism, the second base module transport mechanism, the first pocket module transport mechanism, the second pocket module transport mechanism, and the third pocket module transport mechanism to transport the bills.

Embodiment 64: The currency processing system of embodiment 63, wherein the prime mover is adjacent to the bottom of the first base module, the bottom of the second base module, or a top of one of the first, the second, and the third pocket modules.

Embodiment 65: The currency processing system of embodiment 63, wherein the prime mover only directly engages the at least one driver of one of the transport mechanisms.

Embodiment 66: The currency processing system of embodiment 65, wherein the prime mover indirectly engages the at least one driver of the other transport mechanisms via one or more gears, belts, or a combination thereof.

Embodiment 67: The currency processing system according to any of embodiments 42-66, wherein the first and the second output receptacles each have a receiving opening and an access opening associated therewith, the receiving openings being configured to permit bills from the third segment of the transport path to be passed therethrough, the access openings being proximate a front side of the first base module thereby permitting operator access into the first and the second output receptacles from the front side of the first base module, the receiving opening of the first output receptacle facing the receiving opening of the second output receptacle such that the first and the second output receptacles are oriented in a back-to-back manner with respect to each other.

Embodiment 68: The currency processing system according to any of embodiments 42-67, wherein each of the bills is transported from the input receptacle to one of the output receptacles without rotating the bill around an axis passing through a leading edge and a trailing edge of the bill.

Embodiment 69: The currency processing system according to any of embodiments 42-67 wherein the device transport mechanism is configured to transport the plurality of bills, one at a time, from the input receptacle at a rate of at least about 400 bills per minute.

Embodiment 70: The currency processing system according to any of embodiments 42-67 wherein the device transport mechanism is configured to transport the plurality of bills, one at a time, from the input receptacle at a rate of at least about 800 bills per minute.

Embodiment 71: The currency processing system according to any of embodiments 42-67 wherein the device transport mechanism is configured to transport the plurality of bills, one at a time, from the input receptacle at a rate of at least about 1000 bills per minute.

Embodiment 72: The currency processing system according to any of embodiments 42-67 wherein the device transport mechanism is configured to transport the plurality of bills, one at a time, from the input receptacle at a rate of at least about 1200 bills per minute.

Embodiment 73: A currency processing system is provided comprising: a housing having a front side with a width dimension and a height dimension that define a faceprint of the currency processing device; a plurality of output receptacles contained within the housing, the housing being configured to provide access openings in the front side, respective ones of the access openings being proximate the plurality output receptacles thereby permitting operator access into the plurality of output receptacles from the front side of the housing; a transport mechanism configured to transport bills along one or more transport paths to one or more of the plurality of output receptacles at a rate of at least about 800 documents per minute; wherein the currency processing system has a pocket density of at least about 0.75 pockets per square foot of faceprint.

Embodiment 74: The currency processing system of embodiment 73, wherein the plurality of output receptacles comprises at least 3 output receptacles.

Embodiment 75: The currency processing system of embodiment 73, wherein the plurality of output receptacles comprises 5 or more output receptacles and the pocket density is at least about 0.9 pockets per square foot of faceprint.

Embodiment 76: The currency processing system of embodiment 73, wherein the plurality of output receptacles comprises 7 or more output receptacles and the pocket density is at least about 1.0 pocket per square foot of faceprint.

Embodiment 77: The currency processing system of embodiment 73, wherein the plurality of output receptacles comprises 9 or more output receptacles and the pocket density is at least about 0.9 pockets per square foot of faceprint.

Embodiment 78: The currency processing system of embodiment 73, wherein the plurality of output receptacles comprises 9 or more output receptacles and the pocket density is at least about 1.1 pockets per square foot of faceprint.

Embodiment 79: The currency processing system of embodiment 73, wherein the plurality of output receptacles comprises 17 or more output receptacles and the pocket density is at least about 1.4 pockets per square foot of faceprint.

Embodiment 80: The currency processing system of embodiment 73, wherein the plurality of output receptacles comprises at least about 33 output receptacles and the pocket density is at least about 1.7 pockets per square foot of faceprint.

Embodiment 81: The currency processing system of embodiment 73, further comprising an input receptacle, the input receptacle being configured to receive a stack of documents to be transported via the transport mechanism.

Embodiment 82: The currency processing system of claim embodiment 81, further comprising at least one detector positioned between the input receptacle and a first one of the plurality of output receptacles.

Embodiment 83: A currency processing system, comprising: one or more modules coupled together, the one or more coupled modules having a front side; the one or more coupled modules having a width dimension and a height dimension that define a faceprint of the currency processing system; one or more output receptacles contained within each of the modules, each module being configured to provide one or more access openings in the front side, respective ones of the access openings being proximate the one or more output receptacles thereby permitting operator access into the output receptacles from the front side of the one or more coupled modules; one or more transport mechanisms contained within each of the modules configured to transport bills along one or more transport paths to one or more of the output receptacles at a rate of at least about 800 documents per minute; wherein the currency processing system has a pocket density of at least about 0.75 pockets per square foot of faceprint.

Embodiment 84: The currency processing system of embodiment 83, wherein the one or more modules comprises a base module and wherein the one or more output receptacles comprises at least 3 output receptacles.

Embodiment 85: The currency processing system of embodiment 83, wherein the one or more modules comprises a base module coupled to a pocket module; the base module comprising two or more output receptacles; the pocket module comprising two or more output receptacles; and wherein the pocket density of the currency processing system is at least about 0.9 pockets per square foot of faceprint.

Embodiment 86: The currency processing system of embodiment 83, wherein the one or more modules comprises a base module coupled to two pocket modules; the base module comprising two or more output receptacles; each of the pocket modules comprising two or more output receptacles; and wherein the pocket density of the currency processing system is at least about 1.0 pocket per square foot of faceprint.

Embodiment 87: The currency processing system of embodiment 83, wherein the one or more modules comprises four base modules coupled together, each base module including two or more output receptacles; and wherein the pocket density of the currency processing system is at least about 0.9 pockets per square foot of faceprint.

Embodiment 88: The currency processing system of embodiment 83, wherein the one or more modules comprises two base modules coupled to two pocket modules; each of the base modules comprising two or more output receptacles; each of the pocket modules comprising two or more output receptacles; and wherein the pocket density of the currency processing system is at least about 1.1 pockets per square foot of faceprint.

Embodiment 89: The currency processing system of embodiment 83, wherein the one or more modules comprises two base modules coupled to six pocket modules; each of the base modules comprising two or more output receptacles; each of the pocket modules comprising two or more output receptacles; and wherein the pocket density of the currency processing system is at least about 1.4 pockets per square foot of faceprint.

Embodiment 90: The currency processing system of embodiment 83, wherein the one or more modules comprises four base modules coupled to twelve pocket modules; each of the base modules comprising two or more output receptacles; each of the pocket modules comprising two or more output receptacles; and wherein the pocket density of the currency processing system is at least about 1.7 pockets per square foot of faceprint.

Embodiment 91: The currency processing system according to any of embodiments 83-90, further comprising a document processing device coupled to the one or more coupled modules, the document processing device having an input receptacle configured to receive a stack of documents to be transported via the one or more transport mechanisms.

Embodiment 92: The currency processing system of claim embodiment 91, wherein the document processing device further has at least one detector positioned between the input receptacle and a first one of the one or more output receptacles.

Embodiment 93: A currency processing system, comprising: an output portion having one or more modules coupled together, the output portion having a front side; the output portion having a width dimension and a height dimension that define a faceprint of the output portion; one or more output receptacles contained within each of the modules, each module being configured to provide one or more access openings in the front side of the output portion, respective ones of the access openings being proximate the one or more output receptacles thereby permitting operator access into the output receptacles from the front side of the output portion; one or more transport mechanisms contained within each of the modules configured to transport bills along one or more transport paths to one or more of the output receptacles at a rate of at least about 800 documents per minute; wherein the output portion has a pocket density of at least about 0.9 pockets per square foot of faceprint.

Embodiment 94: The currency processing system of embodiment 93, wherein the output portion comprises a base module and wherein the one or more output receptacles comprises at least 3 output receptacles.

Embodiment 95: The currency processing system of embodiment 93, wherein the output portion comprises a base module coupled to a pocket module; the base module comprising two or more output receptacles; the pocket module comprising two or more output receptacles; and wherein the pocket density of the output portion is at least about 1.6 pockets per square foot of faceprint.

Embodiment 96: The currency processing system of embodiment 93, wherein the output portion comprises a base module coupled to two pocket modules; the base module comprising two or more output receptacles; each of the pocket modules comprising two or more output receptacles; and wherein the pocket density of the output portion is at least about 1.8 pockets per square foot of faceprint.

Embodiment 97: The currency processing system of embodiment 93, wherein the output portion comprises four base modules coupled together, each base module including two or more output receptacles; and wherein the pocket density of the output portion is at least about 1.1 pockets per square foot of faceprint.

Embodiment 98: The currency processing system of embodiment 93, wherein the output portion comprises two base modules coupled to two pocket modules; each of the base modules comprising two or more output receptacles; each of the pocket modules comprising two or more output receptacles; and wherein the pocket density of the output portion is at least about 1.5 pockets per square foot of faceprint.

Embodiment 99: The currency processing system of embodiment 93, wherein the output portion comprises two base modules coupled to six pocket modules; each of the base modules comprising two or more output receptacles; each of the pocket modules comprising two or more output receptacles; and wherein the pocket density of the output portion is at least about 1.9 pockets per square foot of faceprint.

Embodiment 100: The currency processing system of embodiment 93, wherein the output portion comprises four base modules coupled to twelve pocket modules; each of the base modules comprising two or more output receptacles; each of the pocket modules comprising two or more output receptacles; and wherein the pocket density of the output portion is at least about 2.0 pockets per square foot of faceprint.

Embodiment 101: The currency processing system according to any of embodiments 93-100, further comprising a document processing device coupled to the output portion, the document processing device having an input receptacle configured to receive a stack of documents to be transported via the one or more transport mechanisms.

Embodiment 102: The currency processing system of embodiment 101, wherein the document processing device further has at least one detector positioned between the input receptacle and a first one of the one or more output receptacles.

Embodiment 103: A currency processing system, comprising: an output portion having one or more modules coupled together, the output portion having a front side; one or more output receptacles contained within each of the modules, each module being configured to provide one or more access openings in the front side of the output portion, respective ones of the access openings being proximate the one or more output receptacles thereby permitting operator access into the output receptacles from the front side of the output portion; one or more transport mechanisms contained within each of the modules configured to transport bills along one or more transport paths to one or more of the output receptacles; wherein the output portion has a pocket density of at least about 0.9 pockets per lineal foot of transport path length.

Embodiment 104: The currency processing system of embodiment 103, wherein the output portion comprises a base module and wherein the one or more output receptacles comprises at least 2 output receptacles.

Embodiment 105: The currency processing system of embodiment 103, wherein the output portion comprises a base module coupled to a pocket module; the base module comprising two or more output receptacles; the pocket module comprising two or more output receptacles; and wherein the pocket density of the output portion is at least about 1.3 pockets per lineal foot of transport path length.

Embodiment 106: The currency processing system of embodiment 103, wherein the output portion comprises a base module coupled to a pocket module; the base module comprising two or more output receptacles; the pocket module comprising two or more output receptacles; and wherein the pocket density of the output portion is between about 1.3 pockets and about 4.5 pockets per lineal foot of transport path length.

Embodiment 107: The currency processing system of embodiment 103, wherein the output portion comprises a base module coupled to two pocket modules; the base module comprising two or more output receptacles; each of the pocket modules comprising two or more output receptacles; and wherein the pocket density of the output portion is about 3.3 pockets per lineal foot of transport length.

Embodiment 108: The currency processing system of embodiment 103, wherein the output portion comprises a base module coupled to two pocket modules; the base module comprising two or more output receptacles; each of the pocket modules comprising two or more output receptacles; and wherein the pocket density of the output portion is at least about 1.5 pockets per lineal foot of transport length.

Embodiment 109: The currency processing system of embodiment 103, wherein the output portion comprises a base module coupled to two pocket modules; the base module comprising two or more output receptacles; each of the pocket modules comprising two or more output receptacles; and wherein the pocket density of the output portion is between about 1.5 pockets and 4.6 pockets per lineal foot of transport length.

Embodiment 110: The currency processing system of embodiment 103, wherein the output portion comprises a base module coupled to two pocket modules; the base module comprising two or more output receptacles; each of the pocket modules comprising two or more output receptacles; and wherein the pocket density of the output portion is about 3.6 pockets per lineal foot of transport length.

Embodiment 111: The currency processing system of embodiment 103, wherein the output portion comprises four base modules coupled together, each base module including two or more output receptacles; and wherein the pocket density of the output portion is at least about 0.9 pockets per lineal foot of transport length.

Embodiment 112: The currency processing system of embodiment 103, wherein the output portion comprises four base modules coupled together, each base module including two or more output receptacles; and wherein the pocket density of the output portion is between about 0.9 pockets and about 2.1 pockets per lineal foot of transport length.

Embodiment 113: The currency processing system of embodiment 103, wherein the output portion comprises four base modules coupled together, each base module including two or more output receptacles; and wherein the pocket density of the output portion is about 1.5 pockets per lineal foot of transport length.

Embodiment 114: The currency processing system of embodiment 103, wherein the output portion comprises two base modules coupled to two pocket modules; each of the base modules comprising two or more output receptacles; each of the pocket modules comprising two or more output receptacles; and wherein the pocket density of the output portion is at least about 1.4 pockets per lineal foot of transport length.

Embodiment 115: The currency processing system of embodiment 103, wherein the output portion comprises two base modules coupled to two pocket modules; each of the base modules comprising two or more output receptacles; each of the pocket modules comprising two or more output receptacles; and wherein the pocket density of the output portion is between about 1.4 pockets and about 3.3 pockets per lineal foot of transport length.

Embodiment 116: The currency processing system of embodiment 103, wherein the output portion comprises two base modules coupled to two pocket modules; each of the base modules comprising two or more output receptacles; each of the pocket modules comprising two or more output receptacles; and wherein the pocket density of the output portion is about 2.5 pockets per lineal foot of transport length.

Embodiment 117: The currency processing system of embodiment 103, wherein the output portion comprises two base modules coupled to six pocket modules; each of the base modules comprising two or more output receptacles; each of the pocket modules comprising two or more output receptacles; and wherein the pocket density of the output portion is at least about 1.8 pockets per lineal foot of transport length.

Embodiment 118: The currency processing system of embodiment 103, wherein the output portion comprises two base modules coupled to six pocket modules; each of the base modules comprising two or more output receptacles; each of the pocket modules comprising two or more output receptacles; and wherein the pocket density of the output portion is between about 1.8 pockets and about 3.8 pockets per lineal foot of transport length.

Embodiment 119: The currency processing system of embodiment 103, wherein the output portion comprises two base modules coupled to six pocket modules; each of the base modules comprising two or more output receptacles; each of the pocket modules comprising two or more output receptacles; and wherein the pocket density of the output portion is about 3.1 pockets per lineal foot of transport length.

Embodiment 120: The currency processing system of embodiment 103, wherein the output portion comprises four base modules coupled to twelve pocket modules; each of the base modules comprising two or more output receptacles; each of the pocket modules comprising two or more output receptacles; and wherein the pocket density of the output portion is at least about 1.7 pockets per lineal foot of transport length.

Embodiment 121: The currency processing system of embodiment 103, wherein the output portion comprises four base modules coupled to twelve pocket modules; each of the base modules comprising two or more output receptacles; each of the pocket modules comprising two or more output receptacles; and wherein the pocket density of the output portion is between about 1.7 pockets and about 3.5 pockets per lineal foot of transport length.

Embodiment 122: The currency processing system of embodiment 103, wherein the output portion comprises four base modules coupled to twelve pocket modules; each of the base modules comprising two or more output receptacles; each of the pocket modules comprising two or more output receptacles; and wherein the pocket density of the output portion is about 2.8 pockets per lineal foot of transport length.

Embodiment 123: The currency processing system according to any of embodiments 103-122, wherein the one or more transport mechanisms is configured to transport bills along the one or more transport paths at a rate of at least about 500 documents per minute.

Embodiment 124: The currency processing system according to any of embodiments 103-122, wherein the one or more transport mechanisms is configured to transport bills along the one or more transport paths at a rate of at least about 800 documents per minute.

Embodiment 125: The currency processing system according to any of embodiments 103-122, wherein the one or more transport mechanisms is configured to transport bills along the one or more transport paths at a rate of at least about 1000 documents per minute.

Embodiment 126: The currency processing system according to any of embodiments 103-122, wherein the one or more transport mechanisms is configured to transport bills along the one or more transport paths at a rate of at least about 1200 documents per minute.

Embodiment 127: The currency processing system according to any of embodiments 103-122, wherein the one or more transport mechanisms is configured to transport bills along the one or more transport paths at a rate of at least about 1500 documents per minute.

Embodiment 128: A currency processing system, comprising: an output portion having one or more modules coupled together, the output portion having a front side, the output portion having a width dimension and a height dimension that define a faceprint of the output portion; the modules comprising one or more output receptacles, each module being configured to provide one or more access openings in the front side of the output portion, respective ones of the access openings being proximate the one or more output receptacles thereby permitting operator access into the output receptacles from the front side of the output portion, each of the one or more output receptacles including a stacking plate, each stacking plate having a central plate point; the modules comprising one or more transport mechanisms configured to transport bills along one or more transport paths to one or more of the output receptacles; wherein a circular portion of the faceprint, defined by a radius of about three inches, encloses four central plate points for a pocket density of about 22 pockets per square foot of circular area.

Embodiment 129: A currency processing system, comprising: an output portion comprising at least four output receptacles, each output receptacle comprising a stacking plate, each stacking plate having a central plate location; wherein the central plate locations of the at least four output receptacles are positioned within about six inches of each other.

Embodiment 130: A currency processing system, comprising: an output portion comprising at least eight output receptacles, each output receptacle comprising a stacking plate, each stacking plate having a central plate location; wherein the central plate locations of the at least eight output receptacles are positioned within about seventeen inches of each other.

Embodiment 131: A currency processing system, comprising: an output portion comprising at least twelve output receptacles, each output receptacle comprising a stacking plate, each stacking plate having a central plate location; wherein the central plate locations of the at least twelve output receptacles are positioned within about thirty-one inches of each other.

Embodiment 132: A currency processing system, comprising: an output portion comprising at least sixteen output receptacles, each output receptacle comprising a stacking plate, each stacking plate having a central plate location; wherein the central plate locations of the at least sixteen output receptacles are positioned within about thirty-four inches of each other.

Embodiment 133: A currency processing system, comprising: an output portion comprising at least four output receptacles, each output receptacle comprising a stacking plate, each stacking plate having a central plate location; wherein the has output portion has a pocket density of at least about 22 central plate locations per square foot.

Embodiment 134: A currency processing system, comprising: an output portion comprising at least eight output receptacles, each output receptacle comprising a stacking plate, each stacking plate having a central plate location; wherein the has output portion has a pocket density of at least about 5 central plate locations per square foot.

Embodiment 135: A currency processing system, comprising: an output portion comprising at least twelve output receptacles, each output receptacle comprising a stacking plate, each stacking plate having a central plate location; wherein the has output portion has a pocket density of at least about 2.4 central plate locations per square foot.

Embodiment 136: A currency processing system, comprising: an output portion comprising at least sixteen output receptacles, each output receptacle comprising a stacking plate, each stacking plate having a central plate location; wherein the has output portion has a pocket density of at least about 3.1 central plate locations per square foot.

Embodiment 137: A currency processing system, comprising: an output portion having one or more modules coupled together, the output portion having a front side, the output portion having a width dimension and a height dimension that define a faceprint of the output portion; the modules comprising one or more output receptacles, each module being configured to provide one or more access openings in the front side of the output portion, respective ones of the access openings being proximate the one or more output receptacles thereby permitting operator access into the output receptacles from the front side of the output portion, each of the one or more output receptacles including a stacking wheel configured to rotate about a respective shaft, each shaft having a central wheel point; the modules comprising one or more transport mechanisms configured to transport bills along one or more transport paths to one or more of the output receptacles; wherein a circular portion of the faceprint, defined by a radius of about five inches, encloses four central wheel points for a pocket density of about 7.5 pockets per square foot of circular area.

Embodiment 138: A currency processing system, comprising: an output portion comprising at least four output receptacles, each output receptacle-comprising a stacking wheel configured to rotate about a respective axis; wherein the axes of the stacking wheels of the at least four output receptacles are positioned within about ten inches of each other.

Embodiment 139: A currency processing system, comprising: an output portion comprising at least eight output receptacles, each output receptacle-comprising a stacking wheel configured to rotate about a respective axis; wherein the axes of the stacking wheels of the at least eight output receptacles are positioned within about nineteen inches of each other.

Embodiment 140: A currency processing system, comprising: an output portion comprising at least twelve output receptacles, each output receptacle—comprising a stacking wheel configured to rotate about a respective axis; wherein the axes of the stacking wheels of the at least twelve output receptacles are positioned within about twenty-four inches of each other.

Embodiment 141: A currency processing system, comprising: an output portion comprising at least sixteen output receptacles, each output receptacle—comprising a stacking wheel configured to rotate about a respective axis; wherein the axes of the stacking wheels of the at least sixteen output receptacles are positioned within about thirty inches of each other.

Embodiment 142: A currency processing system, comprising: an output portion having one or more modules coupled together, the output portion having a front side, the output portion having a width dimension and a height dimension that define a faceprint of the output portion; the modules comprising one or more output receptacles, each module being configured to provide one or more access openings in the front side of the output portion, respective ones of the access openings being proximate the one or more output receptacles thereby permitting operator access into the output receptacles from the front side of the output portion, each of the one or more output receptacles including entry rollers, the entry rollers having an entry roller point; the modules comprising one or more transport mechanisms configured to transport bills along one or more transport paths to one or more of the output receptacles; wherein a circular portion of the faceprint, defined by a radius of about seven inches, encloses four entry roller points for a pocket density of about 3.8 pockets per square foot of circular area.

Embodiment 143: A currency processing system, comprising: an output portion comprising at least four output receptacles, each receptacle comprising entry rollers, the entry rollers having an entry roller point; wherein the entry roller points of the at least four output receptacles are positioned within about fourteen inches of each other.

Embodiment 144: A currency processing system, comprising: an output portion comprising at least eight output receptacles, each receptacle comprising entry rollers, the entry rollers having an entry roller point; wherein the entry roller points of the at least eight output receptacles are positioned within about twenty inches of each other.

Embodiment 145: A currency processing system, comprising: an output portion comprising at least twelve output receptacles, each receptacle comprising entry rollers, the entry rollers having an entry roller point; wherein the entry roller points of the at least twelve output receptacles are positioned within about twenty-one inches of each other.

Embodiment 146: A currency processing system, comprising: an output portion comprising at least sixteen output receptacles, each receptacle comprising entry rollers, the entry rollers having an entry roller point; wherein the entry roller points of the at least sixteen output receptacles are positioned within about twenty-five inches of each other.

Embodiment 147: A currency processing system, comprising: an output portion having one or more modules coupled together, the output portion having a front side; one or more output receptacles contained within each of the modules, each module being configured to provide one or more access openings in the front side of the output portion, respective ones of the access openings being proximate the one or more output receptacles thereby permitting operator access into the output receptacles from the front side of the output portion; one or more transport mechanisms contained within each of the modules configured to transport bills along one or more transport paths to one or more of the output receptacles; wherein a portion of the transport path between a first diverter and a first output receptacle diverter having a length less than about 22 inches is configured to allow currency bills to be transported to one of at least eight output receptacles positioned adjacent to the portion of the transport path.

Embodiment 148: The currency processing system of embodiment 147, wherein the output portion comprises a base module coupled to three pocket modules; the base module comprising two or more output receptacles; each of the pocket modules comprising two or more output receptacles; and wherein the pocket density of the output portion is at least about 4.5 pockets per lineal foot of transport path length.

Embodiment 149: The currency processing system of embodiment 147, wherein the portion of the transport path includes three additional output receptacle diverters between the first diverter and the first output receptacle diverter.

Embodiment 150: A currency processing system, comprising: an output portion having a plurality of output receptacles and a transport mechanism configured to transport bills along one or more transport paths to one or more of the output receptacles; wherein a portion of the transport path between a first output receptacle diverter and a second output receptacle diverter has a length of less than about 6 inches and is configured to allow currency bills to be transported to one of at least four output receptacles positioned adjacent to the portion of the transport path.

Embodiment 151: A currency processing system, comprising: an output portion having a plurality of output receptacles and a transport mechanism configured to transport bills along one or more transport paths to one or more of the output receptacles; wherein a portion of the transport path between a first output receptacle diverter and a second output receptacle diverter has a pocket per inch ratio of at least 0.6.

Embodiment 152: A currency processing system, comprising: an output portion having a plurality of output receptacles and a transport mechanism configured to transport bills along one or more transport paths to one or more of the output receptacles; wherein a portion of the transport path between a first output receptacle diverter and a second output receptacle diverter has a pocket per inch ratio of at least 0.7.

Embodiment 153: A currency processing system, comprising: an output portion having a plurality of output receptacles and a transport mechanism configured to transport bills along one or more transport paths to one or more of the output receptacles; wherein a portion of the transport path between a first output receptacle diverter and a second output receptacle diverter has a pocket per foot ratio of at least 8.

Embodiment 154: A currency processing system, comprising: an output portion having a plurality of output receptacles and a transport mechanism configured to transport bills along one or more transport paths to one or more of the output receptacles; wherein a portion of the transport path between a plurality of output receptacle diverters has a length of less than about 12 inches and is configured to allow currency bills to be transported to one of at least six output receptacles positioned adjacent to the portion of the transport path.

Embodiment 155: A currency processing system, comprising: an output portion having a plurality of output receptacles and a transport mechanism configured to transport bills along one or more transport paths to one or more of the output receptacles; wherein a portion of the transport path between a plurality of output receptacles has a pocket per inch ratio of at least 0.4.

Embodiment 156: A currency processing system, comprising: an output portion having a plurality of output receptacles and a transport mechanism configured to transport bills along one or more transport paths to one or more of the output receptacles; wherein a portion of the transport path between a plurality of output receptacles has a pocket per foot ratio of at least 6.

Embodiment 157: A currency processing system, comprising: an output portion having a plurality of output receptacles and a transport mechanism configured to transport bills along one or more transport paths to one or more of the output receptacles; wherein a portion of the transport path between a plurality of output receptacle diverters has a length of less than about 18 inches and is configured to allow currency bills to be transported to one of at least eight output receptacles positioned adjacent to the portion of the transport path.

Embodiment 158: A currency processing system, comprising: an output portion having a plurality of output receptacles and a transport mechanism configured to transport bills along one or more transport paths to one or more of the output receptacles; wherein a portion of the transport path between a plurality of output receptacles has a pocket per inch ratio of at least 0.4.

Embodiment 159: A currency processing system, comprising: an output portion having a plurality of output receptacles and a transport mechanism configured to transport bills along one or more transport paths to one or more of the output receptacles; wherein a portion of the transport path between a plurality of output receptacles has a pocket per foot ratio of at least 5.

Embodiment 160: A currency processing system, comprising: an output portion having at least four output receptacles and a transport mechanism configured to transport bills along one or more transport paths to one or more of the output receptacles; wherein the output portion has a width of less than 19 inches.

Embodiment 161: The currency processing system of embodiment 160, wherein the output portion is configured to permit an operator standing in front of the system to reach into and remove bills from any of the output receptacles without moving.

Embodiment 162: The currency processing system of embodiment 160, comprising at least six output receptacles.

Embodiment 163: The currency processing system of embodiment 160, comprising at least eight output receptacles.

Embodiment 164: The currency processing system of embodiment 160, comprising at least nine output receptacles.

Embodiment 165: A currency processing system, comprising: an output portion having a front side and having at least four output receptacles laterally displaced relative to the front side of the output portion; wherein the output portion has a width of less than 34 inches.

Embodiment 166: The currency processing system of embodiment 165, wherein the output portion is configured to permit an operator standing in front of the system to reach into and remove bills from any of the output receptacles without moving.

Embodiment 167: The currency processing system of embodiment 165, comprising at least six output receptacles.

Embodiment 168: The currency processing system of embodiment 165, comprising at least eight output receptacles.

Embodiment 169: The currency processing system of embodiment 165, comprising at least ten output receptacles.

Embodiment 170: The currency processing system of embodiment 165, comprising at least twelve output receptacles.

Embodiment 171: The currency processing system of embodiment 165, comprising at least fourteen output receptacles.

Embodiment 172: The currency processing system of embodiment 165, comprising at least sixteen output receptacles.

Embodiment 169: The currency processing system of embodiment 165, comprising at least seventeen output receptacles.

Embodiment 170: A currency processing system, comprising: an input receptacle; an output portion having a front side and having a plurality of output receptacles laterally displaced relative to the front side of the output portion; and a transport mechanism comprising one or more transport paths leading from the input receptacle to each of the plurality of output receptacles and wherein the transport mechanism is configured to transport bills, one at a time, from the input receptacle along the one or more transport paths; wherein the distance from the input receptacle to the furthest output receptacle is less than six feet; wherein the plurality of output receptacles comprise at least 10 output receptacles.

Embodiment 171: The currency processing system of embodiment 170, wherein the plurality of output receptacles comprise at least 14 output receptacles.

Embodiment 172: The currency processing system of embodiment 170, wherein the plurality of output receptacles comprise at least 18 output receptacles.

Embodiment 173: The currency processing system of embodiment 170, wherein the plurality of output receptacles comprise at least 20 output receptacles.

Embodiment 174: The currency processing system of embodiment 170, wherein the plurality of output receptacles comprise at least 24 output receptacles.

Embodiment 175: The currency processing system of embodiment 170, wherein the plurality of output receptacles comprise at least 28 output receptacles.

Embodiment 176: The currency processing system of embodiment 170, wherein the plurality of output receptacles comprise at least 30 output receptacles.

Embodiment 177: The currency processing system of embodiment 170, wherein the plurality of output receptacles comprise at least 32 output receptacles.

Embodiment 178: The currency processing system according to any of embodiments 170-175, wherein the distance from the input receptacle to the furthest output receptacle is less than 5½ feet.

Embodiment 179: The currency processing system according to any of embodiments 170-174, wherein the distance from the input receptacle to the furthest output receptacle is less than 5 feet.

Embodiment 180: The currency processing system according to any of embodiments 170-174, wherein the distance from the input receptacle to the furthest output receptacle does not exceed about 4½ feet.

Embodiment 179: The currency processing system according to any of embodiments 170-171, wherein the distance from the input receptacle to the furthest output receptacle does not exceed about 3½ feet.

Embodiment 179: The currency processing system of embodiments 170, wherein the distance from the input receptacle to the furthest output receptacle does not exceed about 3 feet.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A currency bill processing device, comprising:

a housing having a front side in opposing spaced relation to a back side, and a first end in opposing spaced relation to a second end, the front and the back sides being generally orthogonal with respect to the first and the second ends;

an input receptacle positioned proximate the first end of the housing, the input receptacle being configured to receive a stack of bills;

a second output receptacle proximate the second end of the housing and a first output receptacle horizontally offset from the second output receptacle in a direction toward the first end of the housing, the housing being configured to provide access openings in the front side, the access openings being proximate the first and the second output receptacles thereby permitting operator access into the first and the second output receptacles from the front side of the housing;

at least one detector positioned between the input receptacle and the first output receptacle; and a transport mechanism configured to transport bills from the input receptacle, one at a time, along a transport path originating at the input receptacle proximate the first end of the housing, the transport path extending generally horizontally past the at least one detector toward the second end of the housing, the transport path transitioning generally-vertically upward between the first and the second output receptacles, the transport mechanism being further configured to deliver some of the bills toward the first end into the first output receptacle and some of the bills toward the second end into the second output receptacle.

2. The currency bill processing device of claim 1, wherein the first and the second output receptacles each have a receiving opening associated therewith, the receiving openings being configured to permit bills from the transport mechanism to be passed therethrough, and the receiving openings being positioned adjacent to and on opposite sides of the generally-vertical portion of the transport path.

3. The currency bill processing device of claim 2, wherein the transport mechanism is configured to transport currency bills, one at a time, from the input receptacle at a rate of at least about 400 bills per minute.

4. The currency bill processing device of claim 2, further comprising five or more output receptacles in addition to the first and the second output receptacles, and wherein a pocket density of the currency bill processing device is at least about 1.0 pockets per square foot of faceprint of the currency bill processing device.

5. The currency bill processing device of claim 2, further comprising six or more output receptacles in addition to the first and the second output receptacles such that the currency bill processing device comprises at least eight output receptacles, each of the at least eight output receptacles including a stacking plate, each stacking plate having a central plate location, wherein the central plate locations of the at least eight output receptacles are positioned within about seventeen inches of each other.

6. The currency bill processing device of claim 2, further comprising two or more output receptacles in addition to the first and the second output receptacles such that the currency bill processing device comprises at least four output receptacles, each of the at least four output receptacles including entry rollers, the entry rollers having an entry roller point, wherein the entry roller points of the at least four output receptacles are positioned within about fourteen inches of each other.

7. The currency bill processing device of claim 2, further comprising twenty-six or more output receptacles in addition to the first and the second output receptacles such that the currency bill processing device comprises at least twenty-eight output receptacles, wherein the distance from the input receptacle to the furthest output receptacle is less than five and a half feet.

8. The currency bill processing device of claim 2, further comprising seven or more output receptacles in addition to the first and the second output receptacles, and wherein a pocket density of the currency bill processing device is about 1.2 pockets per square foot of faceprint of the currency bill processing device.

9. The currency bill processing device of claim 2, further comprising one or more output receptacles in addition to the first and the second output receptacles, and wherein a pocket density of the currency bill processing device is about 1.1 pockets per square foot of faceprint of the currency bill processing device.

10. The currency bill processing device of claim 2, further comprising three or more output receptacles in addition to the first and the second output receptacles, and wherein a pocket density of the currency bill processing device is about 1.2 pockets per square foot of faceprint of the currency bill processing device.

11. The currency bill processing device of claim 1, further comprising a diverter located along the transport path and between the first and the second output receptacles, the diverter being configured to selectively direct bills being transported by the transport mechanism into the first and the second output receptacles.

12. The currency bill processing device of claim 11, wherein the transport mechanism is configured to transport currency bills, one at a time, from the input receptacle at a rate of at least about 800 bills per minute.

13. The currency bill processing device of claim 11, further comprising seven or more output receptacles in addition to the first and the second output receptacles, and wherein a pocket density of the currency bill processing device is at least about 0.9 pockets per square foot of faceprint of the currency bill processing device.

14. The currency bill processing device of claim 11, further comprising ten or more output receptacles in addition to the first and the second output receptacles such that the currency bill processing device comprises at least twelve output receptacles, each of the at least twelve output receptacles including a stacking plate, each stacking plate having a central plate location, wherein the central plate locations of the at least twelve output receptacles are positioned within about thirty-one inches of each other.

15. The currency bill processing device of claim 11, further comprising six or more output receptacles in addition to the first and the second output receptacles such that the currency bill processing device comprises at least eight output receptacles, each of the at least eight output receptacles including entry rollers, the entry rollers having an entry roller point, wherein the entry roller points of the at least eight output receptacles are positioned within about twenty inches of each other.

16. The currency bill processing device of claim 11, further comprising twenty-two or more output receptacles in addition to the first and the second output receptacles such that the currency bill processing device comprises at least twenty-four output receptacles, wherein the distance from the input receptacle to the furthest output receptacle is less than five feet.

17. The currency bill processing device of claim 11, further comprising seven or more output receptacles in addition to the first and the second output receptacles, and wherein a pocket density of the currency bill processing device is between about 0.8 pockets per square foot of footprint of the currency bill processing device and about 1.3 pockets per square foot of footprint of the currency bill processing device.

18. The currency bill processing device of claim 11, further comprising one or more output receptacles in addition to the first and the second output receptacles, and wherein a pocket density of the currency bill processing device is between about 0.6 pockets per square foot of footprint of the currency bill processing device and about 1.2 pockets per square foot of footprint of the currency bill processing device.

19. The currency bill processing device of claim 11, further comprising three or more output receptacles in addition to the first and the second output receptacles, and wherein a pocket density of the currency bill processing device is between about 1.0 pockets per square foot of footprint of the currency bill processing device and about 1.9 pockets per square foot of footprint of the currency bill processing device.

20. The currency bill processing device of claim 1, wherein the first and the second output receptacles each have a receiving opening associated therewith, the receiving openings being configured to permit bills from the transport mechanism to be passed therethrough, and the receiving opening of the first output receptacle facing the receiving opening of the second output receptacle.

21. The currency bill processing device of claim 20, further comprising four or more output receptacles in addition to the first and the second output receptacles such that the currency bill processing device comprises at least six output receptacles, each of the at least six output receptacles including a stacking plate, each stacking plate having a central plate location, wherein the distance from the input receptacle to the furthest one of the central plate locations of the at least six output receptacles is less than 2.4 feet.

22. The currency bill processing device of claim 20, further comprising four or more output receptacles in addition to the first and the second output receptacles such that the currency bill processing device comprises at least six output receptacles, each of the at least six output receptacles including a stacking wheel configured to rotate about a respective axis, wherein the distance from the input receptacle to the furthest one of the axes of the stacking wheels of the at least six output receptacles is less than 2.5 feet.

23. The currency bill processing device of claim 1, further comprising a third and a fourth output receptacle, the third and the fourth output receptacles being horizontally offset from one another, the third and the fourth output receptacles being vertically offset from the first and the second output receptacles.

24. The currency bill processing device of claim 23, wherein the transport path extends generally-vertically upward past the first and the second output receptacles and between the third and the fourth output receptacles, the transport mechanism being further configured to deliver some of the bills toward the first end into the third output receptacle and some of the bills toward the second end into the fourth output receptacle.

25. The currency bill processing device of claim 24, wherein the transport mechanism is configured to transport currency bills, one at a time, from the input receptacle at a rate of at least about 1000 bills per minute.

26. The currency bill processing device of claim 24, further comprising seven or more output receptacles in addition to the first and the second output receptacles, and wherein a pocket density of the currency bill processing device is at least about 1.1 pockets per square foot of faceprint of the currency bill processing device.

27. The currency bill processing device of claim 24, further comprising fourteen or more output receptacles in addition to the first and the second output receptacles such that the currency bill processing device comprises at least sixteen output receptacles, each of the at least sixteen output receptacles including a stacking plate, each stacking plate having a central plate location, wherein the central plate locations of the at least sixteen output receptacles are positioned within about thirty-four inches of each other.

28. The currency bill processing device of claim 24, further comprising ten or more output receptacles in addition to the first and the second output receptacles such that the currency bill processing device comprises at least twelve output receptacles, each of the at least twelve output receptacles including entry rollers, the entry rollers having an entry roller point, wherein the entry roller points of the at least twelve output receptacles are positioned within about twenty-one inches of each other.

29. The currency bill processing device of claim 24, further comprising twenty-two or more output receptacles in addition to the first and the second output receptacles such that the currency bill processing device comprises at least twenty-four output receptacles, wherein the distance from the input receptacle to the furthest output receptacle is less than four and a half feet.

30. The currency bill processing device of claim 24, further comprising seven or more output receptacles in addition to the first and the second output receptacles, and wherein a pocket density of the currency bill processing device is about 1.0 pockets per square foot of footprint of the currency bill processing device.

31. The currency bill processing device of claim 24, further comprising one or more output receptacles in addition to the first and the second output receptacles, and wherein a pocket density of the currency bill processing device is about 0.9 pockets per square foot of footprint of the currency bill processing device.

32. The currency bill processing device of claim 24, further comprising three or more output receptacles in addition to the first and the second output receptacles, and wherein a pocket density of the currency bill processing device is about 1.4 pockets per square foot of footprint of the currency bill processing device.

33. The currency bill processing device of claim 1, wherein each output receptacle includes a transition surface upon which bills pass as delivered from the transport path into a respective one of the output receptacles, the bills transitioning at least about 90 degrees from the transport path into the respective output receptacle.

34. The currency bill processing device of claim 33, wherein the bills transition between about 100 degrees to about 140 degrees from the transport path to the respective output receptacle.

35. The currency bill processing device of claim 33, wherein each output receptacle includes a belt configured to engage and press bills against a respective one of the transition surfaces as the bills are delivered from the transport path into a respective one of the output receptacles.

36. The currency bill processing device of claim 34, further comprising third and fourth horizontally-offset output receptacles, the third and the fourth output receptacles being vertically offset from the first and the second output receptacles, wherein the currency bill processing device has a pocket density between about 0.9 and about 1.7 output receptacles per square foot of faceprint.

37. The currency bill processing device of claim 34, further comprising fifteen or more output receptacles in addition to the first and the second output receptacles, and wherein a pocket density of the currency bill processing device is at least about 1.4 pockets per square foot of faceprint of the currency bill processing device.

38. The currency bill processing device of claim 34, further comprising six or more output receptacles in addition to the first and the second output receptacles such that the currency bill processing device comprises at least eight output receptacles, each of the at least eight output receptacles including a stacking wheel configured to rotate about a respective axis, wherein the axes of the stacking wheels of the at least eight output receptacles are positioned within about nineteen inches of each other.

39. The currency bill processing device of claim 34, further comprising fourteen or more output receptacles in addition to the first and the second output receptacles such that the currency bill processing device comprises at least sixteen output receptacles, each of the at least sixteen output receptacles including entry rollers, the entry rollers having an entry roller point, wherein the entry roller points of the at least sixteen output receptacles are positioned within about twenty-five inches of each other.

40. The currency bill processing device of claim 34, further comprising twelve or more output receptacles in addition to the first and the second output receptacles such that the currency bill processing device comprises at least fourteen output receptacles, wherein the distance from the input receptacle to the furthest output receptacle is less than three and a half feet.

41. The currency bill processing device of claim 34, further comprising seven or more output receptacles in addition to the first and the second output receptacles, and wherein a pocket density of the currency bill processing device is between about 0.5 pockets per cubic foot of volume of the currency bill processing device and about 1.4 pockets per cubic foot of volume of the currency bill processing device.

42. The currency bill processing device of claim 34, further comprising one or more output receptacles in addition to the first and the second output receptacles, and wherein a pocket density of the currency bill processing device is between about 0.4 pockets per cubic foot of volume of the currency bill processing device and about 1.3 pockets per cubic foot of volume of the currency bill processing device.

43. The currency bill processing device of claim 34, further comprising three or more output receptacles in addition to the first and the second output receptacles, and wherein a pocket density of the currency bill processing device is between about 0.5 pockets per cubic foot of volume of the currency bill processing device and about 1.4 pockets per cubic foot of volume of the currency bill processing device.

44. The currency bill processing device of claim 1, wherein the transport mechanism transports the bills from the input receptacle to one of the output receptacles without contacting the bills with a driven belt.

45. The currency bill processing device of claim 44, further comprising third and fourth horizontally-offset output receptacles and fifth and sixth horizontally-offset output receptacles, the third and the fourth output receptacles being vertically offset from the first and the second output receptacles and the fifth and the sixth output receptacles being vertically offset from the first and the second output receptacles and the third and the fourth output receptacles, wherein the currency bill processing device has a pocket density between about 1.0 and about 1.9 output receptacles per square foot of faceprint.

46. The currency bill processing device of claim 44, further comprising thirty-one or more output receptacles in addition to the first and the second output receptacles, and wherein a pocket density of the currency bill processing device is at least about 1.7 pockets per square foot of faceprint of the currency bill processing device.

47. The currency bill processing device of claim 44, further comprising ten or more output receptacles in addition to the first and the second output receptacles such that the currency bill processing device comprises at least twelve output receptacles, each of the at least twelve output receptacles including a stacking wheel configured to rotate about a respective axis, wherein the axes of the stacking wheels of the at least twelve output receptacles are positioned within about twenty-four inches of each other.

48. The currency bill processing device of claim 44, further comprising two or more output receptacles in addition to the first and the second output receptacles such that the currency bill processing device comprises a plurality of output receptacles adjacent to the transport path, wherein a portion of the transport path between the plurality of output receptacles has a pocket per inch ratio of at least 0.4.

49. The currency bill processing device of claim 44, further comprising eight or more output receptacles in addition to the first and the second output receptacles such that the currency bill processing device comprises at least ten output receptacles, wherein the distance from the input receptacle to the furthest output receptacle is less than three and a half feet.

50. The currency bill processing device of claim 44, further comprising seven or more output receptacles in addition to the first and the second output receptacles, and wherein a pocket density of the currency bill processing device is about 0.8 pockets per cubic foot of volume of the currency bill processing device.

51. The currency bill processing device of claim 44, further comprising one or more output receptacles in addition to the first and the second output receptacles, and wherein a pocket density of the currency bill processing device is about 0.7 pockets per cubic foot of volume of the currency bill processing device.

52. The currency bill processing device of claim 44, further comprising three or more output receptacles in addition to the first and the second output receptacles, and wherein a pocket density of the currency bill processing device is about 0.9 pockets per cubic foot of volume of the currency bill processing device.

53. The currency bill processing device of claim 1, wherein the transport mechanism is configured to transport currency bills, one at a time, from the input receptacle at a rate of at least about 1200 bills per minute.

54. The currency bill processing device of claim 1, further comprising three or more output receptacles in addition to the first and the second output receptacles, and wherein a pocket density of the currency bill processing device is at least about 0.9 pockets per square foot of faceprint of the currency bill processing device.

55. The currency bill processing device of claim 1, further comprising two or more output receptacles in addition to the first and the second output receptacles such that the currency bill processing device comprises at least four output receptacles, each of the at least four output receptacles including a stacking plate, each stacking plate having a central plate location, wherein the central plate locations of the at least four output receptacles are positioned within about six inches of each other.

56. The currency bill processing device of claim 1, further comprising fourteen or more output receptacles in addition to the first and the second output receptacles such that the currency bill processing device comprises at least sixteen output receptacles, each of the at least sixteen output receptacles including a stacking wheel configured to rotate about a respective axis, wherein the axes of the stacking wheels of the at least sixteen output receptacles are positioned within about thirty inches of each other.

57. The currency bill processing device of claim 1, further comprising two or more output receptacles in addition to the first and the second output receptacles such that the currency bill processing device comprises a plurality of output receptacles adjacent to the transport path, wherein a portion of the transport path between the plurality of output receptacles has a pocket per foot ratio of at least 5.

58. The currency bill processing device of claim 1, further comprising two or more output receptacles in addition to the first and the second output receptacles such that the currency bill processing device comprises a plurality of output receptacles adjacent to the transport path, wherein a portion of the transport path between the plurality of output receptacles has a pocket per foot ratio of at least 8.

59. The currency bill processing device of claim 1, further comprising eight or more output receptacles in addition to the first and the second output receptacles such that the currency bill processing device comprises at least ten output receptacles, wherein the distance from the input receptacle to the furthest output receptacle is less than three feet.

60. The currency bill processing device of claim 1, further comprising seven or more output receptacles in addition to the first and the second output receptacles, and wherein a pocket density of the currency bill processing device is between about 0.9 pockets per square foot of faceprint of the currency bill processing device and about 1.7 pockets per square foot of faceprint of the currency bill processing device.

61. The currency bill processing device of claim 1, further comprising one or more output receptacles in addition to the first and the second output receptacles, and wherein a pocket density of the currency bill processing device is between about 0.8 pockets per square foot of faceprint of the currency bill processing device and about 1.6 pockets per square foot of faceprint of the currency bill processing device.

62. The currency bill processing device of claim 1, further comprising three or more output receptacles in addition to the first and the second output receptacles, and wherein a pocket density of the currency bill processing device is between about 0.9 pockets per square foot of faceprint of the currency bill processing device and about 1.7 pockets per square foot of faceprint of the currency bill processing device.

63. The currency bill processing device of claim 1, further comprising six or more output receptacles in addition to the first and the second output receptacles such that the currency bill processing device comprises at least eight output receptacles, each of the at least eight output receptacles including a stacking plate, each stacking plate having a central plate location, wherein the distance from the input receptacle to the furthest one of the central plate locations of the at least eight output receptacles is less than 2.7 feet.

64. The currency bill processing device of claim 1, further comprising six or more output receptacles in addition to the first and the second output receptacles such that the currency bill processing device comprises at least eight output receptacles, each of the at least eight output receptacles including a stacking wheel configured to rotate about a respective axis, wherein the distance from the input receptacle to the furthest one of the axes of the stacking wheels of the at least eight output receptacles is less than 2.8 feet.

65. A currency bill processing device for processing a stack of currency bills, the currency bill processing device comprising:

an input receptacle configured to receive the stack of currency bills;

a first output receptacle and a second output receptacle, each output receptacle having a receiving opening and an access opening associated therewith, the receiving openings being configured to receive bills therethrough, and the access openings being proximate a front side of the currency bill processing device thereby permitting operator access into the first and the second output receptacles from the front side of the currency bill processing device, and the receiving opening of the first output receptacle facing the receiving opening of the second output receptacle such that the first and the second output receptacles are oriented in a back-to-back manner with respect to each other;

at least one detector positioned between the input receptacle and the output receptacles; and a transport mechanism configured to transport currency bills, one at a time, from the input receptacle past the at least one detector to one of the output receptacles.

66. The currency bill processing device of claim 65, wherein the transport mechanism is configured to transport currency bills, one at a time, from the input receptacle at a rate of at least about 400 bills per minute.

67. The currency bill processing device of claim 65, wherein the transport mechanism transports the bills along a transport path originating at the input receptacle proximate a first end of the currency bill processing device, the transport path extending generally horizontally past the at least one detector, the transport path transitioning generally vertically between the first and second output receptacles.

68. The currency bill processing device of claim 67, further comprising two or more output receptacles in addition to the first and the second output receptacles such that the currency bill processing device comprises a plurality of output receptacles adjacent to the transport path, wherein a portion of the transport path between the plurality of output receptacles has a pocket per inch ratio of at least 0.4.

69. The currency bill processing device of claim 67, further comprising two or more output receptacles in addition to the first and the second output receptacles such that the currency bill processing device comprises a plurality of output receptacles adjacent to the transport path, wherein a portion of the transport path between the plurality of output receptacles has a pocket per foot ratio of at least 5.

70. The currency bill processing device of claim 67, further comprising two or more output receptacles in addition to the first and the second output receptacles such that the currency bill processing device comprises a plurality of output receptacles adjacent to the transport path, wherein a portion of the transport path between the plurality of output receptacles has a pocket per foot ratio of at least 8.

71. The currency bill processing device of claim 65, further comprising a controller and a diverter, the diverter being positioned between the receiving openings of the first and the second output receptacles, the controller being configured to selectively cause the diverter to direct bills being transported via the transport mechanism into the first and the second output receptacles.

72. The currency bill processing device of claim 71, wherein the diverter is configured to transition between at least three positions, the diverter directing bills into the first output receptacle in response to being in a first position, directing bills into the second output receptacle in response to being in a second position, and directing bills past both the first and second output receptacles in response to being in a third position.

73. The currency bill processing device of claim 72, wherein the diverter has a slot configured to pass bills therethrough past the first and the second output receptacles in response to the diverter being in the third position.

74. The currency bill processing device of claim 72, wherein the transport mechanism is configured to transport currency bills, one at a time, from the input receptacle at a rate of at least about 800 bills per minute.

75. The currency bill processing device of claim 72, further comprising seven or more output receptacles in addition to the first and the second output receptacles, and wherein a pocket density of the currency bill processing device is at least about 1.1 pockets per square foot of faceprint of the currency bill processing device.

76. The currency bill processing device of claim 72, further comprising twenty-six or more output receptacles in addition to the first and the second output receptacles such that the currency bill processing device comprises at least twenty-eight output receptacles, wherein the distance from the input receptacle to the furthest output receptacle is less than five and a half feet.

77. The currency bill processing device of claim 72, further comprising one or more output receptacles in addition to the first and the second output receptacles, and wherein a pocket density of the currency bill processing device is between about 0.8 pockets per square foot of faceprint of the currency bill processing device and about 1.6 pockets per square foot of faceprint of the currency bill processing device.

78. The currency bill processing device of claim 73, further comprising five or more output receptacles in addition to the first and the second output receptacles, and wherein a pocket density of the currency bill processing device is at least about 1.0 pockets per square foot of faceprint of the currency bill processing device.

79. The currency bill processing device of claim 73, further comprising fifteen or more output receptacles in addition to the first and the second output receptacles, and wherein a pocket density of the currency bill processing device is at least about 1.4 pockets per square foot of faceprint of the currency bill processing device.

80. The currency bill processing device of claim 73, further comprising ten or more output receptacles in addition to the first and the second output receptacles such that the currency bill processing device comprises at least twelve output receptacles, each of the at least twelve output receptacles including a stacking wheel configured to rotate about a respective axis, wherein the axes of the stacking wheels of the at least twelve output receptacles are positioned within about twenty-four inches of each other.

81. The currency bill processing device of claim 73, further comprising eight or more output receptacles in addition to the first and the second output receptacles such that the currency bill processing device comprises at least ten output receptacles, wherein the distance from the input receptacle to the furthest output receptacle is less than three feet.

82. The currency bill processing device of claim 73, further comprising one or more output receptacles in addition to the first and the second output receptacles, and wherein a pocket density of the currency bill processing device is between about 0.6 pockets per square foot of footprint of the currency bill processing device and about 1.2 pockets per square foot of footprint of the currency bill processing device.

83. The currency bill processing device of claim 73, further comprising three or more output receptacles in addition to the first and the second output receptacles, and wherein a pocket density of the currency bill processing device is about 1.2 pockets per square foot of faceprint of the currency bill processing device.

84. The currency bill processing device of claim 73, further comprising four or more output receptacles in addition to the first and the second output receptacles such that the currency bill processing device comprises at least six output receptacles, each of the at least six output receptacles including a stacking plate, each stacking plate having a central plate location, wherein the distance from the input receptacle to the furthest one of the central plate locations of the at least six output receptacles is less than 2.4 feet.

85. The currency bill processing device of claim 65, wherein each of the bills in the stack of bills has two parallel wide edges, and wherein the transport mechanism transports the bills in a wide-edge leading manner such that one of the wide edges is the sole leading edge during transport from the input receptacle to one of the output receptacles.

86. The currency bill processing device of claim 85, wherein the transport mechanism is configured to transport currency bills, one at a time, from the input receptacle at a rate of at least about 1000 bills per minute.

87. The currency bill processing device of claim 85, further comprising seven or more output receptacles in addition to the first and the second output receptacles, and wherein a pocket density of the currency bill processing device is at least about 0.9 pockets per square foot of faceprint of the currency bill processing device.

88. The currency bill processing device of claim 85, further comprising six or more output receptacles in addition to the first and the second output receptacles such that the currency bill processing device comprises at least eight output receptacles, each of the at least eight output receptacles including a stacking plate, each stacking plate having a central plate location, wherein the central plate locations of the at least eight output receptacles are positioned within about seventeen inches of each other.

89. The currency bill processing device of claim 85, further comprising fourteen or more output receptacles in addition to the first and the second output receptacles such that the currency bill processing device comprises at least sixteen output receptacles, each of the at least sixteen output receptacles including a stacking wheel configured to rotate about a respective axis, wherein the axes of the stacking wheels of the at least sixteen output receptacles are positioned within about thirty inches of each other.

90. The currency bill processing device of claim 85, further comprising twenty-two or more output receptacles in addition to the first and the second output receptacles such that the currency bill processing device comprises at least twenty-four output receptacles, wherein the distance from the input receptacle to the furthest output receptacle is less than five feet.

91. The currency bill processing device of claim 85, further comprising seven or more output receptacles in addition to the first and the second output receptacles, and wherein a pocket density of the currency bill processing device is between about 0.9 pockets per square foot of faceprint of the currency bill processing device and about 1.7 pockets per square foot of faceprint of the currency bill processing device.

92. The currency bill processing device of claim 85, further comprising one or more output receptacles in addition to the first and the second output receptacles, and wherein a pocket density of the currency bill processing device is between about 0.4 pockets per cubic foot of volume of the currency bill processing device and about 1.3 pockets per cubic foot of volume of the currency bill processing device.

93. The currency bill processing device of claim 85, further comprising three or more output receptacles in addition to the first and the second output receptacles, and wherein a pocket density of the currency bill processing device is about 1.4 pockets per square foot of footprint of the currency bill processing device.

94. The currency bill processing device of claim 65, wherein each of the bills is moved from the input receptacle to one of the plurality of output receptacles without rotating the bill around an axis passing through a leading edge and a trailing edge of the bill.

95. The currency bill processing device of claim 94, further comprising third and fourth horizontally-offset output receptacles and fifth and sixth horizontally-offset output receptacles, the third and the fourth output receptacles being vertically offset from the first and the second output receptacles and the fifth and the sixth output receptacles being vertically offset from the first and the second output receptacles and the third and the fourth output receptacles, wherein the currency bill processing device has a pocket density between about 1.0 and about 1.9 output receptacles per square foot of faceprint.

96. The currency bill processing device of claim 94, further comprising ten or more output receptacles in addition to the first and the second output receptacles such that the currency bill processing device comprises at least twelve output receptacles, each of the at least twelve output receptacles including a stacking plate, each stacking plate having a central plate location, wherein the central plate locations of the at least twelve output receptacles are positioned within about thirty-one inches of each other.

97. The currency bill processing device of claim 94, further comprising six or more output receptacles in addition to the first and the second output receptacles such that the currency bill processing device comprises at least eight output receptacles, each of the at least eight output receptacles including entry rollers, the entry rollers having an entry roller point, wherein the entry roller points of the at least eight output receptacles are positioned within about twenty inches of each other.

98. The currency bill processing device of claim 94, further comprising twenty-two or more output receptacles in addition to the first and the second output receptacles such that the currency bill processing device comprises at least twenty-four output receptacles, wherein the distance from the input receptacle to the furthest output receptacle is less than four and a half feet.

99. The currency bill processing device of claim 94, further comprising seven or more output receptacles in addition to the first and the second output receptacles, and wherein a pocket density of the currency bill processing device is about 1.0 pockets per square foot of footprint of the currency bill processing device.

100. The currency bill processing device of claim 94, further comprising three or more output receptacles in addition to the first and the second output receptacles, and wherein a pocket density of the currency bill processing device is between about 0.9 pockets per square foot of faceprint of the currency bill processing device and about 1.7 pockets per square foot of faceprint of the currency bill processing device.

101. The currency bill processing device of claim 94, further comprising six or more output receptacles in addition to the first and the second output receptacles such that the currency bill processing device comprises at least eight output receptacles, each of the at least eight output receptacles including a stacking plate, each stacking plate having a central plate location, wherein the distance from the input receptacle to the furthest one of the central plate locations of the at least eight output receptacles is less than 2.7 feet.

102. The currency bill processing device of claim 65, wherein the transport mechanism transports the bills from the input receptacle to one of the output receptacles without contacting the bills with a driven belt.

103. The currency bill processing device of claim 65, wherein the transport mechanism includes a moveable transport plate and a stationary transport plate, wherein the moveable transport plate is pivotably within the device, the moveable transport plate having an open position and a closed position, the moveable transport plate being generally parallel to the stationary transport plate in the closed position, and the moveable transport plate being generally oblique with respect to the stationary transport plate in the open position such that bills remaining on the moveable transport plate slide toward the front side of the currency bill processing device in response to the moveable transport plate being in the open position.

104. The currency bill processing device of claim 103, wherein the transport mechanism further comprises a latch assembly configured to selectively retain the moveable transport plate in the closed position.

105. The currency bill processing device of claim 104, wherein the latch assembly includes a knob rigidly mounted to the moveable transport plate, and a latch pivotably mounted to the stationary transport plate, the latch including a roller mounted at one end thereof, the knob being configured to receive and mate with the roller and thereby lock the latch to the knob whereby the moveable transport plate is retained in the closed position.

106. The currency bill processing device of claim 105, wherein the latch is moveable from a latched orientation to an unlatched orientation, the latch assembly further comprising a biasing member biasing the latch into the latched orientation.

107. The currency bill processing device of claim 65, wherein the currency bill processing device has a pocket density of about 1.5 output receptacles per cubic foot.

108. The currency bill processing device of claim 65, wherein the transport mechanism is configured to transport currency bills, one at a time, from the input receptacle at a rate of at least about 1200 bills per minute.

109. The currency bill processing device of claim 65, further comprising third and fourth horizontally-offset output receptacles, the third and the fourth output receptacles being vertically offset from the first and the second output receptacles, wherein the currency bill processing device has a pocket density between about 0.9 and about 1.7 output receptacles per square foot of faceprint.

110. The currency bill processing device of claim 65, further comprising three or more output receptacles in addition to the first and the second output receptacles, and wherein a pocket density of the currency bill processing device is at least about 0.9 pockets per square foot of faceprint of the currency bill processing device.

111. The currency bill processing device of claim 65, further comprising thirty-one or more output receptacles in addition to the first and the second output receptacles, and wherein a pocket density of the currency bill processing device is at least about 1.7 pockets per square foot of faceprint of the currency bill processing device.

112. The currency bill processing device of claim 65, further comprising two or more output receptacles in addition to the first and the second output receptacles such that the currency bill processing device comprises at least four output receptacles, each of the at least four output receptacles including a stacking plate, each stacking plate having a central plate location, wherein the central plate locations of the at least four output receptacles are positioned within about six inches of each other.

113. The currency bill processing device of claim 65, further comprising fourteen or more output receptacles in addition to the first and the second output receptacles such that the currency bill processing device comprises at least sixteen output receptacles, each of the at least sixteen output receptacles including a stacking plate, each stacking plate having a central plate location, wherein the central plate locations of the at least sixteen output receptacles are positioned within about thirty-four inches of each other.

114. The currency bill processing device of claim 65, further comprising six or more output receptacles in addition to the first and the second output receptacles such that the currency bill processing device comprises at least eight output receptacles, each of the at least eight output receptacles including a stacking wheel configured to rotate about a respective axis, wherein the axes of the stacking wheels of the at least eight output receptacles are positioned within about nineteen inches of each other.

115. The currency bill processing device of claim 65, further comprising two or more output receptacles in addition to the first and the second output receptacles such that the currency bill processing device comprises at least four output receptacles, each of the at least four output receptacles including entry rollers, the entry rollers having an entry roller point, wherein the entry roller points of the at least four output receptacles are positioned within about fourteen inches of each other.

116. The currency bill processing device of claim 65, further comprising ten or more output receptacles in addition to the first and the second output receptacles such that the currency bill processing device comprises at least twelve output receptacles, each of the at least twelve output receptacles including entry rollers, the entry rollers having an entry roller point, wherein the entry roller points of the at least twelve output receptacles are positioned within about twenty-one inches of each other.

117. The currency bill processing device of claim 65, further comprising fourteen or more output receptacles in addition to the first and the second output receptacles such that the currency bill processing device comprises at least sixteen output receptacles, each of the at least sixteen output receptacles including entry rollers, the entry rollers having an entry roller point, wherein the entry roller points of the at least sixteen output receptacles are positioned within about twenty-five inches of each other.

118. The currency bill processing device of claim 65, further comprising twelve or more output receptacles in addition to the first and the second output receptacles such that the currency bill processing device comprises at least fourteen output receptacles, wherein the distance from the input receptacle to the furthest output receptacle is less than three and a half feet.

119. The currency bill processing device of claim 65, further comprising eight or more output receptacles in addition to the first and the second output receptacles such that the currency bill processing device comprises at least ten output receptacles, wherein the distance from the input receptacle to the furthest output receptacle is less than three and a half feet.

120. The currency bill processing device of claim 65, further comprising seven or more output receptacles in addition to the first and the second output receptacles, and wherein a pocket density of the currency bill processing device is about 1.2 pockets per square foot of faceprint of the currency bill processing device.

121. The currency bill processing device of claim 65, further comprising seven or more output receptacles in addition to the first and the second output receptacles, and wherein a pocket density of the currency bill processing device is between about 0.8 pockets per square foot of footprint of the currency bill processing device and about 1.3 pockets per square foot of footprint of the currency bill processing device.

122. The currency bill processing device of claim 65, further comprising seven or more output receptacles in addition to the first and the second output receptacles, and wherein a pocket density of the currency bill processing device is between about 0.5 pockets per cubic foot of volume of the currency bill processing device and about 1.4 pockets per cubic foot of volume of the currency bill processing device.

123. The currency bill processing device of claim 65, further comprising seven or more output receptacles in addition to the first and the second output receptacles, and wherein a pocket density of the currency bill processing device is about 0.8 pockets per cubic foot of volume of the currency bill processing device.

124. The currency bill processing device of claim 65, further comprising one or more output receptacles in addition to the first and the second output receptacles, and wherein a pocket density of the currency bill processing device is about 1.1 pockets per square foot of faceprint of the currency bill processing device.

125. The currency bill processing device of claim 65, further comprising one or more output receptacles in addition to the first and the second output receptacles, and wherein a pocket density of the currency bill processing device is about 0.9 pockets per square foot of footprint of the currency bill processing device.

126. The currency bill processing device of claim 65, further comprising one or more output receptacles in addition to the first and the second output receptacles, and wherein a pocket density of the currency bill processing device is about 0.7 pockets per cubic foot of volume of the currency bill processing device.

127. The currency bill processing device of claim 65, further comprising three or more output receptacles in addition to the first and the second output receptacles, and wherein a pocket density of the currency bill processing device is between about 1.0 pockets per square foot of footprint of the currency bill processing device and about 1.9 pockets per square foot of footprint of the currency bill processing device.

128. The currency bill processing device of claim 65, further comprising three or more output receptacles in addition to the first and the second output receptacles, and wherein a pocket density of the currency bill processing device is between about 0.5 pockets per cubic foot of volume of the currency bill processing device and about 1.4 pockets per cubic foot of volume of the currency bill processing device.

129. The currency bill processing device of claim 65, further comprising three or more output receptacles in addition to the first and the second output receptacles, and wherein a pocket density of the currency bill processing device is about 0.9 pockets per cubic foot of volume of the currency bill processing device.

130. The currency bill processing device of claim 65, further comprising six or more output receptacles in addition to the first and the second output receptacles such that the currency bill processing device comprises at least eight output receptacles, each of the at least eight output receptacles including a stacking wheel configured to rotate about a respective axis, wherein the distance from the input receptacle to the furthest one of the axes of the stacking wheels of the at least eight output receptacles is less than 2.8 feet.

131. The currency bill processing device of claim 65, further comprising four or more output receptacles in addition to the first and the second output receptacles such that the currency bill processing device comprises at least six output receptacles, each of the at least six output receptacles including a stacking wheel configured to rotate about a respective axis, wherein the distance from the input receptacle to the furthest one of the axes of the stacking wheels of the at least six output receptacles is less than 2.5 feet.

132. The currency bill processing device of claim 65, further comprising a controller, a first diverter, and a second diverter, the first and the second diverters being positioned adjacent one another and between the receiving openings of the first and the second output receptacles, the controller being configured to cooperatively control the first and the second diverters to selectively direct bills being transported via the transport mechanism into one of the first and the second output receptacles and past the first and the second output receptacles.

133. A method of transporting bills from a stack of bills in an input receptacle of a currency bill processing device to at least one of a plurality of output receptacles including first and second horizontally-offset output receptacles, the method comprising:

receiving a stack of bills in the input receptacle of the currency bill processing device;

transporting the bills, one at a time, from the input receptacle along a first segment of a transport path past at least one detector, the first segment including a generally-horizontal portion;

generating data associated with the bills via the at least one detector;

transporting the bills from the first segment along a second segment of the transport path, the second segment extending in a generally horizontal direction beneath the first and the second output receptacles;

transporting the bills from the second segment along a third segment of the transport path that extends generally vertically from the second segment between the first and the second output receptacles;

delivering some of the bills from third segment into the first output receptacle; and delivering some of the bills from third segment into the second output receptacle, wherein the bills are delivered to one of the plurality of output receptacles based in part on the generated data.

134. The method of claim 133, wherein the bills are transported from the input receptacle to one of the plurality of output receptacles without changing a leading edge of the bill and without rotating the bill around an axis passing through the leading edge and a trailing edge of the bill.

135. The method of claim 134, wherein each of the acts of transporting includes transporting the bills at a rate of at least about 800 bills per minute.

136. The method of claim 134, wherein the plurality of output receptacles comprises nine or more output receptacles and a pocket density of the currency bill processing device is at least about 0.9 pockets per square foot of faceprint of the currency bill processing device.

137. The method of claim 134, wherein the plurality of output receptacles comprises at least eight output receptacles, each of the at least eight output receptacles including a stacking plate, each stacking plate having a central plate location, wherein the central plate locations of the at least eight output receptacles are positioned within about seventeen inches of each other.

138. The method of claim 134, wherein the plurality of output receptacles comprises at least sixteen output receptacles, each of the at least sixteen output receptacles including a stacking wheel configured to rotate about a respective axis, wherein the axes of the stacking wheels of the at least sixteen output receptacles are positioned within about thirty inches of each other.

139. The method of claim 134, wherein a portion of the transport path between the plurality of output receptacles has a pocket per inch ratio of at least 0.4.

140. The method of claim 134, wherein the plurality of output receptacles comprises at least twenty-four output receptacles, and wherein the distance from the input receptacle to the furthest output receptacle is less than four and a half feet.

141. The method of claim 134, wherein the plurality of output receptacles comprises at least nine output receptacles, and wherein a pocket density of the currency bill processing device is about 1.2 pockets per square foot of faceprint of the currency bill processing device.

142. The method of claim 134, wherein the plurality of output receptacles comprises at least three output receptacles, and wherein a pocket density of the currency bill processing device is between about 0.6 pockets per square foot of footprint of the currency bill processing device and about 1.2 pockets per square foot of footprint of the currency bill processing device.

143. The method of claim 133, wherein the plurality of output receptacles further comprises third and fourth horizontally-offset output receptacles, the third and the fourth output receptacles being vertically offset from the first and the second output receptacles, the method further comprising:

transporting bills not delivered to one of the first and the second output receptacles along a fourth segment of the transport path that extends generally vertically from the third segment between the third and the fourth output receptacles;

delivering some of the bills from the fourth segment to the third output receptacle; and delivering some of the bills from the fourth segment to the fourth output receptacle.

144. The method of claim 143, wherein the currency bill processing device has a pocket density between about 0.9 and about 1.7 output receptacles per square foot of faceprint.

145. The method of claim 143, wherein the plurality of output receptacles further comprises fifth and sixth horizontally-offset output receptacles, the fifth and the sixth output receptacles being vertically offset from the first and the second output receptacles and the third and the fourth output receptacles, the method further comprising:

transporting bills not delivered to one of the first, the second, the third, and the fourth output receptacles along a fifth segment of the transport path that extends generally vertically from the fourth segment between the fifth and the sixth output receptacles;

delivering some of the bills from the fifth segment to the fifth output receptacle; and delivering some of the bills from the fifth segment to the sixth output receptacle.

146. The method of claim 145, wherein the currency bill processing device has a pocket density between about 1.0 and about 1.9 output receptacles per square foot of faceprint.

147. The method of claim 133, wherein the bills transition through an angle between about 100 degrees and about 140 degrees while being delivered from the transport path into one of the plurality of output receptacles.

148. The method of claim 133, wherein each of the bills is transported from the input receptacle to one of the plurality of output receptacles without touching a continuous belt driven by a motor.

149. The method of claim 148, wherein each of the acts of transporting includes transporting the bills at a rate of at least about 1000 bills per minute.

150. The method of claim 148, wherein the plurality of output receptacles comprises seventeen or more output receptacles and a pocket density of the currency bill processing device is at least about 1.4 pockets per square foot of faceprint of the currency bill processing device.

151. The method of claim 148, wherein the plurality of output receptacles comprises at least sixteen output receptacles, each of the at least sixteen output receptacles including a stacking plate, each stacking plate having a central plate location, wherein the central plate locations of the at least sixteen output receptacles are positioned within about thirty-four inches of each other.

152. The method of claim 148, wherein the plurality of output receptacles comprises at least eight output receptacles, each of the at least eight output receptacles including entry rollers, the entry rollers having an entry roller point, wherein the entry roller points of the at least eight output receptacles are positioned within about twenty inches of each other.

153. The method of claim 148, wherein the plurality of output receptacles comprises at least ten output receptacles, and wherein the distance from the input receptacle to the furthest output receptacle is less than three feet.

154. The method of claim 148, wherein the plurality of output receptacles comprises at least nine output receptacles, and wherein a pocket density of the currency bill processing device is about 1.0 pockets per square foot of footprint of the currency bill processing device.

155. The method of claim 148, wherein the plurality of output receptacles comprises at least three output receptacles, and wherein a pocket density of the currency bill processing device is between about 0.8 pockets per square foot of faceprint of the currency bill processing device and about 1.6 pockets per square foot of faceprint of the currency bill processing device.

156. The method of claim 133, wherein the first and the second output receptacles each have a receiving opening in a respective side portion, the side portions laying in one or more planes parallel to a first plane, the first and the second output receptacles each have an access opening in a respective front portion, the front portions laying in one or more planes parallel to a second plane, the second plane being generally orthogonal with respect to the first plane, the receiving openings being configured to receive therethrough bills from the third segment of the transport path, and the access openings configured to provide operator access to retrieve bills from associated output receptacles, the receiving opening of the first output receptacle facing the receiving opening of the second output receptacle across the third segment of the transport path.

157. The method of claim 133, wherein each of the acts of transporting includes transporting the bills at a rate of at least about 400 bills per minute.

158. The method of claim 133, wherein the first and the second output receptacles each have an access opening in a respective front portion, the receiving openings being configured to receive therethrough bills from the third segment of the transport path, and the access openings configured to provide operator access to retrieve bills from associated output receptacles.

159. The method of claim 158, wherein each of the acts of transporting includes transporting the bills at a rate of at least about 1200 bills per minute.

160. The method of claim 158, wherein the plurality of output receptacles comprises nine or more output receptacles and a pocket density of the currency bill processing device is at least about 1.1 pockets per square foot of faceprint of the currency bill processing device.

161. The method of claim 158, wherein the plurality of output receptacles comprises at least twelve output receptacles, each of the at least twelve output receptacles including a stacking plate, each stacking plate having a central plate location, wherein the central plate locations of the at least twelve output receptacles are positioned within about thirty-one inches of each other.

162. The method of claim 158, wherein the plurality of output receptacles comprises at least four output receptacles, each of the at least four output receptacles including entry rollers, the entry rollers having an entry roller point, wherein the entry roller points of the at least four output receptacles are positioned within about fourteen inches of each other.

163. The method of claim 158, wherein the plurality of output receptacles comprises at least twenty-four output receptacles, and wherein the distance from the input receptacle to the furthest output receptacle is less than five feet.

164. The method of claim 158, wherein the plurality of output receptacles comprises at least nine output receptacles, and wherein a pocket density of the currency bill processing device is between about 0.5 pockets per cubic foot of volume of the currency bill processing device and about 1.4 pockets per cubic foot of volume of the currency bill processing device.

165. The method of claim 158, wherein the plurality of output receptacles comprises at least three output receptacles, and wherein a pocket density of the currency bill processing device is about 0.9 pockets per square foot of footprint of the currency bill processing device.

166. The method of claim 158, wherein the plurality of output receptacles comprises at least three output receptacles, and wherein a pocket density of the currency bill processing device is about 0.7 pockets per cubic foot of volume of the currency bill processing device.

167. The method of claim 158, wherein the plurality of output receptacles comprises at least five output receptacles, and wherein a pocket density of the currency bill processing device is about 0.9 pockets per cubic foot of volume of the currency bill processing device.

168. The method of claim 158, wherein the plurality of output receptacles comprises at least eight output receptacles, each of the at least eight output receptacles including a stacking wheel configured to rotate about a respective axis, wherein the distance from the input receptacle to the furthest one of the axes of the stacking wheels of the at least eight output receptacles is less than 2.8 feet.

169. The method of claim 133, wherein the plurality of output receptacles comprises five or more output receptacles and a pocket density of the currency bill processing device is at least about 0.9 pockets per square foot of faceprint of the currency bill processing device.

170. The method of claim 133, wherein the plurality of output receptacles comprises seven or more output receptacles and a pocket density of the currency bill processing device is at least about 1.0 pockets per square foot of faceprint of the currency bill processing device.

171. The method of claim 133, wherein the plurality of output receptacles comprises thirty-three or more output receptacles and a pocket density of the currency bill processing device is at least about 1.7 pockets per square foot of faceprint of the currency bill processing device.

172. The method of claim 133, wherein the plurality of output receptacles comprises at least four output receptacles, each of the at least four output receptacles including a stacking plate, each stacking plate having a central plate location, wherein the central plate locations of the at least four output receptacles are positioned within about six inches of each other.

173. The method of claim 133, wherein the plurality of output receptacles comprises at least eight output receptacles, each of the at least eight output receptacles including a stacking wheel configured to rotate about a respective axis, wherein the axes of the stacking wheels of the at least eight output receptacles are positioned within about nineteen inches of each other.

174. The method of claim 133, wherein the plurality of output receptacles comprises at least twelve output receptacles, each of the at least twelve output receptacles including a stacking wheel configured to rotate about a respective axis, wherein the axes of the stacking wheels of the at least twelve output receptacles are positioned within about twenty-four inches of each other.

175. The method of claim 133, wherein the plurality of output receptacles comprises at least twelve output receptacles, each of the at least twelve output receptacles including entry rollers, the entry rollers having an entry roller point, wherein the entry roller points of the at least twelve output receptacles are positioned within about twenty-one inches of each other.

176. The method of claim 133, wherein the plurality of output receptacles comprises at least sixteen output receptacles, each of the at least sixteen output receptacles including entry rollers, the entry rollers having an entry roller point, wherein the entry roller points of the at least sixteen output receptacles are positioned within about twenty-five inches of each other.

177. The method of claim 133, wherein a portion of the transport path between the plurality of output receptacles has a pocket per foot ratio of at least 5.

178. The method of claim 133, wherein a portion of the transport path between the plurality of output receptacles has a pocket per foot ratio of at least 8.

179. The method of claim 133, wherein the plurality of output receptacles comprises at least twenty-eight output receptacles, and wherein the distance from the input receptacle to the furthest output receptacle is less than five and a half feet.

180. The method of claim 133, wherein the plurality of output receptacles comprises at least fourteen output receptacles, and wherein the distance from the input receptacle to the furthest output receptacle is less than three and a half feet.

181. The method of claim 133, wherein the plurality of output receptacles comprises at least ten output receptacles, and wherein the distance from the input receptacle to the furthest output receptacle is less than three and a half feet.

182. The method of claim 133, wherein the plurality of output receptacles comprises at least nine output receptacles, and wherein a pocket density of the currency bill processing device is between about 0.9 pockets per square foot of faceprint of the currency bill processing device and about 1.7 pockets per square foot of faceprint of the currency bill processing device.

183. The method of claim 133, wherein the plurality of output receptacles comprises at least nine output receptacles, and wherein a pocket density of the currency bill processing device is between about 0.8 pockets per square foot of footprint of the currency bill processing device and about 1.3 pockets per square foot of footprint of the currency bill processing device.

184. The method of claim 133, wherein the plurality of output receptacles comprises at least nine output receptacles, and wherein a pocket density of the currency bill processing device is about 0.8 pockets per cubic foot of volume of the currency bill processing device.

185. The method of claim 133, wherein the plurality of output receptacles comprises at least three output receptacles, and wherein a pocket density of the currency bill processing device is about 1.1 pockets per square foot of faceprint of the currency bill processing device.

186. The method of claim 133, wherein the plurality of output receptacles comprises at least three output receptacles, and wherein a pocket density of the currency bill processing device is between about 0.4 pockets per cubic foot of volume of the currency bill processing device and about 1.3 pockets per cubic foot of volume of the currency bill processing device.

187. The method of claim 133, wherein the plurality of output receptacles comprises at least five output receptacles, and wherein a pocket density of the currency bill processing device is between about 0.9 pockets per square foot of faceprint of the currency bill processing device and about 1.7 pockets per square foot of faceprint of the currency bill processing device.

188. The method of claim 133, wherein the plurality of output receptacles comprises at least five output receptacles, and wherein a pocket density of the currency bill processing device is about 1.2 pockets per square foot of faceprint of the currency bill processing device.

189. The method of claim 133, wherein the plurality of output receptacles comprises at least five output receptacles, and wherein a pocket density of the currency bill processing device is between about 1.0 pockets per square foot of footprint of the currency bill processing device and about 1.9 pockets per square foot of footprint of the currency bill processing device.

190. The method of claim 133, wherein the plurality of output receptacles comprises at least five output receptacles, and wherein a pocket density of the currency bill processing device is about 1.4 pockets per square foot of footprint of the currency bill processing device.

191. The method of claim 133, wherein the plurality of output receptacles comprises at least five output receptacles, and wherein a pocket density of the currency bill processing device is between about 0.5 pockets per cubic foot of volume of the currency bill processing device and about 1.4 pockets per cubic foot of volume of the currency bill processing device.

192. The method of claim 133, wherein the plurality of output receptacles comprises at least eight output receptacles, each of the at least eight output receptacles including a stacking plate, each stacking plate having a central plate location, wherein the distance from the input receptacle to the furthest one of the central plate locations of the at least eight output receptacles is less than 2.7 feet.

193. The method of claim 133, wherein the plurality of output receptacles comprises at least six output receptacles, each of the at least six output receptacles including a stacking plate, each stacking plate having a central plate location, wherein the distance from the input receptacle to the furthest one of the central plate locations of the at least six output receptacles is less than 2.4 feet.

194. The method of claim 133, wherein the plurality of output receptacles comprises at least six output receptacles, each of the at least six output receptacles including a stacking wheel configured to rotate about a respective axis, wherein the distance from the input receptacle to the furthest one of the axes of the stacking wheels of the at least six output receptacles is less than 2.5 feet.

* * * * *